US012790085B2

(12) United States Patent
Bogdziewicz et al.

(10) Patent No.: US 12,790,085 B2
(45) Date of Patent: Nov. 10, 2026

(54) PACKAGE WITH OPPOSING LOCKING MECHANISMS

(71) Applicant: Altria Client Services LLC, Richmond, VA (US)

(72) Inventors: William J. Bogdziewicz, Richmond, VA (US); Christopher J. Hession, Mechanicsville, VA (US); Scott A. Fath, Henrico, VA (US); Travis Martin Garthaffner, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 961 days.

(21) Appl. No.: 17/321,233

(22) Filed: May 14, 2021

(65) Prior Publication Data

US 2022/0363458 A1 Nov. 17, 2022

(51) Int. Cl.
*B65D 50/04* (2006.01)
*B65D 25/04* (2006.01)
(Continued)

(52) U.S. Cl.
CPC ..... *B65D 50/06* (2013.01); *B65D 25/04* (2013.01); *B65D 43/162* (2013.01);
(Continued)

(58) Field of Classification Search
CPC .. B65D 2215/02; B65D 50/04; B65D 50/046; B65D 50/06; B65D 45/18; B65D 45/20; B65D 45/22; B65D 43/162
See application file for complete search history.

(56) References Cited

U.S. PATENT DOCUMENTS 3,749,230 A 7/1973 Foster
4,444,326 A 4/1984 Musel
(Continued)

FOREIGN PATENT DOCUMENTS

CN 209814691 U 12/2019
DE 3625477 A1 * 2/1988
(Continued)

OTHER PUBLICATIONS

Standard 16 CFR Ch. II, 1700.2, Jan. 2012.
(Continued)

*Primary Examiner* — Allan D Stevens
(74) *Attorney, Agent, or Firm* — Harness, Dickey & Pierce, P.L.C.

(57) ABSTRACT

The package includes a base, a primary lid connected to the base via a first hinge, the primary lid and the base defining a primary storage area when the primary lid is in a closed position, a first locking mechanism and a second locking mechanism. The first and second locking mechanisms each including an arm with a first engaging structure, the arm being connected to the primary lid, and a flexible structure including a contact structure and at least one attachment member, the at least one attachment member attaching the contact structure to the base, the contact structure including a second engaging structure on a surface of the contact structure, the flexible structure being in a relaxed position when the primary lid is in the closed position, the first engaging structure being retained by the second engaging structure to lock the primary lid onto the base in the closed position.

26 Claims, 100 Drawing Sheets

(51) Int. Cl.
*B65D 43/16* (2006.01)
*B65D 50/06* (2006.01)
*A24F 23/00* (2006.01)

(52) U.S. Cl.
CPC ..... *B65D 50/046* (2013.01); *A24F 23/00* (2013.01); *B65D 2215/02* (2013.01)

(56) References Cited

U.S. PATENT DOCUMENTS

| | | | | |
|---|---|---|---|---|
| 4,511,032 | A | 4/1985 | Bush | |
| 4,733,794 | A | 3/1988 | Kent | |
| 4,746,008 | A | 5/1988 | Heverly et al. | |
| 4,890,742 | A | 1/1990 | Allison | |
| 5,267,668 | A | 12/1993 | Jones | |
| 5,752,615 | A | 5/1998 | Hofmann et al. | |
| 6,021,901 | A | 2/2000 | Wolfe | |
| D469,607 | S | 2/2003 | Wolff | |
| D487,192 | S | 3/2004 | Farnham et al. | |
| 6,832,686 | B2 | 12/2004 | Donegan | |
| D526,192 | S | 8/2006 | Post | |
| D561,995 | S | 2/2008 | Poole | |
| 7,549,541 | B2 | 6/2009 | Brozell et al. | |
| 7,617,935 | B2 | 11/2009 | Reilley et al. | |
| 7,661,534 | B2 | 2/2010 | Saclier et al. | |
| D623,050 | S | 9/2010 | Giraud et al. | |
| D623,051 | S | 9/2010 | Giraud et al. | |
| D623,052 | S | 9/2010 | Giraud et al. | |
| D623,053 | S | 9/2010 | Giraud et al. | |
| 8,033,425 | B2 | 10/2011 | Gelardi | |
| 8,096,411 | B2 | 1/2012 | Bailey et al. | |
| 8,162,144 | B2 | 4/2012 | Intini | |
| D663,943 | S | 7/2012 | Walsh et al. | |
| D668,875 | S | 10/2012 | Meng | |
| D677,051 | S | 3/2013 | Wolff | |
| 8,540,115 | B2 | 9/2013 | Giraud et al. | |
| D701,456 | S | 3/2014 | Farley et al. | |
| D702,438 | S | 4/2014 | Chen | |
| 8,689,978 | B2 | 4/2014 | Flood et al. | |
| D704,442 | S | 5/2014 | Chen | |
| D714,552 | S | 10/2014 | Jiang | |
| 8,875,877 | B2 * | 11/2014 | Cottle | B65D 50/04 206/265 |
| D725,464 | S | 3/2015 | Sawicki | |
| D754,920 | S | 4/2016 | Domon | |
| 9,445,631 | B1 | 9/2016 | Patel et al. | |
| 9,481,496 | B2 | 11/2016 | Cottle et al. | |
| 9,725,206 | B2 * | 8/2017 | Linssen | B65D 83/0472 |
| D801,685 | S | 11/2017 | Meng | |
| D818,195 | S | 5/2018 | Burger | |
| 9,968,516 | B2 | 5/2018 | Rogers et al. | |
| 10,017,303 | B2 | 7/2018 | Wagner et al. | |
| 10,046,887 | B2 | 8/2018 | Azelton et al. | |
| D834,819 | S | 12/2018 | Burek et al. | |
| D837,049 | S | 1/2019 | Sumiya et al. | |
| D858,276 | S | 9/2019 | Blomberg et al. | |
| D858,989 | S | 9/2019 | Kim | |
| D863,677 | S | 10/2019 | Chung et al. | |
| 10,463,075 | B2 | 11/2019 | Beardsall | |
| 10,463,569 | B2 | 11/2019 | Wagner et al. | |
| 10,596,066 | B2 | 3/2020 | Wagner et al. | |
| 10,618,707 | B2 | 4/2020 | Straughan | |
| D887,703 | S | 6/2020 | Charm | |
| D890,421 | S | 7/2020 | Godwin, III et al. | |
| 10,780,022 | B2 | 9/2020 | Terhune et al. | |
| 10,850,897 | B2 | 12/2020 | Charm | |
| 10,954,044 | B2 | 3/2021 | Perdue et al. | |
| 2002/0084239 | A1 * | 7/2002 | Dressel | B65D 50/046 215/209 |
| 2004/0045858 | A1 | 3/2004 | Harrold | |
| 2009/0255842 | A1 | 10/2009 | Brozell et al. | |
| 2009/0283437 | A1 | 11/2009 | Angelucci et al. | |
| 2011/0186579 | A1 | 8/2011 | Bailey et al. | |
| 2011/0259783 | A1 | 10/2011 | Angelucci et al. | |
| 2015/0344202 | A1 * | 12/2015 | Schneider | B65D 50/046 220/263 |
| 2016/0270440 | A1 | 9/2016 | Patel et al. | |
| 2017/0001764 | A1 | 1/2017 | Belleville | |
| 2017/0137184 | A1 | 5/2017 | Burek et al. | |
| 2018/0086518 | A1 | 3/2018 | Charm | |
| 2018/0305092 | A1 | 10/2018 | Lucas, Jr. | |
| 2019/0023461 | A1 | 1/2019 | Faragher | |
| 2019/0270556 | A1 | 9/2019 | Patton et al. | |
| 2019/0276196 | A1 | 9/2019 | French et al. | |
| 2019/0344937 | A1 * | 11/2019 | Elkind | B65D 43/162 |
| 2019/0367226 | A1 | 12/2019 | Charm | |
| 2020/0130903 | A1 | 4/2020 | Ornduff et al. | |
| 2020/0148428 | A1 | 5/2020 | Georgiadis et al. | |
| 2020/0156832 | A1 | 5/2020 | Perdue et al. | |
| 2021/0122538 | A1 | 4/2021 | Knobel et al. | |
| 2022/0041344 | A1 * | 2/2022 | Bailey | B65D 47/08 |

FOREIGN PATENT DOCUMENTS

| | | | |
|---|---|---|---|
| DE | 20022999 | U1 | 10/2002 |
| EP | 1088769 | B1 | 11/2006 |
| GB | 2374862 | B | 12/2004 |
| WO | WO-2020-208275 | A1 | 10/2020 |

OTHER PUBLICATIONS

'Child-resistant packaging—Requirements and testing procedures for reclosable packages' International Standard ISO 8317:2015.
'Reclosable child-resistant packages' Canadian standard CAN/CSA Z76.1-16, Jul. 2017.

* cited by examiner (VIEW XXI-XXI)

(VIEW XXXI-XXXI)

(VIEW XXXI-XXXI)

PACKAGE WITH OPPOSING LOCKING MECHANISMS

BACKGROUND

Field

Example embodiments generally relate to a package or container with locking mechanisms.

Description of Related Art

Packages can include locking, restraining, or retaining mechanisms that reduce and/or prevent opening and subsequent exposure and/or ingestion of substances contained therein by children or the elderly.

SUMMARY

At least one example embodiment is directed toward a package.

In at least one example embodiment, the package includes a base; a primary lid connected to an upper portion of the base via a first hinge, the primary lid and the base collectively defining a primary storage area when the primary lid is in a closed position; a first locking mechanism on a first side of the package; and a second locking mechanism on a second side of the package, the first locking mechanism and the second locking mechanism each including, an arm with a first engaging structure, the arm being connected to the primary lid, and a flexible structure including a contact structure and at least one attachment member, the at least one attachment member attaching the contact structure to the base, the contact structure including a second engaging structure on an interior surface of the contact structure, the flexible structure being in a relaxed position when the primary lid is in the closed position, the first engaging structure being retained by the second engaging structure to lock the primary lid onto the base in the closed position, the flexible structure configured to move from the relaxed position to a flexed position to disengage the second engaging structure from the first engaging structure when a first force is applied in a first direction on an exterior surface of a lower portion of the contact structure, the lower portion of the contact structure moving inward and an upper portion of the contact structure moving outward in response to the first force being applied to the lower portion of the contact structure, and the flexible structure being configured to return to the relaxed position absent the first force.

In at least one example embodiment, the second engaging structure is moved in a second direction as the flexible structure moves from the relaxed position to the flexed position, the first direction and the second direction being opposite each other.

In at least one example embodiment, the contact structure pivots relative to the at least one attachment member as the flexible structure is moved from the relaxed position to the flexed position.

In at least one example embodiment, the at least one attachment member is attached to a portion of the base, and the at least one attachment member bends or pivots relative to the portion of the base as the flexible structure is moved from the relaxed position to the flexed position.

In at least one example embodiment, the at least one attachment member is attached to a portion of the base, and the contact structure pivots relative to the at least one attachment member and the at least one attachment member pivots relative to the portion of the base as the flexible structure is moved from the relaxed position to the flexed position.

In at least one example embodiment, the base includes a guard, the guard being inwardly adjacent to the contact structure, the at least one attachment member being connected to the guard.

In at least one example embodiment, the at least one attachment member traverses horizontally across a gap between the interior surface of the contact structure and the guard.

In at least one example embodiment, the base includes a guard, the guard being a section of a peripheral wall of the package, the at least one attachment member being connected to the guard.

In at least one example embodiment, the at least one attachment member is connected to a section of a sidewall of the base, the section of the sidewall being inwardly adjacent to the contact structure.

In at least one example embodiment, the at least one attachment member traverses horizontally across a gap between the interior surface of the contact structure and the section of the sidewall.

In at least one example embodiment, the first engaging structure includes exposed surfaces that are exposed by a channel and a ledge that are defined by an outer surface of the arm, a portion of the second engaging structure fitting into the channel and contacting the exposed surfaces when the primary lid is in the closed position.

In at least one example embodiment, the first engaging structure includes exposed surfaces that are exposed by an opening that traverses through an outer surface and an inner surface of the arm, the second engaging structure engaging the exposed surfaces of the arm with a portion of the second engaging structure extending within the opening when the primary lid is in the closed position.

In at least one example embodiment, the arm is U-shaped, the arm including a first end and a second end that are connected to the primary lid.

In at least one example embodiment, the second engaging structure includes a catch, the catch defining a step, the step being configured to retain the catch in the first engaging structure when the primary lid is in the closed position.

In at least one example embodiment, the at least one attachment member includes a pair of attachment members, the pair of attachment members being connected to the contact structure at a same vertical elevation along a vertical midsection of the contact structure.

In at least one example embodiment, the primary lid is configured to be moved to an open position from the closed position in response to a second force applied to the primary lid in a second direction perpendicular to the first direction while the first locking mechanism and the second locking mechanism are both in the flexed position.

In at least one example embodiment, the package further includes a secondary lid connected to a lower portion of the base via a second hinge, the secondary lid and the base collectively defining a secondary storage area when the secondary lid is closed.

In at least one example embodiment, the exterior surface of the contact structure is flush with an exterior surface of a wall of the base.

In at least one example embodiment, at least one first step is defined along an interior upper portion of the base, and a lower portion of the primary lid defines at least one second step, the at least one first step mating with the at least one second step when the primary lid is in the closed position.

In at least one example embodiment, the primary lid has at least three points of contact with the base when the primary lid is in the closed position, the three points of contact being provided by the first locking mechanism, the second locking mechanism and the first hinge.

In at least one example embodiment, the base includes a frame, the frame including outer walls, and an insert, the insert including a floor, the insert and the frame being connected such that the outer walls and the floor combine to at least partially form an outer surface of the package.

In at least one example embodiment, the first locking mechanism and the second locking mechanism are offset from each other, on the first side and the second side of the package, respectively.

In at least one example embodiment, the first locking mechanism and the second locking mechanism are directly opposed to each other, on the first side and the second side of the package, respectively.

In at least one example embodiment, the first hinge is a living hinge.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
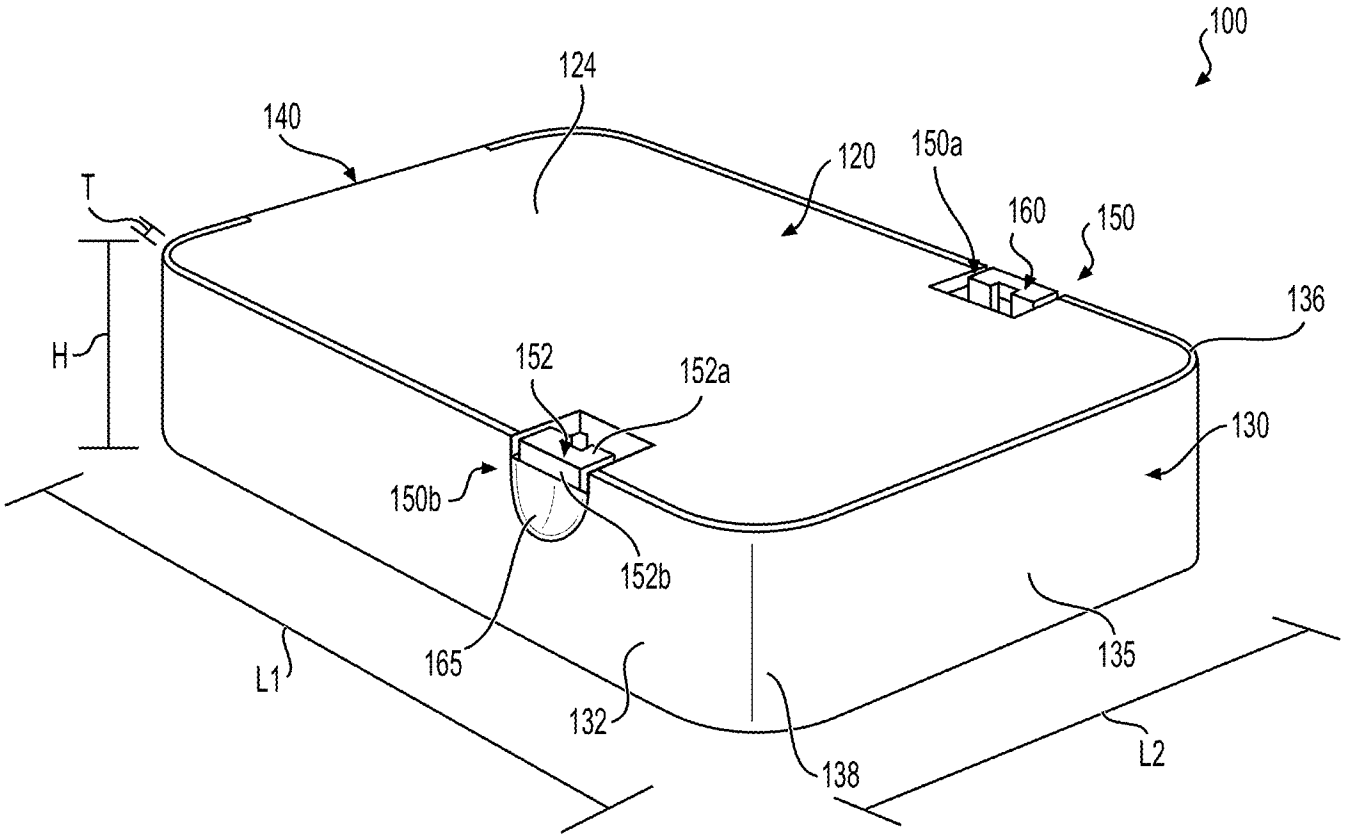
FIG. 1 is an illustration of a perspective view of a package, in accordance with at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Package

At least some example embodiments are directed to packages and/or containers that are considered to be "child-resistant packages (CR packages)," from the standpoint that an opening of the packages requires a complex motion involving an application of different forces in different directions. In at least one example embodiment, CR packages are used to reduce a risk of children and/or the elderly accessing and ingesting, or being exposed to, substances or materials contained therein. In at least some example embodiment, the packages are tested under guidelines from the Consumer Product Safety Commission (CPSC) Poison Prevention Packaging Act and are certified under 16 CFR 1700.2 (Jan. 1, 2012), and/or the packages are tested as defined by Standard ISO 8317:2015, in order to ensure the packages are "child-resistant" and provide child-resistant access to one or more storage areas of the packages. In at least one example embodiment, the packages are tested under guidelines from Canadian standard CAN/CSA Z76.1-16.

In at least one example embodiment, the packages include or can contain at least one substance. In at least one example embodiment, the at least one substance is a consumer product. In at least one example embodiment, the at least one substance and/or the consumer product includes an oral product. In at least one example embodiment, the oral product is one or more pouches.

In at least one example embodiment, the oral product is an oral tobacco product, an oral non-tobacco product, an oral cannabis product, or any combination thereof. The oral product may be in a form of loose material (e.g., loose cellulosic material), shaped material (e.g., plugs or twists), pouched material, tablets, lozenges, chews, gums, films, any other oral product, or any combination thereof.

The oral product may include chewing tobacco, snus, moist snuff tobacco, dry snuff tobacco, other smokeless tobacco and non-tobacco products for oral consumption, or any combination thereof.

Where the oral product is an oral tobacco product including smokeless tobacco product, the smokeless tobacco product may include tobacco that is whole, shredded, cut, granulated, reconstituted, cured, aged, fermented, pasteurized, or otherwise processed. Tobacco may be present as whole or portions of leaves, flowers, roots, stems, extracts (e.g., nicotine), or any combination thereof.

In at least one example embodiment, the oral product includes a tobacco extract, such as a tobacco-derived nicotine extract, and/or synthetic nicotine. The oral product may include nicotine alone or in combination with a carrier (e.g., white snus), such as a cellulosic material. The carrier may be a non-tobacco material (e.g., microcrystalline cellulose) or a tobacco material (e.g., tobacco fibers having reduced or eliminated nicotine content, which may be referred to as "exhausted tobacco plant tissue or fibers"). In some example embodiments, the exhausted tobacco plant tissue or fibers can be treated to remove at least 25%, 40%, 50%, 60%, 70%, 75%, 80%, 85%, 90%, or 95% of the nicotine. For example, the tobacco plant tissue can be washed with water or another solvent to remove the nicotine.

In other example embodiments, the oral product may include cannabis, such as cannabis plant tissue and/or cannabis extracts. In at least one example embodiment, the cannabis material includes leaf and/or flower material from one or more species of cannabis plants and/or extracts from the one or more species of cannabis plants. The one or more species of cannabis plants may include *Cannabis sativa, Cannabis indica*, and/or *Cannabis ruderalis*. In at least one example embodiment, the cannabis may be in the form of fibers. In at least one example embodiment, the cannabis may include a cannabinoid, a terpene, and/or a flavonoid. In at least one example embodiment, the cannabis material may be a cannabis-derived cannabis material, such as a cannabis-derived cannabinoid, a cannabis-derived terpene, and/or a cannabis-derived flavonoid.

The oral product (e.g., the oral tobacco product, the oral non-tobacco product, or the oral cannabis product) may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

In at least one example embodiment, oral product may further include one or more elements such as a mouth-stable polymer, a mouth-soluble polymer, a sweetener (e.g., a synthetic sweetener and/or a natural sweetener), an energizing agent, a soothing agent, a focusing agent, a plasticizer, mouth-soluble fibers, an alkaloid, a mineral, a vitamin, a dietary supplement, a nutraceutical, a coloring agent, an amino acid, a chemesthetic agent, an antioxidant, a food-grade emulsifier, a pH modifier, a botanical, a tooth-whitening agent, a therapeutic agent, a processing aid, a stearate, a wax, a stabilizer, a disintegrating agent, a lubricant, a preservative, a filler, a flavorant, flavor masking agents, a bitterness receptor site blocker, a receptor site enhancers, other additives, or any combination thereof.

In at least one example embodiment, the package may contain any product or substance. For example, the package may contain confectionary products, food products, medicines, or any other product.

First Example Embodiment

FIG. 1 is a perspective view of a package 100, in accordance with at least one example embodiment.

Figure 6:
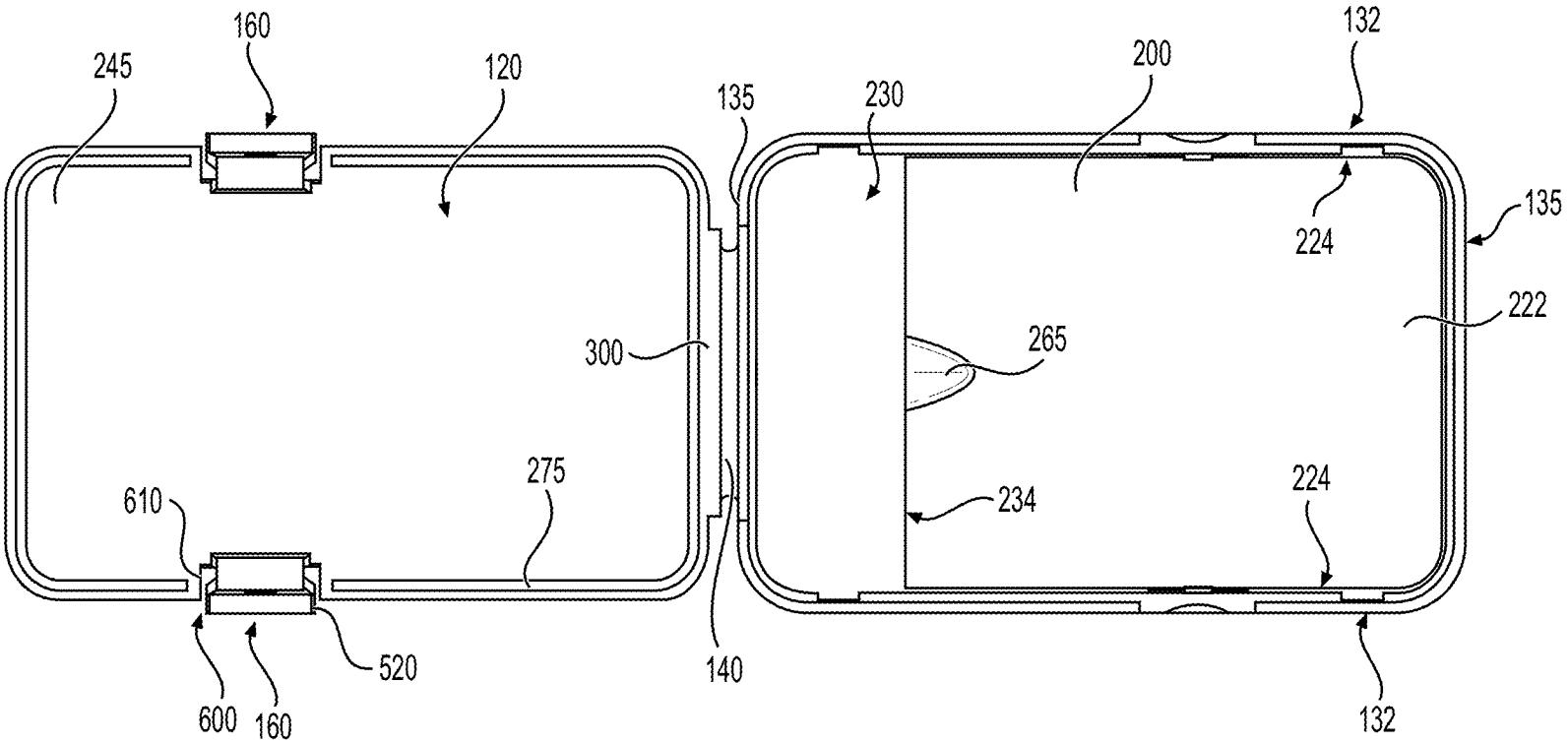
FIG. 6 is an illustration of an upper view of the package in the opened configuration, in accordance with at least one example embodiment.

In at least one example embodiment, as shown in FIG. 1, the package 100 is substantially rectangular in shape, from an overhead perspective (see at least FIG. 6). In at least one example embodiment, the package 100 may have any other suitable shape. In at least one example embodiment, from an overhead perspective view, the package 100 is triangular, oval, square, circular, polygonal, or any other shape.

In at least one example embodiment, the package 100 includes a base 130. In at least one example embodiment, the base 130 includes sidewalls 132 along a long side of the base 130, and end walls 135 along a short side of the base 130. In at least one example embodiment, the walls (e.g., sidewalls 132 and end walls 135) of the package 100 are a same length. In at least one example embodiment, the base 130 includes curved (beveled) corners 138 connecting the sidewalls 132 to the end walls 135. In other example embodiments, the corners 138 may not be rounded or beveled, but may instead have sharp outer edges.

In at least one example embodiment, the package 100 includes a primary lid 120 that meets with an upper portion of the base 130 to close the package 100. In at least one example embodiment, the base 130 may be connected to the primary lid 120 via a hinge 140. In at least one example embodiment, the hinge 140 is a living hinge (as further discussed with respect to FIGS. 2-3). In other example embodiments, the primary lid 120 may be completely removable from the base 130, and may not be hingedly connected to the base 130. In at least one example embodiment, the primary lid 120 includes an exterior surface 124 that is visible when the package 100 is in a closed configured, as shown in FIG. 1.

In at least one example embodiment, the base 130 has a height H ranging from about 0.5 inch to 2.0 inches (e.g., about 0.75 inch to about 1.75 inches, about 1.0 inch to about 1.5 inches). In at least one example embodiment, each of the sidewalls 132 has a length L1 ranging from about 2.0 inches to about 6.0 inches (e.g., about 2.5 inches to about 5.5 inches, about 3.0 inches to about 5.0 inches, or about 3.5 inches to about 4.5 inches). In at least one example embodiment, each of the end walls 135 has a length L2 ranging from about 1.0 inch to about 4.0 inches (e.g., about 1.5 inches to about 3.5 inches, about 2.0 inches to about 3.0 inches, or about 2.25 inches to about 2.75 inches). It should be understood that the package 100 may be any suitable size, and the dimensions can be chosen based on the product to be contained therein.

In at least one example embodiment, the sidewalls 132 and/or the end walls 135 have a thickness T ranging from about 0.1 mm to about 2.0 mm (e.g., about 0.5 mm to about 1.5 mm or about 0.7 mm to about 0.9 mm).

In at least one example embodiment, the package 100 is formed from one or more polymers. In at least one example embodiment, the package 100 is formed of one or more homopolymers, one or more copolymers, or any combination of one or more homopolymers and copolymers. In at least some example embodiments, the polymer includes a thermoplastic polymer. In at least some example embodiments, the polymer includes polyethylene terephthalate (PET), polypropylene (PP), a polyethylene (PE), or any combination thereof. In at least one example embodiment, the polymer is suitable for storing an oral product having one or more flavorings and/or volatile agents therein. In some example embodiments, the package 100 may further include one or more coatings on an inner surface thereof, if desired.

In at least one example embodiment, the package 100 is formed from a polymer, as described above, and a filler, such as talc. The filler may be present in an amount less than or equal to about 50 weight percent (e.g., less than or equal to about 45 weight percent, less than or equal to about 40 weight percent, less than or equal to about 30 weight percent, less than or equal to about 25 weight percent, less than or equal to about 20 weight percent, less than or equal to about 15 weight percent, less than or equal to about 10 weight percent, or less than or equal to about 5 weight percent). The filler may be present in an amount greater than or equal to 0 weight percent (e.g., greater than or equal to about 5 weight percent, greater than or equal to about 10 weight percent, greater than or equal to about 15 weight percent, greater than or equal to about 20 weight percent, greater than or equal to about 25 weight percent, greater than or equal to about 30 weight percent, greater than or equal to about 35 weight percent, greater than or equal to about 40 weight percent, or greater than or equal to about 45 weight percent). In at least one example embodiment, the package 100 further includes a colorant (with or without a filler). In at least one example embodiment, the base 130 and the primary lid 120 are formed of the same polymer. In other example embodiments, the base 130 is formed of a different polymer than the primary lid 120.

In at least one example embodiment, the base 130 and/or the primary lid 120 may be a same or a different color. In at least one example embodiment, a color of the package 100 may denote a flavor of the enclosed product. For example, a green container may contain a mint or menthol flavored product, while a brown container may contain a tobacco flavored product.

In at least one example embodiment, the package 100 is formed by injection molding, blow molding, thermoforming, compression molding, vacuum casting, 3D printing and/or any other any other suitable process.

In at least one example embodiment, the package 100 includes at least one locking, restraining or retaining mechanism 150. While the use of the term locking mechanism will be used throughout the example embodiments. It will be understood that the locking mechanism operates to restrain movement of, for example, a lid of the package from a closed position or configuration to an open position or configuration; and may not necessarily prevent opening. As such, the packages described herein provide a measure of child resistant opening, but do not provide child proof opening. In at least one example embodiment, as shown in FIG. 1, the at least one locking mechanism 150 includes a first locking mechanism 150*a* and a second locking mechanism 150*b*. In at least one example embodiment, the locking mechanisms 150 oppose each other on the package 100. In at least one example embodiment, the package 100 includes one locking mechanism 150. In other example embodiments, the package 100 includes more than two locking mechanisms 150 (e.g., 3, 4, 5, 6, 7, 8, 9, or 10).

In at least one example embodiment, the locking mechanisms 150 are positioned along the sidewalls 132 of the package 100. In other example embodiments, the locking mechanisms 150 can be positioned along one or both of the end walls 135 and/or positioned along one sidewall 132. In at least one example embodiment, the locking mechanisms 150 can be centrally positioned or non-centrally positioned along the sidewalls 132 and/or the end walls 135. In at least one example embodiment, the locking mechanisms 150 are positioned between about 20 mm and about 35 mm from a first one of the end walls 135 (the end wall 135 that is opposite a position of the hinge 140), or about 27.2 mm from the first one of the end walls 135. Positioning of the locking mechanisms 150 may be chosen to further inhibit the relatively small hands of a child from being able to grasp and/or open the package 100. In one embodiment, the locking mechanisms 150 may be placed symmetrically about a longitudinal axis of the package 100. In another embodiment, the locking mechanisms may be placed asymmetrically about a longitudinal axis of the package 100.

Figure 2:
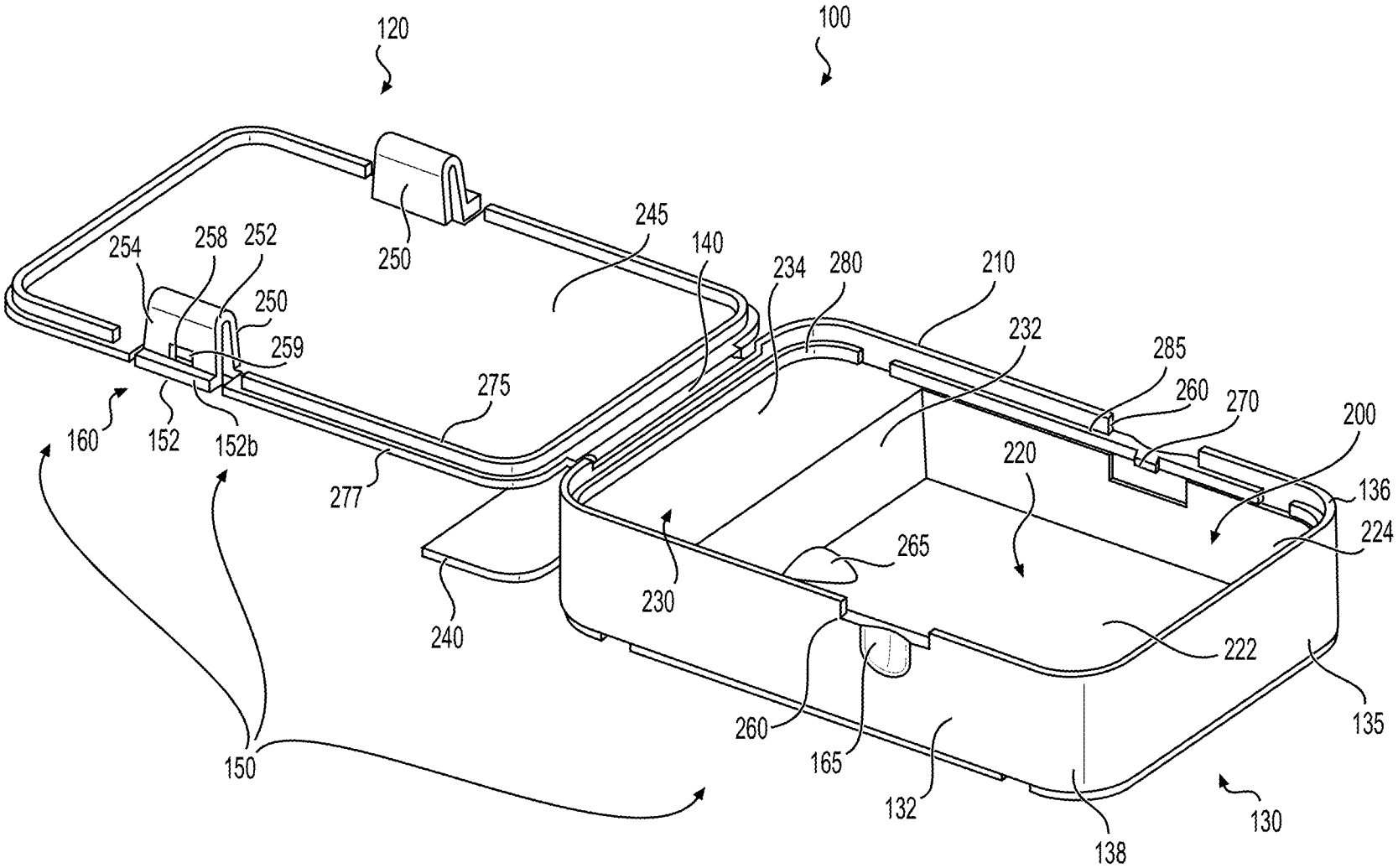
FIG. 2 is an illustration of the package in an opened configuration, in accordance with at least one example embodiment.

FIG. 2 is an illustration of the package 100 of FIG. 1 in an opened configuration (opened position), in accordance with at least one example embodiment.

In at least one example embodiment, as shown in FIGS. 1 and 2, each locking mechanism 150 includes an arm 160 (described in more detail with respect to FIG. 2) and a tab (contact structure, or contact plate) 152 at an end of each arm 160. In at least one example embodiment, the tab 152 includes an upper surface 152*a* that is substantially flush with the exterior surface 4 of the primary lid 120. In at least one example embodiment, the tab 152 is positioned near an upper portion of the sidewall 132 of the package 100. In at least one embodiment, the tab 152 is positioned near an upper portion of the end wall 135 of the package 100. The tab also has an outer surface 152*b*, which is flush with an exterior surface of the sidewall 132. The tab 152 provides a contact surface, against which an adult consumer may push when opening the package 100 as further described herein.

In at least one example embodiment, an upper surface 136 of the base 130 is about flush with the exterior surface 124 of the primary lid 120 so as to mitigate pick points and the ability to circumvent the locking mechanisms 150 when the primary lid 120 is in a closed position (closed configuration, as shown in FIG. 1). As shown in FIG. 1, the primary lid 120 nests within the base 130 when closed. However, in other example embodiments, the primary lid 120 may overlap an upper edge of the base 130 when closed.

In at least one example embodiment, the package 100 further includes a respective indentation 165 along the sidewall 132 adjacent each of the arms 160 and tabs 152. In at least one example embodiment, the indentation 165 provides an access point that allows for the tabs 152 to be more easily pressed inward during an opening of the package 100. The indentation 165 may be sized to allow a finger to be inserted at or under the tabs 152.

In at least one example embodiment, as shown in FIG. 2, the base 130 is connected to the primary lid 120 by the hinge 140. The base 130 and the primary lid 120 combine to at least partially define a portion of the primary storage area 200. In at least one example embodiment, the primary storage area 200 may contain at least one consumer product, as described herein. The primary storage area 200 may have a volume of about 10,000 square millimeters to about 100,000 square millimeters. The volume may be chosen based on a desired number and/or quantity of products to be included therein. In at least one example embodiment, the package 100 provides child resistant access to the primary storage area 200.

Figure 11:
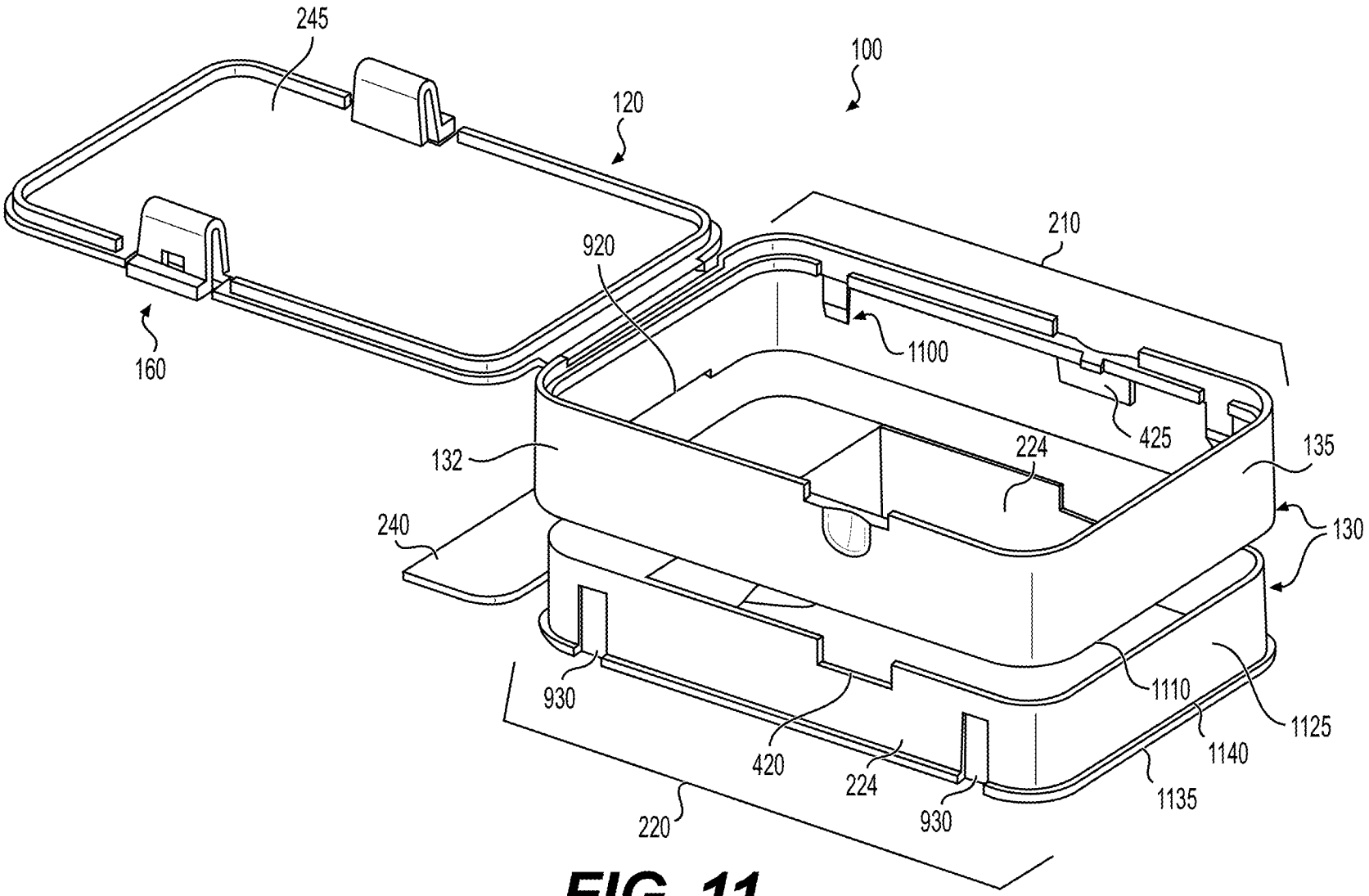
FIG. 11 is an illustration of an exploded view of the package, in accordance with at least one example embodiment.

In at least one example embodiment, the base 130 includes a frame 210 and an insert 220 (as shown and further described with respect to FIG. 11). In at least one example embodiment, the base 130 includes a floor (bottom wall) 222, with interior sidewalls 224 extending from the floor 222. The floor 222 may be formed by a portion of the insert 220. In at least one example embodiment, the floor 222 includes a bump 265, on the floor 222 of the primary storage area 200. The bump 265 opposes a groove 700 (FIG. 7) when the package 100 is viewed from a bottom, as shown and further described with respect to FIGS. 6 and 7. In at least one example embodiment, the groove 700 (shown and discussed with respect to FIG. 7) opposes the bump 265 and facilitates opening of the secondary lid 240.

Figure 9:
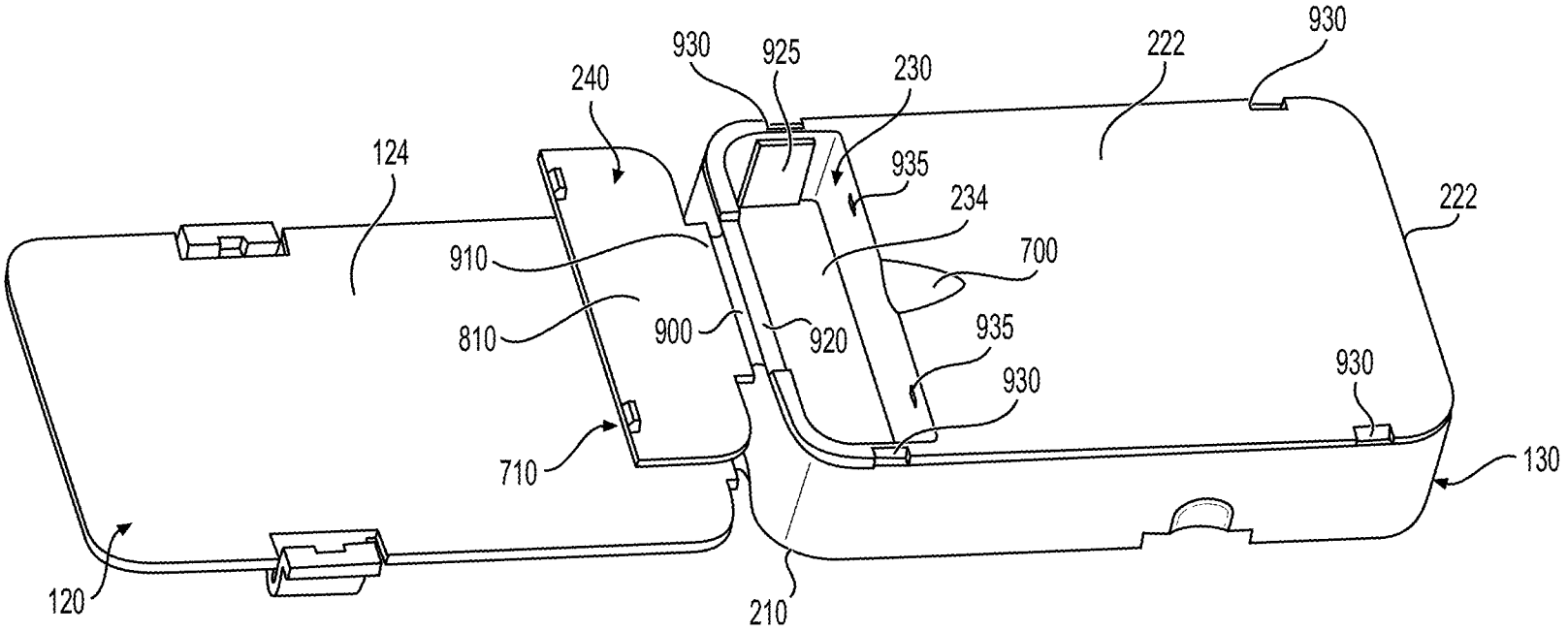
FIG. 9 is an illustration of a perspective view of the package, in accordance with at least one example embodiment.

In at least one example embodiment, the insert 220 also at least partially defines a secondary storage area 230 (as shown and described with respect to FIG. 9). In at least one example embodiment, the secondary storage area 230 is a disposal area or waste cavity. In other example embodiments, the secondary storage area 230 may contain additional consumer products. The secondary storage area 230 may have a volume ranging from about 1,000 square millimeters to about 30,000 square millimeters.

In at least one example embodiment, the secondary storage area 230 is defined at least in part by an end wall 232 and an upper wall 234. The end wall 232 and the upper wall 234 are portions of the insert 220 as further described with respect to FIG. 11. In at least one example embodiment, the secondary storage area 230 includes a secondary lid 240 (as further shown and described with respect to at least FIGS. 7 and 9).

In other example embodiments, the package 100 excludes the secondary storage area 230. In such an embodiment, the floor 222 extends across a full length of the lower portion of the package 100, such that the floor 222 extends between the end walls 135. In another example embodiment, a proportion (size) of the secondary storage area 230 is larger or smaller than the proportion shown in FIG. 2. In at least one example embodiment, a volume of the secondary storage area 230 is larger or smaller than a volume of the primary storage area 200.

In at least one example embodiment, each locking mechanism 150 includes the arms (flexible members, clips, D-clips, etc.) 160. In at least one example embodiment, the arms 160 extend from an interior surface 245 of the primary lid 120. In at least one example embodiment, the tabs 152 are on a distal end of each of the arms 160. In at least one example embodiment, the arms 160 include a first segment 250 connected to the interior surface 245 of the primary lid 120. In at least one example embodiment, the first segment 250 extends from, and is directly connected to, the interior surface 245 of the primary lid 120. In at least one example embodiment, the arms 160 include a second segment 254 that is connected to the first segment 250 via an elbow (bridge) 252, which may be U-shaped. In at least one example embodiment, the first segment 250 and the second segment 254 are substantially flat surfaces, or sheets of material, that oppose each other. In at least one example embodiment, the elbow 252 acts as a hinge, or a living hinge, for the first segment 250 and the second segment 254. In at least one example embodiment, the elbow 252 acts as a spring for the first segment 250 and the second segment 254. In at least one example embodiment, the elbow 252 of each locking mechanism 150 allows the tab 152 to be pressed inward towards the first segment 250 of the arm 160 so as to articulate the second segment 254 inward relative to the first segment 250. In at least one example embodiment, the tab 152, the first segment 250, the second segment 254 and the elbow 252 form a flexible member, where the second segment 254 moves with respect to the first segment 250. In at least one example embodiment, the first segment 250 is a stationary or rigid member. In at least one example embodiment, the elbow 252 is directly connected to the primary lid 120. In this embodiment, the arm (flexible member) 160 includes the tab 152, the second segment 254 and the elbow 252.

In at least one example embodiment, the second segment 254 defines a first engaging structure 258. In at least one example embodiment, the first engaging structure 258 is an exposed surface of the second segment 254, which is exposed in part due to an opening 259. In at least one example embodiment, the opening 259 traverses through a front and back surface of the second segment 254. In another example embodiment, the first engaging structure 258 is an exposed surface of the second segment 254, which is exposed in part due to a ledge or channel defined by an outer surface of the second segment 254, where the ledge or the channel does not traverse fully through the second segment 254. In at least one example embodiment, the first engaging structure 258 is on the second segment 254 at a location that is between the tab 152 and the elbow 252. In at least one example embodiment, the opening 259 is substantially square or rectangular in shape. In other example embodiments, the opening 259 may be circular, oval, or any other shape.

In at least one example embodiment, the elbow 252, and/or the arm 160 (including the first segment 250 and the second segment 254), are made from a resilient material that offers a spring force, such that the second segment 254 and the tab 152 spring or relax away from the first segment 250 once an inward pressing force is released from the tab 152. In at least one example embodiment, the elbow 252 and/or the arm 160 are made from any of the materials used to form other portions of the package 100 as described herein. In other example embodiments, the elbow 252 and/or the arm 160 are formed from a material different from that used to form other portions of the package 100. In at least one example embodiment, the tab 152, the first segment 250, the second segment 254 and the elbow 252 are made from resilient materials. In at least one example embodiment, the tab 152, the first segment 250 and/or the second segment 254 are made from a rigid member, and the elbow 252 is made from a resilient material.

In at least one example embodiment, each locking mechanism 150 further includes a notch 260 defined by the base 130. In at least one example embodiment, at least a portion of the tabs 152 mate with each of the notches 260 once the package 100 is in the closed configuration (as shown in FIG. 1). In at least one example embodiment, the indentation 165 is under each of the notches 260. The indentation 165 allows for the tab 152 to be more easily pressed inward during an opening of the package 100.

Figure 13:
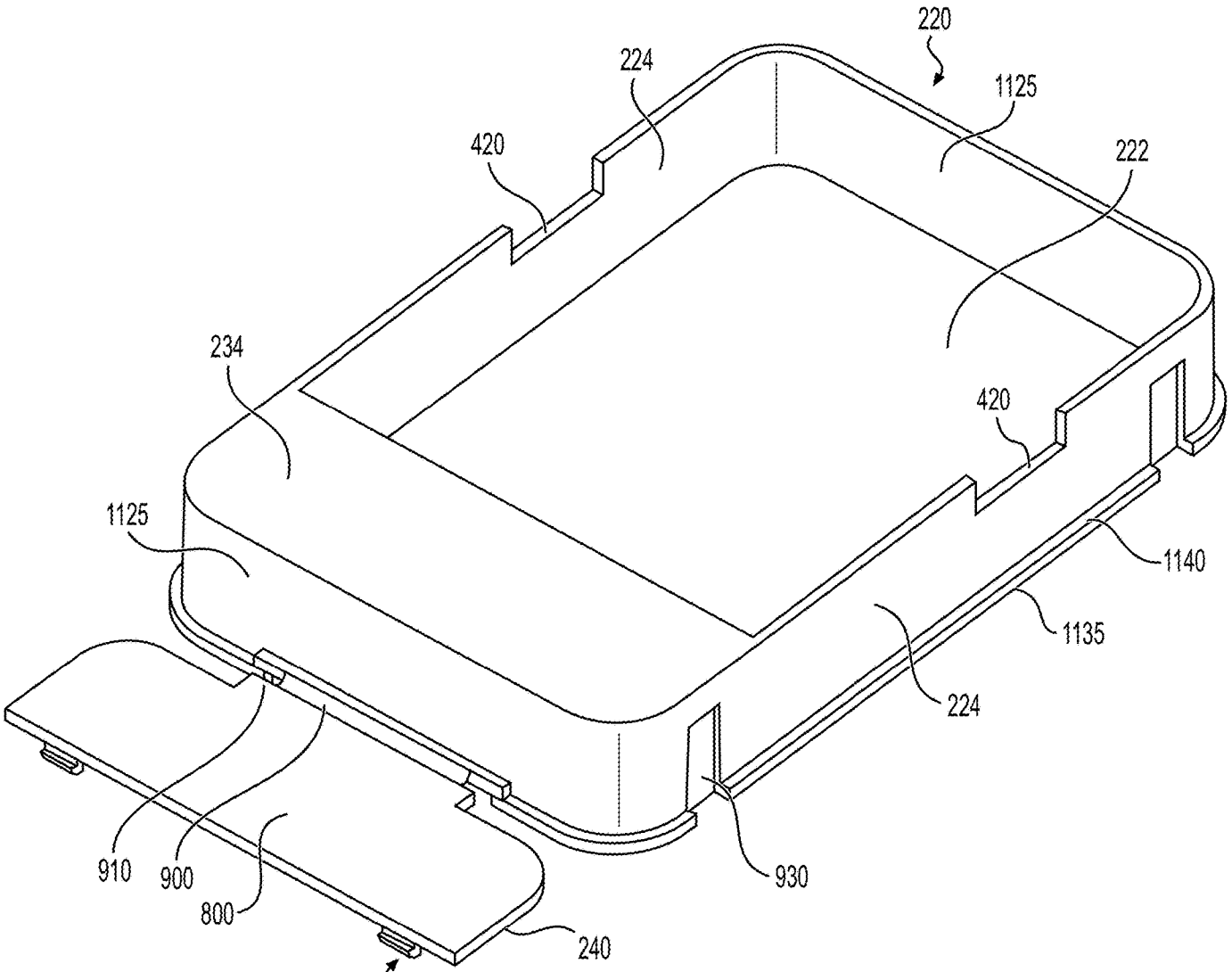
FIG. 13 is an illustration of a perspective view of an insert of the package, in accordance with at least one example embodiment.

In at least one example embodiment, each locking mechanism 150 includes a second engaging structure 270. In at least one example embodiment, the second engaging structure 270 is positioned below each of the notches 260 on an upper interior surface of the sidewalls 132 of the frame 210, or an upper interior surface of the interior sidewalls 224 of the insert 220. In at least one example embodiment, the second engaging structure 270 is on an upper interior surface of another wall (e.g., an interior end wall 1125, as shown in FIG. 13). In at least one example embodiment, the second engaging structure 270 is a catch, projection, tab or protrusion that projects, protrudes or faces toward an interior of the primary storage area 200. The catch will be described in greater detail below with respect to FIG. 4. In at least one example embodiment, the second engaging structure 270 fits into the opening 259, and is retained by, the first engaging structure 258 of the arm 160, once the package 100 is in the closed configuration.

In at least one example embodiment, the package 100 includes a pair of locking mechanisms 150. In this example embodiment, the pair of locking mechanisms 150 and the hinge 140 provide three main points of contact that securely lock the primary lid 120 onto the base 130, once the package 100 is in the closed configuration. In at least one example embodiment, the package 100 locks automatically once the lid 120 is pressed down firmly onto the base 130, by virtue of the arms 160 extending in an outward direction causing the second engaging structure 270 to engage with (e.g., mate with and be retained by) the first engaging structure 258.

In at least one example embodiment, the package 100 requires three separate motions in three separate directions to open. In at least one example embodiment, to open the package 100 from the closed configuration (as shown in FIG. 1), a respective inward force is applied to each of the tabs 152 simultaneously (e.g., a first inward force and a second inward force that are in opposite directions) on their outer (side) surface 152*b*. The respective inward forces move the locking mechanisms 150 from a locked, retrained or retained position or state to an unlocked, unrestrained or retained position or state. With the locking mechanisms in the unlocked position, a lifting force substantially perpendicular to the first and second inward forces may be applied to the primary lid 120 to move the primary lid 120 from the closed position to the open position. It will be understood, the a person applies the forces to unlock and move the lid, and involves a complex set of three different motions to apply three different forces in three separate directions to open the package 100.

In one example embodiment, when the primary lid 120 is moved to the closed position, the first engaging structure 258 is retained by the second engaging structure 270 so as to lock the primary lid 120 in the closed position onto the base 130. In the closed position, the arm 160 (flexible member) is in a first position (partially flexed position). The arm 160 is configured to move from the first position to a second position (flexed position) when an inward pressing force is applied on the outer (side) surface 152*b* of the tab 152 (contact structure, or contact plate) so as to articulate the second segment 254 of the arm 160 towards the first segment 250 and disengage the first engaging structure 258 from the second engaging structure 270. In at least one example embodiment, the arm 160 is flexed (e.g., flexed against the spring force of the elbow 252) in both the first position and the second position. When the primary lid 120 is in the opened position and the inward pressing forces are no longer applied to the arm 160, the arm 160 relaxes to a third position (or relaxed position or state), where the second segment 254 is extended away from the first segment 250 due to the spring force from the elbow 252.

In at least one example embodiment, the primary lid 120 also includes a seal 275 that projects from the interior surface 245 of the primary lid 120 and extends substantially around a perimeter of the primary lid 120. The seal 275 may be inset from an edge 277 of the primary lid 120.

In at least one example embodiment, the base 130 includes a ledge (or seal) 280 that defines a step 285 that extends substantially around an upper portion of a perimeter of an interior of the base 130. In at least one example embodiment, the seal 275 of the lid 120 makes contact and rests on (or mates with) the step 285 of the ledge 280 so as to create an effective seal between the primary lid 120 and the base 130 once the package 100 is in the closed configuration. In at least one example embodiment, the seal 275 mates with the ledge 280 by fitting into an interior of the ledge 280, so that the edge 277 of the primary lid 120 rests on top of the ledge 280. In some example embodiments, the ledge 280 is continuous. In other example embodiments, the ledge 280 is discontinuous.

In at least one example embodiment, the seal 275 is made from a resilient material, and the ledge 280 is made from a hard material. In at least one example embodiment, the seal 275 is made from a hard material and the ledge 280 is made from a resilient material. In another example embodiment, the seal 275 and the ledge 280 are made from either a resilient or a hard material, where the seal 275 and the ledge 280 may be made from different materials or a same material. In at least one example embodiment, once the primary lid 120 is in the closed position (as shown in FIG. 1), the seal 275 and the ledge 280 contact each other, and the edge 277 of the primary lid 120 forms a tight seal with an interior surface of the sidewalls 132 and end walls 135 of the frame 210 of the base 130 so as to create an effective seal between the primary lid 120 and the base 130 that substantially reduces and/or prevents accessible pick points or opening points that may otherwise be used to circumvent the locking mechanisms 150.

In at least one example embodiment, the seal between the base 130 and the primary lid 120 may be hermetic or non-hermetic. In at least one example embodiment, the seal is a non-hermetic seal constructed to allow for air, byproduct gases, and/or other gases to permeate through the seal. The seal may permit gas transfer both into and out of the package. In other example embodiments, the package 100 may not include a seal.

Figure 3:
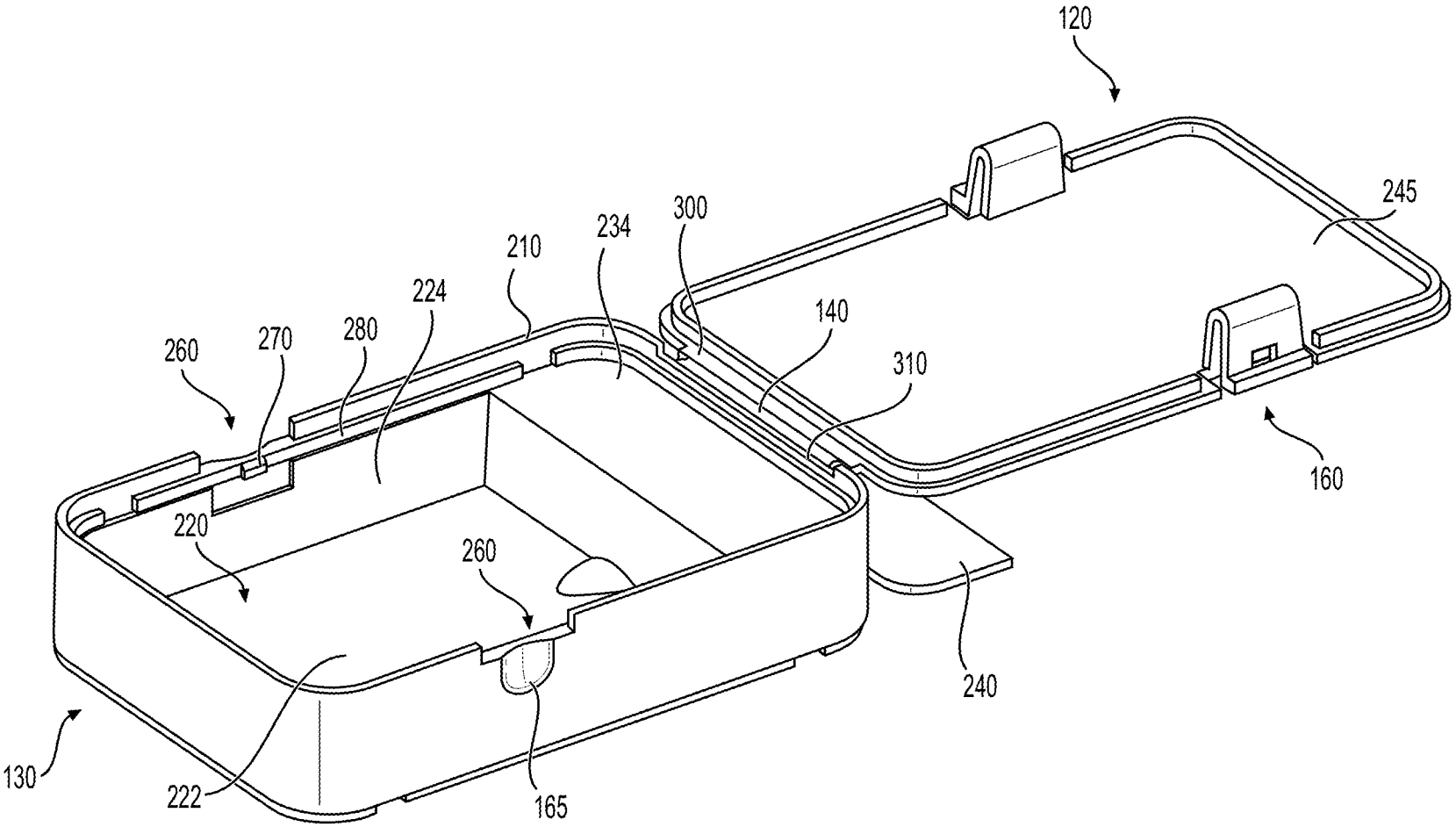
FIG. 3 is an illustration of another perspective view of the package in the opened configuration, in accordance with at least one example embodiment.

FIG. 3 is an illustration of another perspective view of the package 100 in the opened configuration, in accordance with at least one example embodiment.

In at least one example embodiment, as shown in FIG. 3, the primary lid 120 includes an extension 300 that extends from an end of the primary lid 120. In at least one example embodiment, the hinge 140, which may be a living hinge, connects the extension 300 to the frame 210 of the base 130. In at least one example embodiment, the hinge 140 allows the primary lid 120 to articulate between the closed position (as shown in FIG. 1) and the opened position (as shown in FIGS. 2-3).

In at least one example embodiment, a cutout area 310 is defined by an upper portion of an end of the frame 210 of the base 130. In at least one example embodiment, the extension 300 of the primary lid 120 fits within the cutout area 310 once the primary lid 120 is closed onto the base 130 of the package 100.

Figure 4:
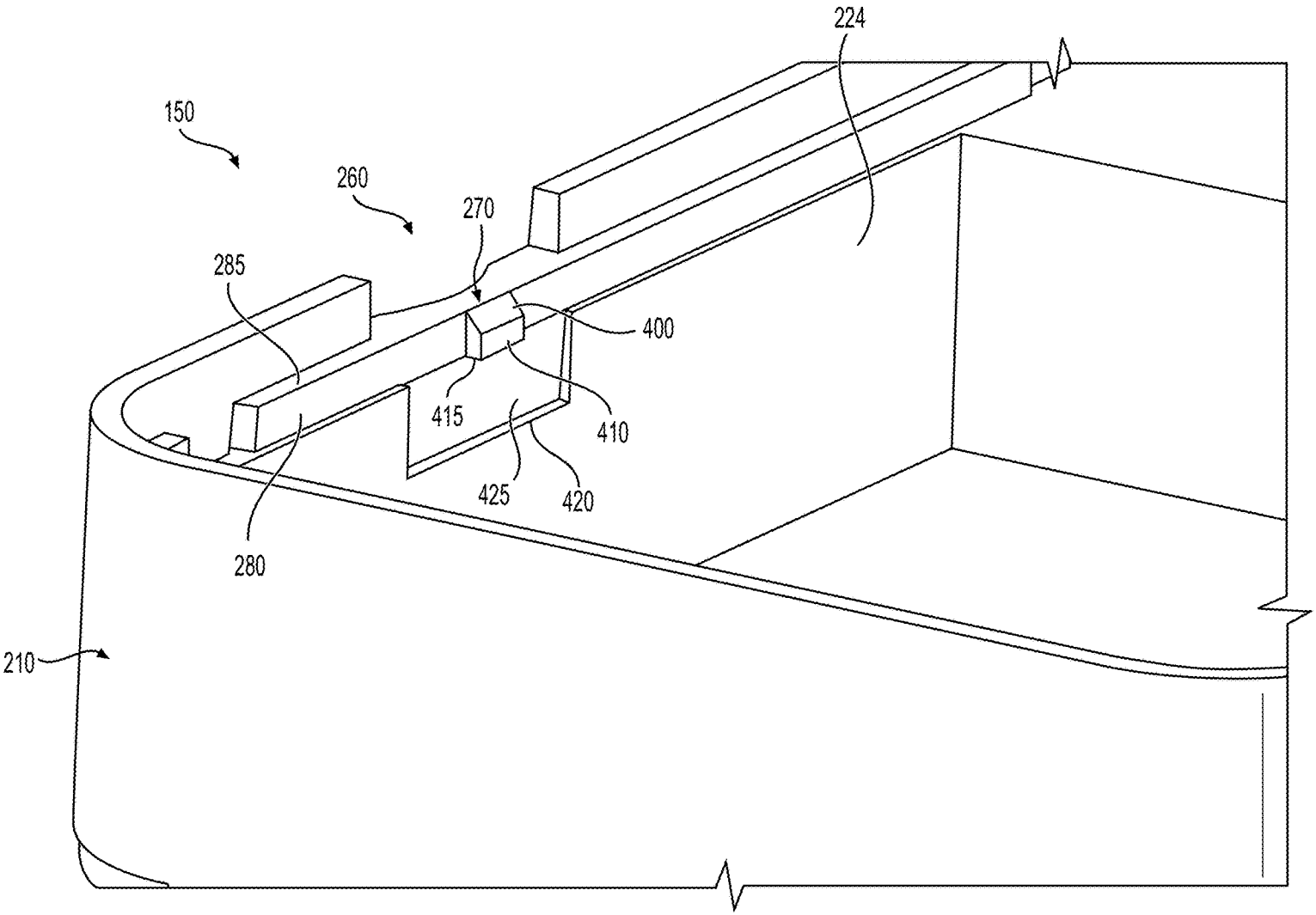
FIG. 4 is an illustration of a close-up view of a portion of a locking mechanism of the package, in accordance with at least one example embodiment.

FIG. 4 is an illustration of a close-up view of a portion of the locking mechanism 150 of the package 100 of FIGS. 1-3, in accordance with at least one example embodiment.

In at least one example embodiment, as shown in FIG. 4, the second engaging structure 270 includes a first surface 400 and a second surface 410. In at least one example embodiment, the first surface 400 is substantially inclined, and the second surface 410 is substantially vertical. In at least one example embodiment, the first surface 400 is substantially inclined so as to allow the second segment 254 (shown in FIG. 2) of the arm 160 of the primary lid 120 to slide across the second engaging structure 270 (shown in FIG. 2), prior to the second engaging structure 270 being retained by the first engaging structure 258 (shown in FIG. 2) of the arm 160. In at least one example embodiment, the second engaging structure 270 includes a third surface 415 perpendicular to the second surface 410, and forming a step (referred to as step 415). In at least one example embodiment, once the second engaging structure 270 slides into the opening 259 as the package 100 is closed, the step 415 is engaged and retained by the first engaging structure 258 (exposed surface of the second segment 254 that is exposed by the opening 259), so as to lock the package 100 in the closed position.

In at least one example embodiment, each of the interior sidewalls 224 define a cutout 420. In at least one example embodiment, a tab 425 of the frame 210 fits into the cutout 420 to further assist in connecting the frame 210 to the insert 220 (see FIG. 11).

Figure 5:
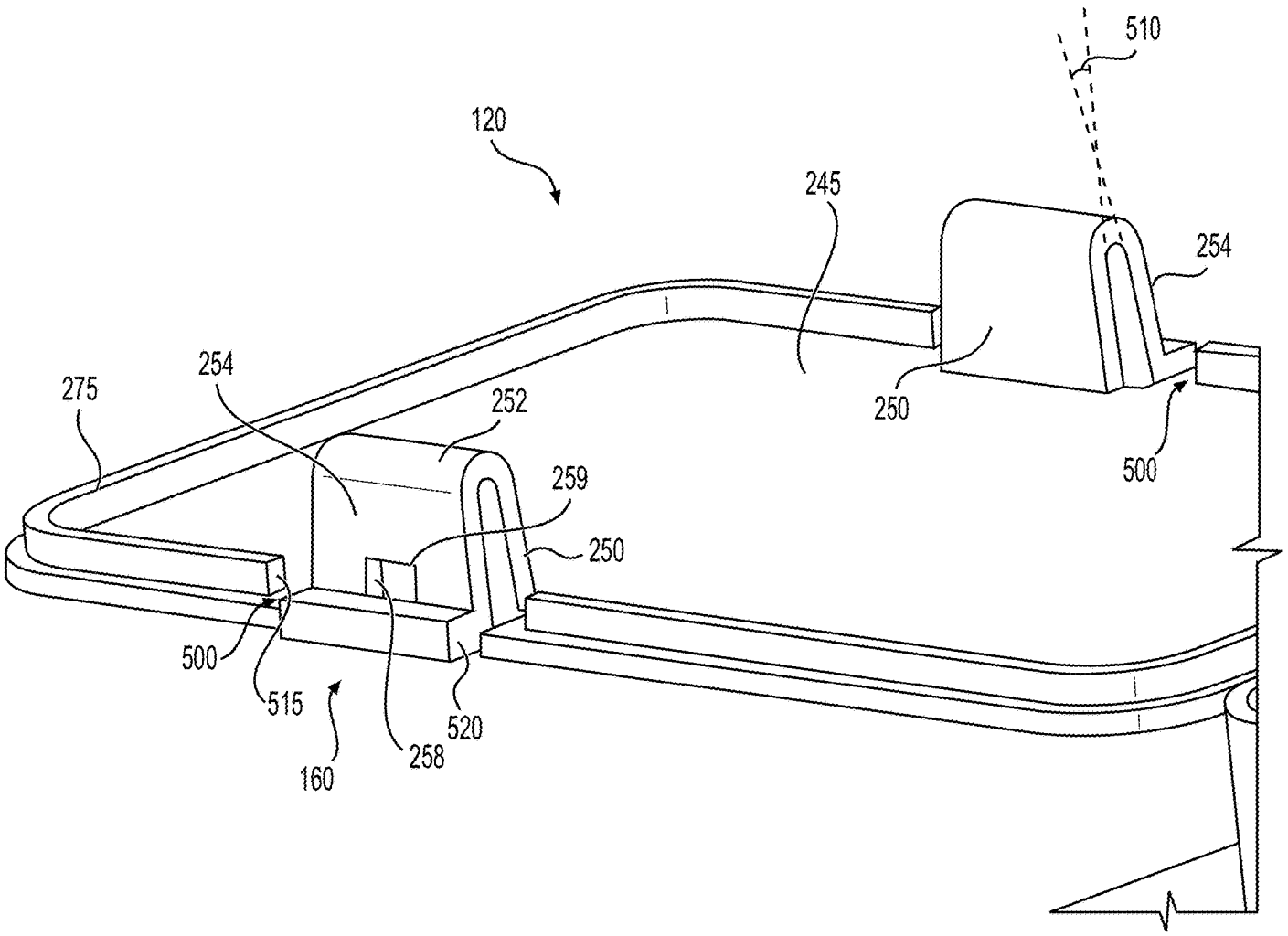
FIG. 5 is an illustration of a close-up view of an arm of the package, in accordance with at least one example embodiment.

FIG. 5 is an illustration of a close-up view of another portion of the locking mechanism 150 of the package 100 of FIGS. 1-4, in accordance with at least one example embodiment.

In at least one example embodiment, a gap 500 exists between an edge 515 of the seal 275 and an edge (side surface) 520 of the arm 160. The gap 500 provides for tolerances in the manufacturing of the package 100, and ensures that movement of the arm 160 is not obstructed during use of the package 100.

In at least one example embodiment, the first segment 250 and the second segment 254 share an angle of incline 510 with each other that ensures the elbow 252 provides an adequate spring force. In at least one example embodiment, the angle of incline 510 is in the range of about 10-30 degrees (e.g., about 15 to about 25 degrees), when the arm 160 is at rest.

FIG. 6 is an illustration of an upper view of the package 100 of FIGS. 1-5 in the opened configuration, in accordance with at least one example embodiment.

In at least one example embodiment, as shown in FIG. 6, a gap 600 exists between the edge 520 of the arm 160 and an edge 610 of the primary lid 120. The gap 600 is sized and configured to allow for movement of the arm 160 during locking and unlocking of the locking mechanisms and during an opening and closing of the package 100.

Figure 7:
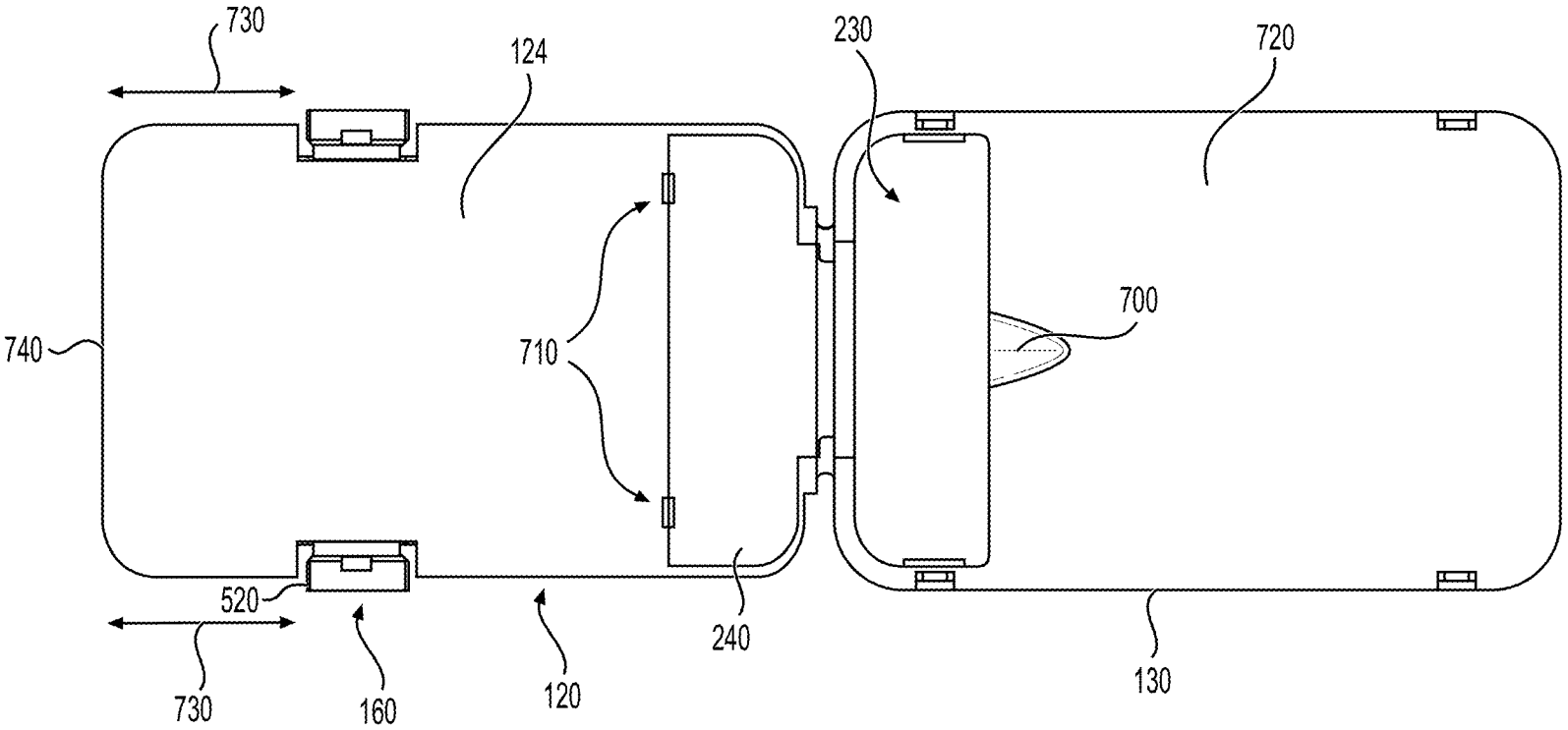
FIG. 7 is an illustration of a lower view of the package in the opened configuration, in accordance with at least one example embodiment.

FIG. 7 is an illustration of a lower or bottom view of the package 100 of FIGS. 1-6 in the opened configuration, in accordance with at least one example embodiment.

In at least one example embodiment, as shown in FIG. 7, both the primary lid 120 and the secondary lid 240 are opened. In at least one example embodiment, the secondary lid 240 includes at least one catch 710 (shown in better detail in FIG. 8). In at least one example embodiment, the at least one catch 710 extends from the secondary lid 240. In at least one example embodiment, the at least one catch 710 is a beak shaped catch (beak catch), that includes a projection or protrusion with a beak shape on an end of the projection. In at least one example embodiment, the beak shape faces toward an interior of the primary storage area 200 when the secondary lid 240 is in a closed position (closed configuration).

In at least one example embodiment, the secondary storage area 230 can be used as a disposal area for a consumed (spent) substance. In at least one example embodiment, the consumed substance may include a consumer product (initially stored in the primary storage area 200) that has been at least partially consumed. In another example embodiment, the secondary storage area 230 may contain a substance or a consumer product that does not, for example, require or necessitate child resistant access. In at least one example embodiment, the at least one catch 710 is not a child resistant lock. In another example embodiment, the secondary lid 240 is locked with the base 130 in order to provide child resistant access to the secondary storage area 230. In at least one example embodiment, a locking mechanism (e.g., locking mechanism 150) is included near the secondary lid 240 to lock the secondary lid 240 on the base 130.

In at least one example embodiment, and as shown in FIG. 7, a distance 730 between the arms 160 and an end 740 of the primary lid 120 is equal, causing the arms 160 to be symmetrically (directly) opposed to each other. In at least one example embodiment, by being symmetrically opposed to each other, the package 100 may be more easily opened using, for instance, one hand to open. In other example embodiments, the distance 730 between the arms 160 and an end 740 may differ from each other, such that the arms 160 on opposing sides of the package 100 are not aligned, but are instead offset (e.g., asymmetric with respect to a longitudinal direction of the package).

In at least one example embodiment, the groove 700 formed in an exterior surface 720 of the base 130 opposes the bump 265 (shown and described with respect to FIG. 2). The groove 700 allows a consumer to insert their finger and grasp an edge of the secondary lid 240 when opening the secondary storage area 230.

Figure 8:
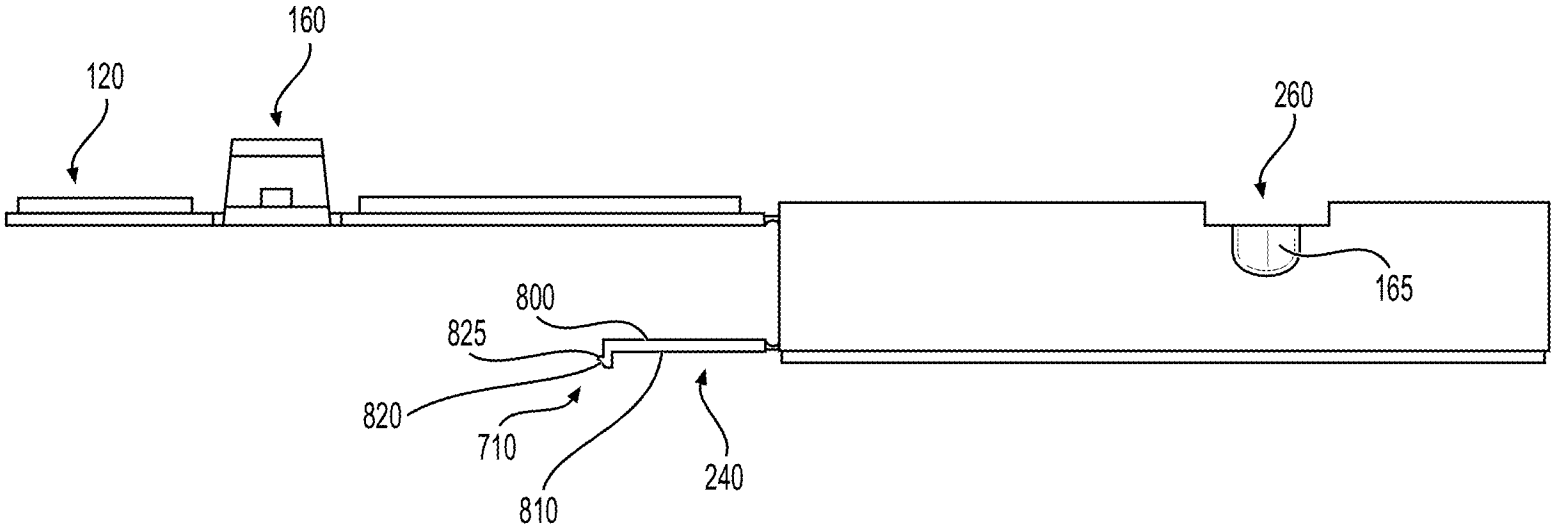
FIG. 8 is an illustration of a side view of the package in the opened configuration, in accordance with at least one example embodiment.

FIG. 8 is an illustration of a side view of the package 100 of FIGS. 1-7 in the opened configuration, in accordance with at least one example embodiment.

In at least one example embodiment, the secondary lid 240 includes an exterior surface 800 that forms a portion of an outside of the package 100 when the secondary lid 240 is in the closed position.

In at least one example embodiment, the secondary lid 240 includes an interior surface 810 that helps define a portion of an interior of the secondary storage area 230 (as shown in FIG. 7). In at least one example embodiment, the at least one catch 710 extends from the interior surface 810 of the secondary lid 240. In at least one example embodiment, the at least one catch 710 includes a first surface 820. In at least one example embodiment, the first surface 820 is an angled (inclined) surface. In at least one example embodiment, the at least one catch 710 includes a second surface 825. In at least one example embodiment, the second surface 825 defines a step configured to hold the at least one catch 710 to maintain the secondary lid 240 in the closed position, once the at least one catch 710 is retained within a slot 935 (shown and discussed with respect to FIG. 9) on an interior of the secondary storage area 230. In at least one example embodiment, the first surface 820 and the second surface 825 collectively form the beak shape on the end of the projection of the at least one catch 710. In at least one example embodiment, when the secondary lid 240 is in the closed position, the beak shape of the at least one catch 710 faces toward the primary storage area 200, where the beak shape mates with the slot 935 (FIG. 9).

Figure 10:
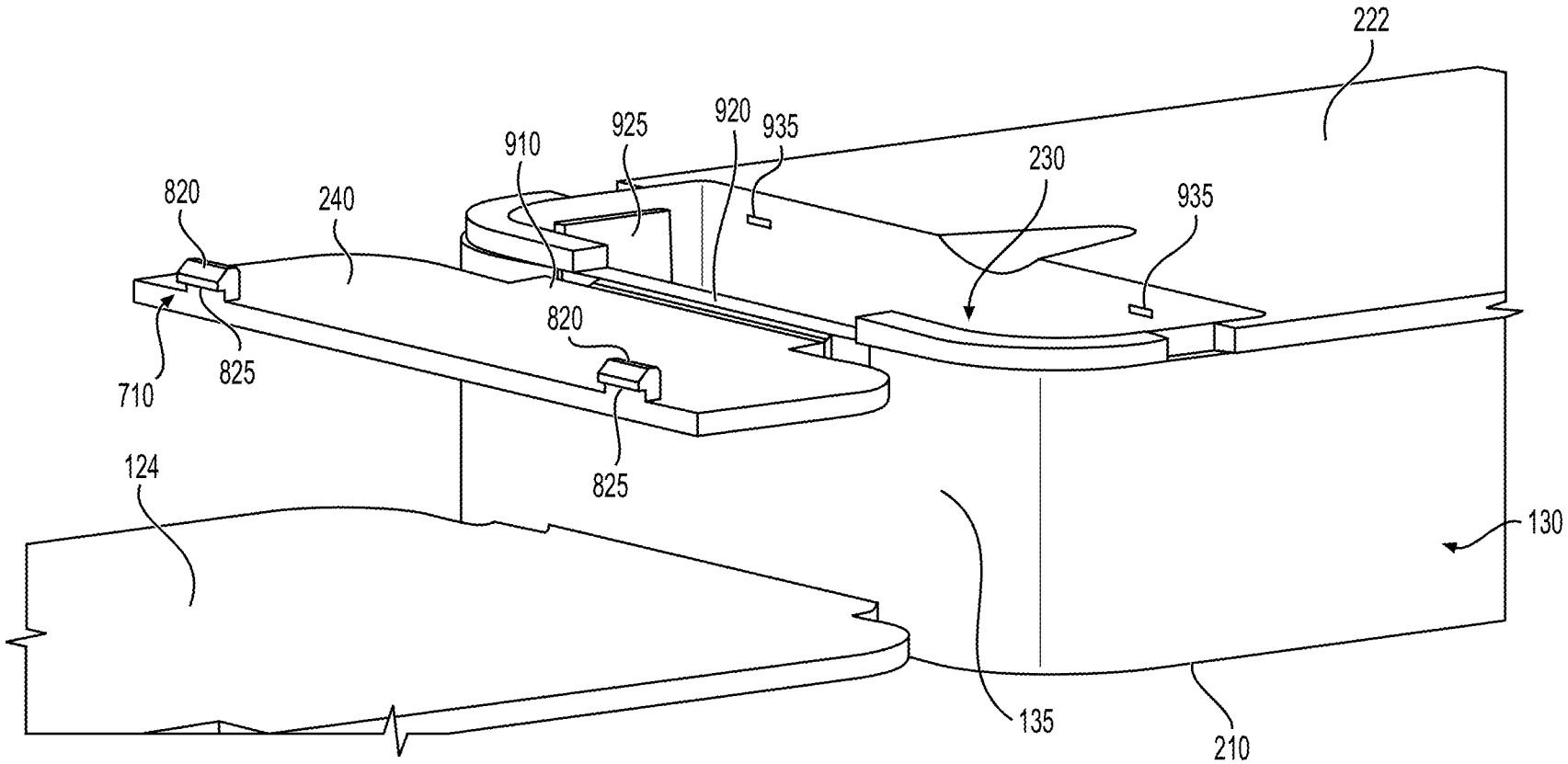
FIG. 10 is an illustration of a perspective view of a secondary storage area of the package, in accordance with at least one example embodiment.

FIG. 9 is an illustration of a perspective view of the package 100 of FIGS. 1-8, in accordance with at least one example embodiment. FIG. 10 is an illustration of a perspective view of the secondary storage area 230 of the package 100, in accordance with at least one example embodiment.

In at least one example embodiment, as shown in FIGS. 9 and 10, a hinge 900 connects an extension 910 of the secondary lid 240 to the base 130. In at least one example embodiment, the hinge 900 allows the secondary lid 240 to articulate between an opened position (opened configuration or state) and the closed position (closed configuration or state). In at least one example embodiment, the hinge 900 is a living hinge.

In at least one example embodiment, the frame 210 defines a cutout area 920. In at least one example embodiment, the extension 910 of the secondary lid 240 fits within the cutout area 920 once the secondary lid 240 is closed onto the base 130 of the package 100. In at least one example embodiment, a block 925 is included on either end of an interior of the secondary storage area 230. In at least one example embodiment, each of the blocks 925 help support the secondary lid 240 so as to ensure the secondary lid 240 does not inadvertently get stuck within the secondary storage area 230 and/or damage the hinge 900. In at least one example embodiment, the floor 222 defines channels 930 along an outer periphery of the insert 220 (also shown in FIG. 11).

In at least one example embodiment, the slots 935 are defined in a sidewall of the secondary storage area 230. In at least one example embodiment, the beak shape (the first surface 820 and the second surface 825) of the at least one catch 710 of the secondary lid 240 faces the slots 935, when the secondary lid 240 is in the closed position, where the second surface 825 of each of the at least one catch 710 is retained within the slot 935 to lock the secondary lid 240 in the closed position on the base 130.

Figure 12:
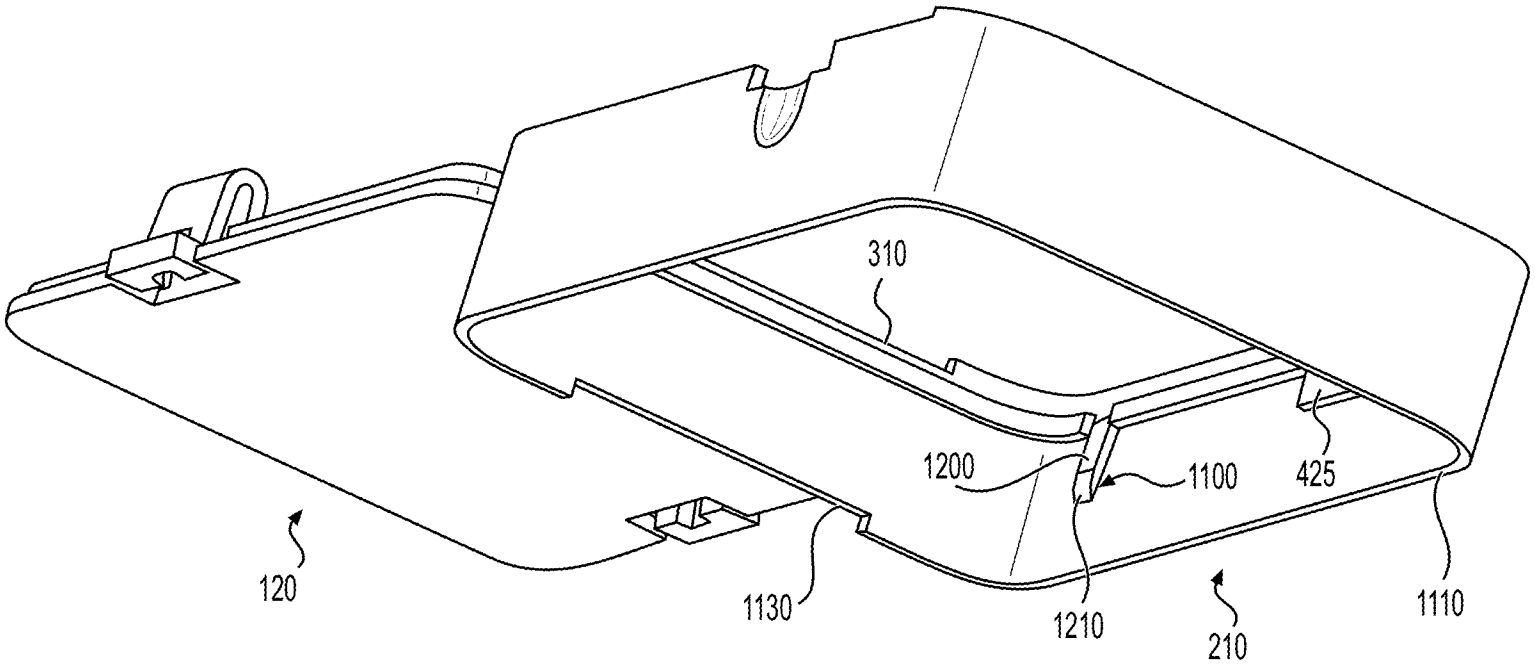
FIG. 12 is an illustration of a perspective view of a frame and lid of the package, in accordance with at least one example embodiment.

FIG. 11 is an illustration of an exploded view of the package 100, in accordance with at least one example embodiment. FIG. 12 is an illustration of a perspective view of the frame 210 and the primary lid 120 of the package 100 of FIGS. 1-11, in accordance with at least one example embodiment. FIG. 13 is an illustration of a perspective view of the insert 220 of the package 100, in accordance with at least one example embodiment.

In at least one example embodiment, as shown in FIGS. 11-13, the base 130 includes the frame 210 and the insert 220. In at least one example embodiment, in order to assemble the base 130, the frame 210 is pressed down onto the insert 220.

In at least one example embodiment, a wedge 1100 mates with the channels 930 (shown in FIG. 9) to help connect the insert 220 with the frame 210. In at least one example embodiment, each wedge 1100 of the frame 210 slides into a respective one of the channels 930 of the insert 220 and is retained within the channel 930, in order to connect the frame 210 to the insert 220. In at least one example embodiment, the insert 220 defines a ridge 1135 along a lower periphery of the insert 220 (e.g., the ridge 1135 extends along a lower end of the interior end walls 1125 and the interior sidewalls 224 of the insert 220). In at least one example embodiment, a step 1140 of the ridge 1135 contacts a bottom edge 1110 of the frame 210 in order to assist the wedges 1100 in connecting the frame 210 to the insert 220 In at least one example embodiment, each of the interior sidewalls 224 of the insert 220 define a cutout 1115.

In at least one example embodiment, the tab 425 of the frame 210 fits into the cutout 420 to further assist in connecting the frame 210 to the insert 220. In other example embodiments, the insert 220 may friction fit within the frame 210 and/or may be glued or otherwise held in position within the frame 210.

In another example embodiment, the frame 210 and the insert 220 may be a single integral element, rather than separate elements.

In at least one example embodiment, as shown in FIG. 12, the wedge 1100 includes a front surface 1200 and an angled (or beveled) surface 1210. The angled surface 1210 facilitates insertion of the wedge 1100 into the channels 930. In at least one example embodiment, the wedge 1100 mates with the channel 930, and is retained in the channel 930 due to a friction fit between the wedge 1100 and the channel 930. In at least one example embodiment, glue, and adhesive, or structure is used in lieu of a friction fit, or in combination with a friction fit, to retain the wedge 1100 within the channel 930.

In at least one example embodiment, as shown in FIG. 13, the upper wall 234 of the insert 220 helps define the secondary storage area 230 (shown in FIG. 9).

Figure 14:
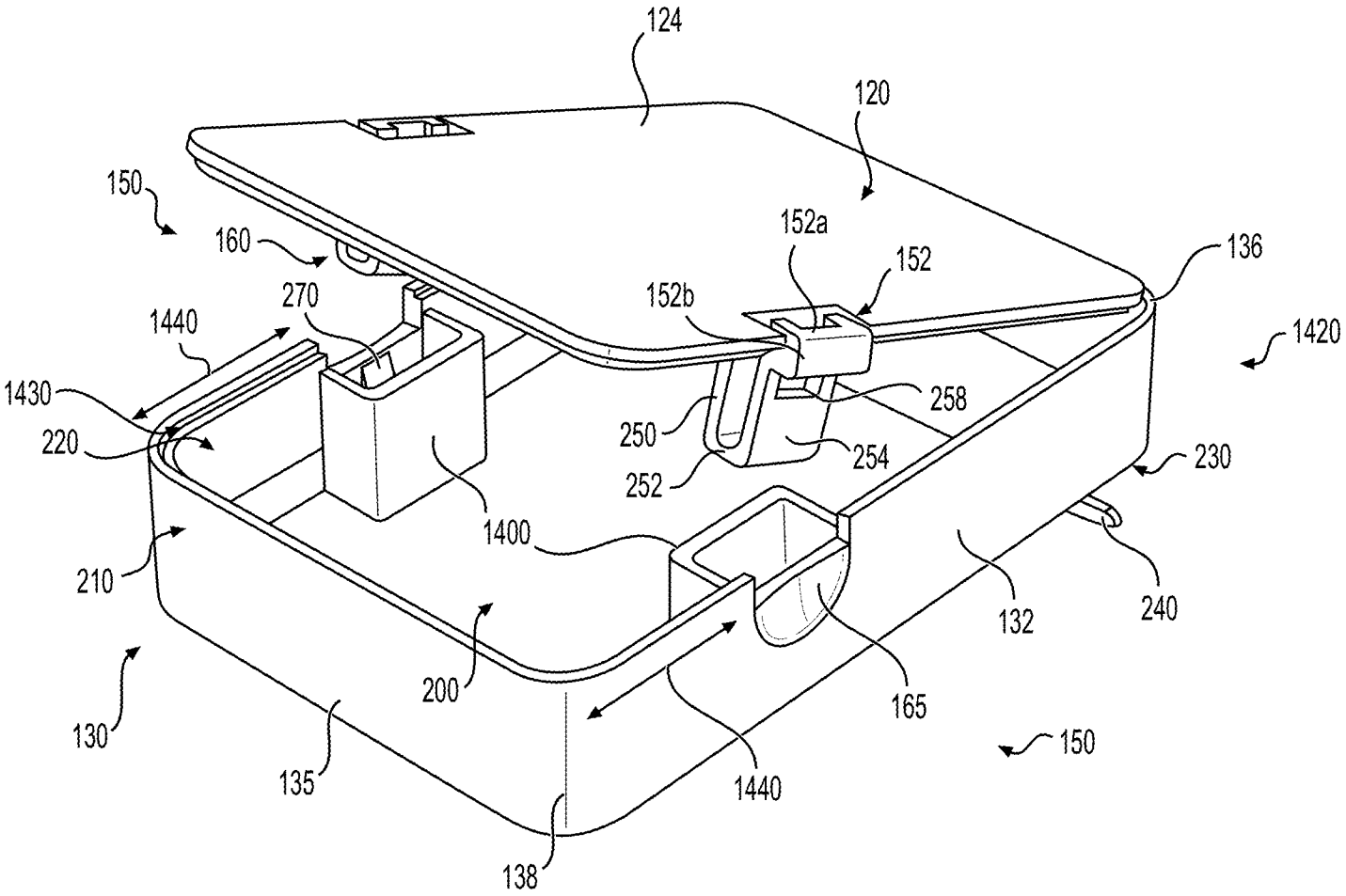
FIG. 14 is an illustration of a perspective view of another package, in a partially opened configuration, in accordance with at least one example embodiment.
Figure 15:
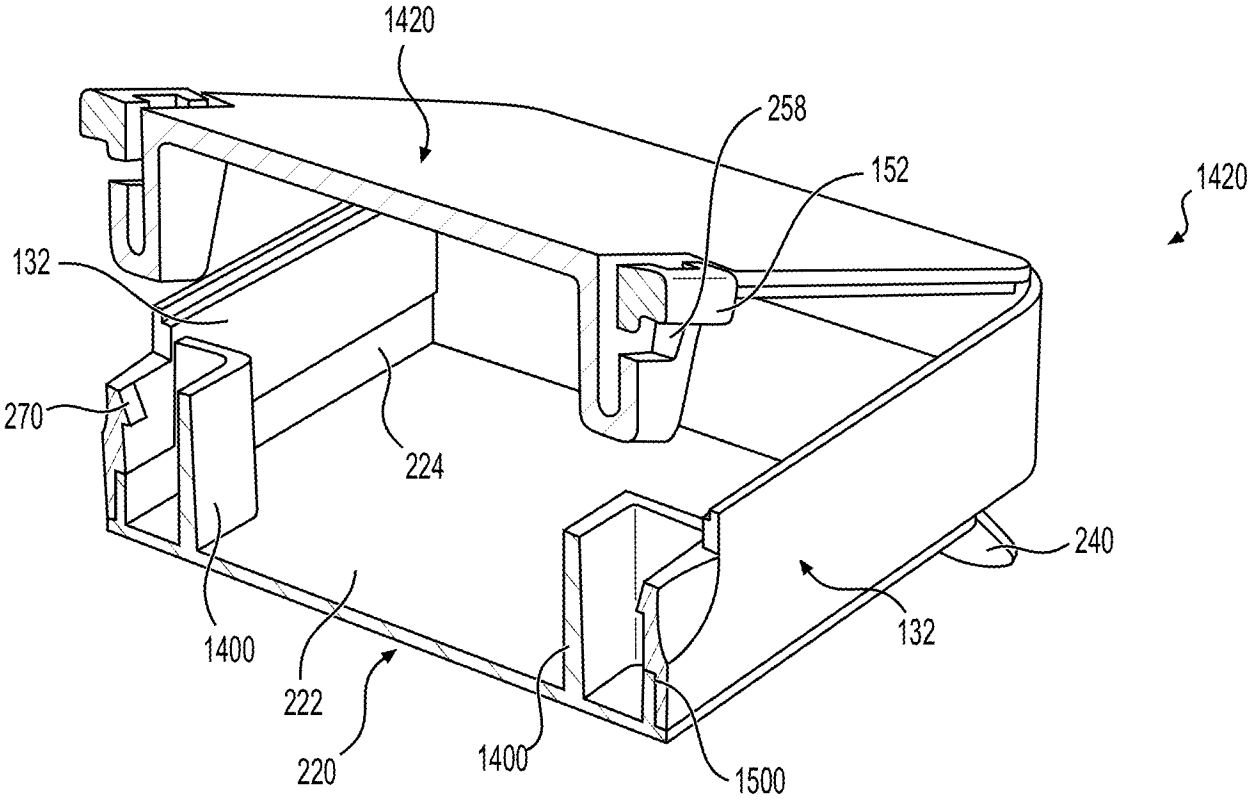
FIG. 15 is an illustration of a cross-sectional view of the package, in accordance with at least one example embodiment.

FIG. 14 is an illustration of a perspective view of another package 1420, in a partially opened configuration, in accordance with at least one example embodiment. FIG. 15 is an illustration of a cross-sectional view of the package 1420, in accordance with at least one example embodiment.

In at least one example embodiment, as shown in FIGS. 14 and 15, the package 1420 is the same as the package 100 of FIGS. 1-13, with exceptions described herein. In at least one example embodiment, the locking mechanism 150 includes a guard (gate) 1400. In at least one example embodiment, the guard 1400 at least partially encloses the arm 160 and the second engaging structure 270, when the primary lid 120 is in the closed position. In at least one example embodiment, a top edge 1430 of the frame 210 contacts the seal 275 of the primary lid 120 so as to seal the package 1420 when the primary lid 120 and base 130 are in the closed position. In at least one example embodiment, the seal 275 may be hermetic or non-hermetic. In at least one example embodiment, the seal 275 is a non-hermetic seal constructed to allow for air, byproduct gases, and/or other gases to permeate through the seal. In at least one example embodiment, the seal 275 permits gas transfer both into and out of the package 1420. In other example embodiments, the package 1420 may not include a seal.

In at least one example embodiment, the frame 210 connects to the insert 220, as shown in FIGS. 1-13. In at least one example embodiment, as shown in FIG. 15, the frame 210 and the insert 220 are joined by a dovetailed seam 1500. In at least one example embodiment, due to the dovetailed seam 1500, a lower portion of the interior sidewalls 224 of the insert 220 and an upper portion of the sidewalls 132 of the frame 210 combine to form an interior surface of the primary storage area 200. In at least one example embodiment, as shown in FIGS. 14-15, the frame 210 defines a ledge 1430. In at least one example embodiment, when the primary lid 120 is in the closed position, the seal 275 on the primary lid 120 mates with the ledge 1430.

In at least one example embodiment, the guard 1400 is an integral part of the insert 220. In at least one example embodiment, the guard 1400 is an integral part of the frame 210. In another example embodiment, the insert 220 and the frame 210 are a single, integral element, rather than separate elements, and the guard 1400 is part of the single, integral element.

As shown in FIG. 14, the locking mechanisms 150 are both a distance 1440 from the end wall 135. Thus, the locking mechanisms 150 are parallel to one another (directly oppose each other). In at least one example embodiment, the distance 1440 ranges from about 0.25 inch to about 1.5 inch (e.g., about 0.5 inch to about 1.25 inch, about 0.75 inch to about 1.0 inch). In at least one example embodiment, the distance 1440 may be chosen to further reduce the possibility of a child with relatively small hands being able to grasp and reach both locking mechanisms 150 simultaneously, while still allowing an adult consumer to open the package 100.

Figure 16B:
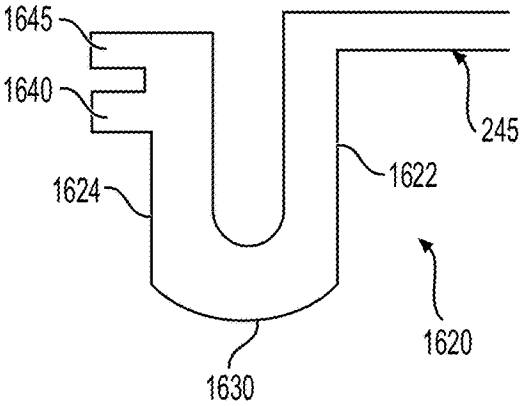
FIG. 16B is an enlarged view of the arm of the locking mechanism of FIG. 16A according to at least one example embodiment.
Figure 16A:
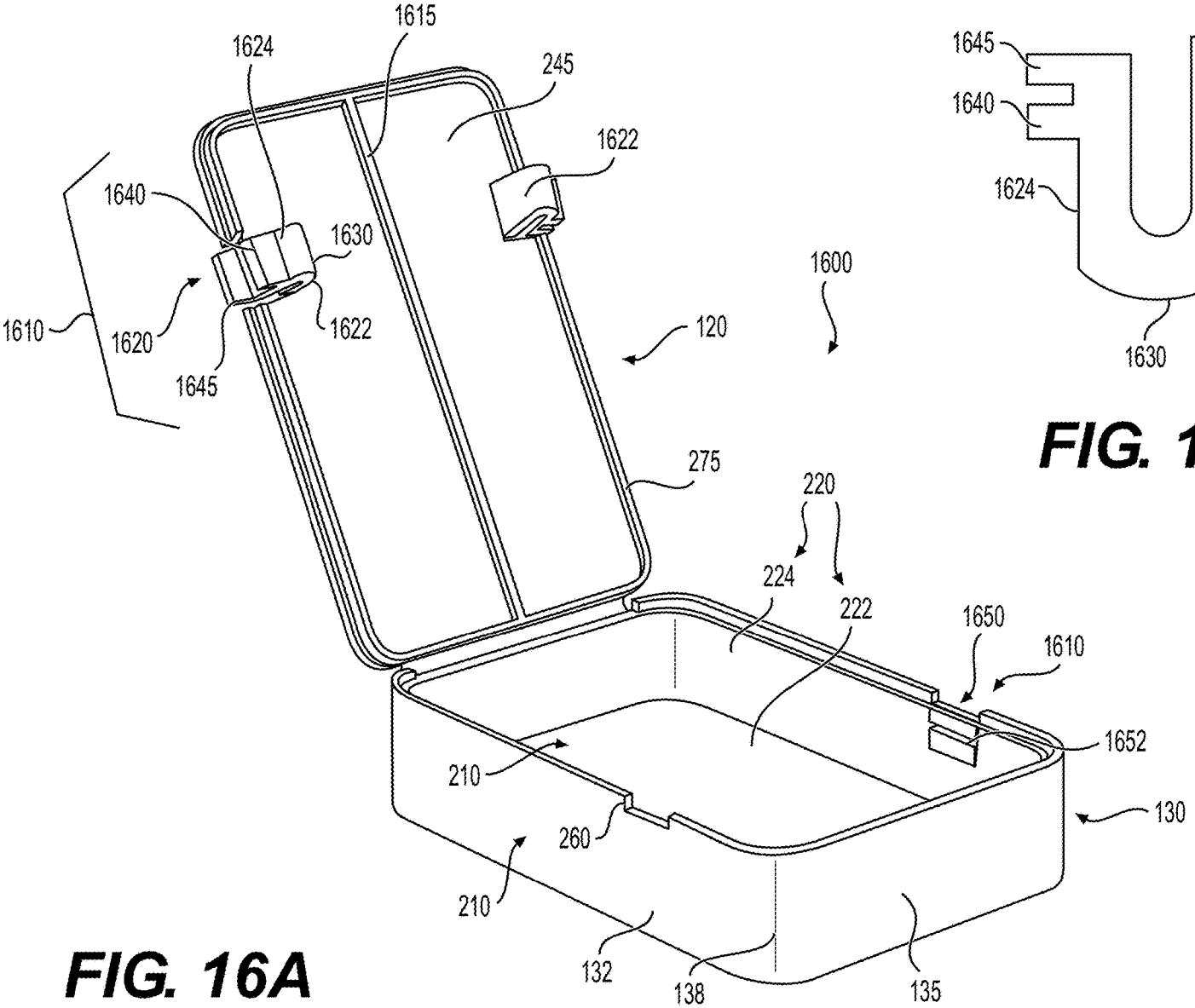
FIG. 16A is an illustration of a perspective view of another package in an opened configuration, in accordance with at least one example embodiment.
Figure 17:
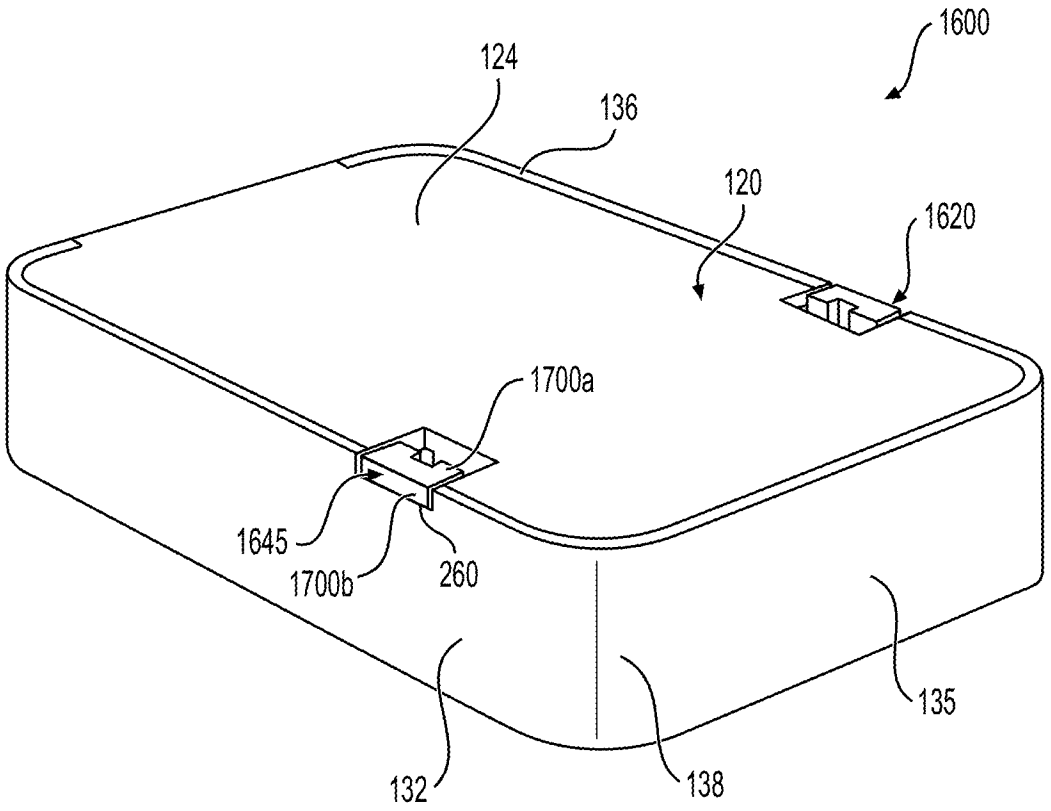
FIG. 17 is an illustration of a perspective view of the package of FIG. 16 in a closed configuration, in accordance with at least one example embodiment.

FIG. 16A is an illustration of a perspective view of another package 1600 in an opened configuration, in accordance with at least one example embodiment. FIG. 16B is an enlarged view of an arm 1620 of a locking mechanism 1610 of FIG. 16A, according to at least one example embodiment. FIG. 17 is an illustration of a perspective view of the package 1600 of FIG. 16 with the primary lid 120 in the closed position (closed configuration), in accordance with an example embodiment.

In at least one example embodiment, as shown in FIGS. 16A, 16B, and 17, the package 1600 is the same as the package of FIGS. 1-13, with exceptions described herein. In at least one example embodiment, the primary lid 120 includes at least one rib 1655. In at least one example embodiment, the arm 1620 includes a first engaging structure 1640. In at least one example embodiment, the first engaging structure 1640 includes a prong (extension) that extends from a second segment 1624 of the arm 1620. In at least one example embodiment, the locking mechanism 1610 includes a second engaging structure 1650 on an interior of the base 130. In at least one example embodiment, the second engaging structure 1650 includes a groove 1652.

In at least one example embodiment, as shown in FIGS. 16A and 16B, the arms 1620 directly oppose each other on the package 1600. In at least one example embodiment, each of the arms 1620 include a first segment 1622 and the second segment 1624 that are connected by an elbow 1630. In at least one example embodiment, the first segment 1622 is a stationary or rigid member, while the second segment 1624 is a flexible member that flexes and/or moves with respect to the first segment 1622 during an operation of the locking mechanism 1610. In at least one example embodiment, the second segment 1624 includes a tab (contact structure, or contact plate) 1645 on a distal end of the second segment 1624. In at least one example embodiment, the second segment 1624 includes the first engaging structure 1640 between the elbow 1630 and the tab 1645. In at least one example embodiment, the arm 1620 is the same as the arm 160, with the exception of the first engaging structure 1640 being a prong, rather than an opening. In at least one example embodiment, the groove 1652 is sized and configured to engage an exposed portion of the first engaging structure 1640 when the primary lid 120 is in the closed position. In at least one example embodiment, a vertical cross-section of the tab 1645 and the first engaging structure 1640 of the arm 1620 (as shown in FIG. 16B) has an F-shape. In at least one example embodiment, when the primary lid 120 is in the closed position, the F-shape of the arm 1620 faces outward toward the sidewalls 224. In at least one example embodiment, the tab 1645 can be retained by the notch 260 and the first engaging structure 1640 can be retained by the groove 1652.

In at least one example embodiment, as shown in FIG. 17, the frame 210 defines the notch 260. In at least one example embodiment, when the primary lid 120 is in the closed position, an outer (side) surface 1700*b* of the tab 1645 extends at least partially through the notch 260, such that the tab 1645 is accessible and can be pressed to open the package 100. In at least one example embodiment, the outer surface 1700*b* of the tab 1645 is flush with the exterior surface of the sidewall 132, when the primary lid 120 is in the closed position. In at least one example embodiment, an upper surface 1700*a* of the tab 1645 is flush with the exterior surface 124 of the primary lid 120, when the primary lid 120 is in the closed position.

In at least one example embodiment, the seal 275 extends from the interior surface 245 of the primary lid 120. In at least one example embodiment, a rib 1615 extends across the interior surface 245 of the primary lid 120. In at least one example embodiment, the rib 1615 adds structural strength to the primary lid 120. In some example embodiments, the rib 1615 may only extend partially across the interior surface 245 of the primary lid 120 and/or the package 1600 may include multiple ribs 1615 (not shown).

In at least one example embodiment, the package may include features of other example embodiments described herein and/or other example embodiments may include features of the package as described above.

Second Example Embodiment

Figure 18:
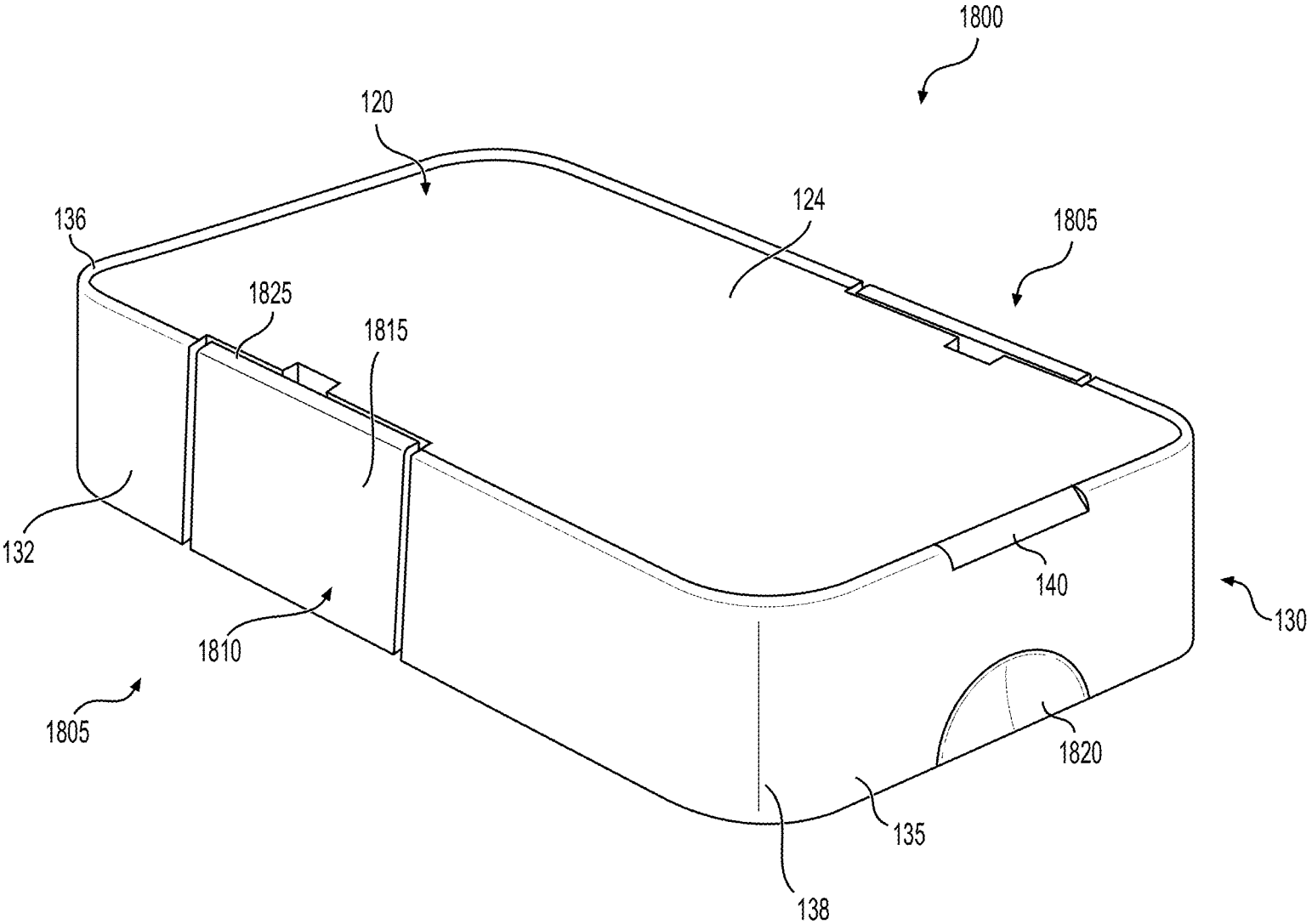
FIG. 18 is an illustration of a perspective view of a package, in accordance with at least one example embodiment.
Figure 19:
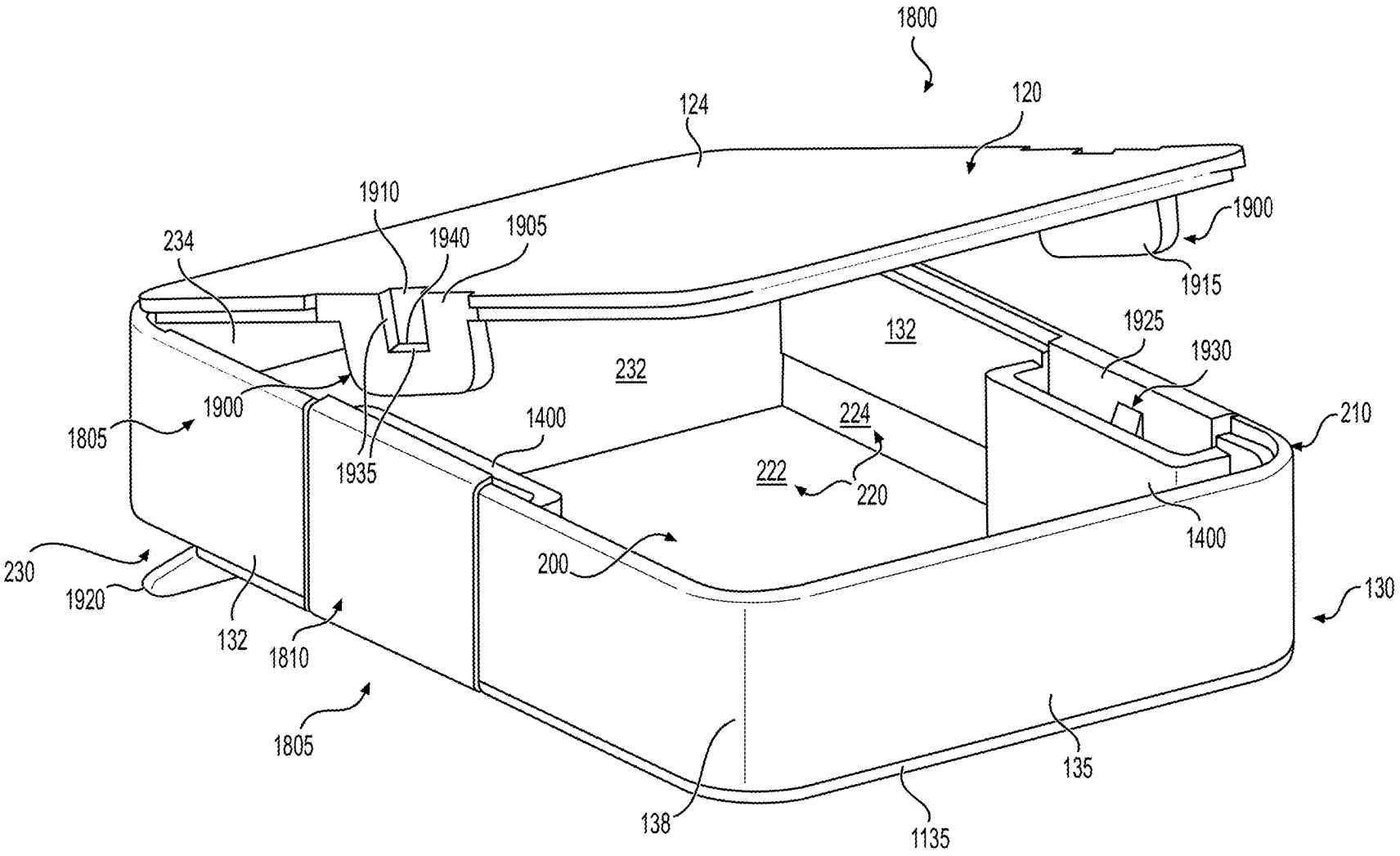
FIG. 19 is an illustration of a perspective view of the package in a partially opened configuration, in accordance with at least one example embodiment.

FIG. 18 is an illustration of a perspective view of a package 1800, in accordance with at least one example embodiment. FIG. 19 is an illustration of a perspective view of the package 1800 in a partially opened configuration, in accordance with at least one example embodiment.

In at least one example embodiment, as shown in FIGS. 18 and 19, the package 1800 is the same as the package 1420 (FIGS. 14 and 15), with exceptions described herein. In at least one example embodiment, the package 1800 includes locking mechanisms 1805 that oppose each other on the package 1800. In at least one example embodiment, a placement and a number of the locking mechanisms 1805 may be the same as the locking mechanisms for the packages 100, 1420 and 1600, as previously described.

In at least one example embodiment, each locking mechanism 1805 includes a tab 1810 (contact structure, or contact plate). In at least one example embodiment, the tab 1810 includes an outer (exterior) surface 1815. In at least one example embodiment, the outer surface 1815 is flush with an exterior surface of the walls (peripheral walls) of the package 1800 (e.g., exterior surface of sidewalls 132, or end walls 135). In at least one example embodiment, the tab 1810 is in a same plane as the sidewall 132, but the tab 1810 is not a continuous portion of the sidewall 132. In at least one example embodiment, the tab 1810 includes an upper surface 1825. In at least one example embodiment, the upper surface 1825 is flush with the exterior surface 124 of the lid 120. In at least one example embodiment, the tab 1810 is a rectangular or a square shape. In at least one example embodiment, other shapes of the tab 1810 are contemplated.

In at least one example embodiment, an indentation 1820 is defined by a lower portion of at least one of the walls (e.g., the sidewalls 132 or end walls 135). In at least one example embodiment, the indentation 1820 is adjacent to a secondary lid 1920 (see at least FIG. 25) to assist in an opening of the secondary lid 1920.

In at least one example embodiment, as shown in FIG. 19, the locking mechanism 1805 includes an arm 1900 with an exterior surface 1905 and an interior surface 1915. In at least one example embodiment, the exterior surface 1905 defines a first engaging structure (first engagement) 1935. In at least one example embodiment, the first engaging structure 1935 is exposed surfaces of the arm 1900 that are defined at least in part by a channel (or recess) 1910 in the arm 1900. In at least one example embodiment, the first engaging structure 1935 includes a ledge 1940 defined by the exterior surface 1905 of the arm 1900. In at least one example embodiment, the first engaging structure 1935 engages, and is retained by, a second engaging structure (second engagement) 1930, when the primary lid 1920 is in a closed position (closed configuration; see FIG. 18). In at least one example embodiment, the exterior surface 1905 of the arm 1900 is a rectangular or a square shape. In at least one example embodiment, other shapes of the exterior surface 1905 are contemplated. In at least one example embodiment, a depth of the channel 1910 (a depth into the exterior surface 1905 of the arm 1900) is between about 1 mm to about 10 mm, or the depth is about 1 mm to about 2 mm.

Figure 22:
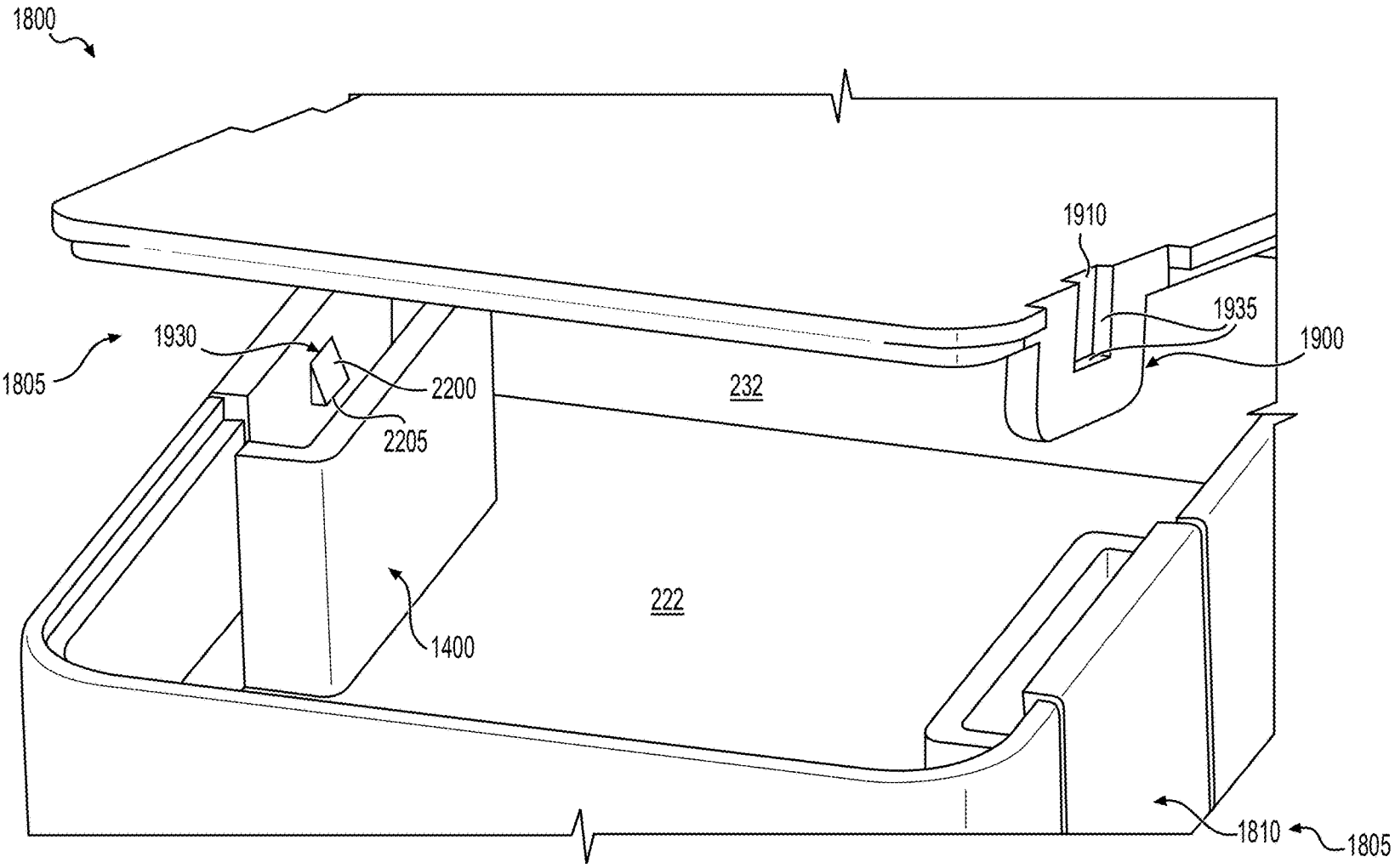
FIG. 22 is an illustration of a close-up view of locking mechanisms of the package, in accordance with at least one example embodiment.

In at least one example embodiment, the locking mechanism 1805 includes the tab 1810, where an interior surface 1925 of the tab includes the second engaging structure 1930 (also see FIG. 22). In at least one example embodiment, the guard 1400 at least partially encloses the arm 1900 and the second engaging structure 1930, when the primary lid 120 is in the closed position (closed configuration).

In at least one example embodiment, the primary lid 120 has at least three points of contact with the base 130, when the primary lid 120 is in the closed position (FIG. 18). In at least one example embodiment, the three points of contact are provided by a pair of the locking mechanisms 1805 and the hinge 140.

Figure 20:
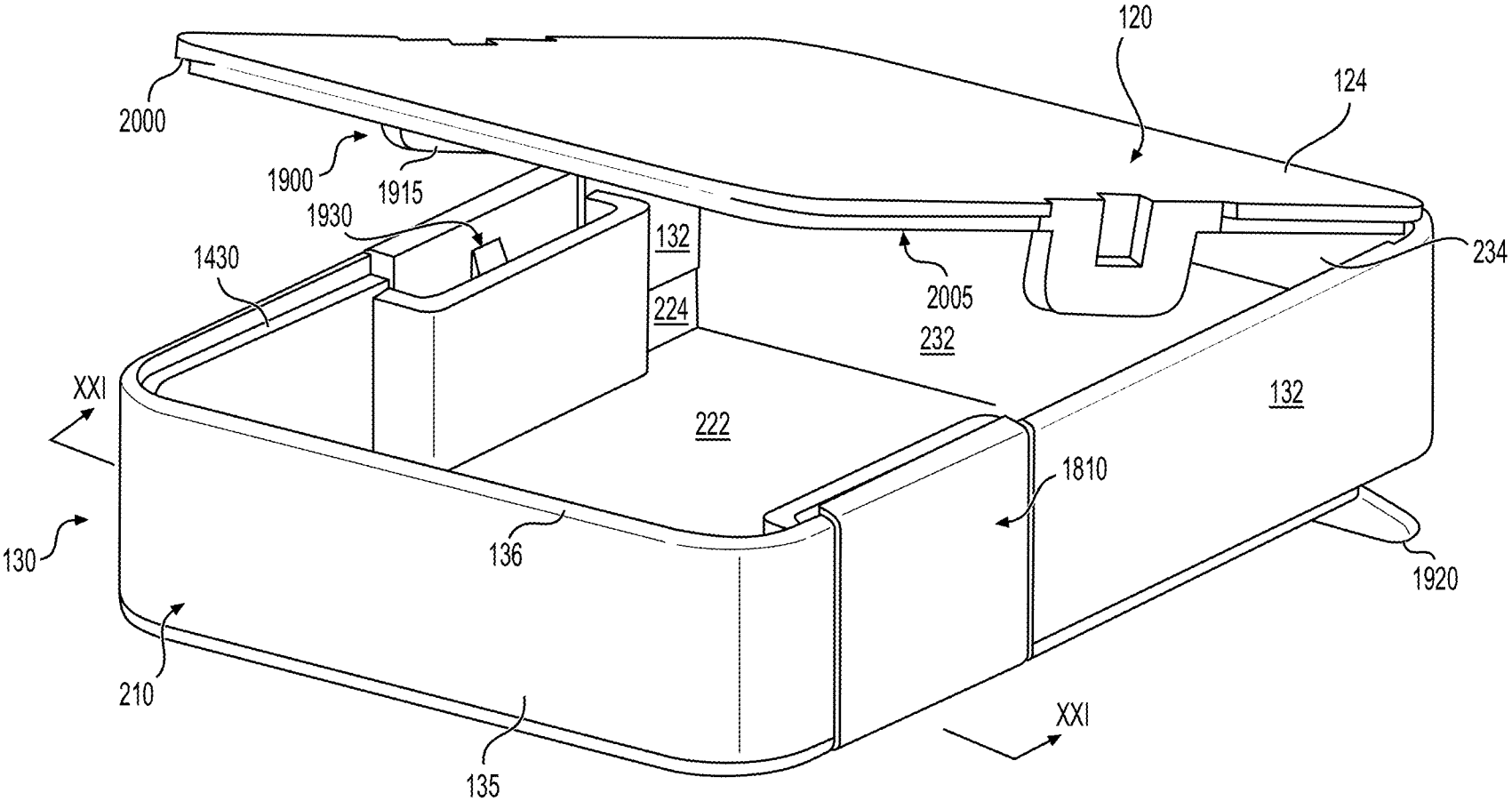
FIG. 20 is an illustration of another perspective view of the package in the partially opened configuration, in accordance with at least one example embodiment.

FIG. 20 is an illustration of another perspective view of the package 1800 in the partially opened configuration, in accordance with at least one example embodiment.

In at least one example embodiment, an interior surface 2005 of the primary lid 120 defines a step 2000. In at least one example embodiment, the step 2000 mates with the ledge 1430 of the frame 220, when the primary lid 120 is in the closed position (FIG. 18). In this example embodiment, the upper surface 124 of the primary lid 120 is therefore flush with the upper surface 136 of the frame 220. In another example embodiment, the interior sidewalls 224 of the insert 220 may define the ledge 1430, if the interior sidewalls 224 extend from the floor 22 up to an elevation of the primary lid 120 when the primary lid 120 is in the closed position (e.g., the interior sidewalls 224 may be positioned behind the sidewalls 132 of the frame 210, as shown for example for example in FIG. 3).

Figure 21:
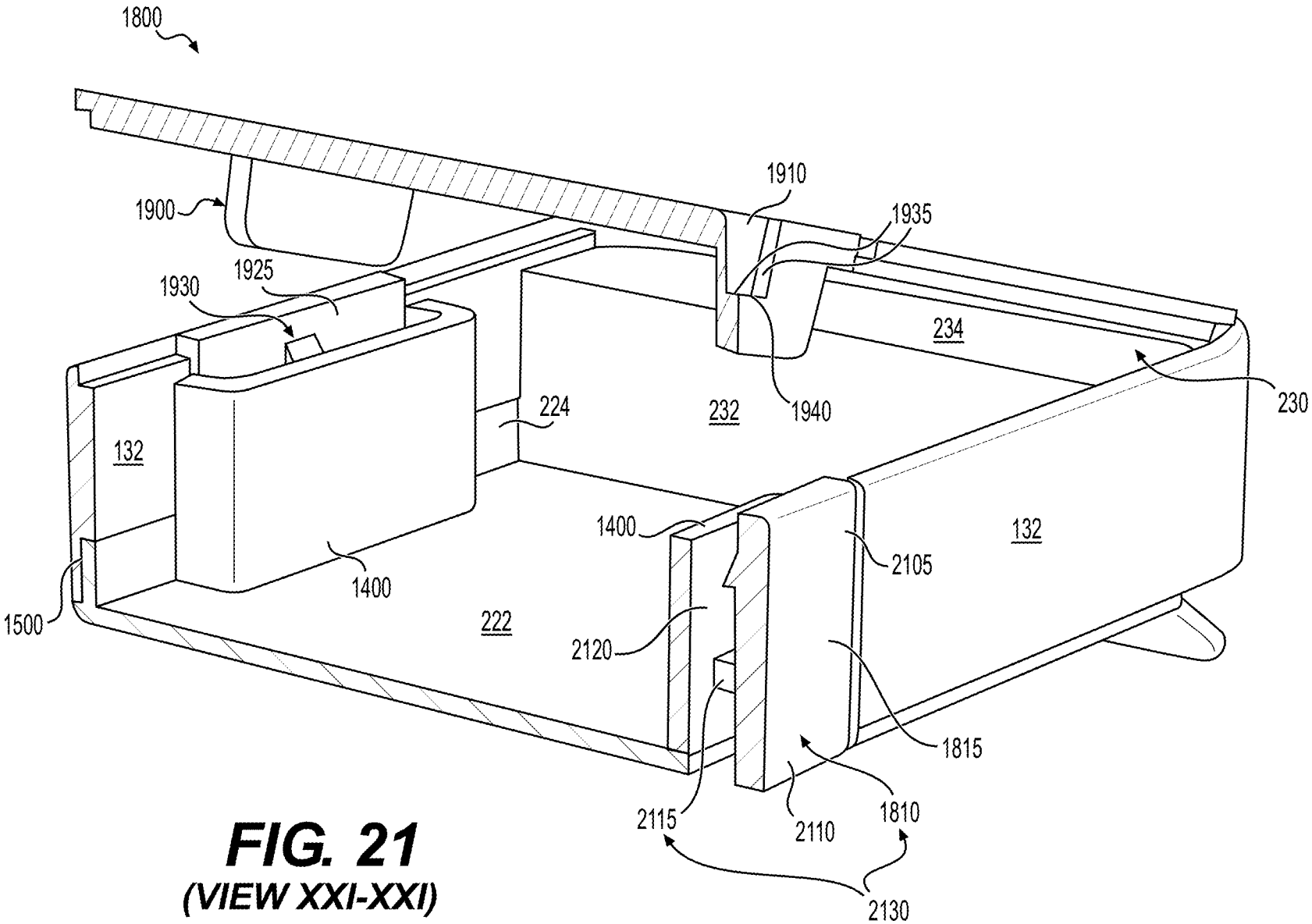
FIG. 21 is an illustration of a cross-sectional view of the package in the partially opened configuration, in accordance with at least one example embodiment.

FIG. 21 is an illustration of a cross-sectional view (along line XXI-XXI in FIG. 20) of the package 1800 in the partially opened configuration, in accordance with at least one example embodiment. FIG. 22 is an illustration of a close-up view of the locking mechanisms 1805 of the package 1800, in accordance with at least one example embodiment.

In at least one example embodiment, the tab 1810 is in a same plane as the peripheral wall (e.g., the sidewall 132 or the end wall 135) of the package 1800. In at least one example embodiment, the tab 1810 pivots due to an applied inward force (pressing force) on a lower portion 2110 of the exterior surface 1815 of the tab 1810. In at least one example embodiment, at least one attachment member (attachment) 2115 connects the tab 1810 to the base 130 (see FIGS. 31A-31D). In at least one example embodiment, the at least one attachment member 2115 is attached to the interior surface 1925 of the tab 1810 and an exterior surface 2120 of the guard 1400, where the at least one attachment member 2115 extends between the interior surface 1925 and the exterior surface 2120. The at least one attachment member 2115 extending from an interior surface 1925 of the tab 1810 in a first direction when the flexible structure 2130 is in a relaxed position. The first direction being perpendicular to the interior surface 1925 when viewed along a line of sight that is parallel to a longitudinal length of the sidewalls 132. In at least one example embodiment, the tab 1810 pivots relative to the at least one attachment member 2115 and/or the at least one attachment member 2115 pivots relative to a portion of the base 130 that the at least one attachment member 2115 is attached to, thereby causing the tab 1810 to pivot due to the inward force applied to the lower portion 2110 of the outer surface 1815 of the tab 1810 (see FIGS. 31A-31D). In one embodiment, as discussed in detail below, alternatively or additionally, the attachment member 2115 bends.

In at least one example embodiment, the guard 1400 is an integral part of the base 130. In at least one example embodiment, the guard is inwardly adjacent to the tab 1810, as shown in FIG. 21. In at least one example embodiment, the guard 1400 is a section of the peripheral wall (e.g., the sidewall 132 or the end wall 135) of the package 1800. For example, the sidewall 132 curves inward to an offset linear section and curves back outward from the offset linear section to form the guard 1400 and define space for the tab 1810 and attachment member 2115. In one embodiment, the offset linear section is parallel to the other linear sections of the sidewall 132. In one embodiment, the tab 1810 is coplanar with the other linear sections of the sidewall 132.

In at least one example embodiment, the applied inward force to the lower portion 2110 causes an upper portion 2105 of the tab 1810 to be articulated to move in an outward direction, causing the first engaging structure 1935 to release the second engaging structure 1930. In at least one example embodiment, the tab 1810 and the at least one attachment member 2115 combine to form a flexible structure 2130 (as further described in FIGS. 31A-31D).

In at least one example embodiment, as shown in FIG. 22, the second engaging structure 1930 includes a first surface 2200. In at least one example embodiment, the first surface 2200 is an inclined surface. In at least one example embodiment, the second engaging structure 1930 includes a second surface 2205. In at least one example embodiment, the second surface 2205 is parallel to the floor 222 and defines a step. In at least one example embodiment, when the primary lid 120 is in the closed position, the second engaging structure 1930 engages the first engaging structure 1935, and the second surface 2205 of the second engaging structure 1930 retains the first engaging structure 1935. In at least one example embodiment, the second engaging structure 1930 has a profile that is a triangular shape (as shown in FIG. 22), thereby giving the second engaging structure 1930 a three dimensional shape of a triangular prism. Other shapes of the profile of the second engaging structure 1930 are contemplated, including rectangular or square. In at least one example embodiment, a depth of the second surface 2205 is about 1 mm to about 10 mm, or the depth is about 1 mm to about 2 mm.

In at least one example embodiment, the locking mechanisms 1805 are offset from each other on sides of the package 1800. That is to say, in at least one example embodiment, and as shown and described in FIG. 29, a first distance 2900 and a second distance 2905 between the respective locking mechanisms 1805 and the end wall 135 of the package 1800 are not equal. In another example embodiment, the locking mechanisms 1805 are directly opposed, such that the first distance 2900 and the second distance 2905 are equal.

Figure 29:
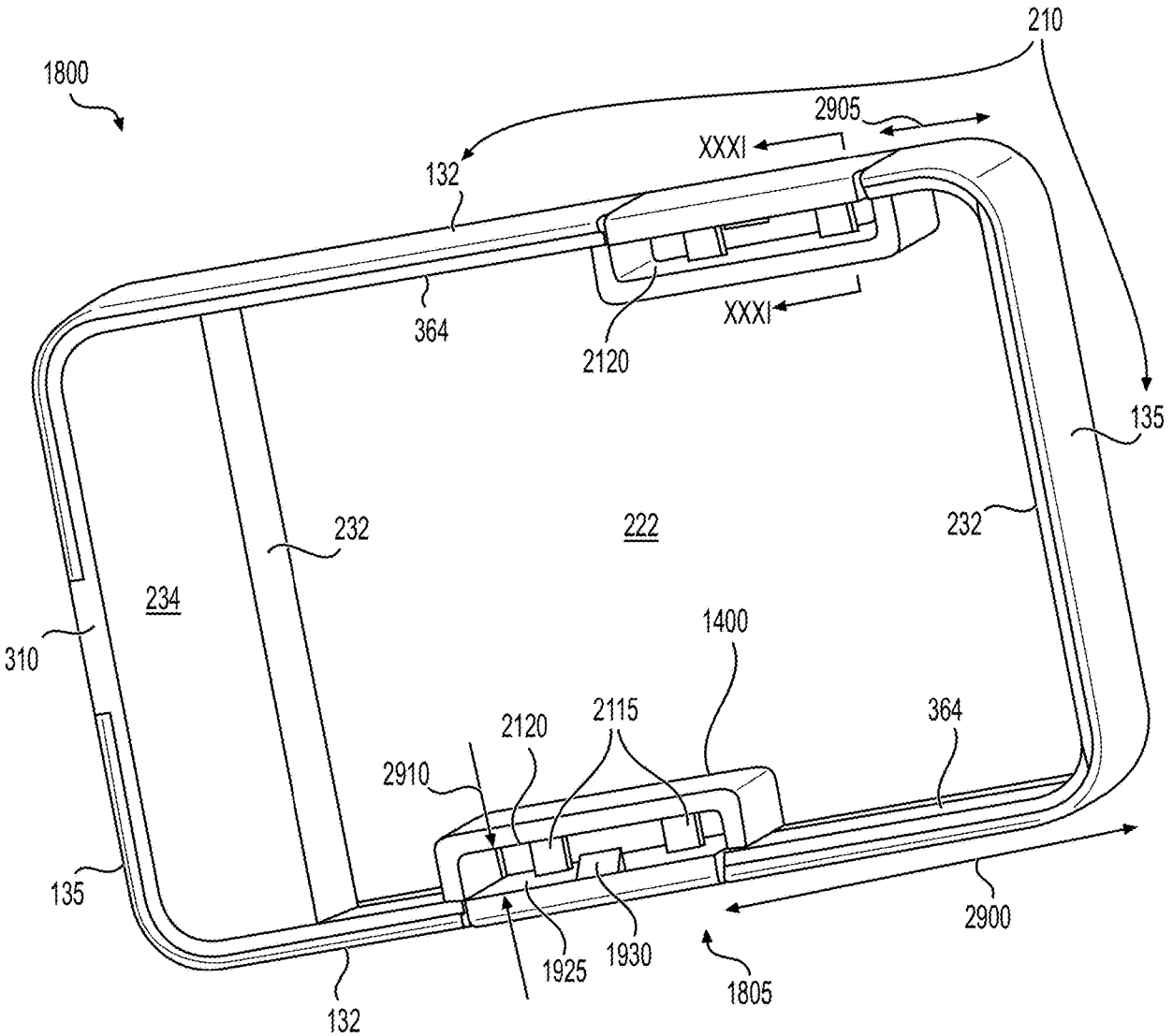
FIG. 29 is an illustration of an upper perspective view of the base of the package, in accordance with at least one example embodiment.

In at least one example embodiment, the package 1800 requires three separate motions in three separate directions to open. In at least one example embodiment, to open the package 1800 from the closed configuration (as shown in FIG. 18), a respective inward force is applied to the lower portion 2110 of the outer surface 1815 of each of the tabs 1810 simultaneously (e.g., a first inward force and a second inward force that are in opposite directions). The respective inward forces move the locking mechanisms 1805 from a locked, retrained or retained position or state to an unlocked, unrestrained or retained position or state. With both of the locking mechanisms 1805 in the unlocked position, a lifting force substantially perpendicular to the first and second inward forces may be applied to the primary lid 120 to move the primary lid 120 from the closed position to the open position. It will be understood that a person applies the forces to unlock and move the primary lid 120, where this application of forces involves a complex set of three different motions to apply three different forces in three separate directions to open the package 1800. In at least one example embodiment, by having the locking mechanisms 1805 offset (e.g., the first distance 2900 and the second distance 2905 are not equal, as shown in FIG. 29), this may increase a complexity of the motions that are to be applied to open the package 1800. For instance, by having the locking mechanisms 1805 offset, this may require more than one hand to apply the inward force to the locking mechanisms 1805 to unlock the locking mechanisms 1805.

Figure 23:
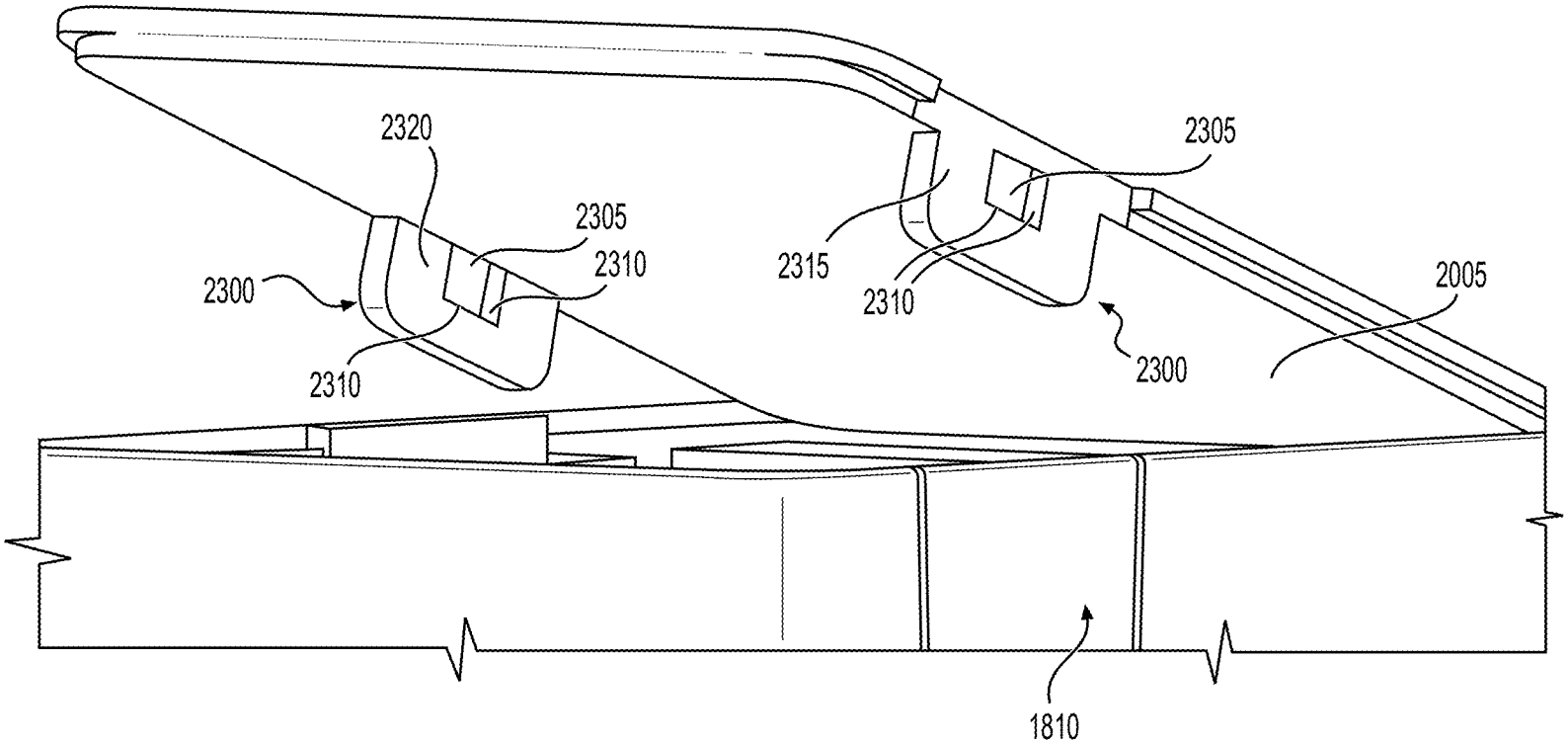
FIG. 23 is an illustration of a close-up view of locking mechanisms of the package, in accordance with at least one example embodiment.

FIG. 23 is an illustration of a close-up view of arms 2300 of the package 1800, in accordance with at least one example embodiment.

In at least one example embodiment, the arm 2300 can be used for the locking mechanisms 1805, in lieu of the arms 1900 (FIG. 19). In at least one example embodiment, the arms 2300 define an opening 2305 that traverses through an exterior surface 2315 and an interior surface 2320 of the arms 2300. In at least one example embodiment, the arms 2300 include a first engaging structure 2310 that retains the second engaging structure 1930. In at least one example embodiment, the first engaging structure 2310 is exposed portions of the arm 2300 that are exposed, at least in part, by the opening 2305. In at least one example embodiment, the arms 2300 are U-shaped, where each end of the arm 2300 is connected to the primary lid 120.

Figure 24:
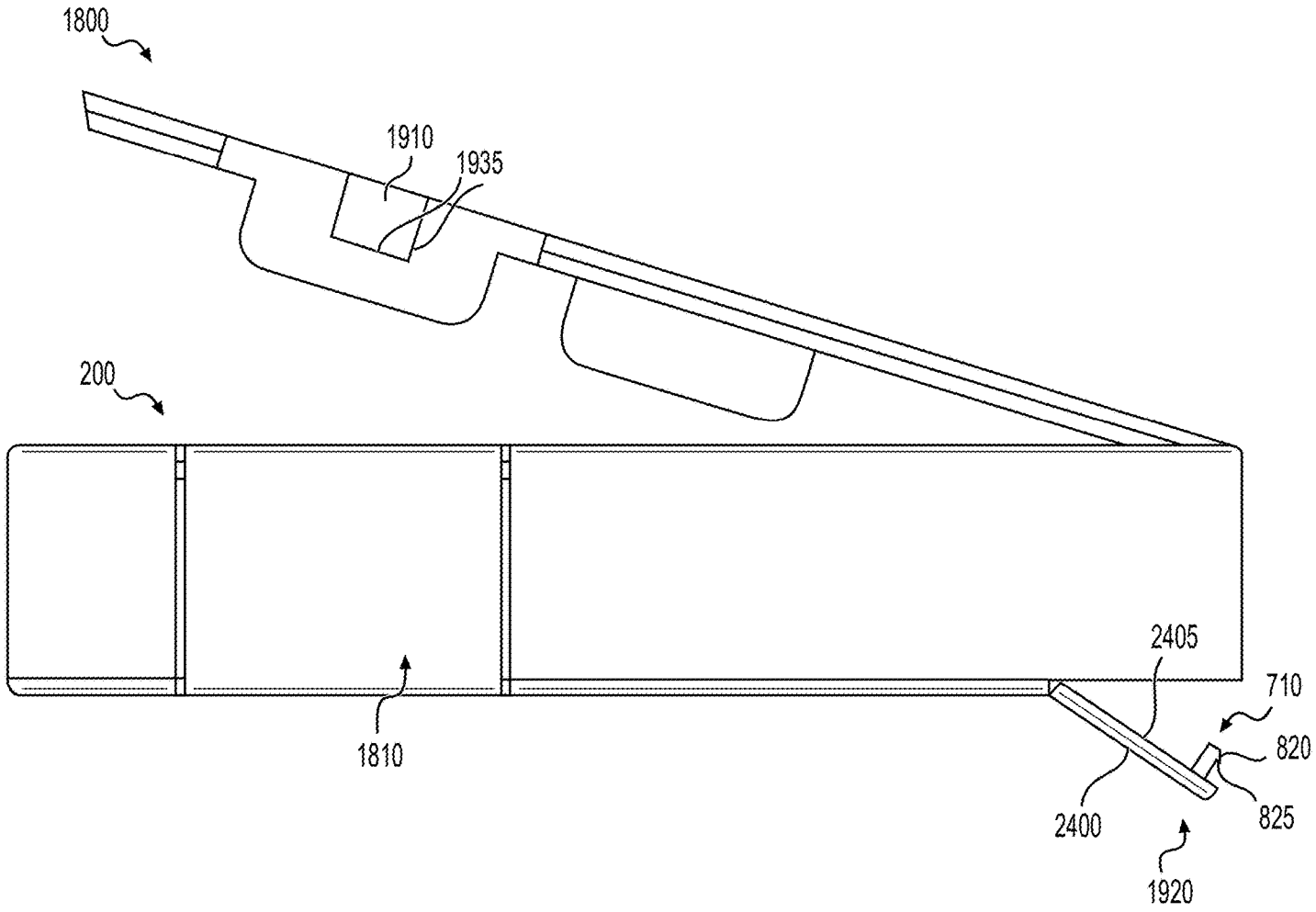
FIG. 24 is an illustration of a side view of the package, in accordance with at least one example embodiment.

FIG. 24 is an illustration of a side view of the package 1800, in accordance with at least one example embodiment.

In at least one example embodiment, the secondary lid 1920 includes an exterior surface 2400 and an interior surface 2405. In at least one example embodiment, the at least one catch 710 extends from the interior surface 2405 of the secondary lid 1920. In at least one example embodiment, the beak shape (the first surface 820 and the second surface 825) of the catch 710 faces away from the primary storage area 200 of the package 1800 when the secondary lid 1920 is the a closed position.

Figure 25:
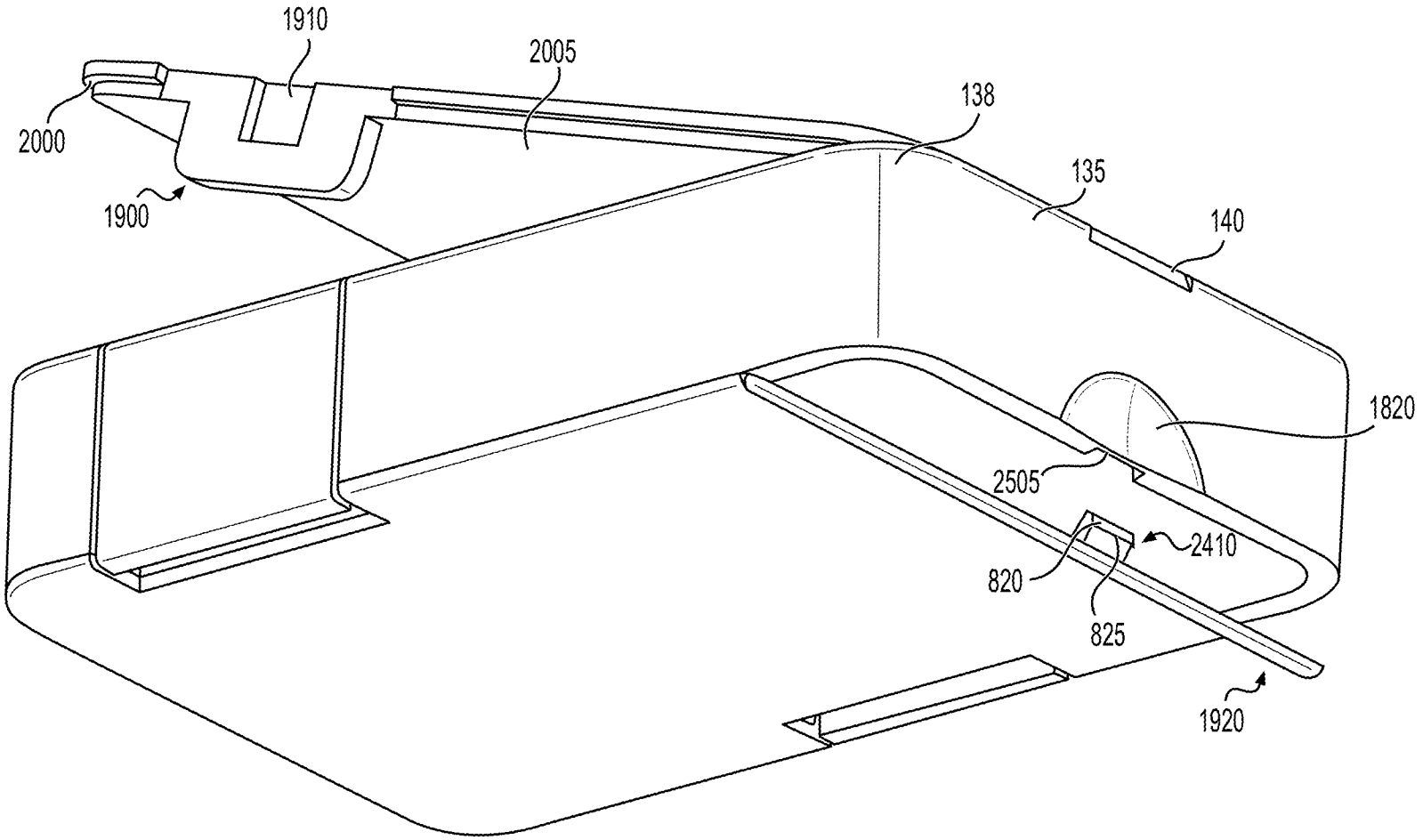
FIG. 25 is an illustration of a lower perspective view of the package, in accordance with at least one example embodiment.
Figure 26:
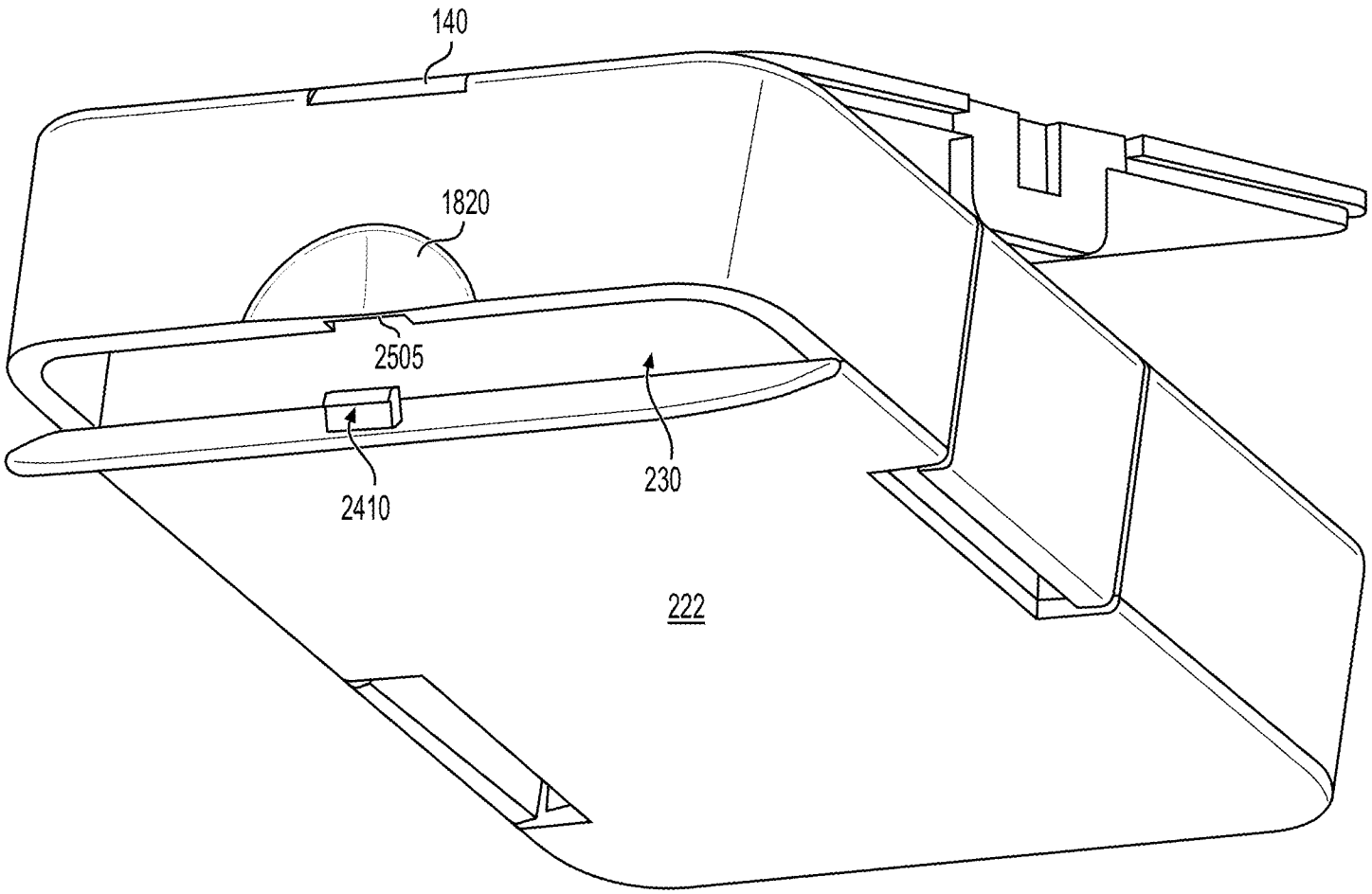
FIG. 26 is an illustration of another lower perspective view of the package, in accordance with at least one example embodiment.
Figure 27:
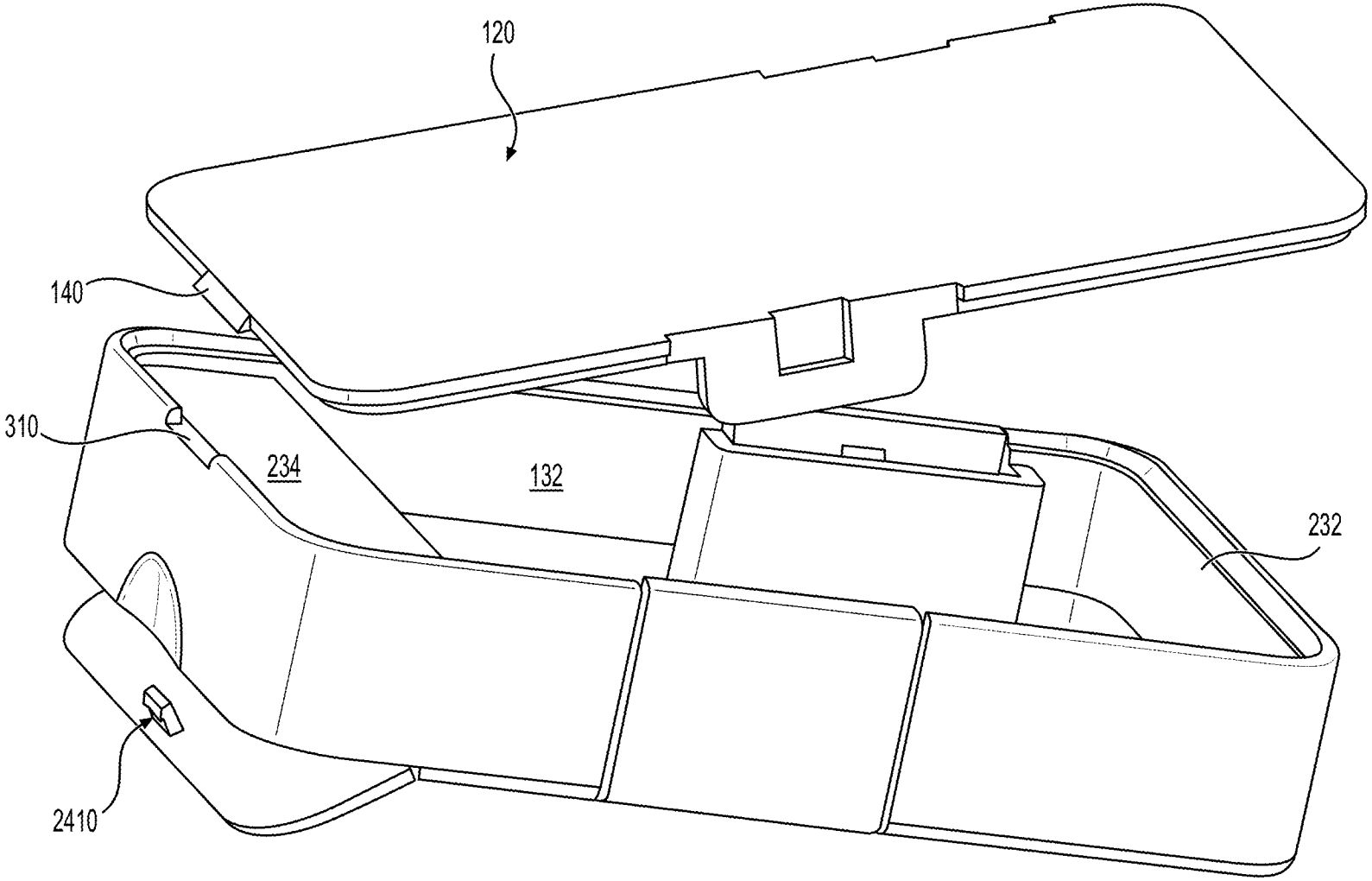
FIG. 27 is an illustration of a perspective view of the package with the lid detached, in accordance with at least one example embodiment.
Figure 28:
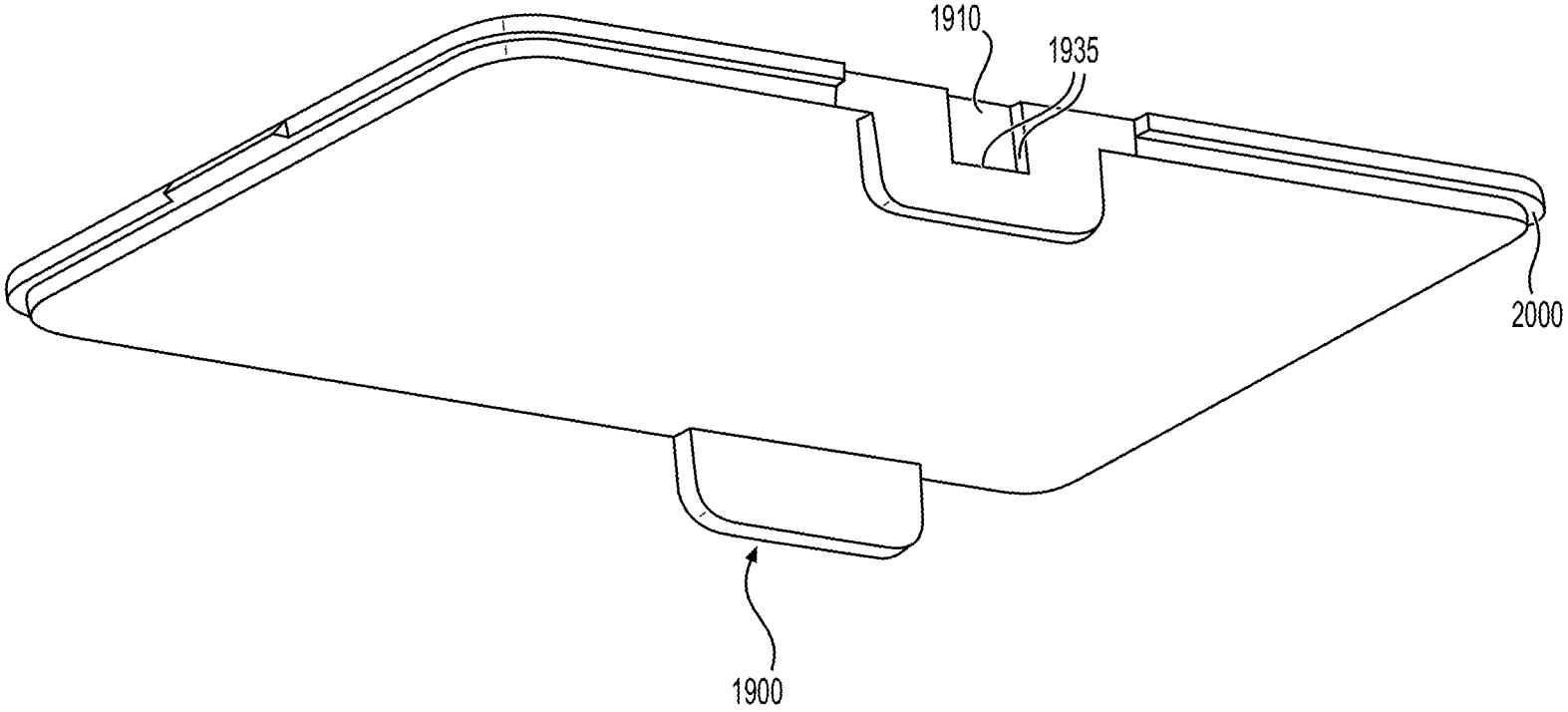
FIG. 28 is an illustration of the lid of the package, in accordance with at least one example embodiment.
Figure 30:
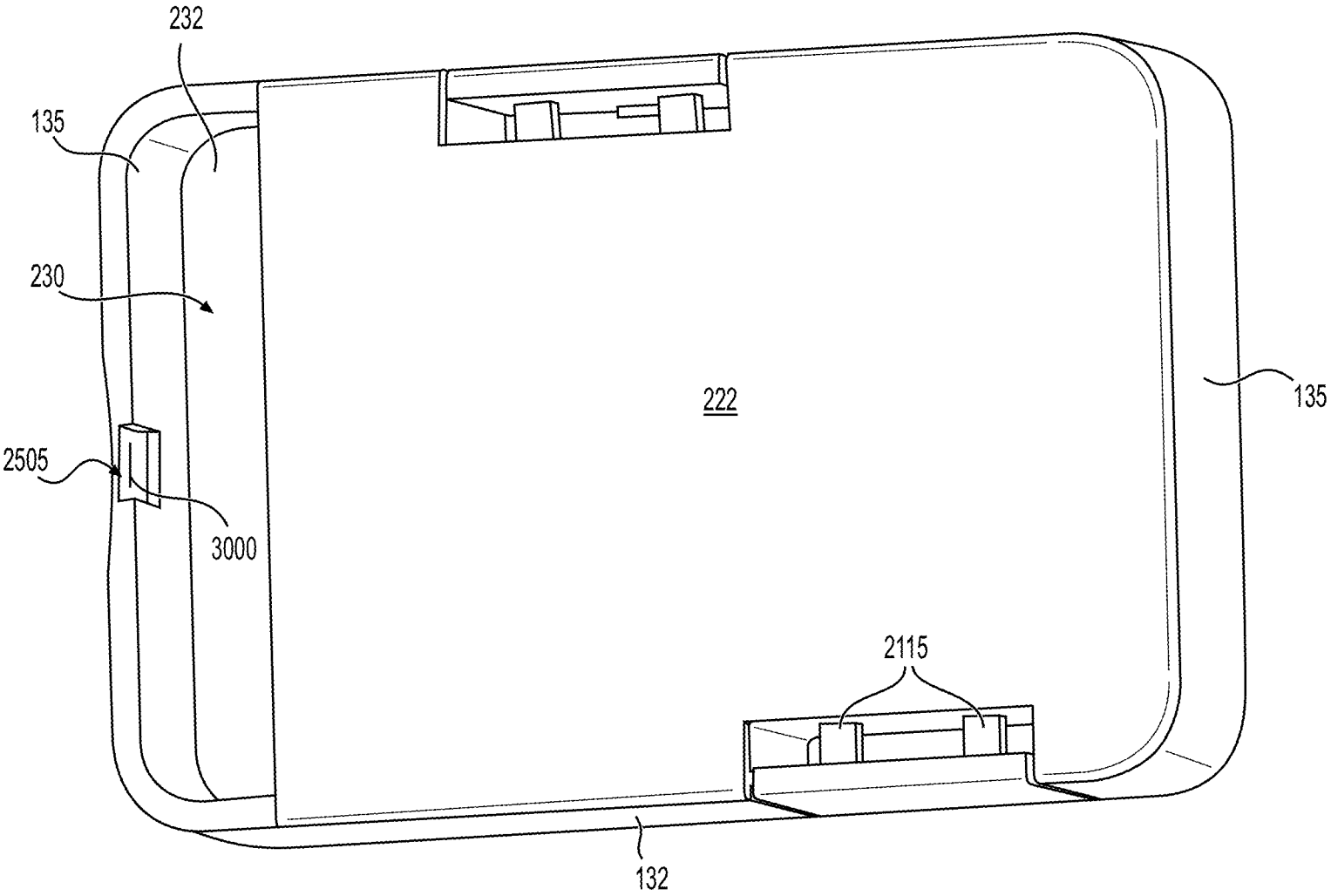
FIG. 30 is an illustration of a lower perspective view of the base of the package, in accordance with at least one example embodiment.

FIG. 25 is an illustration of a lower perspective view of the package 1800, in accordance with at least one example embodiment. FIG. 26 is an illustration of another lower perspective view of the package 1800, in accordance with at least one example embodiment. FIG. 27 is an illustration of a perspective view of the package 1800 with the lid detached, in accordance with at least one example embodiment. FIG. 28 is an illustration of the primary lid 120 of the package 1800, in accordance with at least one example embodiment. FIG. 29 is an illustration of an upper perspective view of the base 130 of the package 1800, in accordance with at least one example embodiment. FIG. 30 is an illustration of a lower perspective view of the base 130 of the package 1800, in accordance with at least one example embodiment.

In at least one example embodiment, the beak shape (the first surface 820 and the second surface 825) of the catch 710 faces, and fits into, a notch 2505 (FIG. 26), where the second surface 825 is retained by a slit 3000 defined by a surface of the notch 2505 (FIG. 30), when the secondary lid 1920 is in the closed position (closed configuration).

In at least one example embodiment, the locking mechanisms 1805 are offset, where the first distance 2900 and the second distance 2905 between the respective locking mechanisms 1805 and the end wall 135 of the package 1800 are not equal (FIG. 29). In another example embodiment, the locking mechanisms 1805 are directly opposed, such that the first distance 2900 and the second distance 2905 are equal.

In at least one example embodiment, a gap 2910 (FIG. 29) exists between the exterior surface 2120 of the guard 1400 and the interior surface 1925 of the tab 1810. The gap 2910 allows for a pivoting movement of the tab 1810, as described in at least FIGS. 31A-31B. In at least one example embodiment, the gap 2910 is about 1 mm to about 5 mm in length, or the gap is about 1 mm to about 2 mm. In at least one example embodiment, a length of the at least one attachment member 2115 is equal to the length of the gap 2910.

In at least one example embodiment, the package 1800 is rectangular from an overhead perspective (FIG. 29). In at least one example embodiment, the package 1800 is square, or another shape, from an overhead perspective.

Figure 31A:
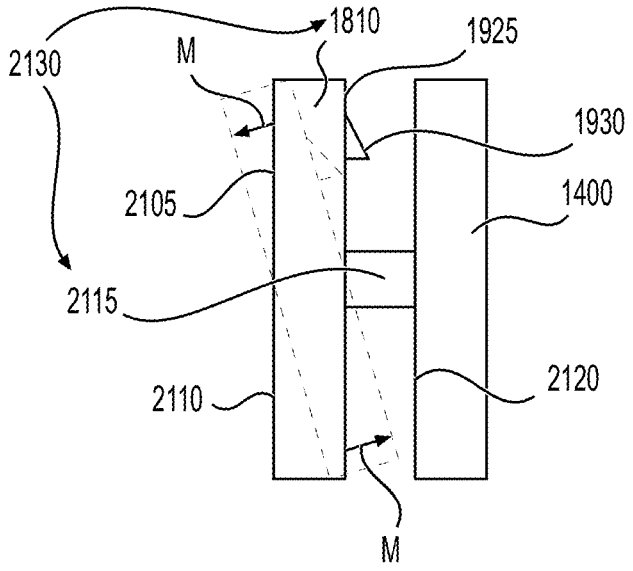
FIG. 31A is an illustration of a vertical cross-sectional view of the flexible structure, in accordance with at least one example embodiment.

FIG. 31A is an illustration of a vertical cross-sectional view (view XXXI-XXXI of FIG. 29) of the flexible structure 2130, in accordance with at least one example embodiment.

In at least one example embodiment, the at least one attachment member 2115 is connected to the guard 1400 and a mid-section of the tab 1810. In at least one example embodiment, the at least one attachment member 2115 includes two attachment members 2115 (FIG. 29), or more than two attachment members, where each of the attachment members is at a same vertical elevation of the package 1800. In at least one example embodiment, the at least one attachment member 2115, or the multiple attachment members, are attached to a vertical mid-section of the interior surface 1915 of the tab 1810 (as shown in FIGS. 29 and 31A). In at least one example embodiment, a vertical cross-section of the at least one attachment member 2115 is rectangular or square in shape, making the at least one attachment member 2115 take the three-dimensional shape of bar (cuboid), or a flat bar (see FIGS. 29 and 31A). In at least one example embodiment, a vertical cross-section of the at least one attachment member 2115 is circular in shape, making the at least one attachment member 2115 take the three-dimensional shape of a cylinder. Other shapes of the at least one attachment member 2115 are contemplated.

Figure 31B:
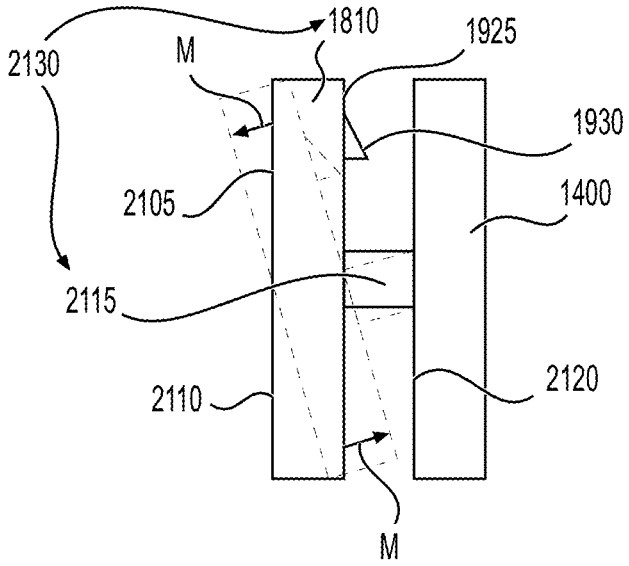
FIG. 31B is an illustration of a vertical cross-sectional view of the flexible structure, in accordance with at least one example embodiment.

In at least one example embodiment, the tab 1810 is resilient and/or made from a resilient material. In at least one example embodiment, when the inward force is applied to the lower portion 2110 of the tab 1810, the tab 1810 pivots or bends (movement M) relative to the attachment member 2115. This movement M of the tab 1810 causes the flexible structure 2130 to transition from a relaxed position to a flexed position, thereby causing the second engaging structure 1930 and the upper portion 2105 of the tab 1810 to move in an outward direction so that the second engaging structure 1930 releases the first engaging structure 1935 when the primary lid 120 is in the closed position (FIG. 18). FIG. 31B is an illustration of the vertical cross-sectional view (view XXXI-XXXI of FIG. 29) of the flexible structure 2130, in accordance with at least one example embodiment. In at least one example embodiment, the flexible structure 2130 returns to the relaxed position absent the inward force.

In at least one example embodiment, the at least one attachment member 2115 is resilient and/or made from a resilient material. In at least one example embodiment, when the inward force is applied to the lower portion 2110 of the tab 1810, the at least one attachment member 2115 pivots or bends (movement M) relative to the guard 1400, or relative to a portion of the base 130 that is connected to the at least one attachment member 2115, which in turn causes the tab 1810 to pivot with the at least one attachment member 2115. This movement M of the tab 1810 and the at least one attachment member 2115 causes the flexible structure 2130 to transition from the relaxed position to the flexed position, thereby causing the second engaging structure 1930 and the upper portion 2105 of the tab 1810 to move in an outward direction so that the second engaging structure 1930 releases the first engaging structure 1935 when the primary lid 120 is in the closed position (FIG. 18).

In at least one example embodiment, both the tab 1810 and the at least one attachment member 2115 are resilient and/or made from a resilient material. In this example embodiment, the inward force applied to the lower portion 2110 of the tab 1810 causes the tab 1810 to pivot or bend relative to the at least one attachment member 2115, and the inward force also causes the at least one attachment member 2115 to pivot or bend relative to the guard 1400, or relative to a portion of the base 130 that is connected to the at least one attachment member 2115. This pivot (movement M) of the tab 1810 and the at least one attachment member 2115 causes the flexible structure 2130 to transition from the relaxed position to the flexed position. In at least one example embodiment, the flexible structure 2130 returns to the relaxed position absent the inward force.

Figure 31C:
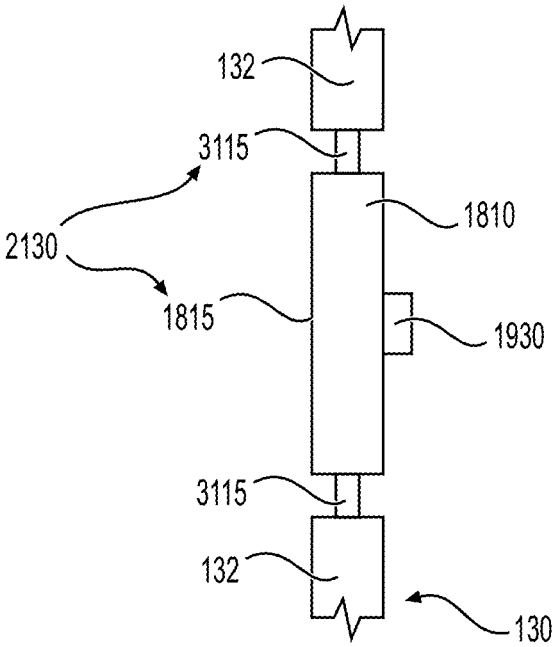
FIG. 31C is an illustration of an overhead view of another flexible structure, in accordance with at least one example embodiment.
Figure 31D:
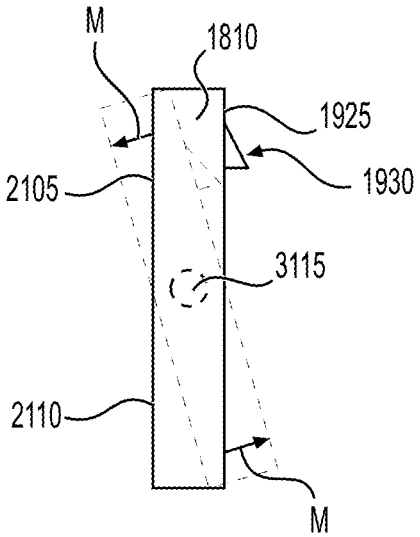
FIG. 31D is an illustration of a vertical cross-sectional view of the flexible structure, in accordance with at least one example embodiment.

FIG. 31C is an illustration of an overhead view of another flexible structure 2130, in accordance with at least one example embodiment. FIG. 31D is an illustration of a vertical cross-sectional view of the flexible structure 2130, in accordance with at least one example embodiment.

In at least one example embodiment, a pair of attachment members 3115 connect the tab 1810 to the base 130. In at least one example embodiment, the pair of attachment members 3115 are connected to side ends of the tab 1810. In at least one example embodiment, the pair of attachment members 3115 is connected to a vertical mid-section of the side ends of the tab 1810 (see FIG. 31D). In at least one example embodiment, each of the pair of attachment members 3115 are connected to the peripheral wall (e.g., the sidewall 132 or end wall 135) and the side edges of the tab 1810.

In at least one example embodiment, the pair of attachment members 3115 are resilient and/or made from a resilient material. In this example embodiment, the inward force applied to the lower portion 2110 of the tab 1810 causes the tab 1810 to pivot relative to the pair of attachment members 3115, while the pair of attachment members 3115 rotates.

This movement M of the tab 1810 and the pair of attachment members 3115 causes the flexible structure 2130 to transition from the relaxed position to the flexed position. In at least one example embodiment, the flexible structure 2130 returns to the relaxed position absent the inward force.

In at least one example embodiment, a length of each one of the pair of attachment members 3115 is about 0.5 mm to 2 mm, or the length is about 0.5 mm to 1 mm, where this length equals a separation (gap) between the side edges of the tab 1810 and a side edge of the sidewalls 132.

In at least one example embodiment, a vertical cross-section of each attachment member 3115 is circular in shape (FIG. 31D), making the attachment member 3115 take the three-dimensional shape of a cylinder. In at least one example embodiment, a vertical cross-section of each attachment member 3115 is square or rectangular in shape, making each attachment member 3115 take the three-dimensional shape of a bar (cuboid) or a flat bar. Other shapes of the at least one attachment member 3115 are contemplated.

Figure 32:
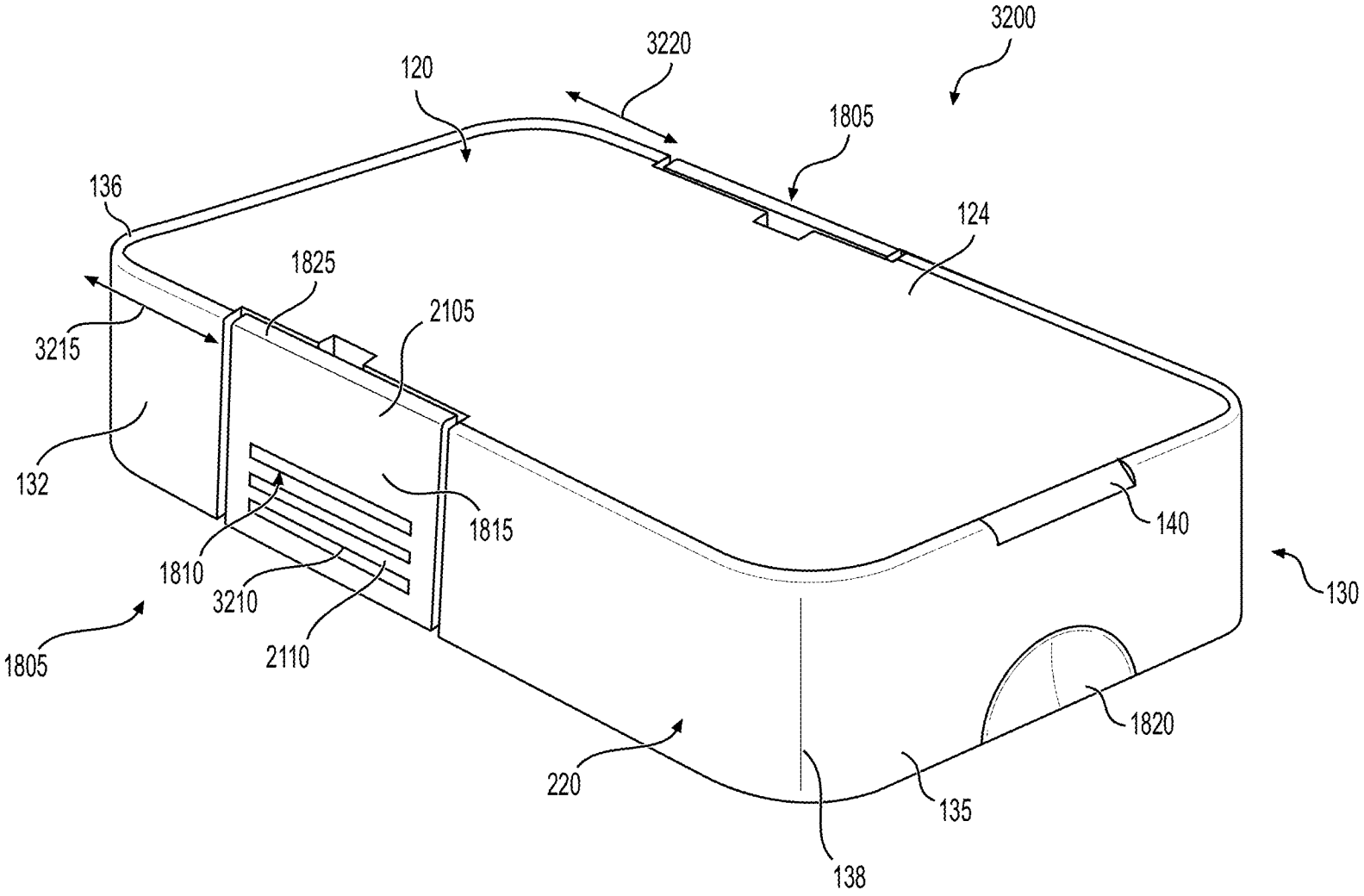
FIG. 32 is an illustration of a perspective view of another package, in accordance with at least one example embodiment.
Figure 33:
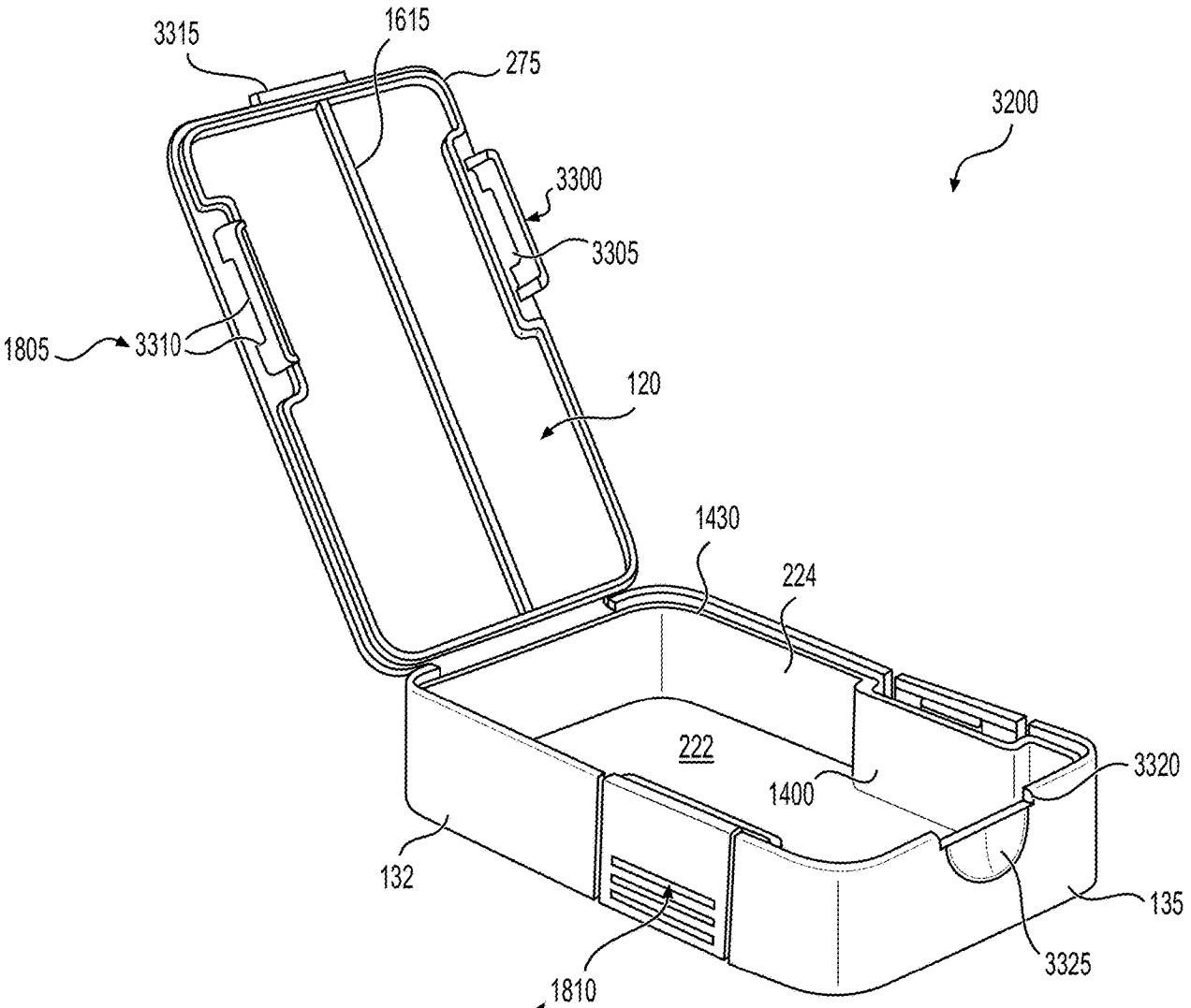
FIG. 33 is an illustration of the package of FIG. 32 in an opened configuration, in accordance with at least one example embodiment.
Figure 34A:
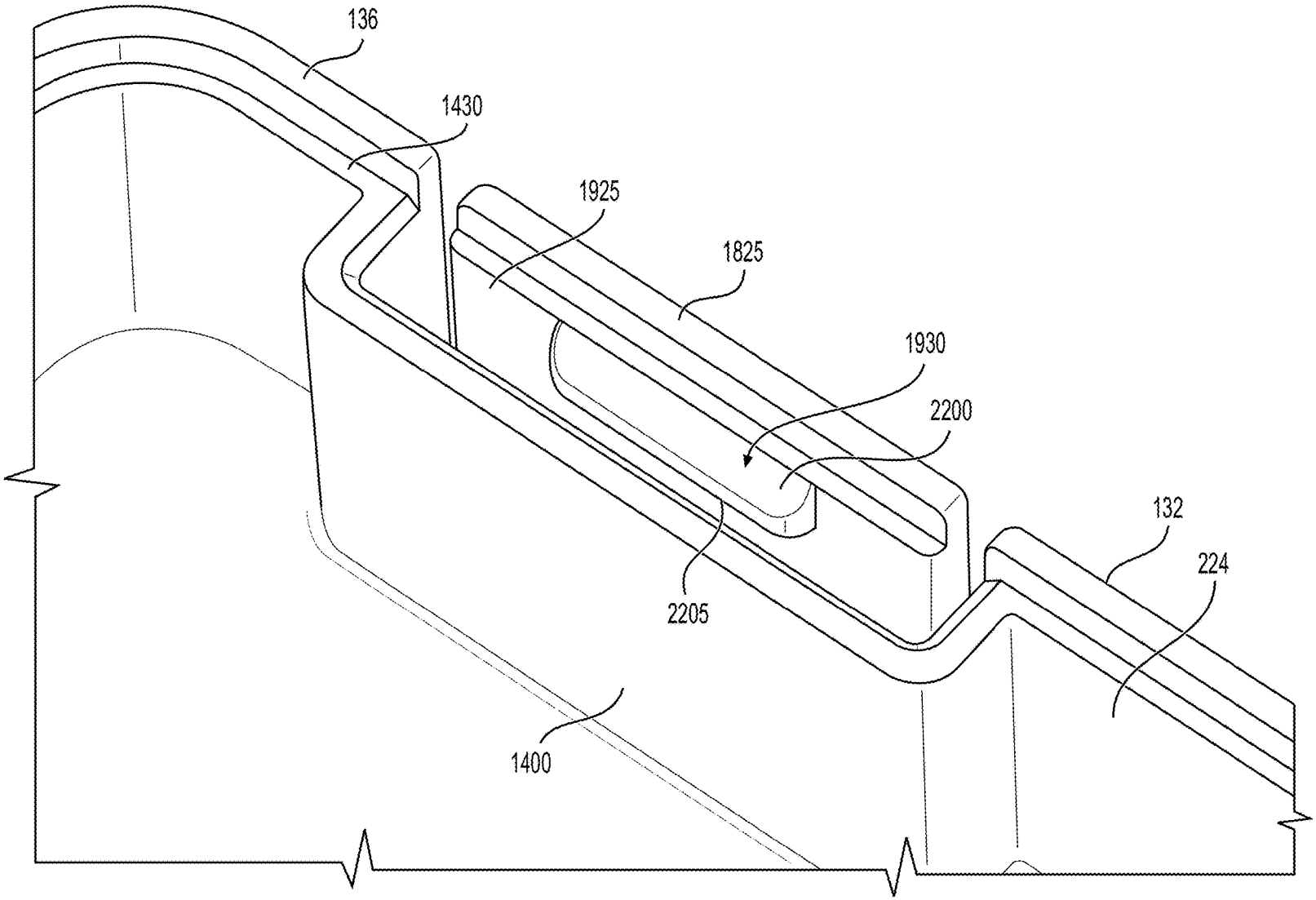
FIG. 34A is an illustration of a close-up view of a portion of a locking mechanism, in accordance with at least one example embodiment.
Figure 34B:
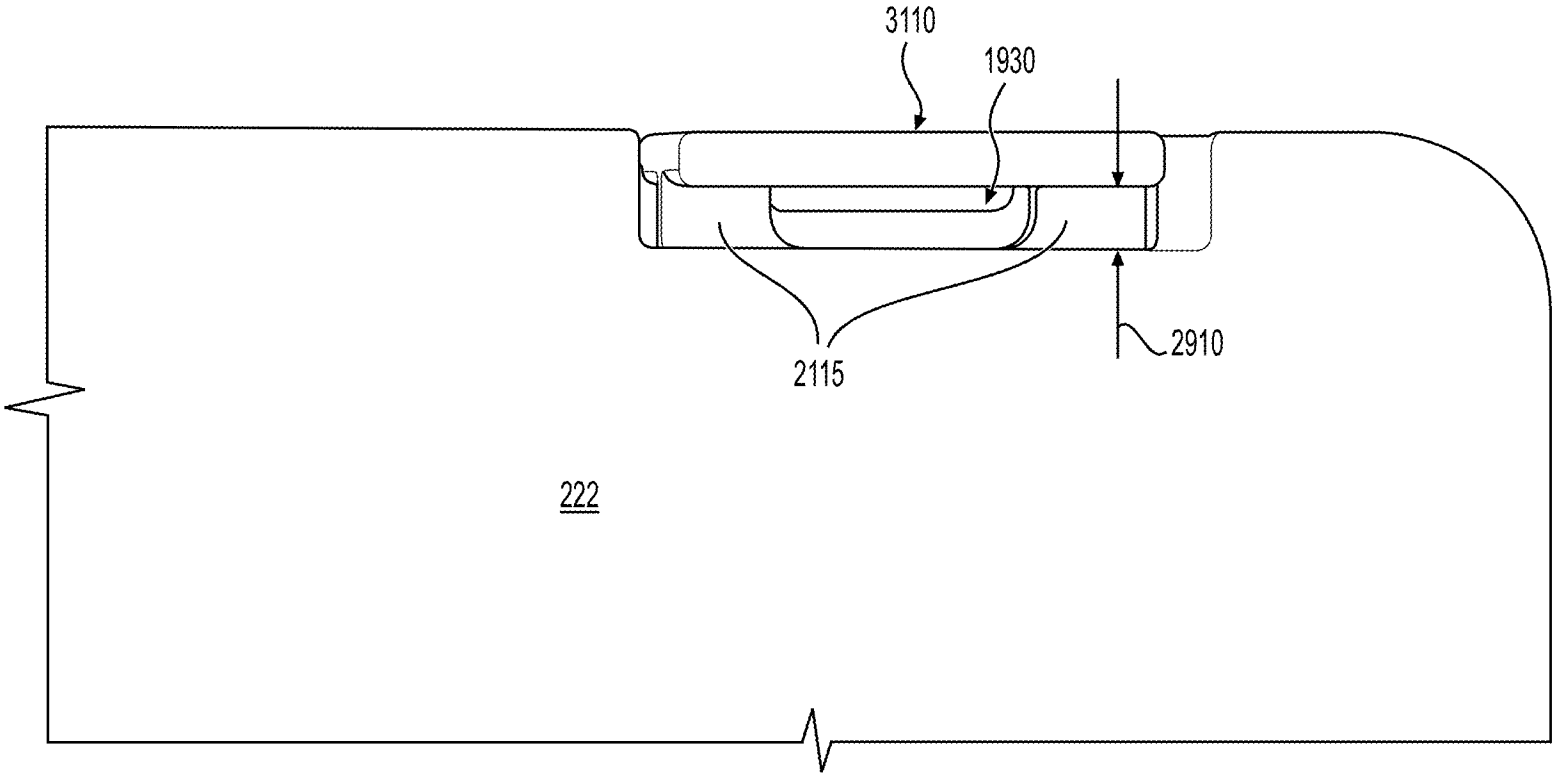
FIG. 34B is an illustration of another close-up of a locking mechanism, in accordance with at least one example embodiment.

FIG. 32 is an illustration of a perspective view of another package 3200, in a closed configuration, in accordance with at least one example embodiment. FIG. 33 is an illustration of the package of the package 3200 in an opened configuration, in accordance with at least one example embodiment. FIG. 34A is an illustration of a close-up view of a portion of the locking mechanism 1805, in accordance with at least one example embodiment. FIG. 34B is an illustration of another close-up of the locking mechanism 1805, in accordance with at least one example embodiment.

In at least one example embodiment, the tab 1810 includes surface bumps 3210 on the outer surface 1815 of the tab 1810. In at least one example embodiment, the surface bumps 3210 are on the lower portion 2110 of the outer surface 1815 of the tab 1810.

In at least one example embodiment, a first distance 3215 and a second distance 3220 between the locking mechanisms 1805 of the end wall 135 of the package 3200 are equal.

In at least one example embodiment, the package 3200 includes an arm 3300 (FIG. 33). In at least one example embodiment, the arm 3300 defines an opening 3305. In at least one example embodiment, the opening 3305 is rectangular or square in shape. In at least one example embodiment, other shapes of the opening 3305 are contemplated, including a circular shape, a triangular shape, etc. In at least one example embodiment, the arm 3300 includes a first engaging structure 3310 which includes exposed areas of the arm 3300 that are exposed, at least in part, due to the opening 3305. In at least one example embodiment, the arm 3300 has a side profile in the shape of a long narrow rectangle (as shown in FIG. 33). In at least one example embodiment, the arm 3300 has a side profile in another shape, such as square, triangular, etc.

In at least one example embodiment, the second engaging structure 1930 has a long narrow shape (as shown in FIG. 34A), which matches a shape of the opening 3305 of the arm 3300 (FIG. 33). In at least one example embodiment, the second engaging structure 1930 has a triangular-shaped side profile (FIGS. 22 and 34A), thereby giving the second engaging structure 1930 a three dimensional shape of a triangular prism. In another example embodiment, the second engaging structure 1930 has a square-shaped side profile, or a rectangular-shaped profile. Other shapes of the second engaging structure are contemplated.

In at least one example embodiment, the primary lid 120 includes a projection 3315. In at least one example embodiment, the projection 3315 is a relatively long and flat tab-shaped projection. In at least one example embodiment, the projection 3315 fits into and mates with a cutout 3320 defined by an upper portion of the peripheral wall (e.g., the end wall 135 or the sidewall 132). In an example embodiment, an indentation 3325 is below the cutout 3320.

In at least one example embodiment, the package may include features of other example embodiments described herein and/or other example embodiments may include features of the package as described above.

Third Example Embodiment

Referring now to FIGS. 35A-47, elements shown in FIGS. 35A-47 having similar reference labels as elements shown in FIGS. 1-34 will be understood to be the same as the elements described with reference to any of FIGS. 1-34 and thus a description of such elements is not repeated with regard to FIGS. 35A-47.

Figure 35A:
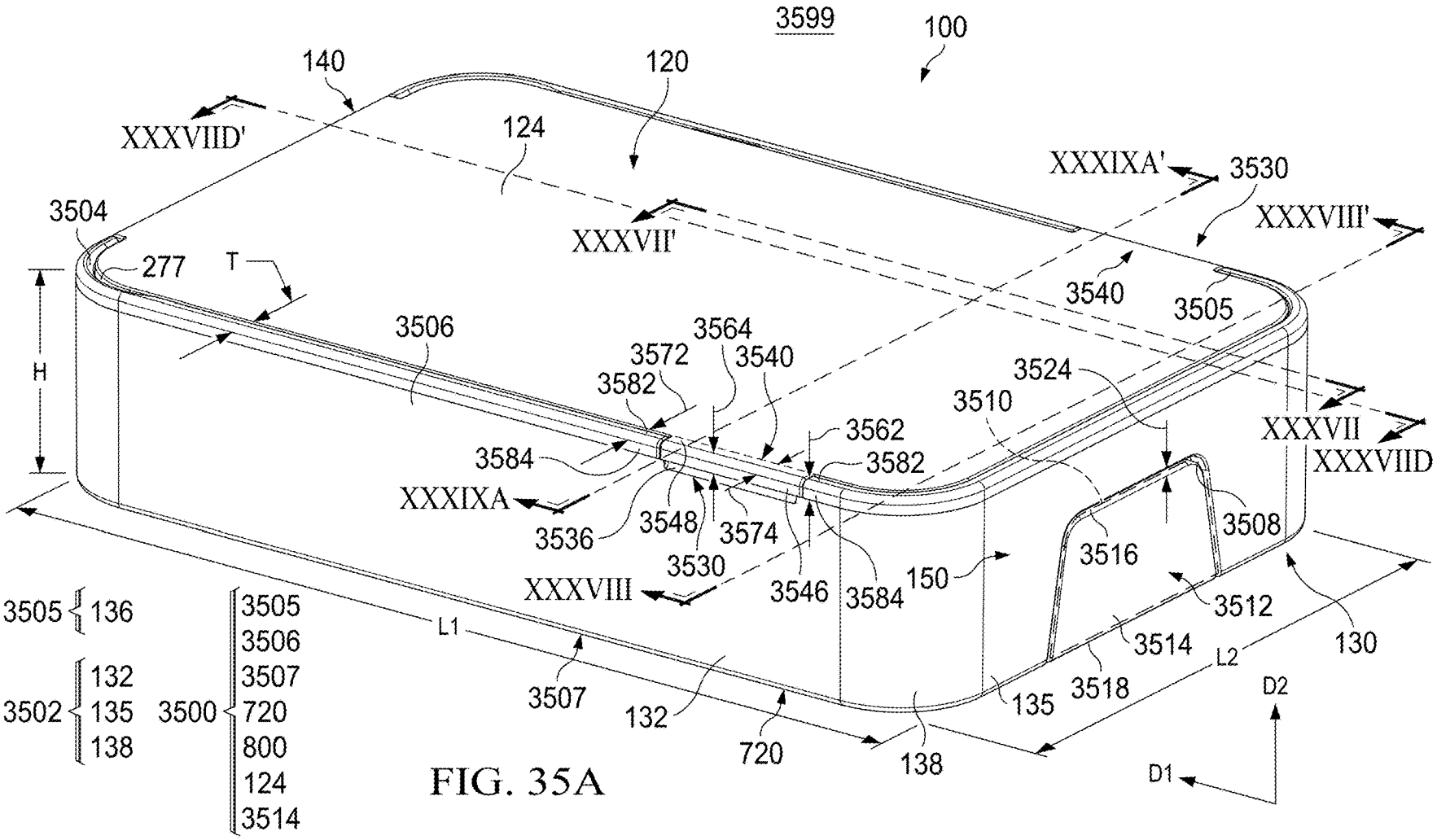
FIGS. 35A and 35B are illustrations of perspective views of another package in a closed configuration, in accordance with at least one example embodiment.
Figure 35B:
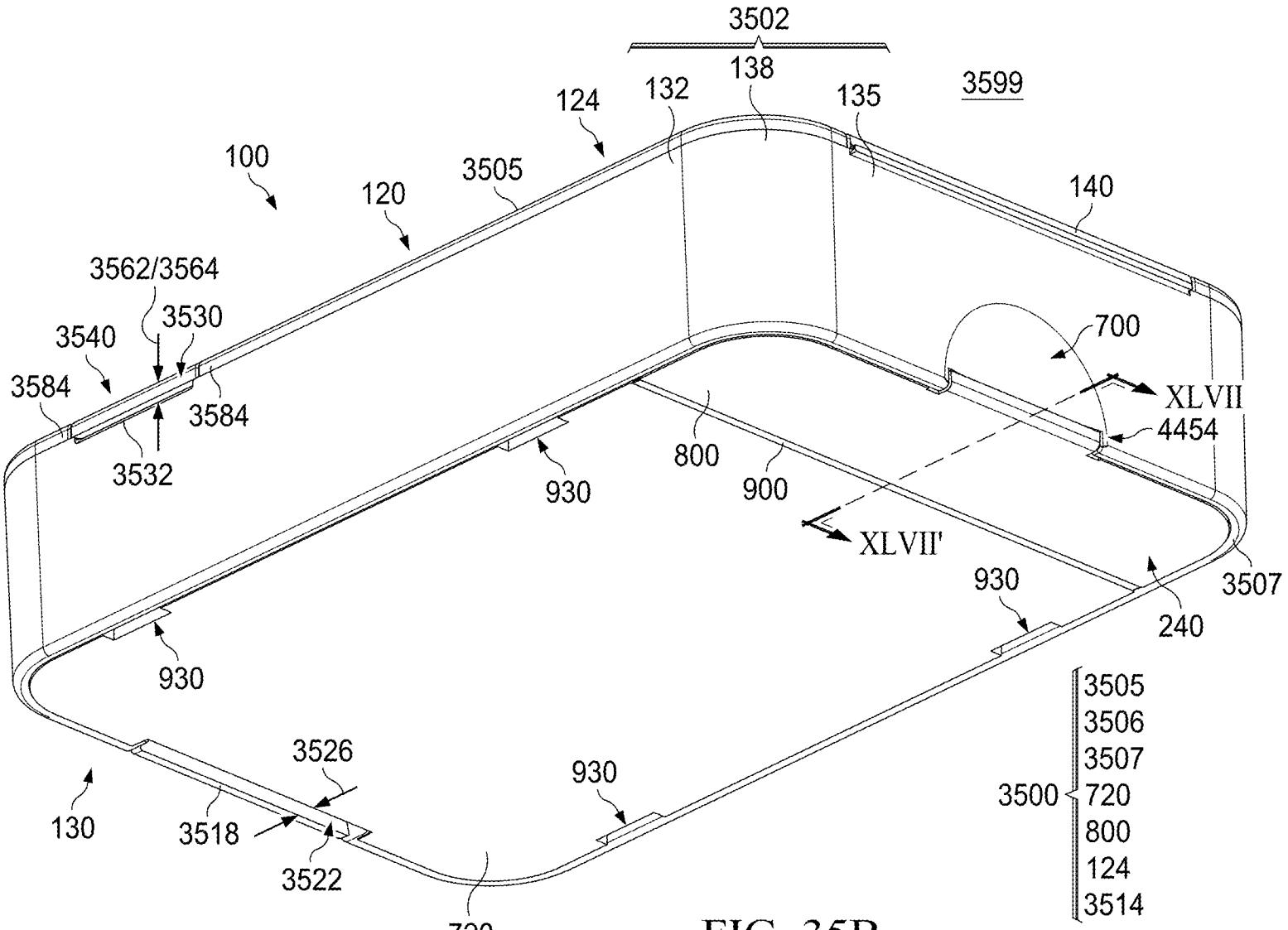
Figure 36A:
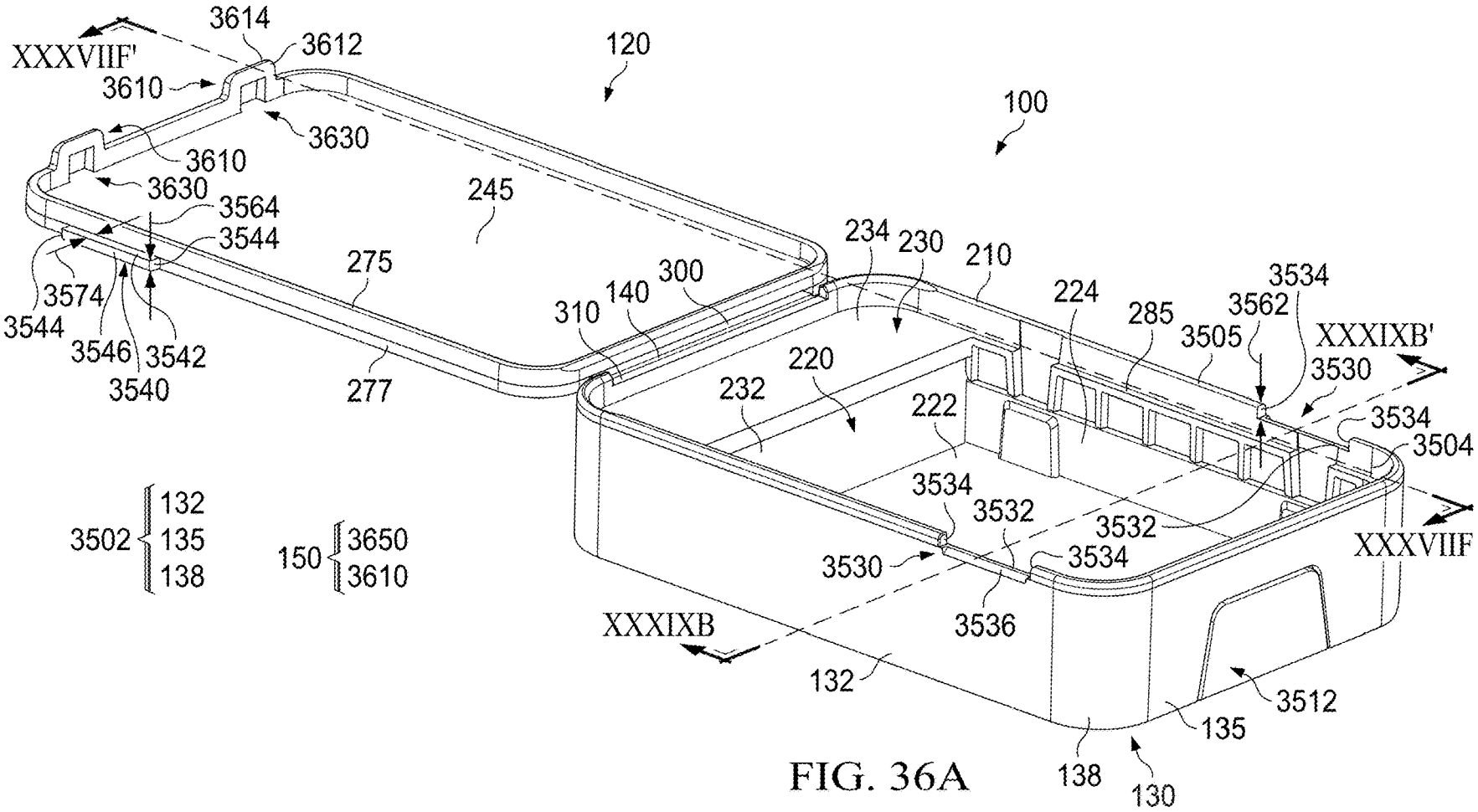
FIGS. 36A and 36B are illustrations of perspective views of the package in an open configuration, in accordance with at least one example embodiment.
Figure 36B:
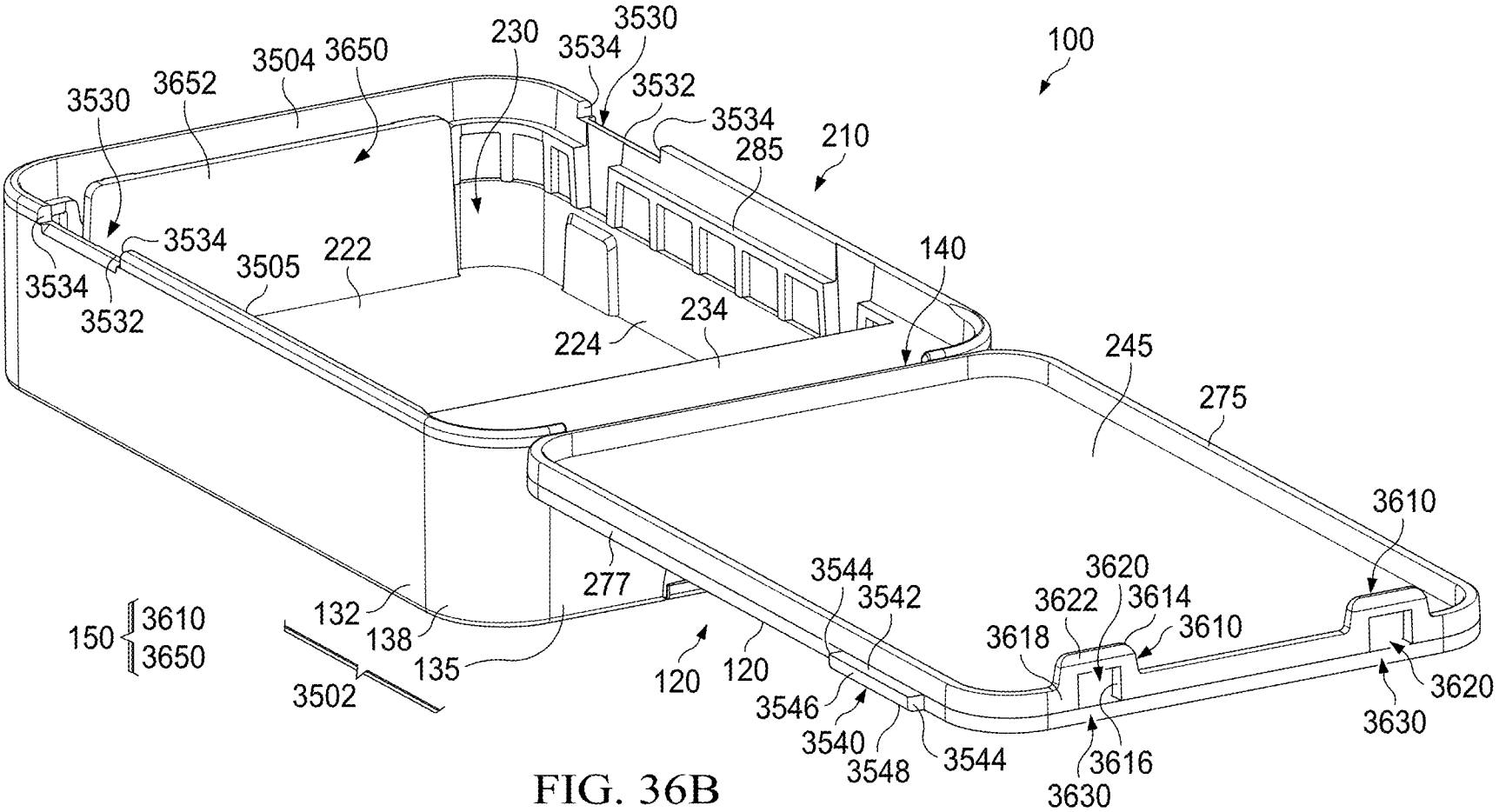
Figure 37A:
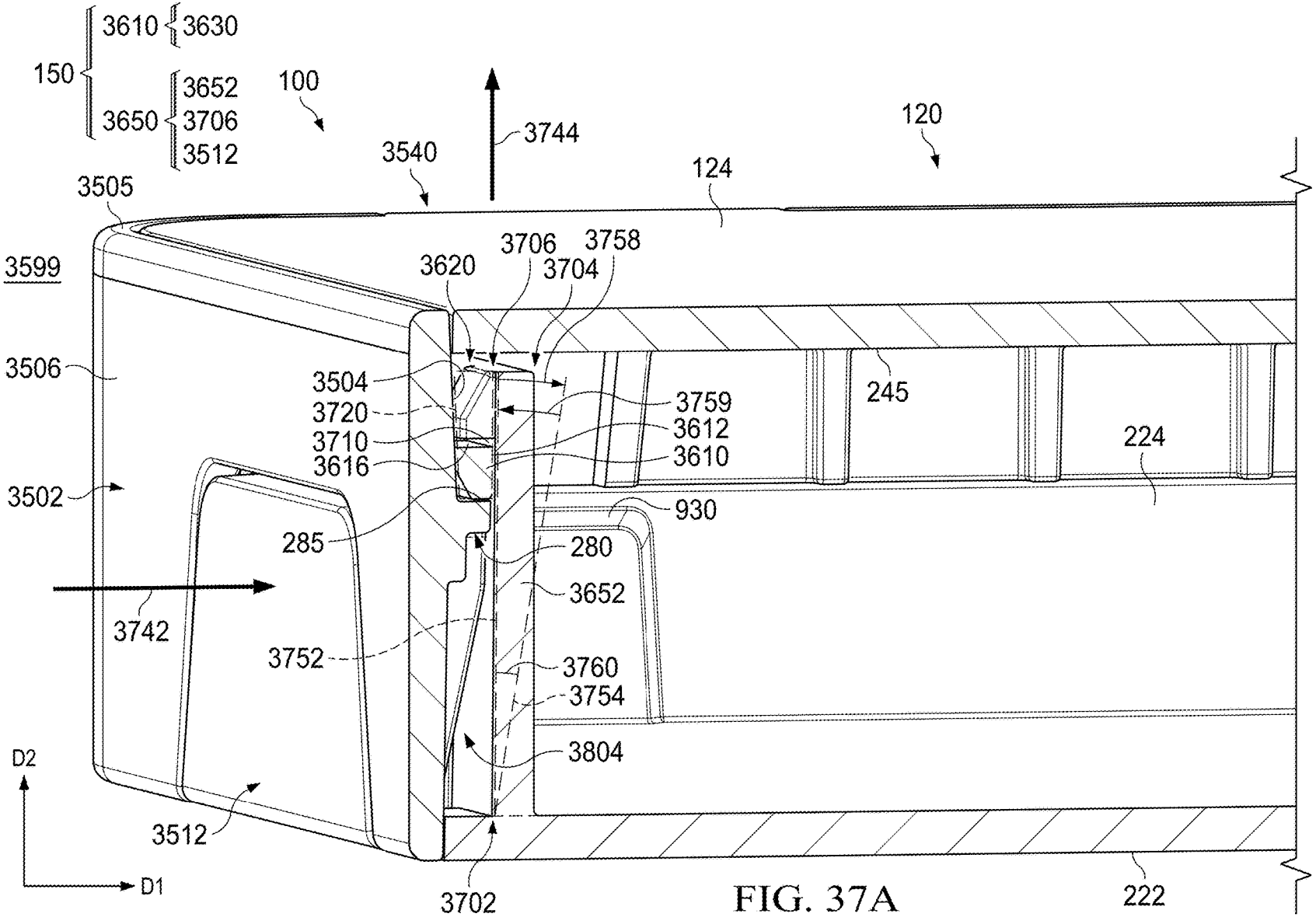
FIGS. 37A, 37B, and 37C are illustrations of close-up perspective cross-sectional views of a portion of the package along cross-sectional view line XXXVII-XXXVII' of FIG. 35A, in accordance with at least one example embodiment.
Figure 37B:
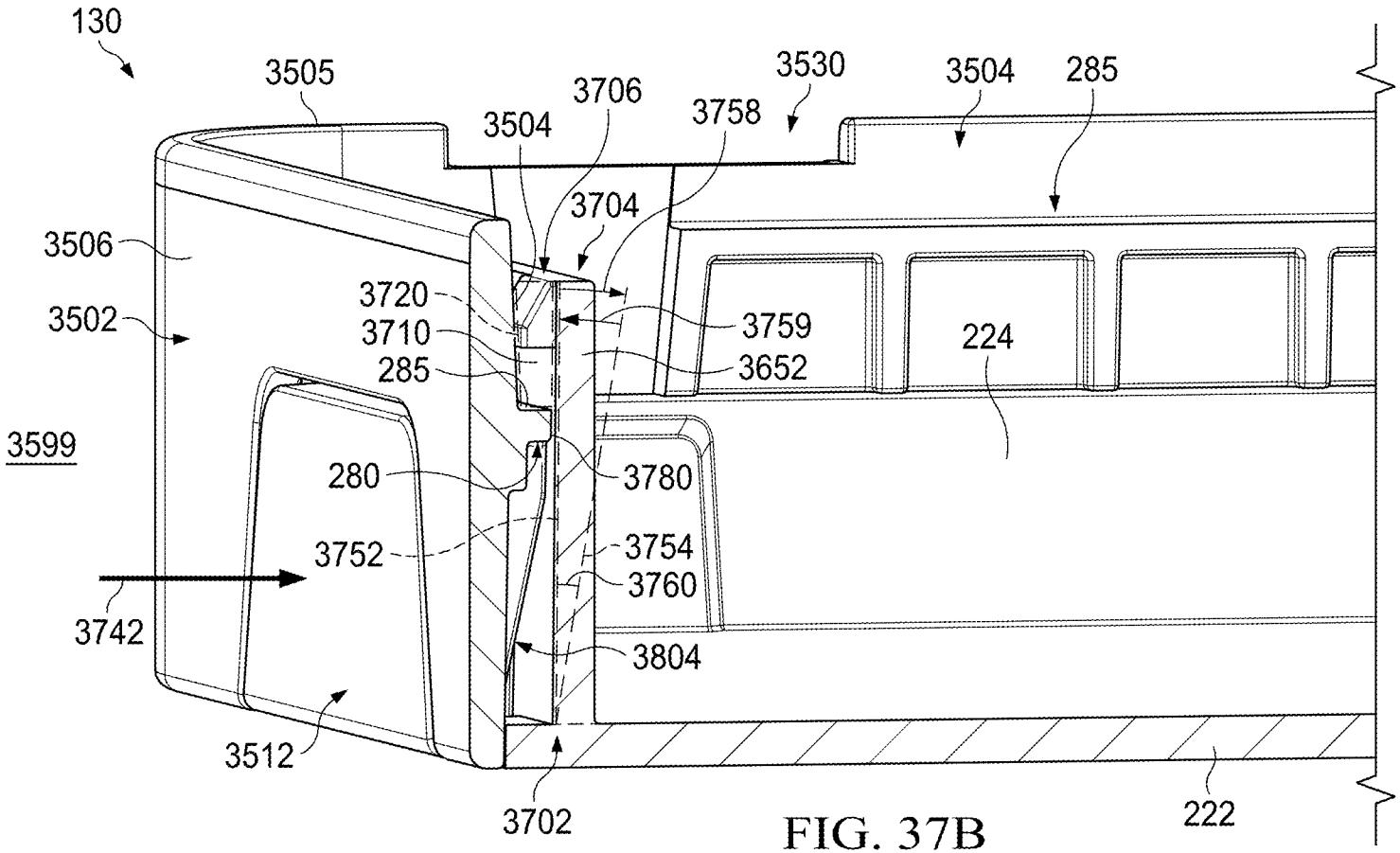
Figure 37C:
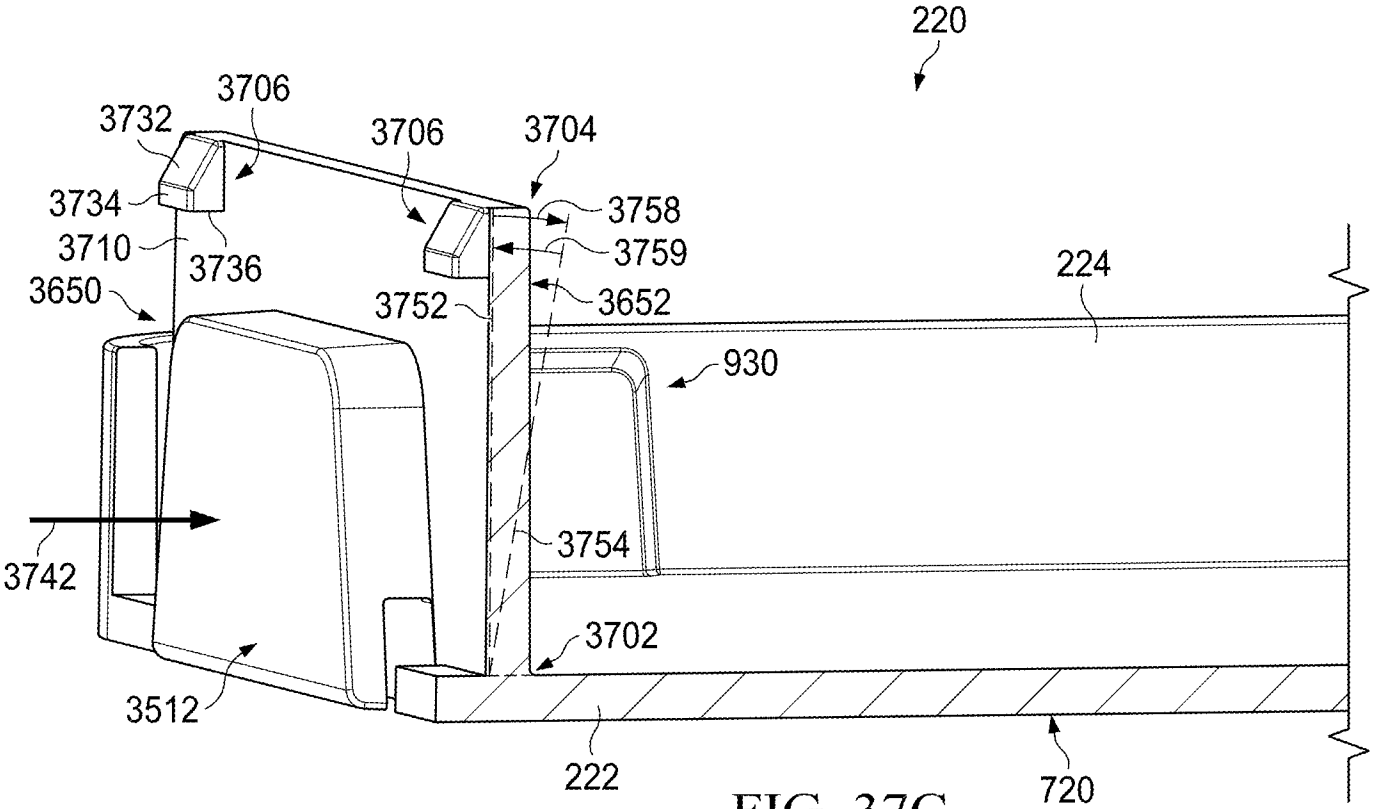
Figure 37D:
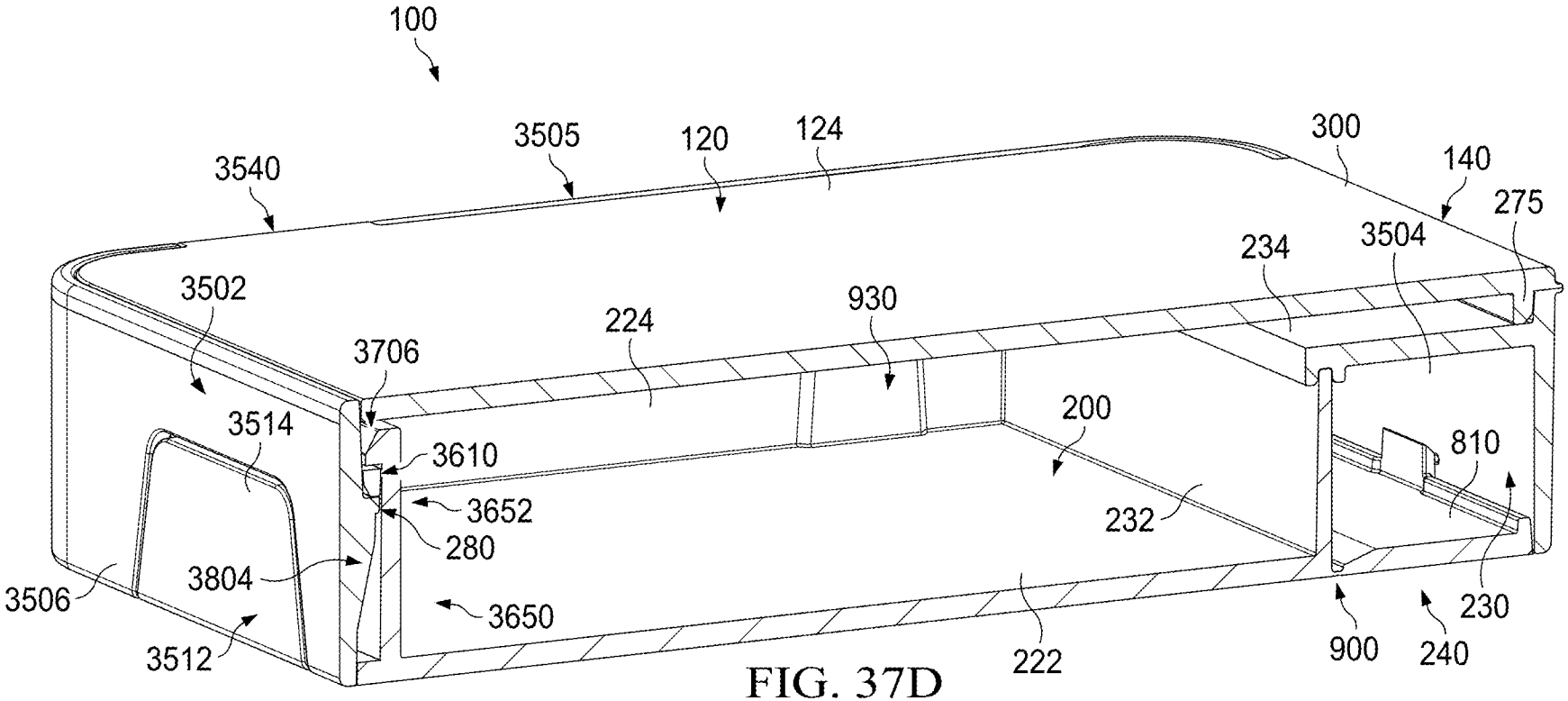
FIGS. 37D and 37E are illustrations of perspective cross-sectional views of the package along cross-sectional view line XXXVIID-XXXVIID' of FIG. 35A, in accordance with at least one example embodiment.
Figure 37E:
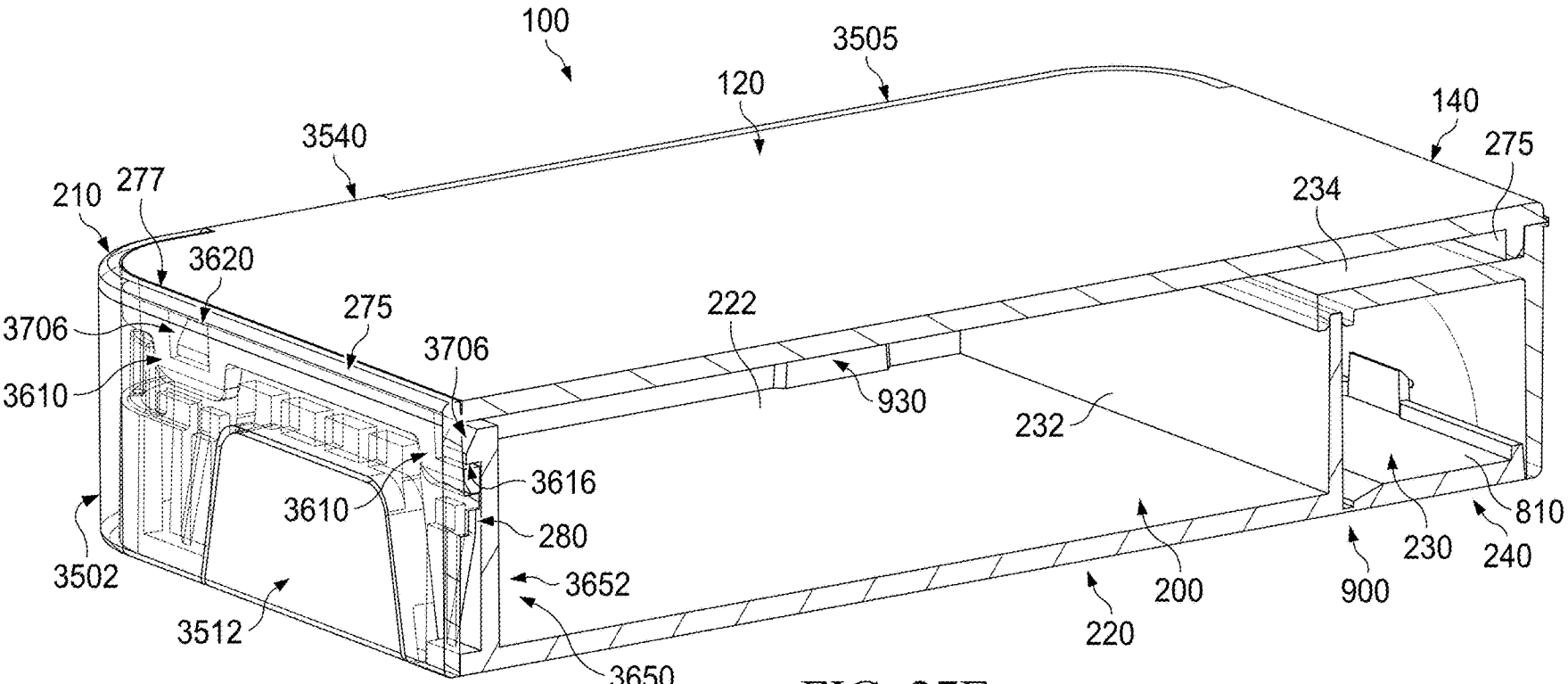
Figure 37F:
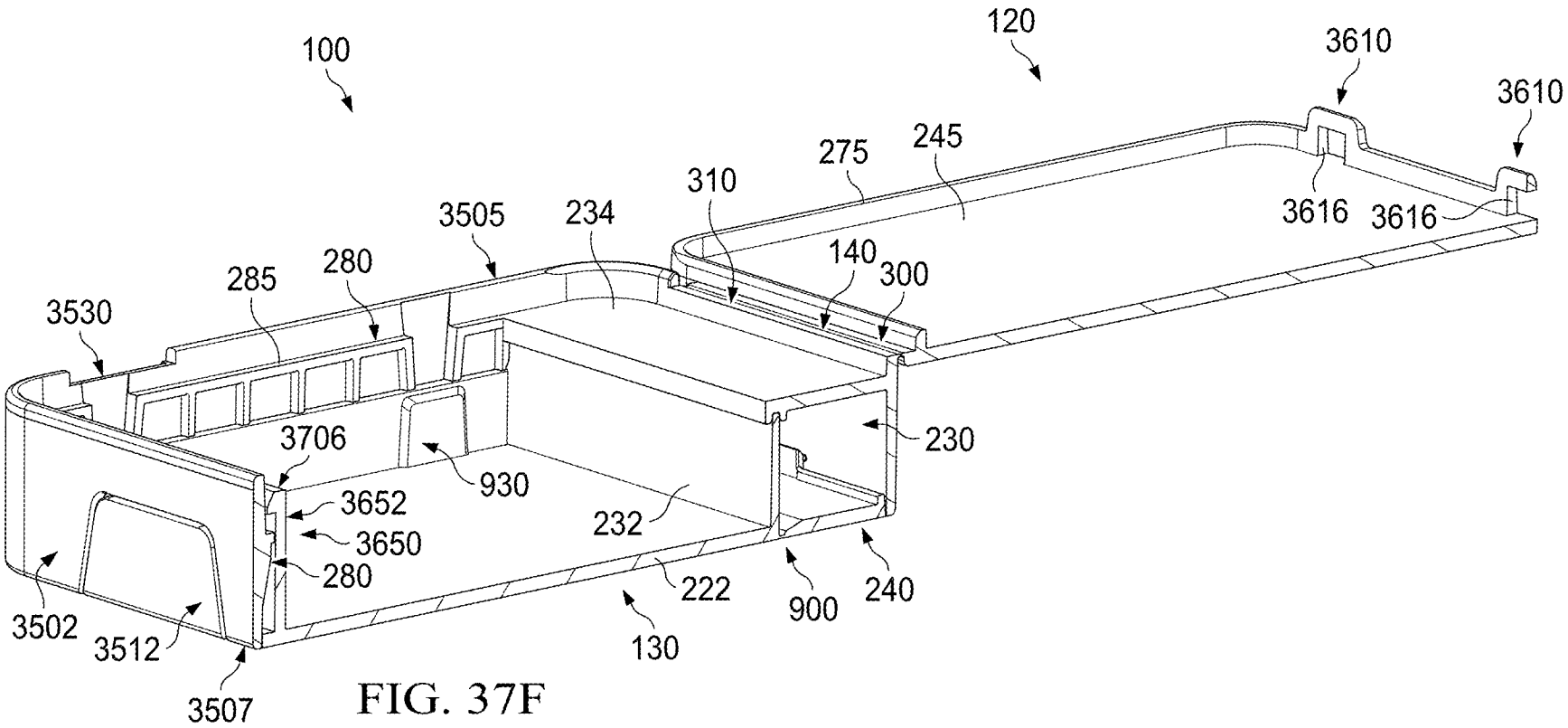
FIG. 37F is an illustration of a perspective cross-sectional view of the package along cross-sectional view line XXXVIIF-XXXVIIF' of FIG. 36A, in accordance with at least one example embodiment.
Figure 38A:
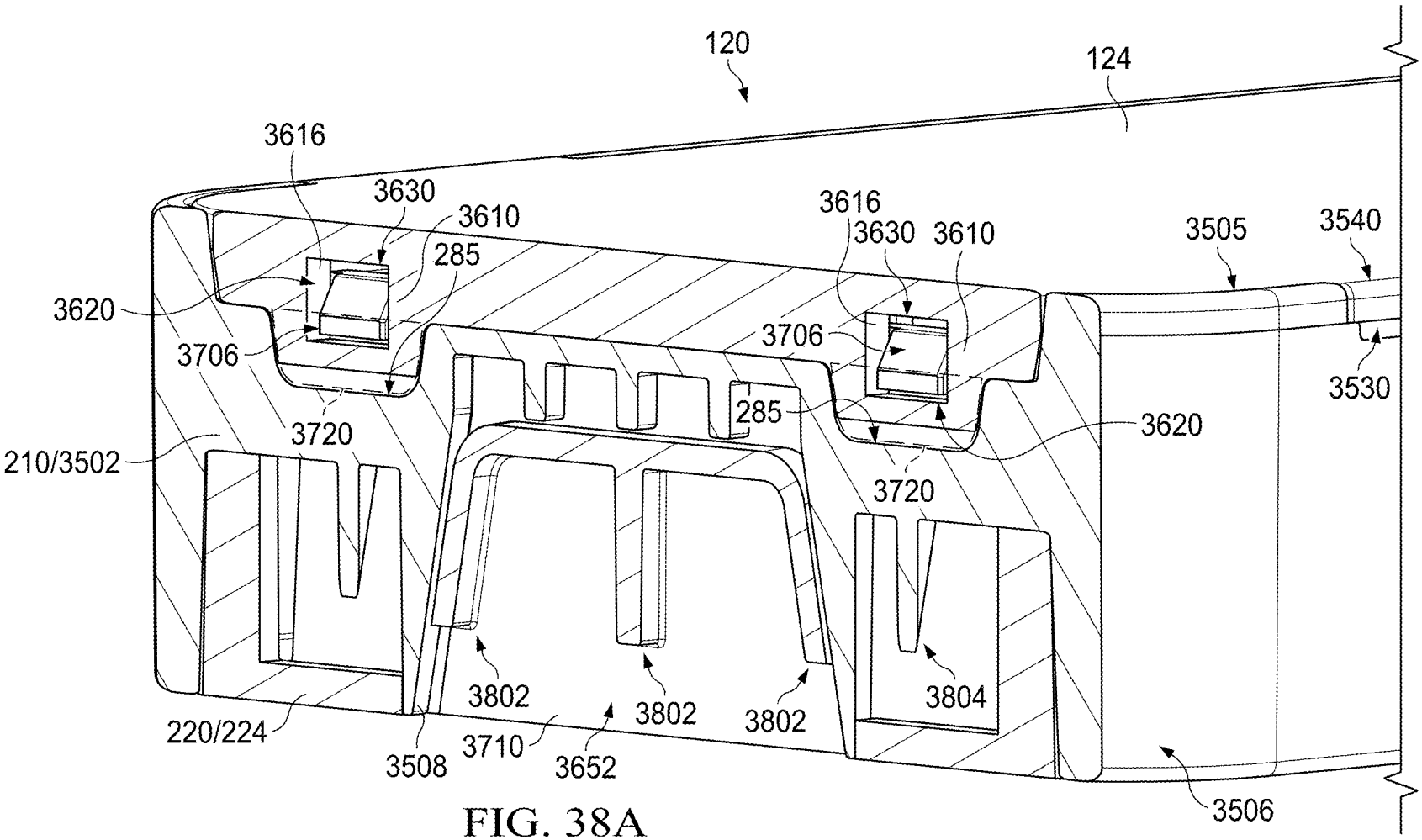
FIGS. 38A, 38B, and 38C are illustrations of close-up perspective cross-sectional views of a portion of the package along cross-sectional view line XXXVIII-XXXVIII' of FIG. 35A, in accordance with at least one example embodiment.
Figure 38B:
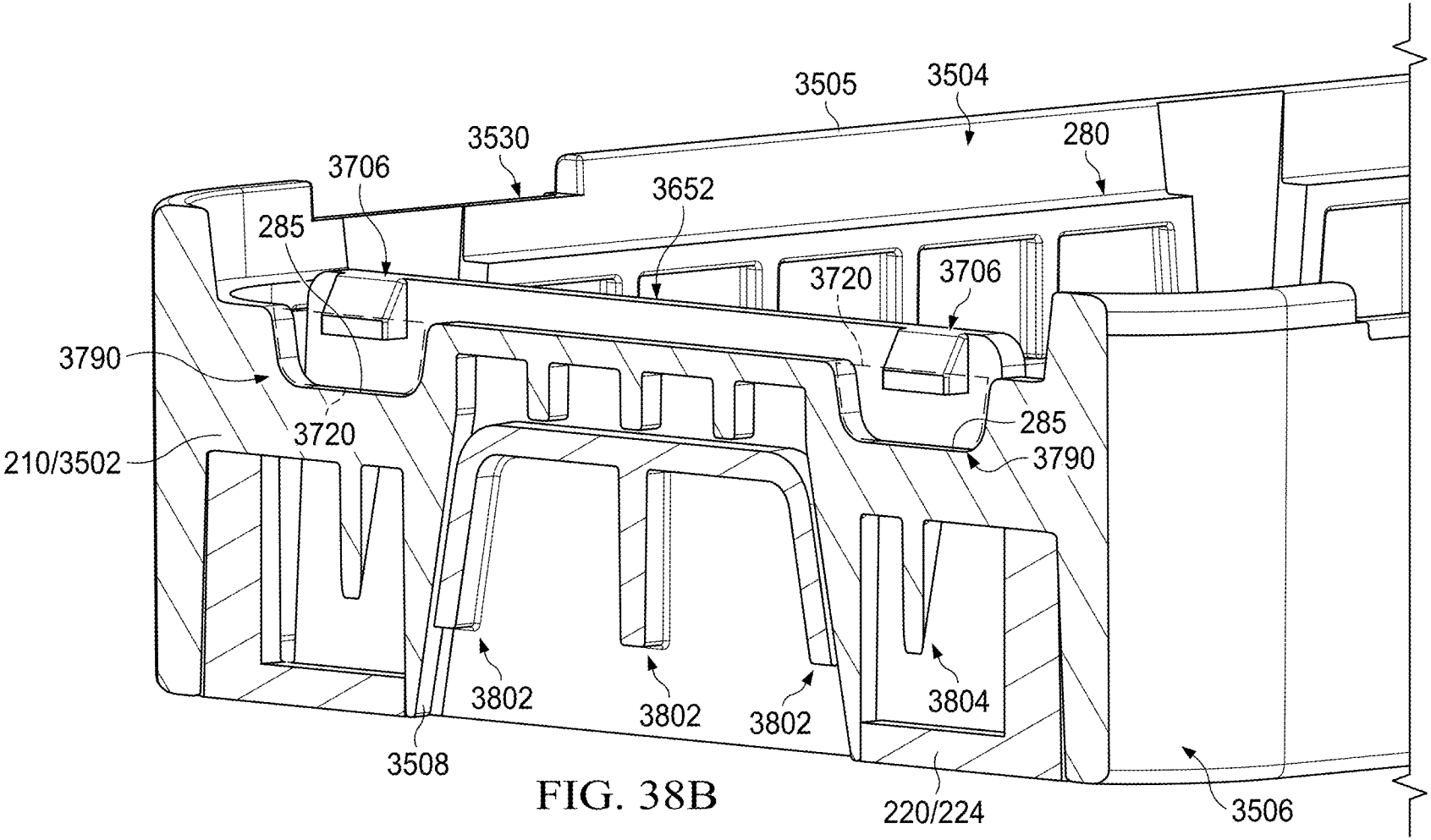
Figure 38C:
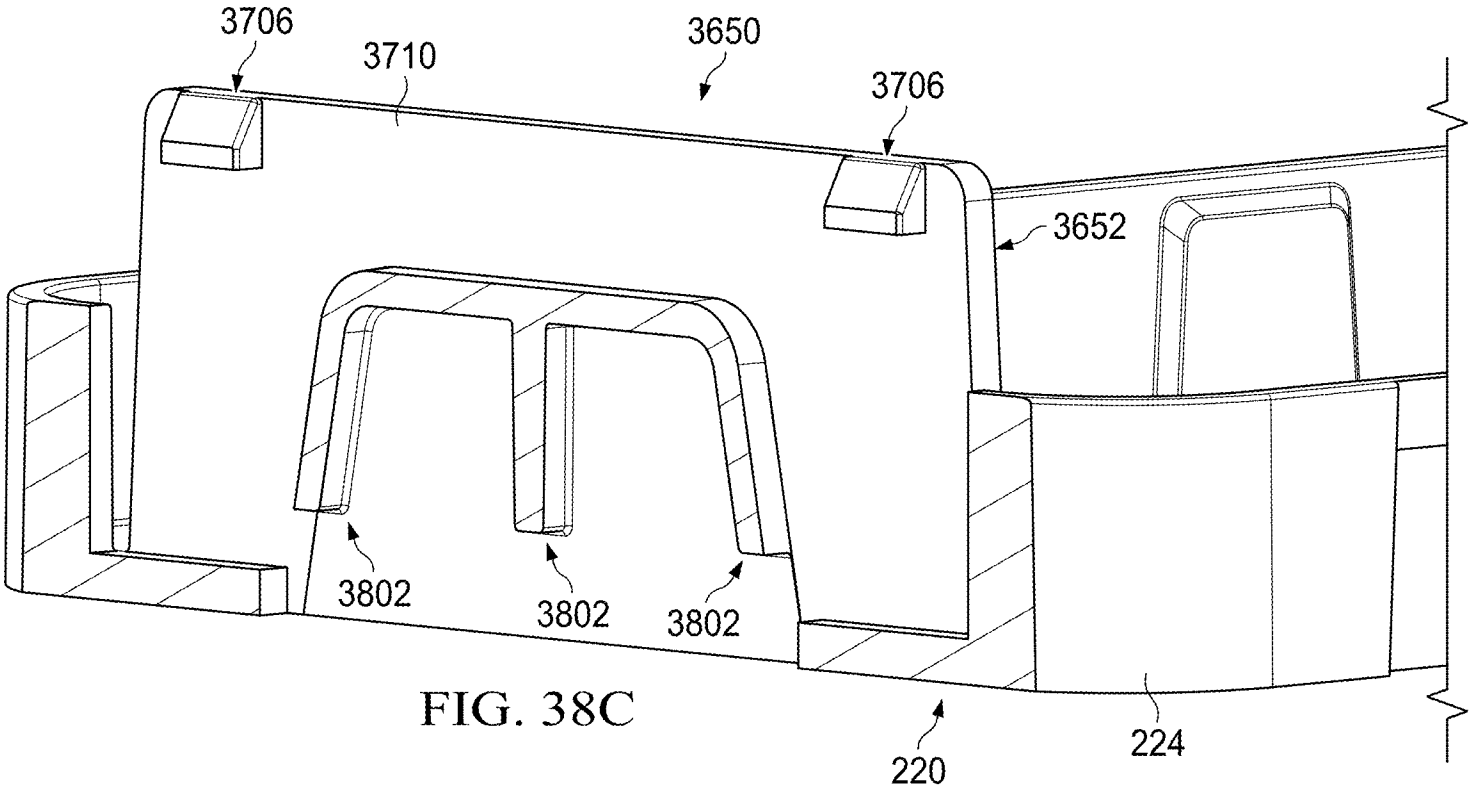
Figure 39A:
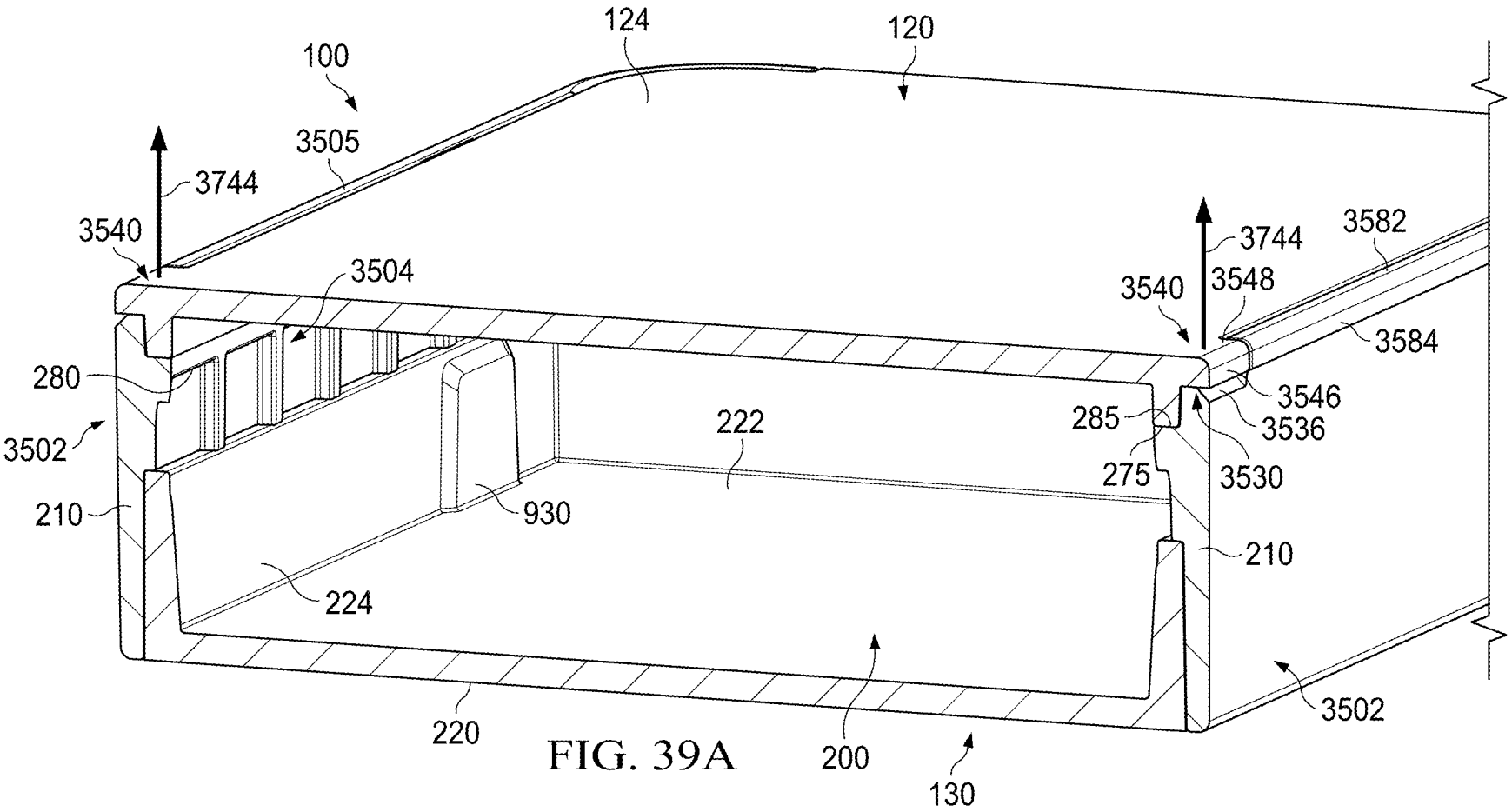
FIG. 39A is an illustration of a close-up perspective cross-sectional view of a portion of the package along cross-sectional view line XXXIXA-XXXIXA' of FIG. 35A, in accordance with at least one example embodiment.
Figure 39B:
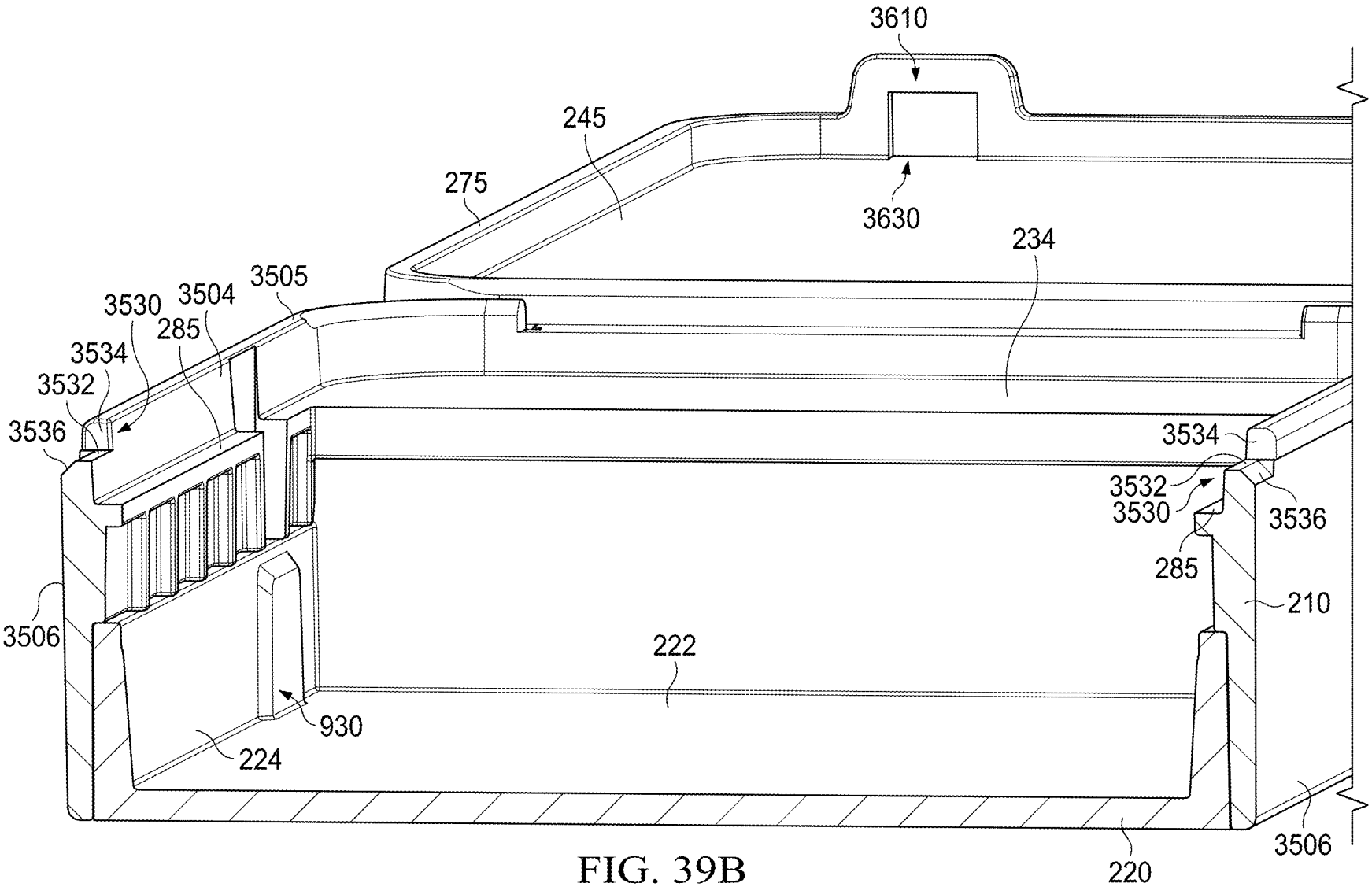
FIG. 39B is an illustration of a close-up perspective cross-sectional view of a portion of the package along cross-sectional view line XXXIXB-XXXIXB' of FIG. 36A, in accordance with at least one example embodiment.

FIGS. 35A and 35B are illustrations of perspective views of another package 100 in a closed configuration, in accordance with at least one example embodiment. FIGS. 36A and 36B are illustrations of perspective views of the package 100 of FIGS. 35A-35B in an open configuration, in accordance with at least one example embodiment. FIGS. 37A, 37B, and 37C are illustrations of close-up perspective cross-sectional views of a portion of the package 100 of FIGS. 35A-36B along cross-sectional view line XXXVII-XXXVII' of FIG. 35A, in accordance with at least one example embodiment. FIGS. 37D and 37E are illustrations of perspective cross-sectional views of the package 100 of FIGS. 35A-37C along cross-sectional view line XXXVIID-XXXVIID' of FIG. 35A, in accordance with at least one example embodiment. FIG. 37F is an illustration of a perspective cross-sectional view of the package 100 of FIGS. 35A-37E along cross-sectional view line XXXVIIF-XXXVIIF' of FIG. 36A, in accordance with at least one example embodiment. FIGS. 38A, 38B, and 38C are illustrations of close-up perspective cross-sectional views of a portion of the package 100 of FIGS. 35A-37C along cross-sectional view line XXXVIII-XXXVIII' of FIG. 35A, in accordance with at least one example embodiment. FIG. 39A is an illustration of a close-up perspective cross-sectional view of a portion of the package 100 of FIGS. 35A-38C along cross-sectional view line XXXIXA-XXXIXA' of FIG. 35A, in accordance with at least one example embodiment. FIG. 39B is an illustration of a close-up perspective cross-sectional view of a portion of the package 100 of FIGS. 35A-39A along cross-sectional view line XXXIXB-XXXIXB' of FIG. 36A, in accordance with at least one example embodiment.

In at least one example embodiment, and as shown in at least FIGS. 35A-36B, the primary lid 120 is connected to the base 130 via a hinge 140 and is configured to move and/or be moved between an open position (shown in at least FIGS. 36A-36B) and a closed position (shown in at least FIGS. 35A-35B) to establish the open and closed configurations, respectively, of the package 100.

The "open position" of the primary lid 120 may be interchangeably referred to herein as an "open configuration" of the primary lid 120. The "closed position" of the primary lid 120" may be interchangeably referred to herein as a "closed configuration" of the primary lid 120. In at least one example embodiment, the package 100 is understood to be in an open configuration when the primary lid 120 is in the open position and the package 100 is understood to be in a closed configuration when the primary lid 120 is in the closed position.

In at least one example embodiment (this, previously described or later described embodiments as well), the sidewalls 132, end walls 135, and curved walls (or corners) 138 of the package 100 may collectively define, and may collectively be referred to herein as, an outer wall 3502 of the base 130 of the package 100. The outer wall 3502 may be interchangeably referred to herein as a "peripheral wall" and may be understood to extend around a periphery of the base 130 and/or a periphery of the floor 222. In this, previously described or later described embodiment, as shown, the outer wall 3502 may be a part of and/or may be at least partially defined by the frame 210. In at least one example embodiment, and as shown in at least FIGS. 35A-39B, the base 130 may include at least a floor 222 and an outer wall 3502 that extends perpendicular to the floor 222, where the outer wall 3502 has an outer surface 3506 that at least partially defines an outer surface 3500 of the package 100. The floor 222 may be interchangeably be referred to herein as a "bottom wall" in this, previously described or later described embodiments.

In at least one example embodiment, and as shown in at least FIGS. 36A-37B, 38A, and 39A-39B, the outer wall 3502 may have an inner surface 3504 facing towards an interior of the frame 210 and/or package 100 (e.g., towards the primary storage area 200 and/or a center of the floor 222), an outer surface 3506 facing towards the exterior 3599 of the package 100 and/or frame 210, an upper surface 3505, and a lower surface 3507. In at least one example embodiment, the upper surface 3505 of the outer wall 3502 may define and/or may be the same as the upper surface 136 of the base 130.

In at least one example embodiment, and as shown in at least FIGS. 35A-35B, the outer wall 3502 may include at least two opposing sidewalls 132 (e.g., at opposite sides of the floor 222, primary storage area 200, or the like) extending along a long side of the base 130 (having length L1) and two opposing end walls 135 (e.g., at opposite sides of the floor 222, primary storage area 200, or the like) extending along a short side of the base 130 (having length L2), but example embodiments are not limited thereto.

In at least one example embodiment, the primary lid 120 has an interior surface 245, an outer surface 124 that is opposite to the interior surface 245, and at least one edge 277 (also referred to interchangeably as at least one edge surface) extending between the interior surface 245 and the outer surface 124 around a periphery of the primary lid 120. The outer surface 124 may at least partially define the outer surface 3500 of the package 100 when the primary lid 120 is in the closed position, as shown in at least FIGS. 35A-35B.

In at least one example embodiment, as shown in at least FIGS. 35A-35B, 37A, 37D-37E, 38A, and 39A, the outer surface 124 is configured to be flush (e.g., substantially flush) with the upper surface 3505 of the outer wall 3502 when the primary lid 120 is in the closed position. As shown in at least FIGS. 35A-35B, the outer wall 3502 may horizontally obscure the at least one edge 277 of the primary lid 120 from exposure to an exterior 3599 of the package 100 when the primary lid 120 is in the closed position. Such obscuring of the at least one edge 277 may limit or prevent application of force to various portions of the primary lid 120, via contact with at least the edge 277, to manipulate (e.g., move) the primary lid 120 between the open and closed positions.

As described herein, "horizontal" may refer to one or more directions extending parallel or substantially parallel to the floor 222 and/or the primary lid 120 in the closed position (including the first direction D1 described further herein). Accordingly, for example, "horizontally" obscuring or exposing an element of the package 100 to the exterior 3599 of the package 100 may be understood to include obscuring or exposing the element in one or more directions extending parallel or substantially parallel to the floor 222.

In at least one example embodiment, and as shown in at least FIGS. 35A-36B, 37B, 38B, and 39A-39B, the outer wall 3502 may define at least one notch structure, referred to herein as a notch 3530, that extends from the upper surface 3505 of the outer wall 3502 towards the lower surface 3507. The notch 3530 may be at least partially defined by opposing side surfaces 3534 and bottom surface 3532 of the outer wall 3502.

In at least one example embodiment, and as shown in at least FIGS. 35A-36B, 37A, 37D-37E, 38A, and 39A, the primary lid 120 may further include a contact structure 3540 extending (e.g., protruding) horizontally from the edge 277 of the primary lid 120 and thus away from the primary lid 120. In at least one example embodiment, the contact structure 3540 may be referred to herein interchangeably as a "tab," "contact tab," "second contact structure," or the like.

As shown in at least FIGS. 35A-36B, 37A, 37D-37E, 38A, and 39A, the contact structure 3540 may protrude horizontally outwards from at least one edge 277, and the contact structure 3540 may include a bottom surface 3542, an upper surface 3548, opposing side surface 3544, and outer surface 3546.

In at least one example embodiment, and as shown in at least FIGS. 35A-35B, 37A, 37D-37E, 38A, and 39A, the primary lid 120 and the base 130 may be configured to position the at least one contact structure 3540 and a corresponding at least one notch 3530 in particular respective positions at the primary lid 120 and base 130 so that the at least one contact structure 3540 may mate with (e.g., contact, be received in, etc.) a corresponding notch 3530 defined by the outer wall 3502 when the primary lid 120 is in the closed position such that an outer surface 3546 of the contact structure 3540 is exposed (e.g., horizontally exposed) from the outer wall 3502 to the exterior 3599 of the package 100 while the at least one edge 277 of the primary lid 120 is horizontally obscured from the exterior 3599 by the outer wall 3502. Mating of the at least one contact structure 3540 with the at least one notch 3530 may include at least the bottom surface 3542 of the at least one contact structure 3540 being in contact (e.g., flush contact) with the bottom surface 3532 of the corresponding notch 3530.

In at least one example embodiment, at least one contact structure 3540 enables contact with and/or manipulation of the primary lid 120 when the primary lid 120 is in the closed position, providing a structure to which a force may be applied (e.g., a force in a second direction D2 as described herein) to cause the primary lid 120 to be moved from the closed position to the open position and/or from the open position to the closed position. For example, the at least one contact structure 3540 may allow a consumer to grasp an outer, horizontally-exposed portion of the primary lid 120 and apply force to the primary lid 120 via the at least one contact structure 3540, when the primary lid 120 is in the closed position such that the at least one edge 277 of the primary lid 120 is horizontally obscured by the outer wall 3502 from the exterior 3599, to facilitate opening of the primary lid 120.

In at least one example embodiment, and as shown in at least FIGS. 35A-36A, each notch 3530 may have a depth 3562 from the upper surface 3505 of the outer wall 3502, between the upper surface 3505 and the bottom surface 3532 in a vertical direction (e.g., the second direction D2 as described herein) that is perpendicular to the bottom surface 3532 and/or upper surface 3505. In at least one example embodiment, and as shown in at least FIGS. 35A-36A, the at least one contact structure 3540 may have a thickness 3564 between opposite upper and lower surfaces 3548 and 3542. In at least one example embodiment, and as shown in at least FIGS. 35A-35B, 38A, and 39A, the thickness 3564 and the depth 3562 may be equal or substantially equal in magnitude, such that, when at least one contact structure 3540 is mated to at least one notch 3530, the upper surface 3548 of the contact structure 3540 may be flush or substantially flush with horizontally adjacent portions 3582 of the upper surface 3505 of the outer wall 3502.

In at least one example embodiment, and as shown in at least FIGS. 35A and 36A, the at least one contact structure 3540 may project horizontally from the at least one edge 277 by a projection distance 3574, such that the outer surface 3546 is offset from the at least one edge 277 from which the at least one contact structure 3540 projects by the projection distance 3574.

In at least one example embodiment, and as shown in at least FIG. 35A, the horizontal distance between the edge 277 and a proximate outer surface 3506 of the outer wall 3502 when the primary lid 120 is in the closed position, at a location at the outer wall 3502 that is adjacent to the location of at least one notch 3530 and corresponding contact structure 3540, may be a horizontal distance 3572. The horizontal distance 3572 may be similar to or the same as the thickness T of the outer wall 3502, but example embodiments are not limited thereto. For example, a portion of the at least one edge 277 adjacent to at least one contact structure 3540 may be spaced apart from (e.g., isolated from direct contact with) the inner surface 3504 of the outer wall 3502 when the primary lid 120 is in the closed position, such that distance 3572 may be greater than thickness T and may be a sum of the thickness T and the spacing distance between edge 277 and the proximate, facing inner surface 3504.

In at least one example embodiment, and as shown in at least FIGS. 35A-35B and FIG. 39A, the projection distance 3574 of at least one contact structure 3540 may be the same or substantially the same as the horizontal distance 3572 at locations adjacent to the at least one contact structure 3540, such that the outer surface 3546 of the contact structure 3540 may lie flush or substantially flush with horizontally adjacent portions 3584 of the outer surface 3506 of the outer wall 3502 when the primary lid 120 is in the closed position and the at least one contact structure 3540 is mated with a corresponding at least one notch 3530.

In at least one example embodiment, and as shown in at least FIGS. 35A-35B, the opposite side surfaces 3544 of at least one contact structure 3540 may be in flush contact with corresponding opposing side surfaces 3534 of a corresponding at least one notch 3530 when the at least one contact structure 3540 is mated with the at least one notch 3530. In at least one example embodiment, the opposite side surfaces 3544 of the at least one contact structure 3540 may be spaced apart from corresponding opposing side surfaces 3534 of the at least one notch 3530 when the at least one contact structure 3540 is mated with the at least one notch 3530.

In at least one example embodiment, and as shown in at least FIGS. 35A-36B and 39A-39B, the package 100 further includes an indentation, also referred to herein as groove 3536 along the outer wall 3502 (e.g., sidewall 132) adjacent at least one notch 3530, for example vertically adjacent (e.g., in the second direction D2) to the bottom surface 3532 of the at least one notch 3530. In at least one example embodiment, the groove 3536 allows for at least one contact structure 3540 that is mated to the adjacent at least one notch 3530 to be more easily contacted (e.g., grasped) to enable the application of force (e.g., a second force in the second direction D2 as described herein) to the primary lid 120 during an opening of the package 100. For example, the groove 3536 may allow a consumer to insert their finger and grasp an edge of the at least one contact structure 3540 when moving the primary lid 120 to the open position to open the primary storage area 200.

In at least one example embodiment, and as shown in at least FIGS. 35A-36B and 39A-39B, the package 100 includes a plurality of separate notches 3530 defined in opposing sides of the outer wall 2502 (e.g., opposite sidewalls 132) that are at opposite sides of the base 130 and define opposing sides of the primary storage area 200. The plurality of notches 3530 may include the at least one notch 3530 as described herein, and aspects of the at least one notch 3530 as described herein may apply to each of the plurality of notches 3530 as described herein. The plurality of notches 3530 may extend from the upper surface 3505 of the outer wall 3502 at opposing sides of the base 130 towards the lower surface 3507 of the outer wall 3502 (e.g., opposing sidewalls 132 at opposite sides of the base 130, such that the notches 3530 directly or indirectly oppose each other). In some example embodiments, where the upper surface 3505 is not continuous around a periphery of the base 130, the outer wall 3502 may be understood to include multiple separate upper surfaces 3505, and the plurality of notches 3530 may extend from opposite upper surfaces 3505 of the outer wall 3502 at opposite sides of the base 130.

In at least one example embodiment, and as shown in at least FIGS. 35A-36B and 39A-39B, the primary lid 120 further includes a plurality of separate contact structures 3540 extending horizontally from opposite sides of the primary lid 120 and configured to mate with separate, respective notches 3530 of a plurality of notches 3530 when the primary lid 120 is in the closed position such that separate, respective outer surfaces 3546 of the plurality of contact structures 3540 are horizontally exposed from the outer wall 3502 to the exterior 3599 of the package 100. The plurality of contact structures 3540 may be understood to extend from opposite sides of the edge 277 at opposite sides of the periphery of the primary lid 120. The plurality of contact structures 3540 may include the at least one contact structure 3540 as described herein, and aspects of the at least one contact structure 3540 as described herein may apply to each of the plurality of contact structures 3540 as described herein.

In at least one example embodiment, the edge 277 may be understood to extend around a periphery of the primary lid 120. In at least one example embodiment, where the edge 277 is not continuous around the periphery of the primary lid 120, the primary lid 120 may be understood to include multiple edges 277 extending around the periphery of the primary lid 120, and the plurality of contact structures 3540 may extend from opposite edges 277 of the primary lid 120 at opposite sides thereof.

Example embodiments shown in at least FIGS. 35A-39B illustrate multiple contact structures 3540 at opposite sides of the primary lid 120 and corresponding notches 3530 extending from respective upper surfaces 3505 of opposite sidewalls 132 of the outer wall 3502. However, example embodiments are not limited thereto. For example, in at least one example embodiment, the outer wall 3502 may define a single notch 3530 extending from an upper surface 3505 of any portion of the outer wall 3502 (e.g., an upper surface of an end wall 135 opposite to the hinge 140 across the floor 222), and the primary lid 120 may include a single contact structure 3540 configured to mate with the single notch 3530 when the primary lid 120 is in the closed position. In at least one other example embodiment, the outer wall 3502 may define multiple notches 3530 extending from an upper surface 3505 of the end wall 135 opposite to the hinge 140 across the floor 222, and the primary lid 120 may include multiple contact structures 3540 configured to mate with the separate, respective notches 3530 when the primary lid 120 is in the closed position.

In at least one example embodiment, and as shown in at least FIGS. 35A-39B, a locking mechanism 150 of the package 100 may be at least partially located within an interior of the package 100 and configured to be at least partially obscured from an exterior of the package 100 when the primary lid 120 is in the closed position. Restated, at least a portion of the locking mechanism 150 may be located "inwardly adjacent" to the outer wall 2502 in the package 100, such that the portion of the locking mechanism 150 is between the outer surface 3506 of the outer wall 2502 and the floor 222 and/or the primary storage area, such that the inner surface 3504 of the outer wall 3502 is between the "inwardly adjacent" portion(s) of the locking mechanism 150 and the outer surface 3506 of the outer wall 3502.

In at least one example embodiment, and as shown in at least FIGS. 36A-36B, 37A-37F, and 38A-38C, the locking mechanism 150 includes at least one first engaging structure 3630 and at least one second engaging structure 3706 that may engage with each other when the primary lid 120 is in the closed position, to retain the primary lid 120 in the closed position and thus lock the primary lid 120 to the base 130. The first and second engaging structures 3630 and 3706 may further disengage to unlock the primary lid 120 from the base 130 and enable the primary lid 120 to be moved from the closed position to the open position.

It will be understood that the primary lid 120 may be locked to, or unlocked from the base 130 when the primary lid 120 is in the closed position, based on whether the first and second engaging structures 3630 and 3706 are engaged or disengaged with each other. When the primary lid 120 is locked to the base 130, the primary lid 120 and/or the package 100 may be understood to be in a locked configuration. When the primary lid 120 is unlocked to the base 130, the primary lid 120 and/or the package 100 may be understood to be in an unlocked configuration, and it will be understood that the primary lid 120 may be in an open position or a closed position when the primary lid 120 is in the unlocked configuration and may be simultaneously in the unlocked configuration and the closed position.

In at least one example embodiment, and as shown in at least FIGS. 36A-36B, 37A, 37D-37E, and 38A, the locking mechanism 150 may include at least one arm 3610 extending from an interior surface 245 of the primary lid 120 (e.g., extending in a direction that is perpendicular to the interior surface 245). As shown in at least FIGS. 36A-36B, 37A, 37D-37E, and 38A, the at least one arm 3610 may extend from an outer periphery or edge 277 of the primary lid 120 that is opposite to the side of the primary lid 120 connected to the hinge 140, but example embodiments are not limited thereto.

In at least one example embodiment, and as shown in at least FIGS. 36A-36B, 37A, 37D-37E, and 38A, the at least one arm 3610 includes a respective first engaging structure 3630 that is configured to engage with a second engaging structure 3706 of the locking mechanism 150.

In at least one example embodiment, and as shown in at least FIGS. 36A-36B, 37A, 37D-37E, and 38A, at least one arm 3610 includes a rear surface 3612, an outer edge 3614, and a front surface 3618 that at least partially define outer surfaces of the arm 3610. The at least one arm 3610 may further include an outer surface 3622 that is substantially inclined, and the front surface 3618 may be substantially vertical (e.g., perpendicular to the interior surface 245). In at least one example embodiment, the outer surface 3622 is substantially inclined so as to allow a surface (e.g., the inner surface 3504 of the outer wall 3502) to slide across the arm 3610, prior to the second engaging structure engaging the first engaging structure 3630 of the arm 3610.

In at least one example embodiment, and as shown in at least FIGS. 36A-36B, 37A, 37D-37E, and 38A, the at least one arm 3610 may include a loop having an opening 3620 extending through the arm 3610. For example, as shown, the arm 3610 may include one or more inner surfaces 3616 that define the opening 3620 that extends between opposite front and rear surfaces 3618 and 3612 of the arm 3610. At least one of the inner surfaces 3616 of a respective arm 3610 may comprise the respective first engaging structure 3630 of the respective arm 3610. In operation, a second engaging structure 3706 may engage with the first engaging structure 3630 based on at least partially extending through the opening 3620 (e.g., from one or both of the front or rear surfaces 3618 or 3612) to engage one or more of the inner surfaces 3616.

While FIGS. 36A-36B, 37A, 37D-37E, and 38A illustrate the opening 3620 defined by the inner surfaces 3616 of the at least one arm 3610 as extending completely between opposite front and rear surfaces 3618 and 3612 of the at least one arm 3610, example embodiments are not limited thereto. For example, in at least one example embodiment, the opening 3620 may extend partially from the rear surface 3612 of an arm 3610 though the thickness of the arm 3610 between opposite surfaces 3612 and 3618 and may not extend through the front surface 3618.

In at least one example embodiment, and as shown in at least FIGS. 36A-38C, the locking mechanism 150 may include a flexible member 3650 that is at least partially inwardly adjacent to the outer wall 3502 (e.g., at least partially between the inner surface 3504 of the outer wall 3502 and the floor 222). The flexible member 3650 may be connected (e.g., fixed, attached, etc.) to the floor 222 and/or any other portion of the base 130. As described further herein, the flexible member 3650 may include at least one second engaging structure 3706 that may be configured to engage with and/or disengage from a respective first engaging structure 3630 of at least one arm 3610

The at least one arm 3610 and the flexible member 3650 and may have respective first and second engaging structures 3630 and 3706 that may be engaged with each other to facilitate locking of the primary lid 120 to the base 130 when the primary lid 120 is in the closed position. The respective first and second engaging structures 3630 and 3706 of the arm 3610 and the flexible member 3650 may be disengaged from each other to facilitate unlocking of the primary lid 120 from the base 130 while the primary lid 120 is in the closed position, to enable the unlocked primary lid 120 to move or be moved from the closed position to the open position to facilitate opening of the package 100.

In at least one example embodiment, and as shown in at least FIGS. 37A-37F, the flexible member 3650 is configured to flex 3758 (e.g., bend, move, etc.) at least inwardly (e.g., away from the outer wall 3502 and towards an interior of the frame 210 and/or package 100), so that the flexible member 3650 may be caused to move between a relaxed position 3752 and a flexed position 3754 in response to an applied force or absence thereof, to facilitate engagement or disengagement of respective engaging structures 3630 and 3706 of the at least one arm 3610 and flexible member 3650 to/from each other.

In at least one example embodiment, and as shown in at least FIGS. 35A-38C, the flexible member 3650 may be at least partially inwardly adjacent to the outer wall 3502, so that the outer wall 3502 is at least partially between the flexible member 3650 and an exterior 3599 of the package 100 and/or an outer surface 3500 of the package 100 in at least a horizontal direction. In at least one example embodiment, and as shown in at least FIGS. 35A-38C, the outer wall 3502 may at least partially horizontally obscure the flexible member 3650 from the exterior 3599 of the package 100, and the flexible member 3650 may be at least partially obscured, both horizontally and vertically, from the exterior 3599 when the primary lid 120 is in the closed position.

In at least one example embodiment, and as shown in at least FIGS. 36B-38C, the flexible member 3650 may include a flexible rib 3652. The flexible rib 3652 includes a fixed end 3702 that is connected (e.g., fixed) to the floor 222 and a free end 3704 that is opposite the fixed end 3702. In at least one example embodiment, the flexible rib 3652 and the floor 222 are separate portions of a single unitary piece of material, such that the fixed end 3702 of the flexible rib 3652 is continuous with the floor 222.

In at least one example embodiment, and as shown in at least FIGS. 37A-37F, the flexible rib 3652 may be configured to flex 3758, or move, between a relaxed position 3752 and a flexed position 3754 in response to a force (e.g., a first force in the first direction D1 as described herein). Such flexing may include at least the free end 3704 moving inwardly or outwardly in the first direction D1, in relation to the package 100 (e.g., primary storage area 200, the floor 22, etc.) while the fixed end 3702 remains stationary in relation to the package 100, for example based on being connected to the floor 222. The flexible rib 3652 may comprise a material according to any of the example embodiments described herein, including a resilient material that offers a spring force and is configured to flex from a relaxed position to a flexed position in response to an applied force and then return to the relaxed position in the absence of the applied force. The flexible rib 3652 may comprise any resilient material according to any of the example embodiment described herein. In some example embodiments, some or all elements of the flexible member 3650, including the flexible rib 3652, the at least one second engaging structure 3706, and the contact structure 3512, may comprise the same material (e.g., the same resilient material) and/or may be separate portions of a single, unitary piece of material.

In at least one example embodiment, some or all of the flexible member 3650, including at least the flexible rib 3652, may comprise a resilient material, which may be an at least partially elastic material, elastic or substantially elastic material, or the like. The resilient material may include one or more polymers. In at least one example embodiment, the resilient material includes one or more homopolymers, one or more copolymers, or any combination of one or more homopolymers and copolymers In at least some example embodiments, the one or more polymers include a thermoplastic polymer. In at least some example embodiments, the polymer includes polyethylene terephthalate (PET), polypropylene (PP), a polyethylene (PE), or any combination thereof.

In at least one example embodiment, and as shown in at least FIGS. 37A-38C, the flexible member 3650 includes at least one second engaging structure 3706 on an outer surface 3710 of the flexible rib 3652. The at least one second engaging structure 3706 may be at the free end 3704 of the flexible rib 3652 as shown in at least FIGS. 37A-38C, but example embodiments are not limited thereto and the at least one second engaging structure 3706 may be located anywhere on the outer surface 3710 of the flexible rib 3652.

In at least one example embodiment, and as shown in at least FIGS. 37A-38C, the flexible member 3650 may include multiple separate second engaging structures 3706 on the outer surface 3710 of the flexible rib 3652, but example embodiments are not limited thereto and in at least one example embodiment the flexible member 3650 may have a single second engaging structure 3706 of the outer surface 3710.

In at least one example embodiment, and as shown in at least FIGS. 37A-38C, the flexible member 3650 may include a plurality of second engaging structures 3706, which may be the same or different from the at least one second engaging structure 3706 as described herein. Each of the second engaging structures 3706 may be at the free end 3702 of the flexible rib 3652 and may be at opposite horizontal sides of the outer surface 3710 of the flexible rib 2652 as shown, for example, in at least FIG. 37C, but example embodiments are not limited thereto.

In at least one example embodiment, each second engaging structure 3706 may be configured to engage a corresponding respective first engaging structure 3630 of at least one arm 3610 of the locking mechanism 150 to lock the primary lid 120 to the base 130 while the primary lid 120 is in the closed position. Each second engaging structure 3706 may be configured to disengage from the corresponding respective first engaging structure 3630 to unlock the primary lid 120 from the base 130 while the primary lid 120 is in the closed position.

Each second engaging structure 3706 may include a first surface 3732 and a second surface 3734. In at least one example embodiment, the first surface 3732 is substantially inclined, and the second surface 3734 is substantially vertical. In at least one example embodiment, the first surface 3732 is substantially inclined so as to allow the rear surface 3612 of at least one arm 3610 of the primary lid 120 to slide across the second engaging structure 3706, prior to the second engaging structure 3706 engaging with (e.g., contacting) the respective first engaging structure 3630 of the at least one arm 3610. In at least one example embodiment, at least one second engaging structure 3706 is a catch, projection or protrusion that includes a third surface 3736 perpendicular to the second surface 3734 to form a step (hereinafter step 3736) on a lower end of the at least one second engaging structure 3706. As shown in at least FIGS. 37A-37C, the catch may have a truncated right angle pyramid shape. In at least one example embodiment, once the at least one second engaging structure 3706 slides into a first engaging structure 3630 as the package 100 is closed, the step 3736 maintains, retains, restricts, etc. the at least one second engaging structure 3706 (e.g., catch) in the first engaging structure 3630 so as to lock the package 100 in the closed configuration (e.g., lock the primary lid 120 to the base 130), for example based on the step 3736 engaging an inner surface 3616 of the at least one arm 3610.

In at least one example embodiment, and as shown in at least FIGS. 37A-38C, at least a portion of the outer surface 3710 of the flexible rib 3652, including a portion of the outer surface 3710 on which at least one second engaging structure 3706 is located, faces the inner surface 3504 of the outer wall 3502, such that the outer wall 3502 horizontally obscures the portion of the flexible rib 3652 from exposure to an exterior 3599 of the package 100.

In at least one example embodiment, and as shown at least FIGS. 37A-38C, the at least one second engaging structure 3706 on the outer surface 3710 of the flexible rib 3652 faces a proximate inner surface 3504 of the outer wall 3502, such that the outer wall 3502 horizontally obscures the at least one second engaging structure 3706 from the exterior 3599 of the package 100. For example, as shown in at least FIGS. 37A-37B, 37D-37F, a portion of the outer wall 3502 that overlaps the outer surface 3710 in a horizontal direction that is normal to the outer surface 3710 (e.g., the first direction D1) may horizontally obscure at least the one or more second engaging structures 3706 from the exterior 3599 of the package 100.

In at least one example embodiment, and as shown in at least FIGS. 35A, 36A, and 37A-37F, the locking mechanism 150 includes a contact structure 3512 that is on an outer surface 3710 of the flexible rib 3652 and which is configured to be contacted (e.g., pressed) by a consumer to facilitate opening of the package 100, based on causing the flexible member 3650 to move between a relaxed position 3752 and a flexed position 3754. The contact structure 3512 may be referred to interchangeably as a button, push-button, push plate, or the like, and the flexible member 3650 may be interchangeably referred to as a button, push-button, or the like. The locking mechanism 150 may further be referred to as a button, push-button, or the like. As shown in at least FIGS. 35A, 36A, and 37A-37F, the contact structure 3512 is a portion of the flexible member 3650, and thus of the locking mechanism 150, that remains exposed to the exterior 3599 of the package 100 when the primary lid 120 is in the closed position.

In at least one example embodiment, and as shown in at least FIGS. 35A, 36A, and 37A-37F, the contact structure 3512 has an outer surface 3514 that is exposed from the outer wall 3502 to the exterior 3599 of the package 100. The outer surface 3514, and thus the contact structure 3512, will be understood to be horizontally exposed from the outer wall 3502 to the exterior 3599 of the package 100. In at least one example embodiment, the contact structure 3512 allows a consumer to apply a first force 3742 in a first direction D1 to a portion of the locking mechanism 150 to unlock the primary lid 120 that is in the closed position from the base 130 and thus enable the primary lid 120 to be moved from the closed position to the open position while the primary lid 120 is unlocked (e.g., via application of another, second force 3744 in another, different direction at least partially while the first force 3742 is being applied). As a result, the opening of the package 100 may be facilitated based on the consumer at least partially simultaneously applying multiple, separate forces 3742 and 3744 in separate, respective directions D1 and D2.

In at least one example embodiment, as shown in at least FIGS. 35A-39B, the outer surface 3514 of the contact structure 3512 may at least partially define an outer surface 3500 of the package 100. For example, as shown in at least FIGS. 35A-39B, the contact structure 3512 may be configured such that the outer surface 3514 may at least sometimes lie flush with adjacent portions of the outer surface 3506 of the outer wall (e.g., when a force is not being applied to the contact structure 3512 and/or when a flexible member of the locking mechanism 150 is in a relaxed position 3752.

In at least one example embodiment, and as shown in at least FIGS. 35A, 36A, 37A-37B, 37D-37F, and 38A-38B, the outer wall 3502 may include one or more inner edges 3508 that at least partially define an opening 3510 in the outer wall 3502 that is configured to expose at least a portion of an interior of the package 100 from the outer wall 3502 to an exterior 3599 of the package 100. In at least one example embodiment, and as shown in at least FIGS. 35A, 36A, 37A-37B, 37D-37F, the contact structure 3512 may be at least partially located within the opening 3510 such that at least the outer surface 3514 is exposed from the outer wall 3502 to the exterior 3599 of the package 100 via the opening 3510.

In at least one example embodiment, and as shown in at least FIGS. 35A-35B, the outer surface 3500 of the package 100 may be at least partially defined by the outer surface 3506, upper surface 3505, and lower surface 3507 of the outer wall 3502, the exterior surface 720 of the floor 222, and the outer surface 124 of the primary lid, and may further be at least partially defined by the outer surface 3514 of the contact structure 3512.

In at least one example embodiment, and as shown in at least FIGS. 35A, 36A, and 37A-38B, the contact structure 3512 that is at least partially located within, exposed through, and/or extending through the opening 3510 may be spaced apart from (e.g., isolated from direct contact with) the one or more inner edges 3508 of the outer wall 3502, such that gap space 3524 is defined by opposing inner edges 3508 of the outer wall 3502 and outer edges 3516 of the contact structure 3512. The presence of the gap space 3524 may provide for tolerances in the manufacturing of the package 100 and may ensure that movement of the contact structure 3512 is not obstructed during use of the package 100.

In at least one example embodiment, and as shown in at least FIG. 35B, the base 130 includes (e.g., defines) a notch 3522 extending into the floor from the outer surface 3506 of the outer wall 3502 at the lower surface 3507 of the outer wall 3502. As further shown, the contact structure 3512 may have a bottom edge 3518 that may lie flush with the lower surface 3507 of the outer wall 3502 and which may be aligned with (e.g., horizontally overlap with) the notch 3522, such that a gap 3526 is defined between the bottom edges 3518 and an inner surface of the notch 3522. The notch and gap 3526 may provide for tolerances in the manufacturing of the package 100 and may ensure that movement of the contact structure 3512 is not obstructed during use of the package 100.

In at least one example embodiment, and as shown in at least FIGS. 37A-37F, the flexible rib 3652 is configured to flex 3758 in response to an application of force thereto and relax 3759 in response to an absence of such applied force. As shown in at least FIGS. 37A-37F, for example, the flexible rib 3652 extends in a second direction D2 that is perpendicular to the floor 222, and the flexible rib 3652 may be configured to flex 3758 from a relaxed position 3752 to a flexed position 3754 in response to a force being applied to the flexible rib 3652 in a first direction D1 which may be directed inwards into the package 100. The flexing 3758 of the flexible rib 3652 in response to the applied first force 3742 may cause the flexible member 3650 to move, or flex 3758 from the relaxed position 3752 to the flexed position 3754.

The flexible rib 3652 may be configured to flex 3758 by a particular angle 3760, and thus cause the flexible member 3650 to flex by the particular angle 3760, to cause the second engaging structure 3706 to disengage from a respective first engaging structure 3630 of at least one arm 3610 based on horizontal inward movement of the second engaging structure 3706 away from the respective first engaging structure 3630. The particular angle 3760 may be, for example, an angle between 1 degree and 30 degrees from the second direction D2, but example embodiments are not limited thereto. The particular angle 3760 may be equal to or greater than 0.1 degrees, 0.5 degrees, 1 degree, 5 degrees, 10 degrees, 20 degree, 30 degrees, 40 degrees, 45 degrees, 50 degrees, 55 degrees, and/or 60 degrees. The particular angle 3760 may be equal to or smaller than 89.9 degrees, 89.5 degrees, 89 degrees, 85 degrees, 80 degrees, 70 degrees, 60 degrees, 50 degrees, 45 degrees, 40 degrees, 35 degrees, and/or 30 degrees.

In at least one example embodiment, and as shown in FIGS. 37A-37F, the flexible member 3650 is configured to flex 3758 inwards (e.g., away from a proximate inner surface 3504 opposing the outer surface 3710) from a relaxed position 3752 to a flexed position 3754 based on flexing 3758 of the flexible rib 3652 in response to a first force 3742 being applied to the contact structure 3512 (e.g., based on a consumer pressing on the contact structure) in a first direction D1 that is directed inwardly (e.g., towards an interior of the package 100). Restated, the flexing 3758 of the flexible rib 3652 may be understood to correspond to flexing 3758 of the flexible member 3650, such that the flexible member 3650 flexes 3758 from a relaxed position 3752 to a flexed position 3754 based on the flexible rib 3652 flexing from a corresponding relaxed position to a corresponding flexed position. As shown in FIGS. 37A-37F, the relaxed position 3752 of the flexible rib 3652 may be the same as the relaxed position 3752 of the flexible member 3650, and the flexed position 3754 of the flexible rib 3652 may be the same as the flexed position 3754 of the flexible member 3650, such that the flexed and relaxed positions of the flexible member 3650 as described herein may interchangeably be referred to as the flexed and relaxed positions, respectively, of the flexible rib 3652.

In at least one example embodiment, the flexible rib 3652, and thus some or all of the flexible member 3650, may be understood to be configured to exert a spring force that opposes forces applied to at least a portion of the flexible member 3650 (e.g., the flexible rib 3652) in a horizontal direction (e.g., the first direction D1) to cause the flexible member 3650 to flex 3758 to the flexed position 3754 in the horizontal direction, such that the spring force may cause the flexible member 3650 to return (e.g., relax 3759) from the flexed position 3754 to the relaxed position 3752 in the absence of the applied force. For example, the flexible rib 3652, and thus some or all of the flexible member 3650, may be understood to be configured to exert a spring force that opposes the first force 3742 applied in the first direction D1, where the first force 3742 exceeds the spring force and thus causes the flexible member 3650 to flex 3758 from the relaxed position 3752 to the flexed position 3754. The flexible rib 3652, and thus some or all of the flexible member 3650, may be understood to be configured to return (e.g., relax 3759) from the flexed position 3754 to the relaxed position in response to the spring force being exerted by the flexible member 3652, and thus some or all of the flexible member 3650, exceeding the first force 3742 in at least magnitude in the direction opposing the first direction D1 (e.g., in response to the first force 3742 ceasing to be applied in the first direction D1 to the flexible member 3650).

In at least one example embodiment, the flexible rib 3652, and thus some or all of the flexible member 3650, may be understood to be a spring, or configured to function (e.g., act) as a spring. For example, at least the flexible rib 3652, and thus some or all of the flexible member 3650, may be understood to function (e.g., act) as a leaf spring that is configured to exert a spring force opposing a first force 3742 that is applied to the flexible member 3650 in the first direction D1 and return (e.g., relax 3759) from a flexed position 3754 to a relaxed position 3752 in response to an absence of the applied first force 3742, or the opposing spring force exceeding the first force 3742 in at least magnitude in the direction opposing the first direction D1.

In at least one example embodiment, the flexible member 3650 is configured to return, or relax 3759, from the flexed position 3754 to the relaxed position 3752 absent an applied force on the flexible member 3650 (e.g., absent the first force 3742). For example, when the flexible member 3650 is in the flexed position 3754 in response to the first force 3742 being applied to the contact structure 3512, the flexible member 3650 may be configured to return (e.g., relax 3759) to the relaxed position 3752 in response to the ceasing of the application of the first force 3742 on the contact structure 3512.

As described herein, at least the flexible rib 3652 may comprise a resilient and/or flexible material configured to flex and/or move between relaxed and flexed positions as described herein in response to a applied force or absence thereof. The resilient and/or flexible material may be any of the materials according to any of the example embodiments as described herein. In at least one example embodiment, the entire flexible member 3650, including the at least one second engaging structure 3706 and the contact structure 3512, may comprise the same material as the flexible rib 3652.

In at least one example embodiment, and as shown in at least FIGS. 37A and 38A, the flexible member 3650 is configured to engage the respective first engaging structure 3630 of at least one arm 3610 with at least one second engaging structure 3706 of the flexible member 3650 in response to the primary lid 120 being in the closed position and the flexible member 3650 being in the relaxed position 3752, to retain the primary lid 120 in the closed position, thereby locking the primary lid 120 to the base 130 such that the primary lid 120 is in the closed position and the locked configuration.

In at least one example embodiment, when the primary lid 120 is moved to the closed position, the arm 3610 may descend into a gap space 3720 at least partially defined between opposing outer surface 3710 and inner surface 3504 and in which at least one second engaging structure 3706 is at least partially located when the flexible member 3650 is in the relaxed position 3752, as shown in at least FIGS. 37A and 38A. In at least one example embodiment, the rear surface 3612 of at least one arm 3610 entering the gap space 3720 may contact the first surface 3732 and/or second surface 3734 of the at least one second engaging structure 3706 that is at least partially in the gap space 3720 to apply a force to the flexible rib 3652 to deflect (e.g., "flex" 3758) the flexible member 3650 in the first direction D1 to a flexed position which may be the flexed position 3754 or may be between the relaxed position 3752 and the flexed position 3754. When the respective first engaging structure 3630 is vertically aligned (e.g., in the second direction D2) in the gap space 3720 with the at least one second engaging structure 3706 at least partially located in the gap space 3720, the flexible member 3650 may return to the relaxed position 3752 to engage the at least one second engaging structure 3706 with the respective first engaging structure 3630.

For example, as shown in at least FIG. 37A and FIG. 38A, where the at least one arm 3610 includes a first engaging structure 3630 that includes a lower inner surface 3616 at least partially defining an opening 3620 through the at least one arm 3610, and where the at least one second engaging structure 3706 includes a catch with a step 3736, and where the flexible member 3650 is deflected or flexed 3758 by the at least one arm 3610 due to sliding contact between the arm 3610 and the second engaging structure 3706 as the arm 3610 is lowered into the gap space 3720 when the primary lid 120 is moved to the closed position, the flexible member 3650 may return (3759) from the flexed position 3754 to the relaxed position 3752 in response to the opening 3620 becoming at least partially aligned (e.g., vertically and/or horizontally aligned) with the second engaging structure 3706 so that the force applied on the second engaging structure 3706 of the flexible member 3650 by the arm 3610 at least partially ceases and the flexible member 3650 responsively returns (3759) to the relaxed position 3752 based on the second engaging structure 3706 at least partially extending through the opening 3620 at least partially vertically and/or horizontally aligned with the second engaging structure 3706 to engage the step 3736 with the at least one inner surface 3616 (e.g., the lower inner surface 3616) at least partially defining the opening 3620.

In at least one example embodiment, and as shown in at least FIGS. 37A-37F, the flexible member 3650 is configured to disengage at least one second engaging structure 3706 from an engaged respective first engaging structure 3630 of at least one arm 3610 in response to the first force 3742 being applied to the contact structure 3512 in the first direction D1 to cause the flexible member 3650 to move (e.g., flex 3758) to the flexed position 3754 while the primary lid 120 is in the closed position. The flexible member 3650 may be configured to flex 3758 by a flexing angle 3760 that is sufficient to disengage the at least one second engaging structure 3706 from the first engaging structure 3630 based on horizontal inward movement of the second engaging structure 3706 away from the arm 3610 due to the flexing 3758 of the flexible member 3650. For example, where the first engaging structure 3630 includes an inner surface 3616 of the arm 3610 which at least partially defines an opening 3620 through which the second engaging structure 3706 extends when the primary lid 120 is in the closed position and the locked configuration, the flexing 3758 due to the first force 3742 being applied to the contact structure 3512 may cause the flexible member 3650 to flex by at least a particular angle 3760 to cause the second engaging structure 3706 to move out of the opening 3620 to disengage from the first engaging structure 3630 and thus release the arm 3610 from engagement, connection, etc. with the flexible member 3650.

When the first and second engaging structures 3706 and 3630 are disengaged from each other, the primary lid 120 is unlocked from the base 130 and is understood to be in an unlocked configuration. The primary lid 120 may be locked to the base or unlocked from the base 130 while being in the closed position based on whether the first and second engaging structures 3630 and 3706 are engaged or disengaged with each other, respectively.

In at least one example embodiment, and as shown in at least FIGS. 37A-37B, 37D-37F, 38A-38B, and 39A-39B, the primary lid 120 is configured to be moved from the closed position to the open position based on applying a second force 3744 to the primary lid 120 in a second direction D2 that is perpendicular to the first direction D1 while the flexible member 3650 is in the flexed position 3754 and thus the primary lid 120 is unlocked from the base 130. For example, the second force 3744 may be applied in the second direction D2 to a contact structure 3540 subsequently to the application of the first force 3742 to the contact structure 3512 in the first direction D1 to unlock the primary lid 120 from the base due to disengagement of the first and second engaging structures 3630 and 3706. The second force 3744 may be applied in the second direction D2 at least partially concurrently with the first force 3742 being applied in the first direction D1 to the contact structure 3512, such that the first and second engaging structures 3630 and 3706 remain disengaged from each other and the primary lid 120 remains unlocked from the base 130 when the second force 3744 is applied and the primary lid 120 is at least partially moved out of the closed position and towards the open position. To enable the primary lid 120 to remain unlocked from the base 130 when the second force 3744 is being applied to move the primary lid 120 from the closed position to the open position, the first force 3742 may be maintained at least when the second force 3744 is initially applied in order to maintain the disengagement between the engaging structures 3630 and 3706 while the at least one arm 3610 of the primary lid 120 is lifted out of gap space 3720, so that at least the first engaging structure 3630 is lifted out of alignment with the second engaging structure 3706 to move the primary lid 120 from the closed position to the open position, before the first force 3742 ceases to be applied to the contact structure.

As a result, the primary lid 120 may be configured to be unlocked from the base 130 and moved from the closed position to the open position based on applying two separate forces 3742 and 3744 at least partially simultaneously and in separate directions D1 and D2, thereby providing child resistant access to the primary storage area 200 of the package 100.

In at least one example embodiment, and as shown in at least FIGS. 37A and 39A, the second force 3744 may be applied to the one or more contact structures 3540 extending horizontally from one or more sides of the edge 277 of the primary lid 120. The second force 3744 may be applied based on a consumer grasping each of the contact structures 3540 of the primary lid 120 (e.g., via contacting separate contact structures 3540 with separate fingers of one hand) while applying the first force 3742 to the contact structure 3512 with a separate hand, in order to both unlock the primary lid 120 from the base 130 (via applying the first force 3742 to the contact structure 3512) and opening the package 100 once the primary lid is unlocked (via applying the second force 3744 to the one or more contact structures 3540 while the primary lid 120 is unlocked in the closed position), thereby providing child resistant access to the primary storage area 200 of the package 100.

In at least one example embodiment, the contact structure 3512 is configured to be spaced apart from the inner edges 3508 of the outer wall 3502 at least when the flexible member 3650 is in the relaxed position 3752.

In at least one example embodiment, and as shown in at least FIGS. 36A-36B, 37A, 37D-37E, and 38A, the locking mechanism 150 may include a plurality of arms 3610 that protrude from the interior surface 245 of the primary lid 120. The plurality of arms 3610 may be spaced apart from each other and may include separate, respective first engaging structures 3630, each of which may be the same as the at least one first engaging structure as described herein. In at least one example embodiment, and as shown in at least FIGS. 37A-38C, the locking mechanism 150 may include a flexible member 3650 that includes a plurality of second engaging structures 3706 on the outer surface 3710 of the flexible rib 3652. As shown in at least FIGS. 37A-38C, the multiple second engaging structures 3706 may be at opposite sides of the outer surface 3710 of the flexible rib 3652, but example embodiments are not limited thereto. The locking mechanism 150 may be configured such that the flexible member 3650 is configured to engage each separate second engaging structure 3706 with a separate, respective first engaging structure 3630 of the plurality of arms 3610 when the primary lid is in the closed position and the flexible member 3650 is in the relaxed position 3752, so that the primary lid 120 has a plurality of points of contact with the flexible member 3650 when the primary lid 120 is locked to the base 130. The plurality of arms 3610 may include the at least one arm 3610 as described herein, and aspects of the at least one arm 3610 as described herein may apply to each of the plurality of arms 3610 as described herein. The plurality of second engaging structures 3706 may include the at least one second engaging structure 3706 as described herein, and aspects of the at least one second engaging structure 3706 as described herein may apply to each of the plurality second engaging structures 3706 as described herein.

In at least one example embodiment, the locking mechanism 150 may be configured to lock the primary lid 120 to the base 130 at an opposite end of the package from the hinge 140. For example, as shown in at least FIGS. 35A-39B, the outer wall 3502 may include two opposing sidewalls 132 extending along a long side of the base 130 and two opposing end walls 135 extending along a short side of the base 130, the hinge 140 may be connected to the base 130 at one end wall 135, and the flexible member 3650 may be inwardly adjacent to an opposite end wall 135 such that the hinge 140 and the flexible member 3650 are at opposite ends of the floor 222 of the base 130 and thus are at opposite ends of the base 130.

In at least one example embodiment, and as shown in at least FIGS. 36A-37B, 38A-38B, and 39A-39B, the base 130 (e.g., the frame 210) may include a ledge 280 on the inner surface 3504 of the outer wall 3502. The ledge may define a first upper surface, or step 285. In at least one example embodiment, the step 285 (e.g., first step) is an upper surface that faces upwards towards the primary lid 120 when the primary lid 120 is in the closed position. In at least one example embodiment, the ledge 280 has an outer surface 3780 that faces inwards, away from the inner surface 3504 of the outer wall 3502 and towards an interior space defined by the inner surface 3504.

In at least one example embodiment, and as shown in at least FIGS. 37A-37B and 38A-38B, the ledge 280 includes one or more portions 3790 that are shaped to accommodate and contact (e.g., mate with) at least one arm 3610 when the primary lid 120 is in the closed position. In at least one example embodiment, and as shown in at least FIGS. 37A-37B and 38A-38B, respective portions of the step 285 in the respective portions 3790 of the ledge 280 may at least partially define one or more gap spaces 3720 configured to receive, retain, and/or mate with at least one arm 3610 when the primary lid 120 is in the closed position, such that the respective portions 3790 of the ledge 280 may hold (e.g., retain) the at least one arm 3610 in place, and restrict vertical and/or horizontal movement of the at least one arm 3610, to vertically and/or horizontally align the respective first engaging structure 3630 of the at least one arm 3610 with a corresponding at least one second engaging structure 3706 of the flexible member 3650 so as to facilitate engagement of the first and second engaging structures 3630 and 3706 with each other when they are so aligned with each other. Restated, at least a portion of the step 285, for example a portion of the step 285 defined by a particular portion 3790 of the ledge 280, may contact the at least one arm 3610 to at least vertically align the respective first engaging structure 3630 of the at least one arm 3610 with at least one second engaging structure 3706 of the flexible member 3650 when the primary lid 120 is in the closed position and the flexible member 3650 is in the relaxed position 3752, thereby enabling engagement between the first and second engaging structures 3630 and 3706 based on the alignment.

It will be understood that, as described herein, a respective first engaging structure 3630 of at least one arm 3610 engaging with at least one second engaging structure 3706 of the flexible member 3650 may be referred to interchangeably as the at least one arm 3610 and the flexible member 3650 engaging with each other. It will be understood that, as described herein, a respective first engaging structure 3630 of at least one arm 3610 disengaging with at least one second engaging structure 3706 of the flexible member 3650 may be referred to interchangeably as the at least one arm 3610 and the flexible member 3650 disengaging from each other.

In at least one example embodiment, and as shown in at least FIGS. 37A-38C. the outer surface 3710 of the flexible rib 3652 and the opposing inner surface 3504 of the outer wall 3502 may define opposite boundaries of a given gap space 3720 in a longitudinal direction of the package 100 (e.g., the first direction D1), and the one or more surfaces of the portion of the step 285 in the portion 3790 of the ledge 280 may define a bottom boundary of the gap space 3720 and opposing boundaries of the gap space 3720 in a lateral direction of the package 100 (e.g., perpendicular to both the first and second directions D1 and D2).

In at least one example embodiment, and as shown in at least FIGS. 37A-38B and 38A-38B, the ledge 280, step 285, and opposing surfaces 3504 and 3710 may be configured to define at least one gap space 3720 having a shape that approximates and/or is the same or substantially the same as (e.g., complementary to) the outer shape of at least a distal portion of an arm 3610 that is configured to be received into the gap space 3720 when the primary lid 120 is in the closed position. For example, based on the structures of the ledge 280, flexible member 3650, outer wall, and the like (e.g., structures of the base 130) being configured to define one or more gap spaces 3720 that have a shape that is complementary or substantially complementary to an outer shape of a distal end of at least one arm 3610, as shown in at least FIGS. 37A and 38A for example, the base 130 may be configured to physically restrain the arm 3610 received into the gap space 3720 when the primary lid 120 is in the closed position and align the arm with a corresponding second engaging structure 3706 of the flexible member 3650 to enable reliable engagement and disengagement of the first and second engaging structures 3630 and 3706 and thus locking and unlocking of the primary lid 120 in relation to the base 130.

In at least one example embodiment, and as shown in at least FIGS. 37A-37F, the ledge 280 may define an outer surface 3780 that may contact the outer surface 3710 of the flexible rib 3652 when the flexible member 3650 is in the relaxed position 3752. The outer surface 3780 of the ledge 280 may contact the flexible rib 3652 at the outer surface 3710 thereof to restrict outward horizontal movement of the flexible member 3650 from the relaxed position 3752.

In at least one example embodiment, the base 130 (e.g., the frame 210) includes and/or defines one or more reinforcing ribs 3804 on the inner surface 3504 of the outer wall 3502, where the one or more reinforcing ribs 3804 are connected to corresponding portions 3790 of the ledge 280 that are configured to mate with corresponding arms 3610 when the primary lid 120 is in the closed position. The reinforcing ribs 3804 may configure the respective portions 3790 of the ledge 280 to support the load of the arm(s) 3610 on the respective portions of the step 285 in the respective portions 3790 of the ledge 280.

In at least one example embodiment, and as shown in at least FIGS. 36A-36B, 37A, 37D-37E, 38A, and 39A-39B, the primary lid 120 includes a seal 275 extending from the interior surface 245 of the primary lid 120. The ledge 280 may, in at least one example embodiment, be configured to mate with the seal 275 when the primary lid 120 is in the closed position.

In at least one example embodiment, and as shown in at least FIGS. 36A-36B, at least one arm 3610 may be included in (e.g., as a part of) the seal 275, such that the at least one arm 3610 and/or the first engaging structures 3630 thereof may be understood to be integrated in (e.g., a part of a same unitary piece of material as) and/or at least partially extending through the seal 275. For example, as shown in at least FIGS. 36A-36B, each arm 3610 may be an integral part of the seal 275 (e.g., part of a same unitary piece of material as the seal 275) and may each define an opening 3620 extending through the thickness of the seal 275.

In at least one example embodiment, and as shown in at least FIGS. 38A-38C, the contact structure 3512 may be connected to the outer surface 3710 of the flexible rib 3652 via one or more connecting ribs 3802 such that the contact structure 3512 is spaced apart outwardly from the flexible rib 3652, enabling the outer surface 3514 of the contact structure 3512 to be exposed from the outer wall 3502 (and in at least one example embodiment to be flush with the outer surface 3506) while the flexible rib 3652 may be inwardly adjacent from the outer wall 3502 and horizontally obscured from the exterior of the package 100 by the outer wall 3502.

In at least one example embodiment, and as shown in at least FIGS. 38A-38C, the connecting ribs 3802 may enable force(s) applied to the contact structure 3512 (e.g., first force 3742 applied to the outer surface 3514) to be transferred to the flexible member 3650.

Figure 40:
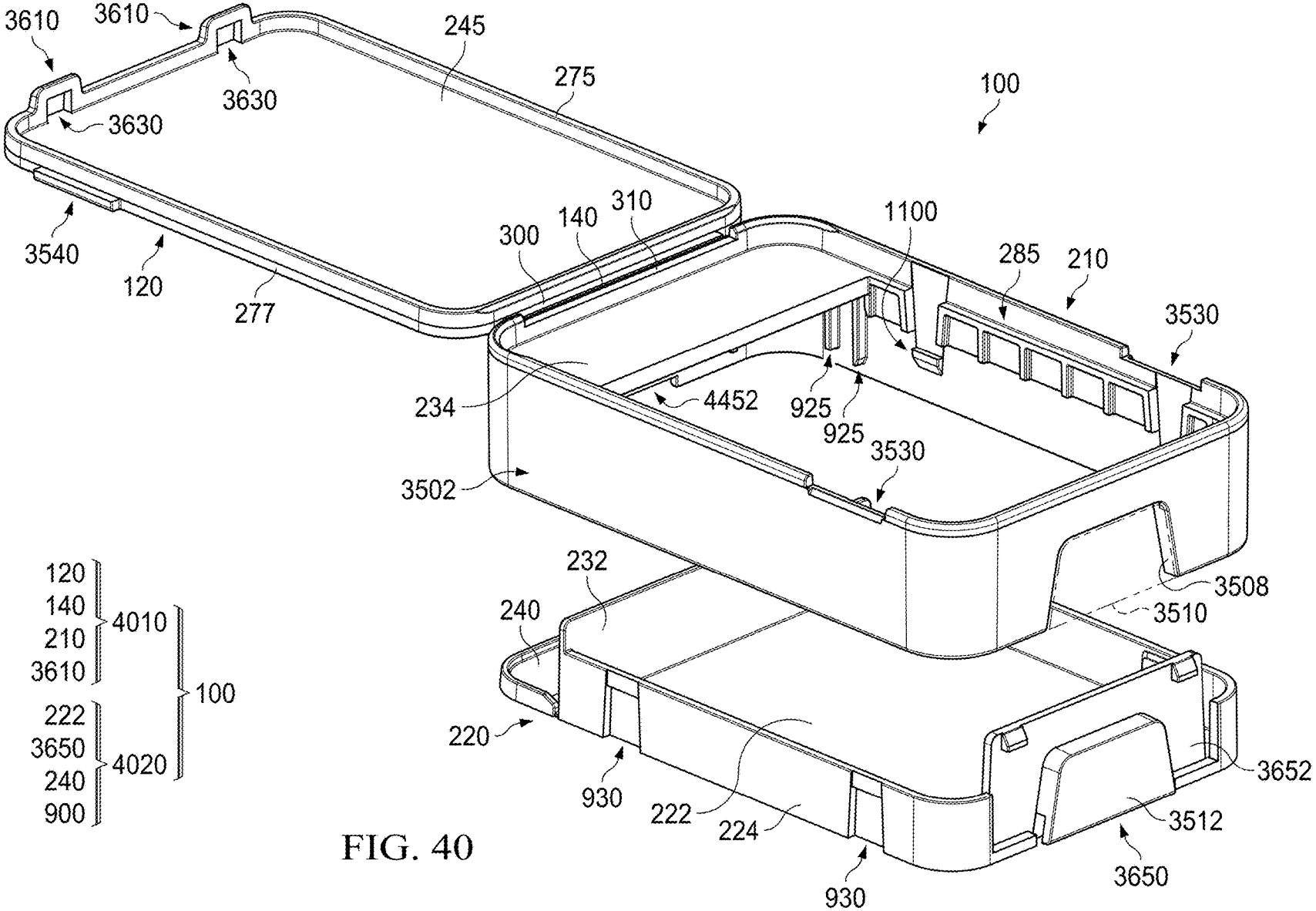
FIG. 40 is an illustration of an exploded view of the package in the open configuration, in accordance with at least one example embodiment.
Figure 41A:
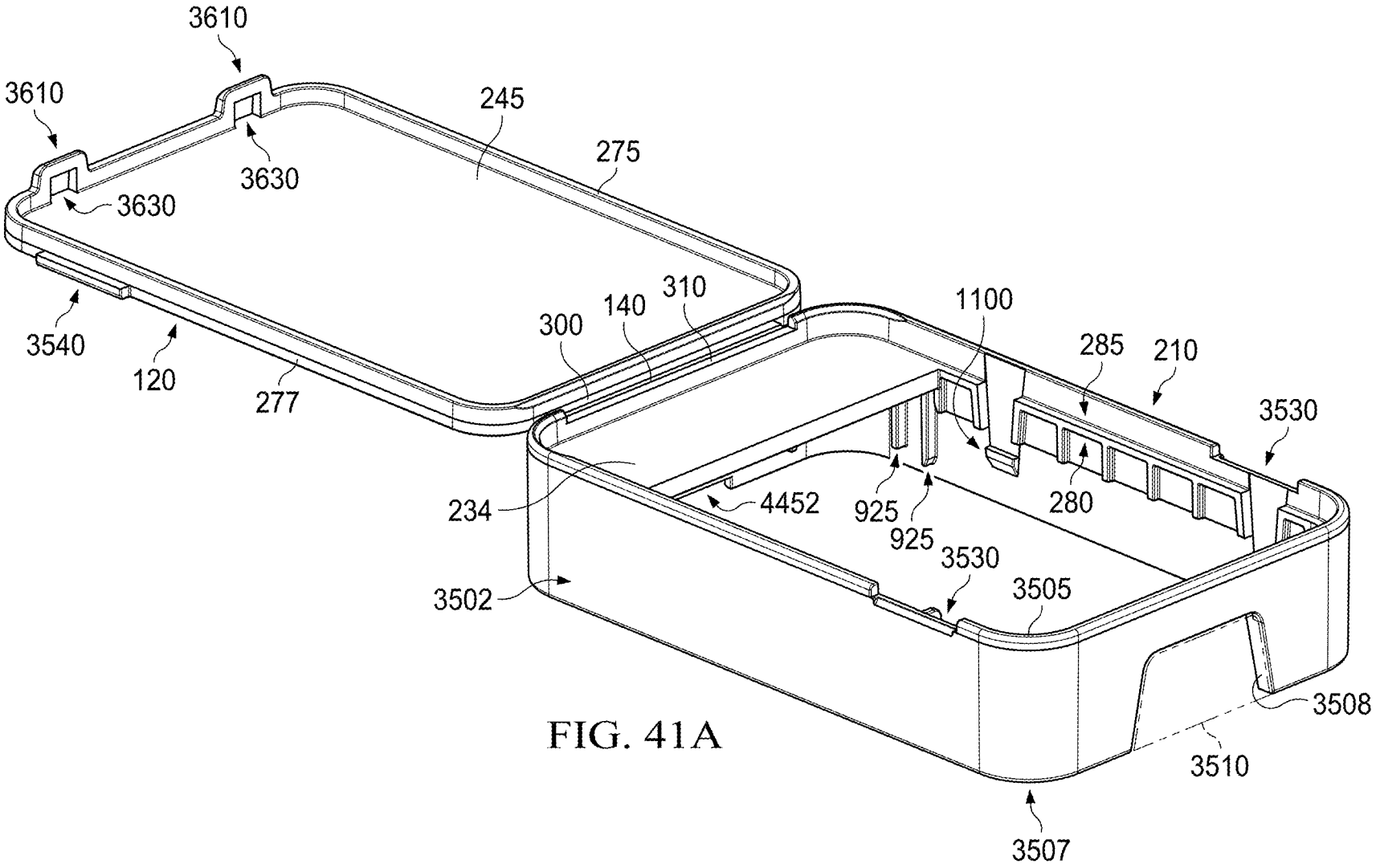
FIGS. 41A and 41B are illustrations of perspective views of a frame and lid of the package, in accordance with at least one example embodiment.
Figure 41B:
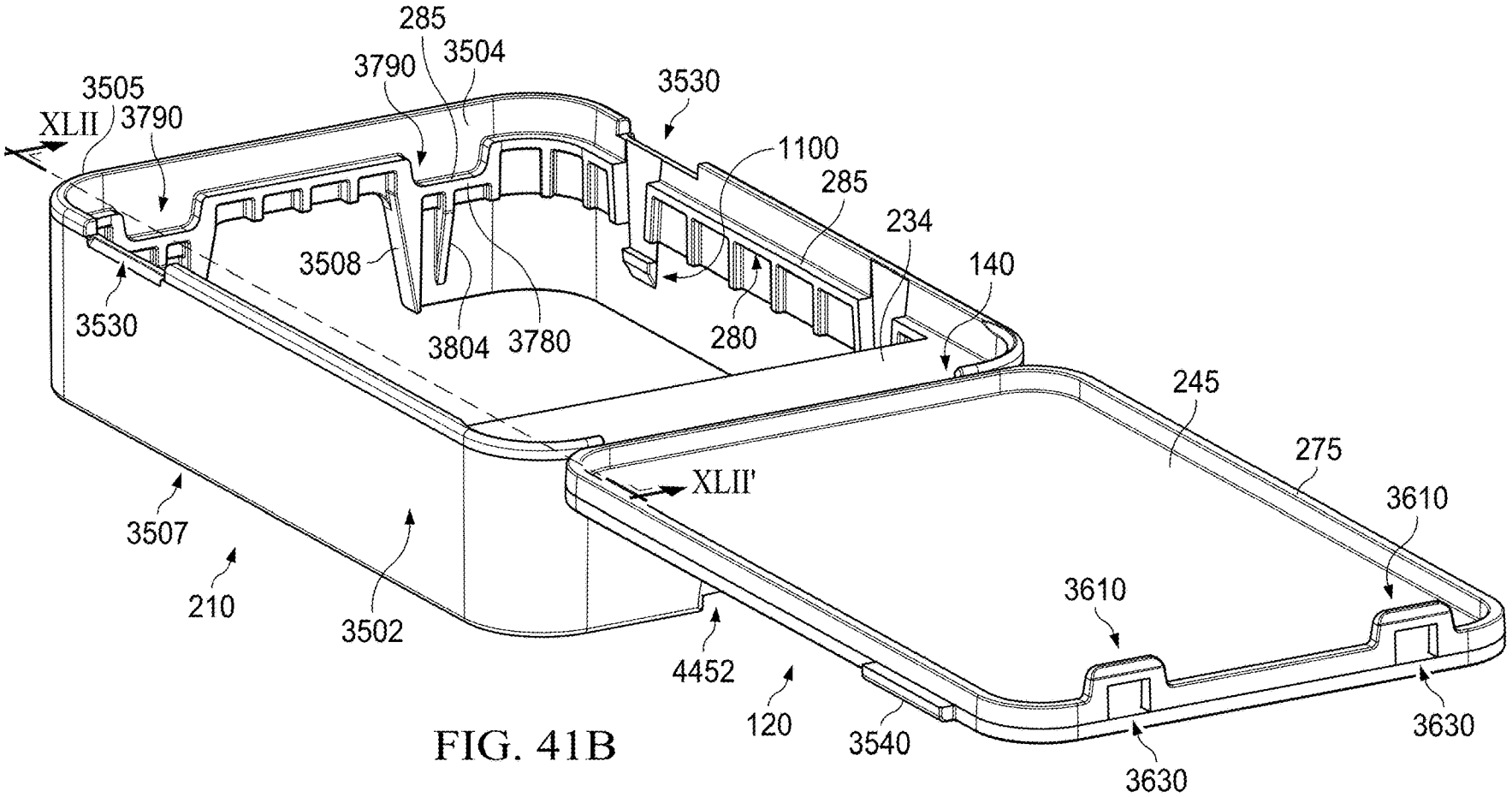
Figure 42:
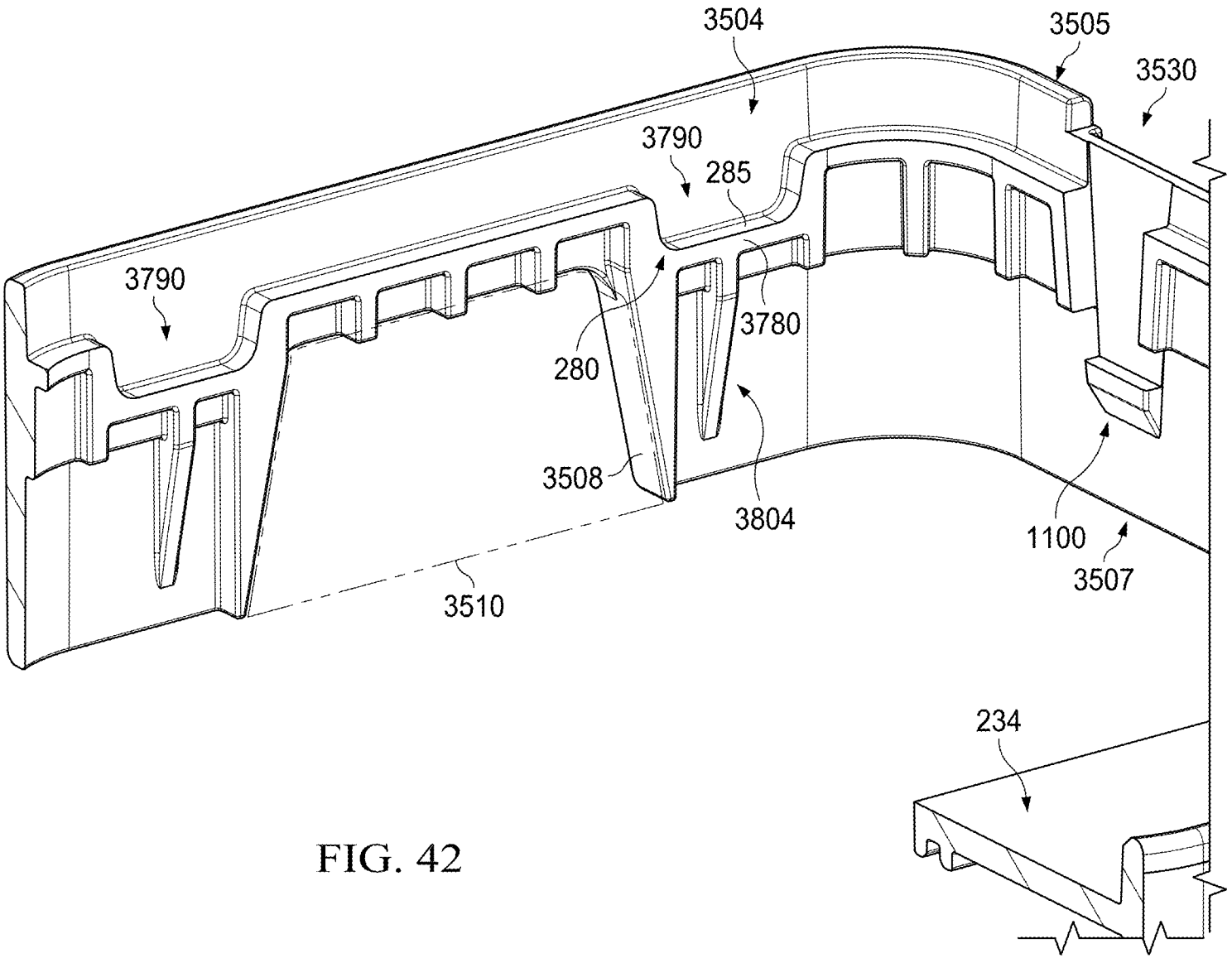
FIG. 42 is an illustration of a close-up perspective cross-sectional view of a portion of a frame along cross-sectional view line XLII-XLII' of FIG. 41B, in accordance with at least one example embodiment.
Figure 43A:
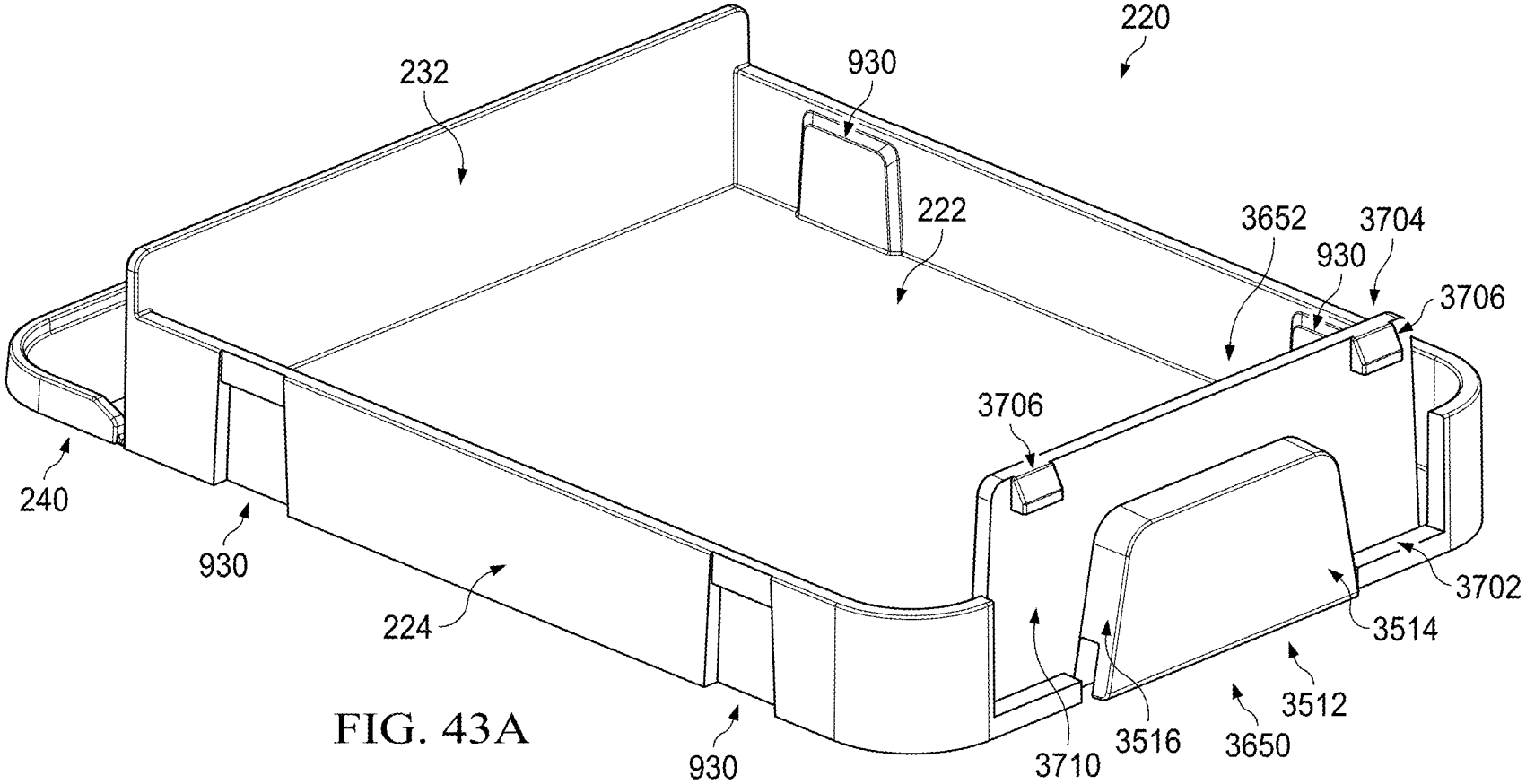
FIGS. 43A and 43B are illustrations of perspective views of an insert of the package, in accordance with at least one example embodiment.
Figure 43B:
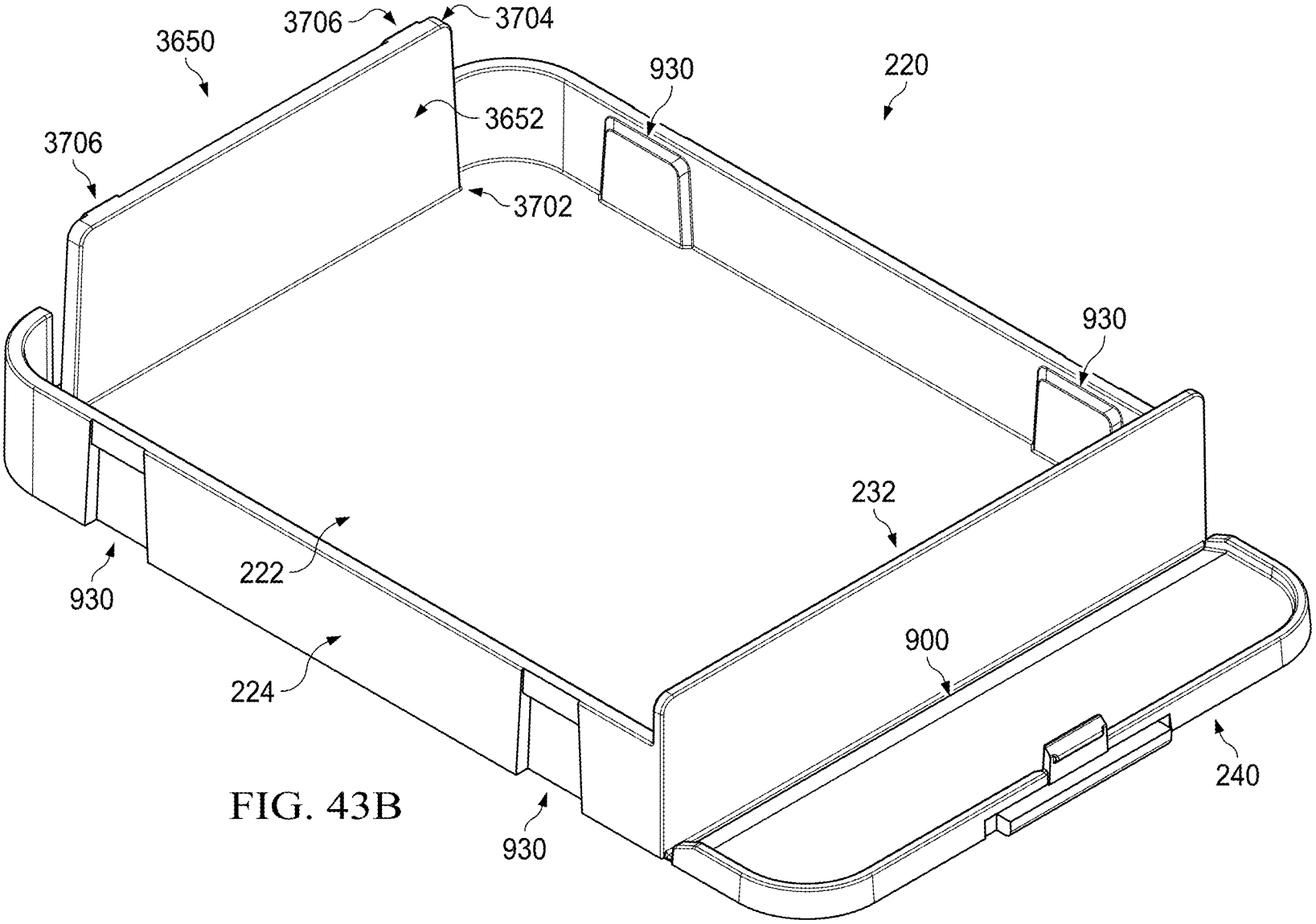

FIG. 40 is an illustration of an exploded view of the package 100 of FIGS. 35A-39B in the open configuration, in accordance with at least one example embodiment. FIGS. 41A and 41B are illustrations of perspective views of a frame 210 and primary lid 120 of the package 100 of FIGS. 35A-40, in accordance with at least one example embodiment. FIG. 42 is an illustration of a close-up perspective cross-sectional view of a portion of a frame 210 of the package 100 of FIGS. 35A-40 along cross-sectional view line XLII-XLII' of FIG. 41B, in accordance with at least one example embodiment. FIGS. 43A and 43B are illustrations of perspective views of an insert 220 of the package 100 of FIGS. 35A-40, in accordance with at least one example embodiment.

In at least one example embodiment, as shown in at least FIGS. 40-43B, the base 130 includes a frame 210 that at least partially defines the outer wall 3502, and the base 130 further includes an insert 220 that includes at least the floor 222. As shown in at least FIGS. 35A-40 and 43A-43B, the flexible member 3650 may be connected to the insert 220. In at least one example embodiment, the flexible member 3650 may be understood to be a part of the insert 220.

In at least one example embodiment, the insert 220 and the frame 210 are configured to be connected to each other independently of the flexible member 3650 (e.g., via interaction between one or more wedges 1100 of the frame 210 and one or more corresponding channels 930 of the insert 220) such that the outer wall 3502 and the floor 222 combine to at least partially define the outer surface of the package 100. In at least one example embodiment the flexible member 3650 may be configured to be isolated from direct contact from the frame 210 during at least a portion of the locking or unlocking operations of the package 100. For example, when the flexible member 3650 is in the flexed position 3754 the flexible member 3650 may not contact an outer surface 3780 of the ledge 280 or the inner edge 3508 of the outer wall 3502 and thus may be isolated from direct contact with the frame 210.

In at least one example embodiment, and as shown in at least FIG. 40, the flexible member 3650 of the locking mechanism 150 and the floor 222 of the base 130 may be separate portions of a unitary piece of material (e.g., a piece of formed material). In at least one example embodiment, and as shown in at least FIG. 40, the frame 210, the hinge 140, the primary lid 120, and the one or more arms 3610 of the locking mechanism 150 are separate portions of a first unitary piece of material 4010. In at least one example embodiment, and as shown in at least FIG. 40, at least the insert 220 and the flexible member 3650 of the locking mechanism 150 are separate portions of a second unitary piece of material 4020. As further shown in FIG. 40, in at least one example embodiment the secondary lid 240 and hinge 900 are further separate portions of the second unitary piece of material 4020. Each of the first and second unitary pieces of material 4010 and 4020 may be composed of any of the materials described herein, including being composed of same or different materials. The first and second unitary pieces of material 4010 and 4020 may be coupled together (e.g., based on engaging wedges 1100 of the frame 210 with the channels 930 of the insert 220) to form the package 100. Thus, the package 100 may be a two-piece package that includes two separate unitary pieces of material that may be formed separately according to any process described herein and coupled together.

In at least one example embodiment, the wedge 1100 of the frame 210 (which may be a portion of the first unitary piece of material 4010) mates with the channel 930 of the insert 220 (which may be a portion of the second unitary piece of material 4020), and is retained in the channel 930 due to a friction fit between the wedge 1100 and the channel 930. In at least one example embodiment, glue, and adhesive, or structure is used in lieu of a friction fit, or in combination with a friction fit, to retain the wedge 1100 within the channel 930 (and thus to couple the first and second unitary pieces of material 4010 and 4020 together to form the package 100).

In at least one example embodiment, some or all of the first unitary piece of material 4010 and/or the second unitary piece of material 4020 may include one or more polymers. In at least one example embodiment, the some or all of the first unitary piece of material 4010 and/or the second unitary piece of material 4020 may include one or more homopolymers, one or more copolymers, or any combination of one or more homopolymers and copolymers. In at least some example embodiments, the one or more polymers include a thermoplastic polymer. In at least some example embodiments, the polymer includes polyethylene terephthalate (PET), polypropylene (PP), a polyethylene (PE), or any combination thereof.

In at least one example embodiment, and as shown in at least FIGS. 40-43B the secondary storage area 230 is defined at least in part by an end wall 232 and an upper wall 234, where the end wall 232 is a portion of the insert 220 and the upper wall 234 is a portion of the frame 210. The end wall 232 and the upper wall 234 have respective free ends that are opposite from respective fixed ends of the end wall 232 and upper wall 234, where the respective fixed ends of the end wall 232 and upper wall 234 are connected to respective ones of the insert 220 or frame 210. In at least one example embodiment, end wall 232 and the upper wall 234 are coupled together at their respective free ends, as shown in at least FIG. 46, when the frame 210 and the insert 220 are coupled together.

Figure 44A:
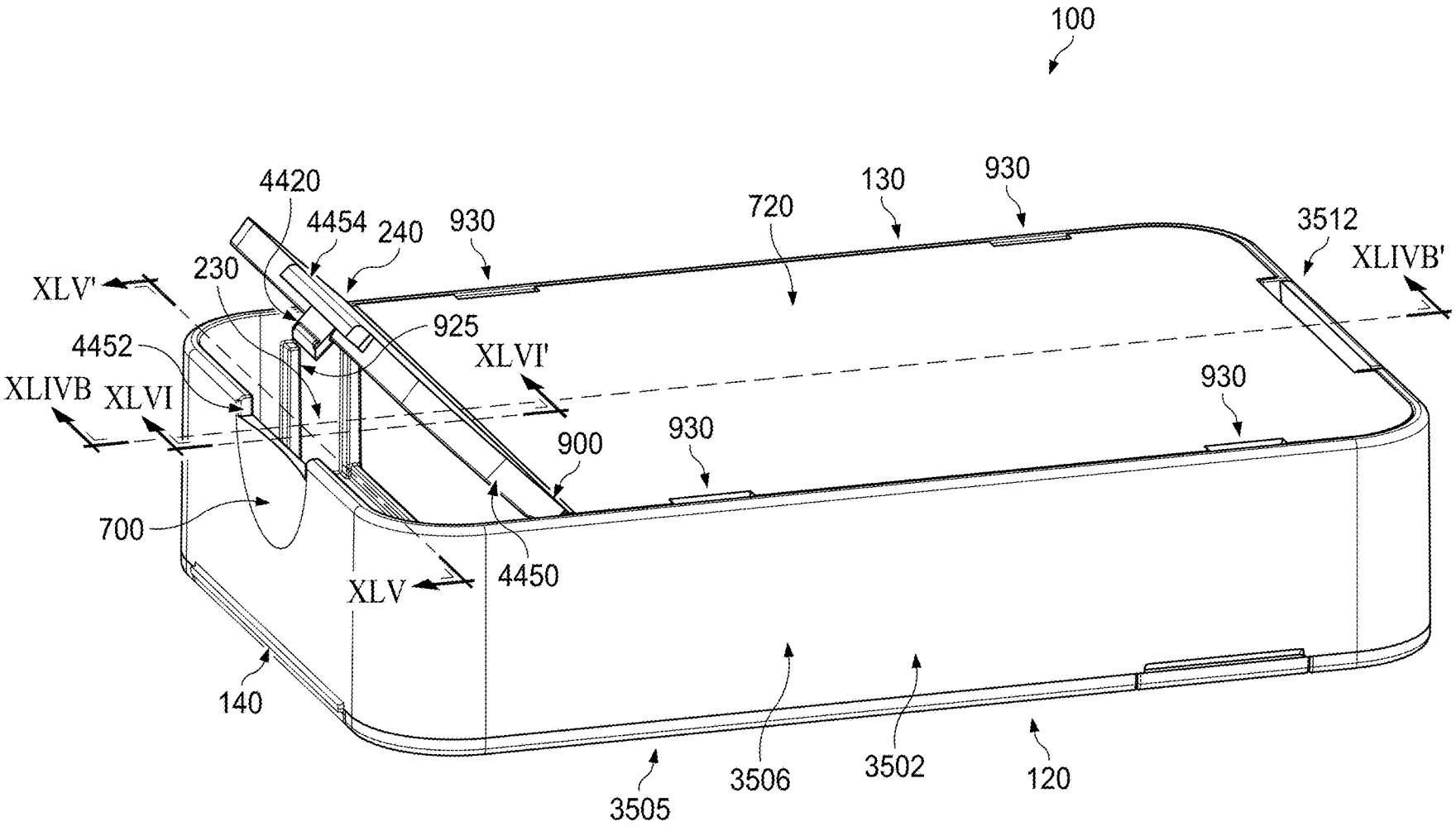
FIG. 44A is an illustration of a perspective view of the package with the secondary lid in an open position in accordance with at least one example embodiment.
Figure 44B:
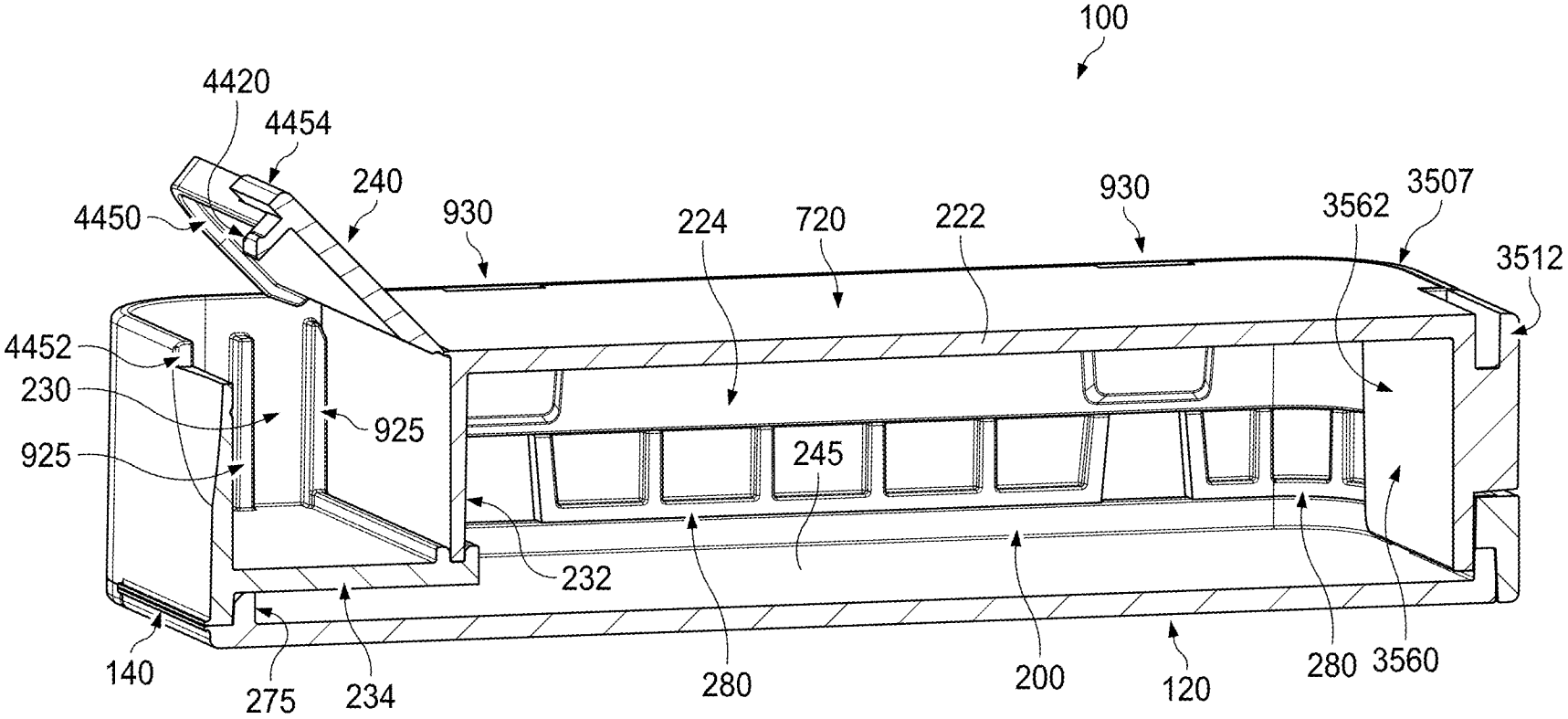
FIG. 44B is an illustration of a perspective cross-sectional view of the package along cross-sectional view line XLIVB-XLIVB' of FIG. 44A, in accordance with at least one example embodiment.
Figure 45:
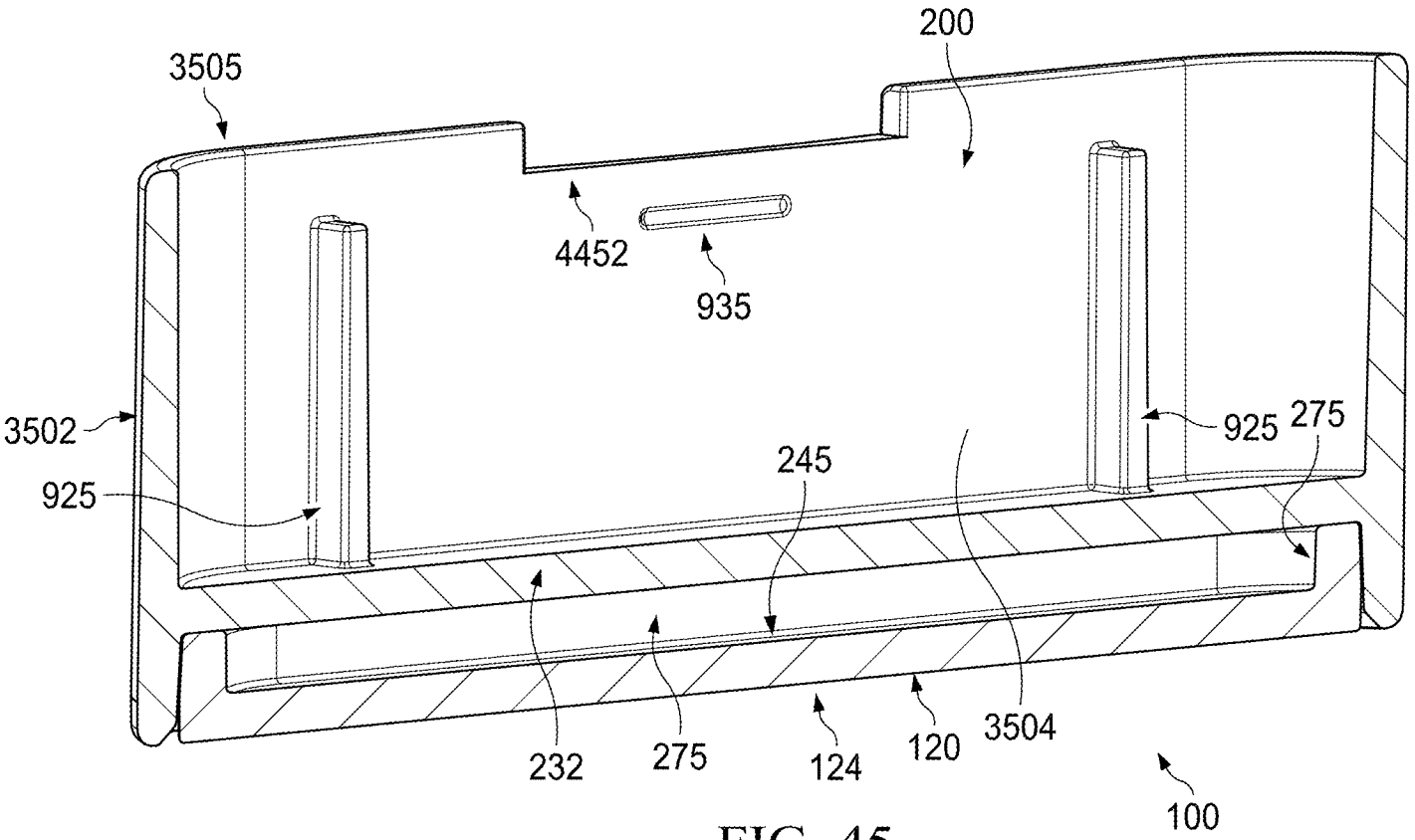
FIG. 45 is an illustration of a close-up perspective cross-sectional view of a portion of the package along cross-sectional view line XLV-XLV' of FIG. 44A, in accordance with at least one example embodiment.
Figure 46:
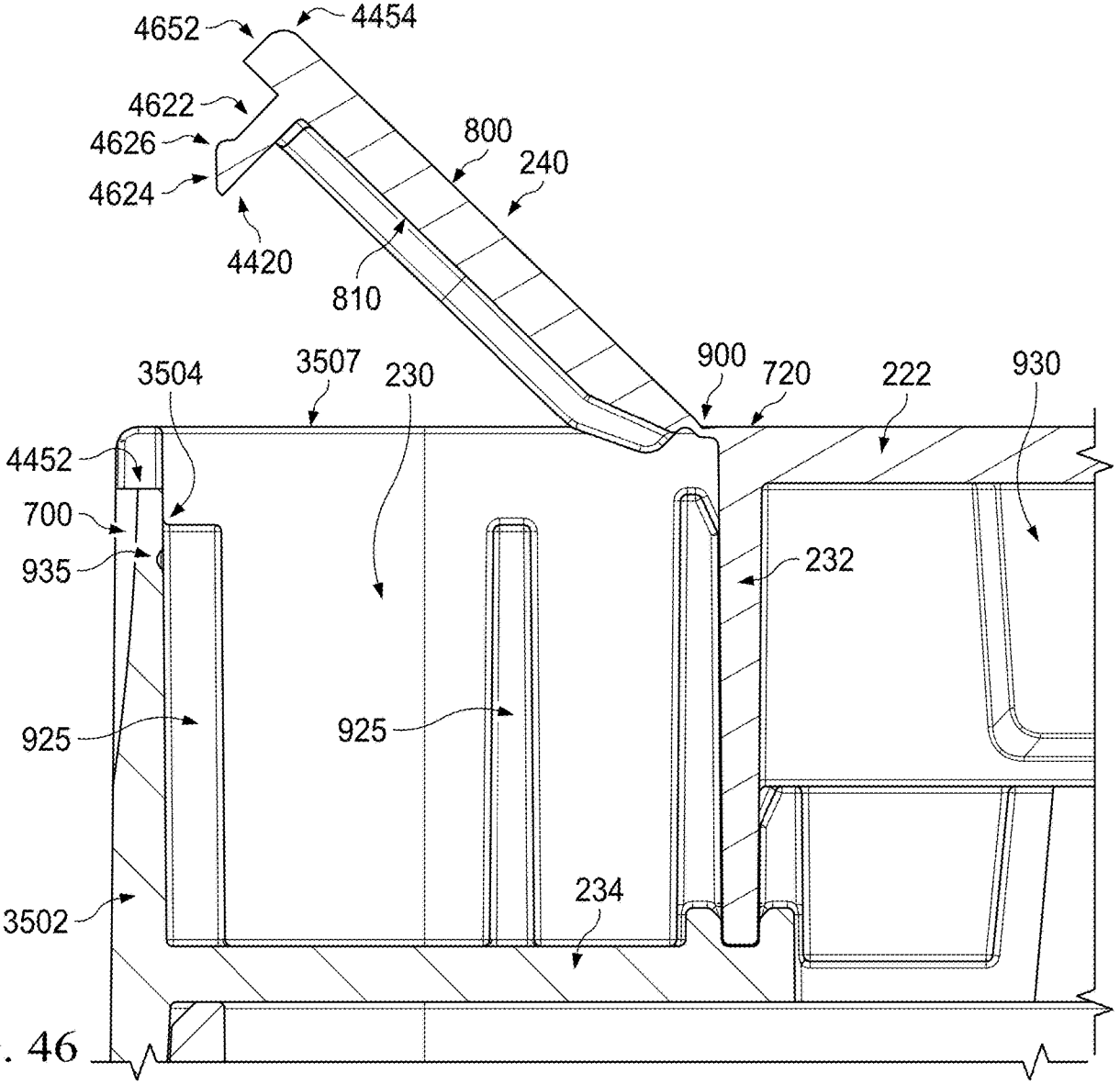
FIG. 46 is an illustration of a side cross-sectional view of a portion of the package along cross-sectional view line XLVI-XLVI' of FIG. 44A, in accordance with at least one example embodiment.
Figure 47:
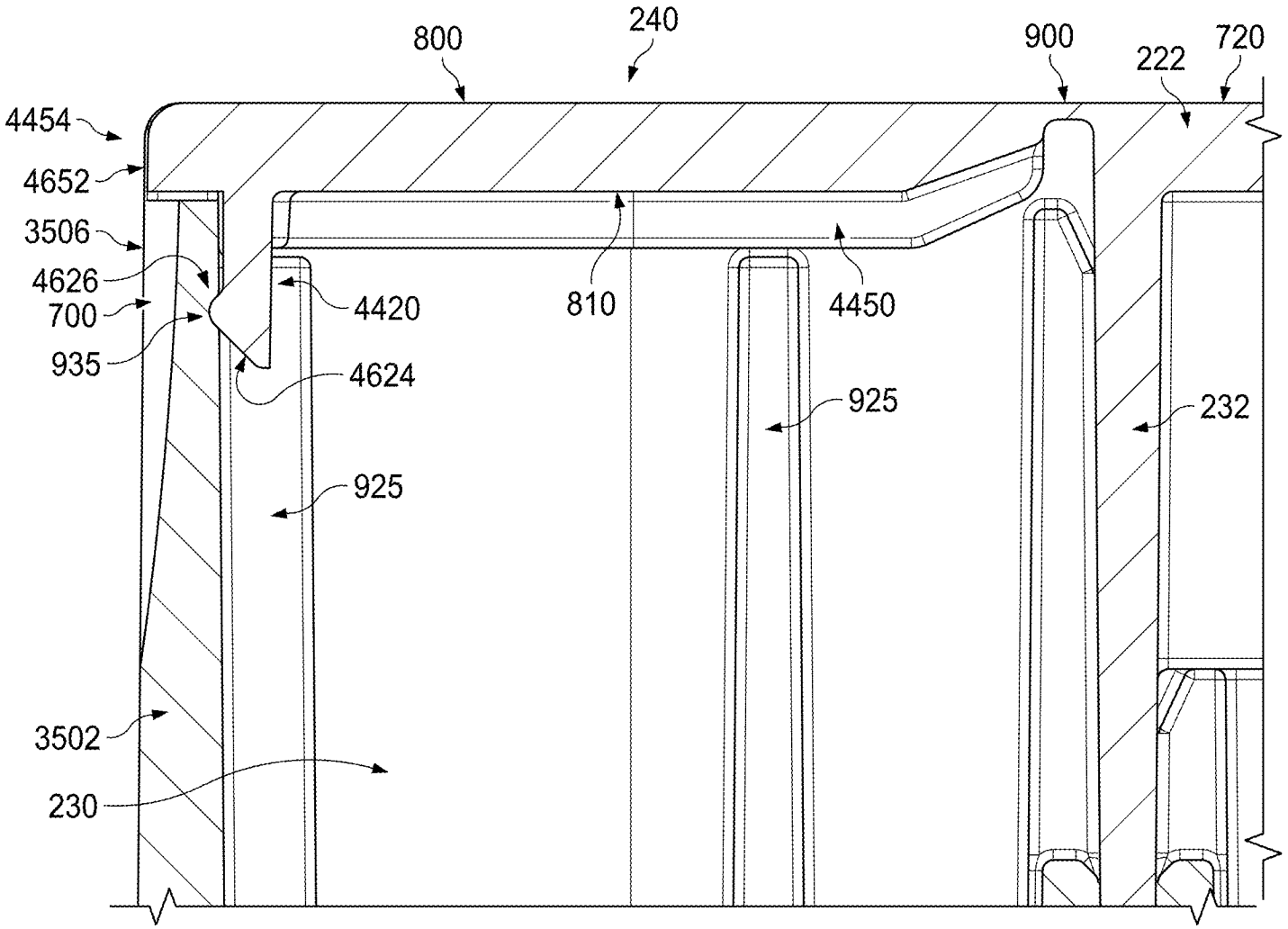
FIG. 47 is an illustration of a side cross-sectional view of a portion of the package along cross-sectional view line XLVII-XLVII' of FIG. 35B, in accordance with at least one example embodiment.

FIG. 44A is an illustration of a perspective view of the package 100 of FIGS. 35A-40 with the secondary lid 240 in an open position in accordance with at least one example embodiment. FIG. 44B is an illustration of a perspective cross-sectional view of the package 100 of FIGS. 35A-40 and 44A along cross-sectional view line XLIVB-XLIVB' of FIG. 44A, in accordance with at least one example embodiment. FIG. 45 is an illustration of a close-up perspective cross-sectional view of a portion of the package of FIGS. 35A-40 and 44A-44B along cross-sectional view line XLV-XLV' of FIG. 44A, in accordance with at least one example embodiment. FIG. 46 is an illustration of a side cross-sectional view of a portion of the package 100 of FIGS. 35A-40 and 44A-45 along cross-sectional view line XLVI-XLVI' of FIG. 44A, in accordance with at least one example embodiment. FIG. 47 is an illustration of a side cross-sectional view of a portion of the package 100 of FIGS. 35A-40 and 44A-46 along cross-sectional view line XLVII-XLVII' of FIG. 35B, in accordance with at least one example embodiment.

In at least one example embodiment, and as shown in at least FIGS. 44A-47, the package 100 includes a secondary lid 240 connected to the floor 222 of the base 130 via a separate hinge 900. In at least one example embodiment, the secondary lid 240 may be configured to move between open and closed positions in relation to the base 130, and the secondary lid 240 and the base 130 may collectively define a secondary storage area 230 when the secondary lid 240 is in a closed position.

In at least one example embodiment, and as shown in at least FIGS. 44A-47, the secondary lid 240 may include a contact structure 4454 (e.g., a tab) that protrudes from a distal edge of the secondary lid 240 that is opposite to an edge connected to the hinge 900. The contact structure 4454 may facilitate contact with and manipulation of the secondary lid 240 (e.g., application of force thereto) to facilitate opening and/or closing of the secondary lid 240.

In at least one example embodiment, and as shown in at least FIGS. 44A-47, the outer wall 3502 may define a notch 4452 extending from the lower surface 3507 of the outer wall 3502 and configured to mate with the contact structure 4454 when the secondary lid 240 is in a closed position, for example to enable an outer surface 800 of the secondary lid 240 to be flush with the exterior surface 720 while horizontally exposing an outer surface 4652 of the contact structure 4454 to an exterior of the package 100 to enable contact with and manipulation of the secondary lid 240, while a remainder of at least the distal edge of the secondary lid 240 may be horizontally obscured from the exterior of the package 100 by the outer wall 3502 when the secondary lid 240 is in the closed position.

In at least one example embodiment, and as shown in at least FIGS. 44A-47, the secondary lid 240 may include at least one catch 4420. In at least one example embodiment, the catch 4420 extends from the secondary lid 240. In at least one example embodiment, the catch 4420 is a beak shaped catch (beak catch), that includes a projection or protrusion with a beak shape and/or rounded shape on an end of the projection. In at least one example embodiment, the beak shape and/or rounded shape faces toward the exterior 3599 of the package 100 when the secondary lid 240 is in a closed position (closed configuration). The at least one catch 4420 has a first surface 4622 and a second surface 4624 facing away from the hinge 900, and a projection 4626 between the first and second surfaces 4622 and 4624.

In at least one example embodiment, and as shown in at least FIGS. 45-47, at least one slot 935 is defined in a portion of the inner surface 3504 of the outer wall 3502 that at least partially defines an inner sidewall of the secondary storage area 230. In at least one example embodiment, and as shown in at least FIG. 47, the projection 4626 of the at least one catch 4420 is retained within the slot 935 when the secondary lid 240 is in a closed position, to lock the secondary lid 240 in the closed position on the base 130.

In an example embodiment, the second surface 4624 is substantially inclined, and the first surface 4622 is substantially vertical in relation to the inner surface 810 of the secondary lid 240. In at least one example embodiment, the second surface 4624 is substantially inclined so as to allow the at least one catch 4420 to slide across the inner surface 3504 of the outer wall 3502, prior to the projection 4626 being retained in the slot 935.

In at least one example embodiment, the at least one catch 4420 comprises a resilient material and is configured to flex inwards, from a relaxed position to a flexed position, in response to contact between the projection 4626 and/or the second surface 4624 with the inner surface 3504.

In at least one example embodiment, and as shown in at least FIGS. 44A-47, the projection 4626 has a rounded shape that is rounded in the direction that is perpendicular to the inner surface 810 of the secondary lid 240 and which faces away from the primary storage area 200 and towards the exterior 3599 of the package 100 when the secondary lid 240 is in the closed position, so that the projection 4626 may horizontally exit the slot 935 based on sliding vertical movement of the projection 4626 away from the end wall 135 when the distal edge of the secondary lid 240 is lifted away from the base 130.

In at least one example embodiment, the at least one catch 4420 may be formed of a resilient material, which may be the same material as the remainder of the secondary lid 240, so that when a force is applied to the contact structure 4454 to move the distal edge of the secondary lid 240 away from the base 130, the at least one catch 4420 may be horizontally deflected by the rounded projection 4626 to flex inwards from a relaxed position to a flexed position by a sufficient horizontal distance to disengage the rounded projection 4626 from the slot 935 as the at least one catch 4420 moves vertically out of the secondary storage area 230, to unlock the secondary lid 240 from the base 130. The at least one catch 4420 may retain the flexed position while the distal edge of the secondary lid 240 is being lifted away from the base 130, due to continued contact between the projection 4626 and/or the second surface 4624 with the inner surface 3504 at least partially defining the secondary storage area 230. The at least one catch 4420 may return to the relaxed position in response to the at least one catch 4420 disengaging contact from the inner surface 3504 once the distal edge of the secondary lid 240 is lifted clear of the base 130.

In at least one example embodiment, when the secondary lid 240 is moved to the closed position, the at least one catch 4420 may be deflected by the inner surface 3504 at least partially defining the secondary storage area to flex inwards due to contact between the projection 4626 and/or second surface 4624 with the inner surface 3504, the at least one catch 4420 may retain the flexed position while the distal edge of the secondary lid 240 is being lowered toward the base 130, due to continued contact between the projection 4626 and/or second surface 4624 with the inner surface 3504 at least partially defining the secondary storage area 230. The at least one catch 4420 may return to the relaxed position in response to the projection 4626 and engaging with, and being retained in, the slot 935, to lock the secondary lid 240 to the base 130.

In at least one example embodiment, and as shown in at least FIGS. 35B and 47, the contact structure 4454 has an outer surface 4652 that is configured to lie flush with at least horizontally adjacent portions of the outer surface 3506 of the outer wall 3502 when the secondary lid 240 is in the closed position In at least one example embodiment, the groove 700 is formed in an outer surface 3506 of the portion of the outer wall 3502 opposite the at least one slot 935 and vertically adjacent to the notch 4452. The groove 700 allows a consumer to insert their finger and grasp at least a portion of the contact structure 4454 of the secondary lid 240 when opening the secondary storage area 230. The consumer may then more easily apply a force to the secondary lid 240 via the grasped contact structure 4454 to move the distal edge of the secondary lid vertically.

In at least one example embodiment, the secondary lid 240 includes a seal 4450 that projects from the inner surface 810 of the secondary lid 240 and extends substantially around a perimeter of the secondary lid 240. The seal 4450 may be inset from an edge of the secondary lid 240.

In at least one example embodiment, a block 925 is included on either end of an interior of the secondary storage area 230. In at least one example embodiment, each of the blocks 925 help support the secondary lid 240 so as to ensure the secondary lid 240 does not inadvertently get stuck within the secondary storage area 230 and/or damage the hinge 900. In at least one example embodiment, the seal 4450 of the secondary lid 240 makes contact and rests on the blocks 825 so as to create an effective seal between the secondary lid 240 and the base 130 once the secondary lid 240 is in the closed position.

In at least one example embodiment, the package may include features of other example embodiments described herein and/or other example embodiments may include features of the package as described above.

Fourth Example Embodiment

Figure 48:
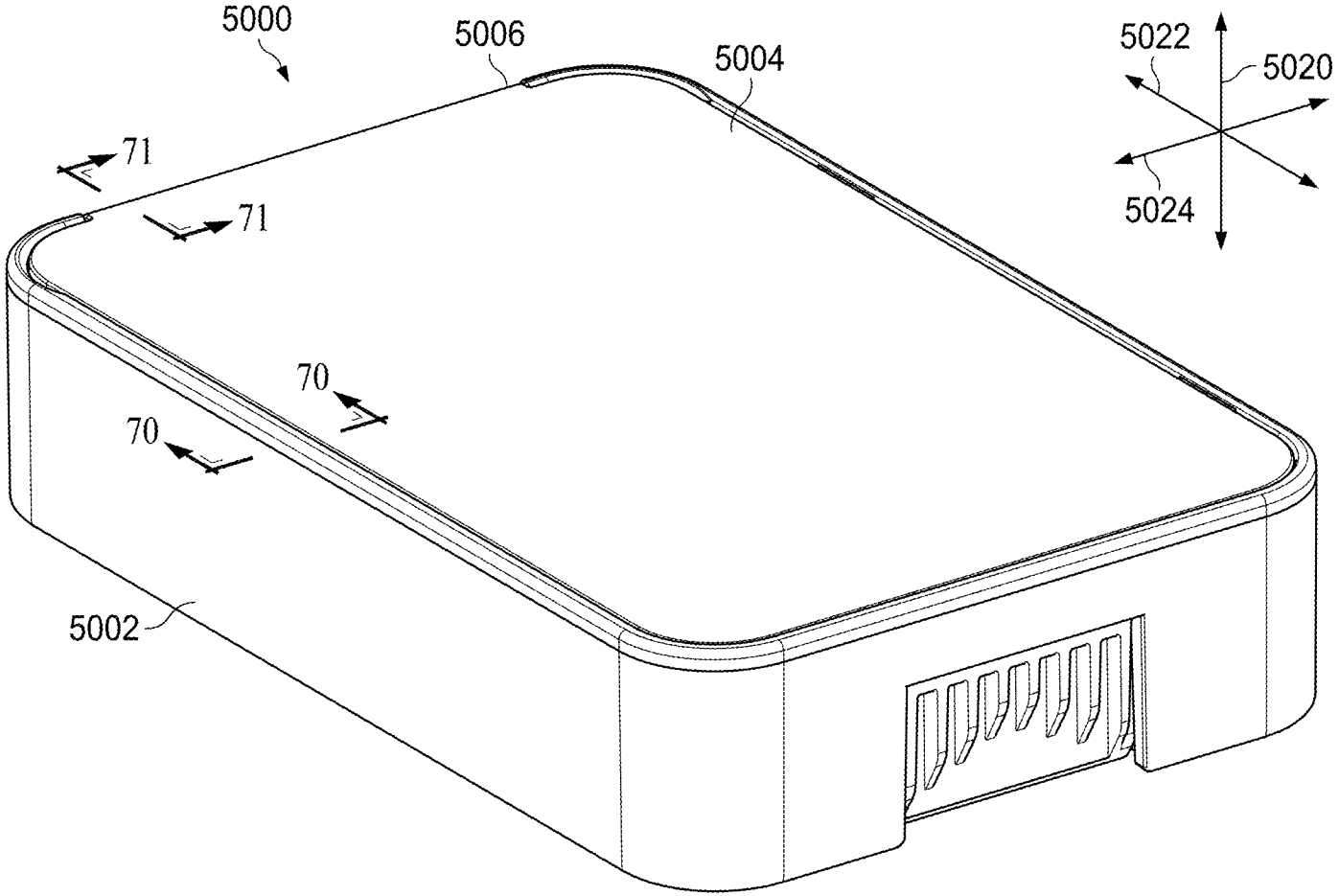
FIG. 48 is a top front perspective view of a container in a closed and locked configuration in accordance with at least one example embodiment.

FIG. 48 is a top front perspective view of a container in a closed configuration in accordance with at least one example embodiment.

In at least one example embodiment, as shown in FIG. 48, a container or package 5000 is provided. The container 5000 may be the same as the package 100 of FIGS. 1-13 except as described below. The container 5000 includes a base 5002 and a lid or primary lid 5004. The base 5002 and the lid 5004 may be coupled to one another. The base 5002 and the lid 5004 may be pivotally connected. In at least one example embodiment, the base 5002 and the lid 5004 are coupled by a hinge. The hinge may be a living hinge 5006. The container 5000 is movable between a closed and locked configuration or position, as shown, and an open configuration (see FIG. 49). In at least one example embodiment, the container 5000 moves or articulates through a closed and unlocked configuration or position between the closed and locked configuration and the open configuration.

The container 5000 may define an orthogonal coordinate system. The orthogonal coordinate system may include a first axis, a second axis, and a third axis. In at least one example embodiment, the first axis is a vertical axis 5020, the second axis is a longitudinal axis 5022, and the third axis is a transverse axis 5024. It will be recognized that this applies to all other example embodiments set forth in this disclosure.

Figure 49:
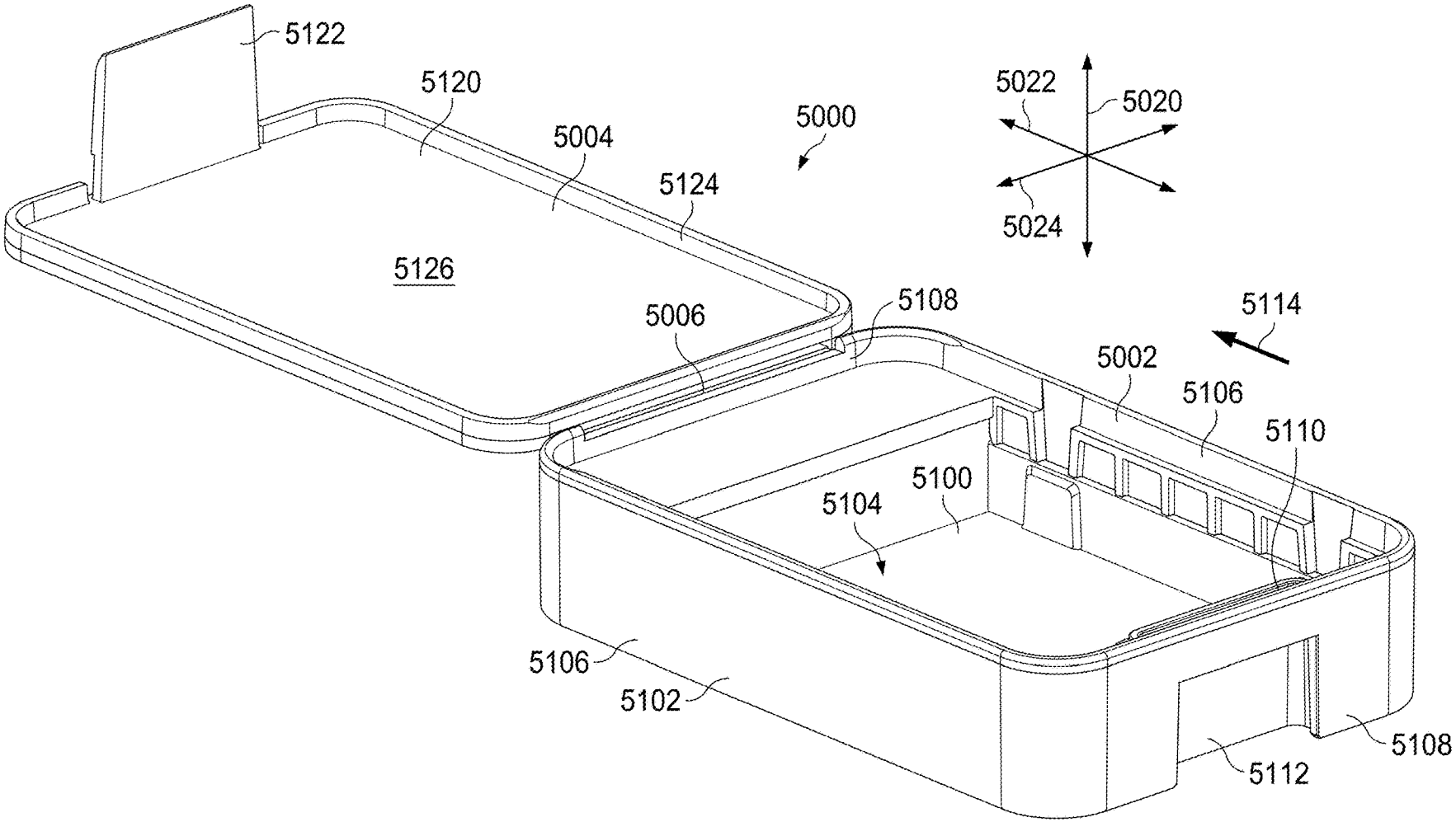
FIG. 49 is a top front perspective view of the container of FIG. 48 in an open configuration in accordance with at least one example embodiment.

FIG. 49 is a top front perspective view of the container of FIG. 48 in an open configuration in accordance with at least one example embodiment.

Figure 50:
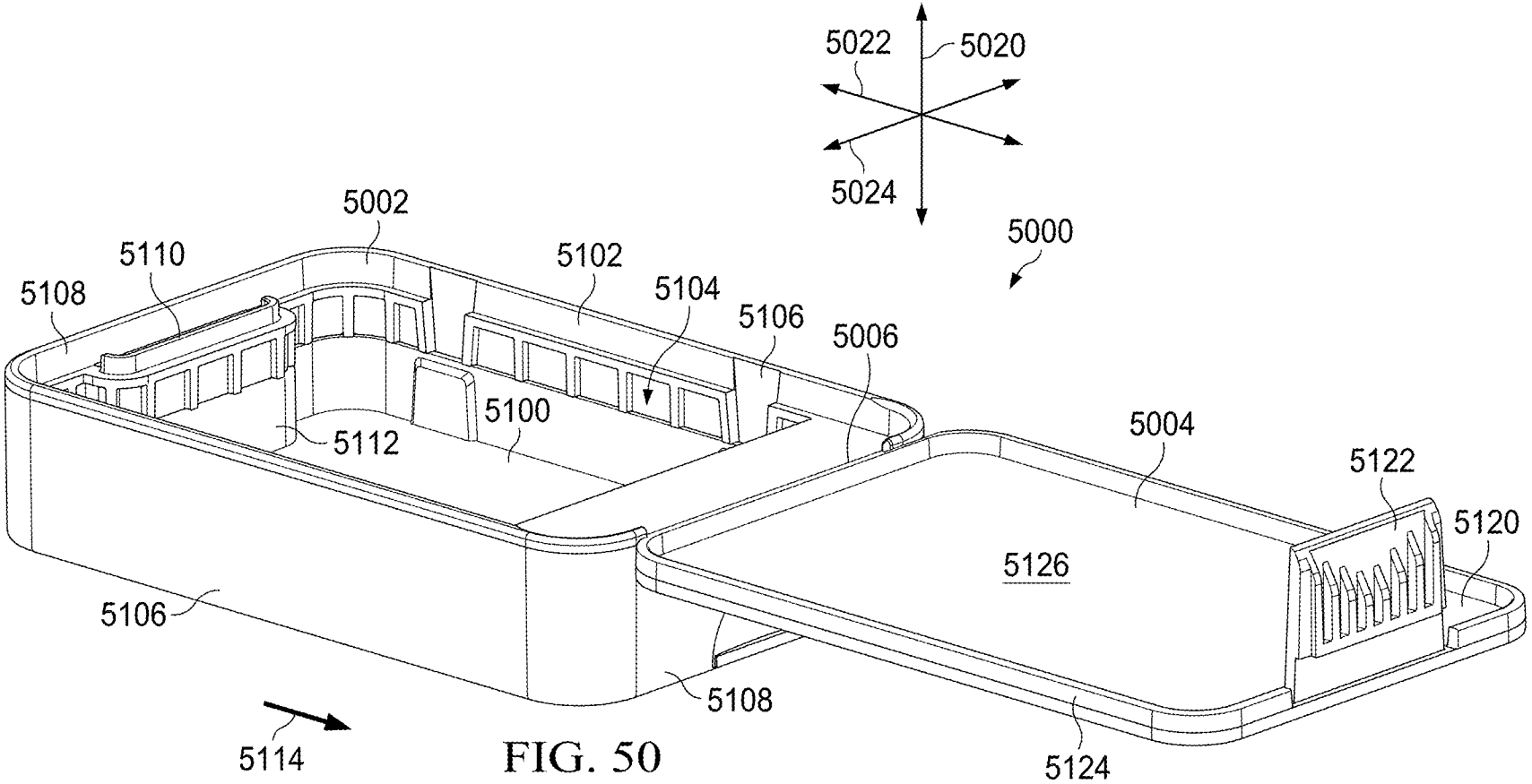
FIG. 50 is a top back perspective view of the container of FIG. 48 in the open configuration in accordance with at least one example embodiment.

FIG. 50 is a top back perspective view of the container of FIG. 48 in the open configuration in accordance with at least one example embodiment.

In at least one example embodiment, as shown in FIGS. 49-50, the base 5002 includes a bottom wall or floor 5100 and a peripheral or outer wall 5102. The base 5002 and the peripheral wall 5102 cooperate to at least partially define a storage area or primary storage area 5104. In the closed and locked configuration (shown in FIG. 48), the lid 5004 prevents and/or reduces access to the storage area 5104. In the open configuration, the storage area 5104 is accessible.

In at least one example embodiment, the peripheral wall 5102 includes a pair of opposing side walls 5106 and a pair of opposing end walls 5108. Each of the side walls 5106 may define a first length substantially parallel to the longitudinal axis 5022. Each of the end walls 5108 may define a second length substantially parallel to the transverse axis 5024. In at least one example embodiment, the container 5000 defines a substantially rectangular profile such that the second length is shorter than the first length.

In at least one example embodiment, the peripheral wall 5102 at least partially defines a receptacle 5110. In at least one example embodiment, one of the end walls 5108 at least partially defines the receptacle 5110. In at least one example embodiment, the receptacle 5110 is an aperture.

In at least one example embodiment, the base 5002 further includes a receptacle wall 5112. The receptacle wall 5112 may be spaced from the peripheral wall 5102 along the longitudinal axis 5022. In at least one example embodiment, the receptacle wall 5112 is spaced from the peripheral wall 5102 in a first direction 5114 substantially parallel to the longitudinal axis 5022. The receptacle wall 5112 may be closer to the storage area 5104 than the peripheral wall 5102. In other example embodiments, a peripheral wall may be spaced from a receptacle wall in the first direction 5114.

The receptacle wall 5112 may be coupled to or integrally formed with the peripheral wall 5102. The receptacle wall 5112 may cooperate with the peripheral wall 5102 to define the receptacle 5110. In at least one example embodiment, the receptacle wall 5112 is coupled to or integrally formed with one of the end walls 5108. In at least one example embodiment, the receptacle wall 5112 is centered on the end wall 5108 along the transverse axis 5024. The receptacle 5110 is described in greater detail below in connection with FIGS. 51-52.

In at least one example embodiment, the lid 5004 includes a top wall 5120 and a flexible structure or tab 5122. The flexible tab (or flexible member) 5122 projects form the top wall 5120. The flexible tab 5122 is configured to be received in the receptacle 5110, as will be described in greater detail below. The flexible tab 5122 and the receptacle 5110 may be collectively referred to as a locking mechanism.

In at least one example embodiment, the lid 5004 further includes a skirt 5124. The skirt projects from the top wall 5120. The skirt 5124 extends around at least a portion of a periphery of an interior or inner surface 5126 of the top wall 5120.

Figure 51:
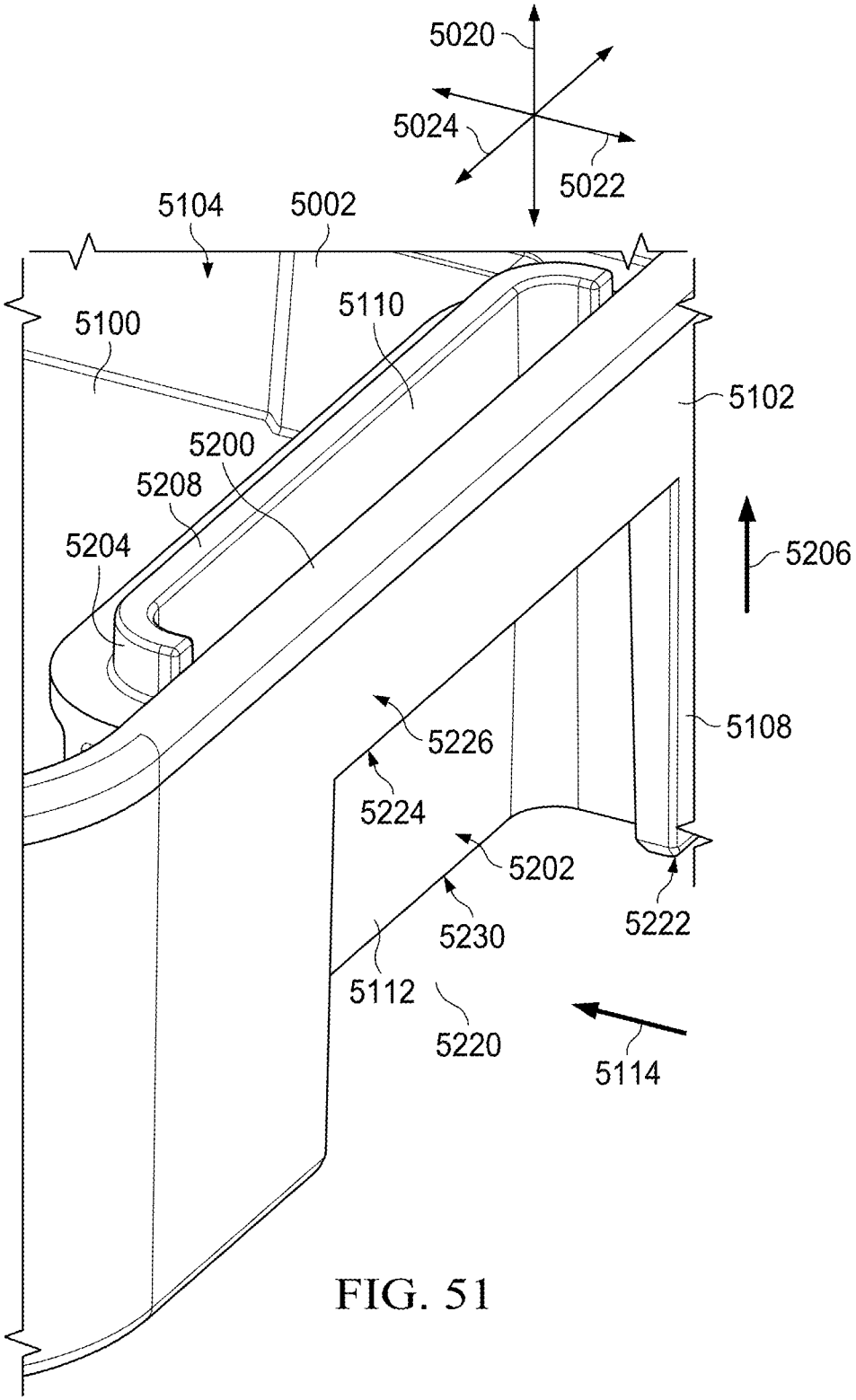
FIG. 51 is a partial top front perspective view of a base of the container of FIG. 48 including a receptacle in accordance with at least one example embodiment.

FIG. 51 is a partial top perspective view of base of the container of FIG. 48 including a receptacle in accordance with at least one example embodiment.

In at least one example embodiment, the receptacle wall 5112 is substantially U-shaped. The receptacle wall 5112 may project into the storage area 5104 from the peripheral wall. In at least one example embodiment, the receptacle wall 5112 includes a main portion 5202 and a ledge 5204. The ledge 5204 may project in a second direction 5206 from the main portion 5202. The second direction 5206 may be substantially parallel to the vertical axis 5020 (shown in FIGS. 49-50). The second direction 5206 may be an upward direction. The second direction 5206 may be substantially perpendicular to the first direction 5114.

In at least one example embodiment, the receptacle wall 5112 is recessed with respect to an upper surface 5200 of the peripheral wall 5102, as shown. For example, an upper surface 5208 of the ledge 5204 may be recessed with respect to the upper surface 5200 of the peripheral wall 5102. In at least one example embodiment, the receptacle wall 5112 may be recessed by about a thickness of the lid 5004 (as shown in FIG. 48) so that the lid 5004 is flush with the upper surface 5200 of the peripheral wall 5102 when the lid 5004 is in the closed configuration (locked or unlocked). In other example embodiments, the upper surface 5208 of the ledge 5204 may be coplanar or flush with the upper surface 5200 of the peripheral wall 5102.

In at least one example embodiment, the peripheral wall 5102 defines a recess 5220. The recess 5220 may be in fluid communication with the receptacle 5110. The recess 5220 may extend between a lower surface 5222 of the peripheral wall 5102 and an intermediate surface 5224 of the peripheral wall 5102. The recess 5220 may provide access to the flexible tab 5122 (shown in FIGS. 49-50) when the lid 5004 (shown in FIG. 48) is in the closed configuration (locked or unlocked), as will be described in greater detail below.

In at least one example embodiment, the peripheral wall 5102 includes a bridge portion 5226 adjacent to the recess 5220. The bridge portion 5226 includes the intermediate surface 5224. The bridge portion 5226 may extend continuously across the receptacle 5110 parallel to the transverse axis 5024.

In at least one example embodiment, a lower surface 5230 of the receptacle wall 5112 is substantially flush or coplanar with the lower surface 5222 of the peripheral wall 5102. In other example embodiments, the receptacle wall 5112 may be recessed with respect to the lower surface 5222 of the peripheral wall 5102. In at least one example embodiment, the recess 5220 has a substantially rectangular profile.

Figure 52:
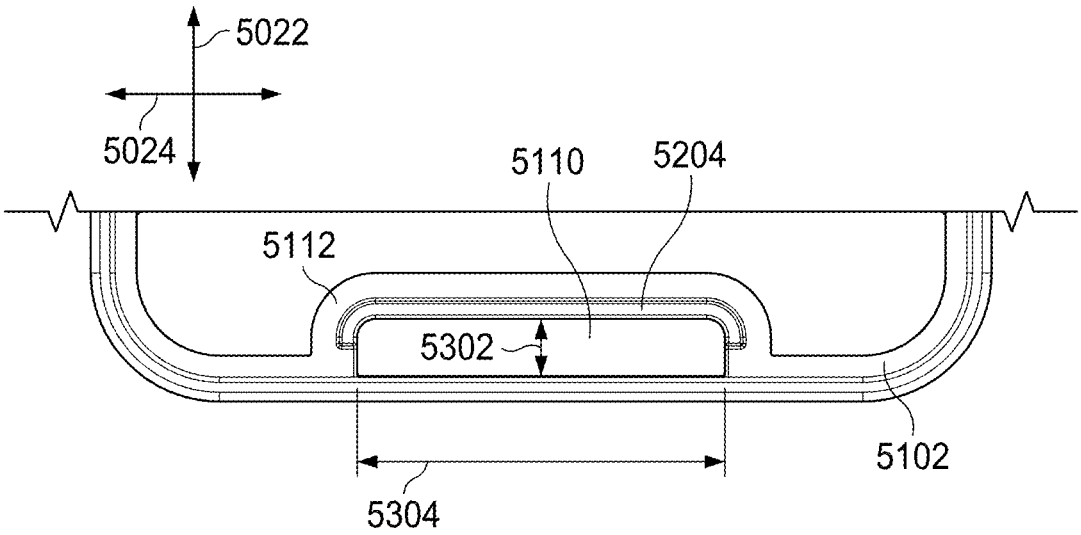
FIG. 52 is a partial top view of the base of FIG. 51 including the receptacle in accordance with at least one example embodiment.

FIG. 52 is a top view of the base FIG. 51 including the receptacle in accordance with at least one example embodiment.

Figure 53:
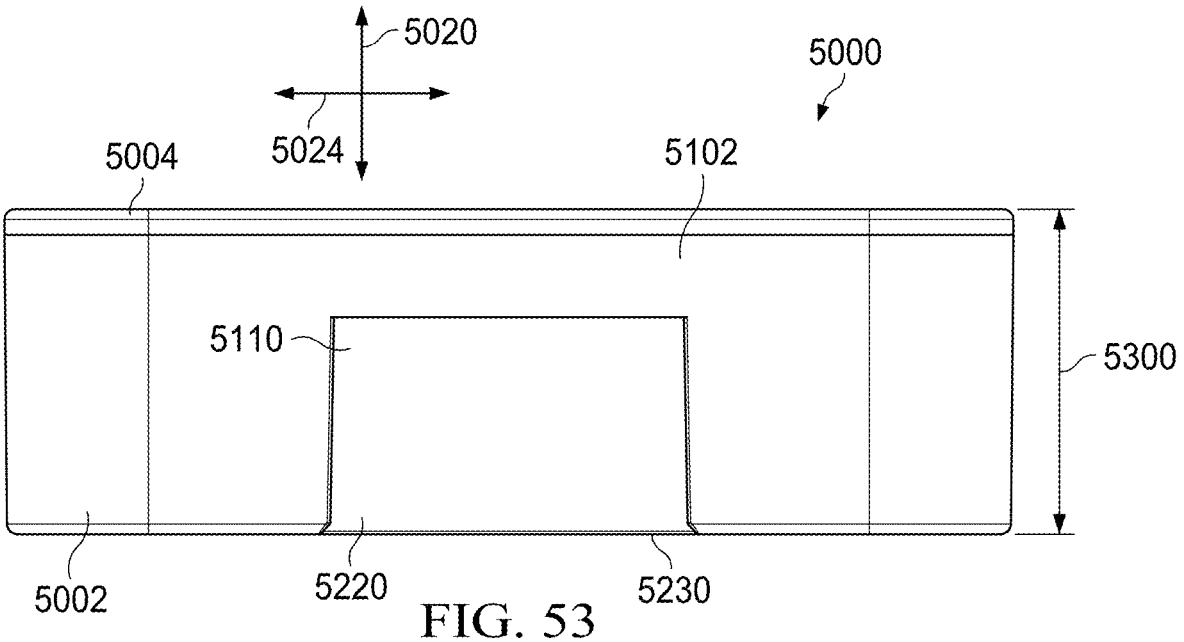
FIG. 53 is a front view of the container of FIG. 48 in the open configuration in accordance with at least one example embodiment.

FIG. 53 is a front view of the container of FIG. 48 in the closed configuration in accordance with at least one example embodiment.

In at least one example embodiment, as shown in FIGS. 52 and 53, the receptacle 5110 may define a height 5300 (shown in FIG. 52) substantially parallel to the vertical axis 5020, a depth 5302 (shown in FIG. 52) substantially parallel to the longitudinal axis 5022, and a width 5304 (shown in FIG. 53) substantially parallel to the transverse axis 5024. Each of the height, depth, and width may be substantially uniform. In other example embodiments, the height, depth, and/or width may vary.

The height 5300 is the height at a highest point of the receptacle 5110. The height 5300 (shown in FIG. 53) may be defined between the lower surface 5230 of the receptacle wall 5112 and the upper surface 5208 of the ledge 5204 (shown in FIG. 51). In at least one example embodiment, the height 5300 is greater than about 5 mm (e.g., greater than or equal to about 7 mm, greater than or equal to about 10 mm, greater than or equal to about 12 mm, greater than or equal to about 14 mm, greater than or equal to about 15 mm, greater than or equal to about 20 mm, greater than or equal to about 25 mm, greater than or equal to about 30 mm, greater than or equal to about 35 mm, greater than or equal to about 40 mm, or greater than or equal to about 45 mm). In at least one example embodiment, the height 5300 is less than or equal to about 50 mm (e.g., less than or equal to about 45 mm, less than or equal to about 40 mm, less than or equal to about 35 mm, less than or equal to about 30 mm, less than or equal to about 25 mm, less than or equal to about 20 mm, less than or equal to about 18 mm, less than or equal to about 15 mm, less than or equal to about 10 mm, or less than or equal to about 7 mm). In at least one example embodiment, the maximum height 5300 ranges from about 12 mm to about 20 mm (e.g., about 14 mm to about 18 mm, about 16 mm, or about 15.8 mm).

In at least one example embodiment, the depth 5302 (shown in FIG. 52) is greater than or equal to about 1 mm (e.g., greater than or equal to about 1.5 mm, greater than or equal to about 2 mm, greater than or equal to about 2.5 mm, greater than or equal to about 3 mm, greater than or equal to about 3.5 mm, greater than or equal to about 4 mm, greater than or equal to about 4.5 mm, greater than or equal to about 5 mm, or greater than or equal to about 7 mm). In at least one example embodiment, the depth 5302 is less than or equal to about 10 mm (e.g., less than or equal to about 7 mm, less than or equal to about 5 mm, less than or equal to about 4.5 mm, less than or equal to about 4 mm, less than or equal to about 3.5 mm, less than or equal to about 3 mm, less than or equal to about 2.5 mm, or less than or equal to about 2 mm). In at least one example embodiment, the depth 5302 ranges from about 2 mm to about 6 mm (e.g., about 3 mm to about 4.5 mm, about 4, or about 3.78 mm).

In at least one example embodiment, the width 5304 (shown in FIG. 52) is greater than or equal to about 10 mm (e.g., greater than or equal to about 12 mm, greater than or equal to about 15 mm, greater than or equal to about 17 mm, greater than or equal to about 20 mm, greater than or equal to about 25 mm, greater than or equal to about 30 mm, greater than or equal to about 35 mm, greater than or equal to about 40 mm, or greater than or equal to about 45 mm). In at least one example embodiment, the width 5304 is less than or equal to about 50 mm (e.g., less than or equal to about 45 mm, less than or equal to about 40 mm, less than or equal to about 35 mm, less than or equal to about 30 mm, less than or equal to about 25 mm, less than or equal to about 20 mm, less than or equal to about 17 mm, or less than or equal to about 15 mm). In at least one example embodiment, the width 5304 ranges from about 15 mm to about 25 mm (e.g., about 18 mm to about 22 mm, about 20 mm, or about 20.66 mm).

Figure 54:
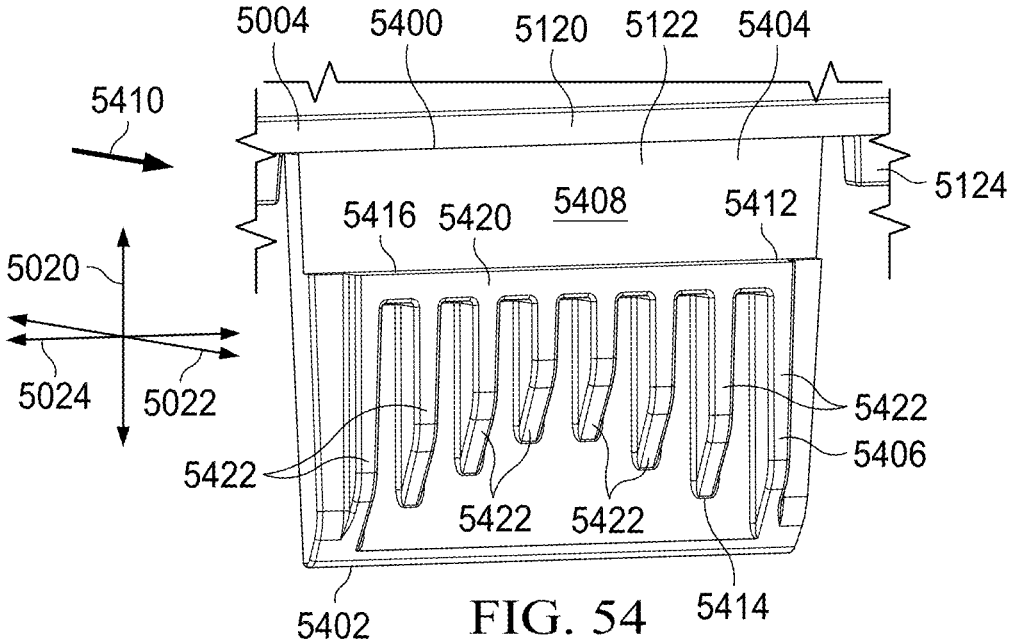
FIG. 54 is a partial front perspective view of a lid of the container of FIG. 48 including a flexible tab in accordance with at least one example embodiment.

FIG. 54 is a partial front perspective view of a lid of the container of FIG. 48 including a flexible tab in accordance with at least one example embodiment.

In at least one example embodiment, as shown in FIG. 54, the flexible tab 5122 includes a fixed end 5400 and a free end 5402. The fixed end 5400 may be coupled to or integrally formed with the top wall 5120 of the lid 5004.

In at least one example embodiment, the flexible tab 5122 includes a body 5404 and a projection 5406. The projection 5406 may be configured to engage the base (shown in FIG. 48) to retain the lid 5004 in the closed and locked configuration. The projection 5406 may extend from a tab surface 5408. The projection 5406 may project in a third direction 5410 opposite the first direction 5114 (shown in FIG. 49) from the tab surface 5408 when the lid 5004 is in the closed configuration (locked or unlocked).

The projection 5406 may extend parallel to the vertical axis 5020 between a proximal end 5412 and a distal end 5414. The proximal end 5412 may include a projection surface, proximal end surface, or step 5416. The projection surface 5416 may be configured to engage the intermediate surface 5224 of the peripheral wall 5102 when the lid 5004 is in the closed and locked configuration. Engagement of the projection surface 5412 with the intermediate surface 5224 may facilitate retention of the lid 5004 in the closed and locked configuration.

In at least one example embodiment, the projection 5406 includes a transversely-extending connector 5420 and a plurality of ribs 5422. The transversely-extending connector 5420 may be on the proximal end 5412 of the projection 5406. The transversely-extending connector 5420 may include the projection surface 5416. The ribs 5422 may be substantially parallel to one another. The ribs 5422 may be substantially aligned with the vertical axis 5020 and extend substantially vertically.

Figure 55:
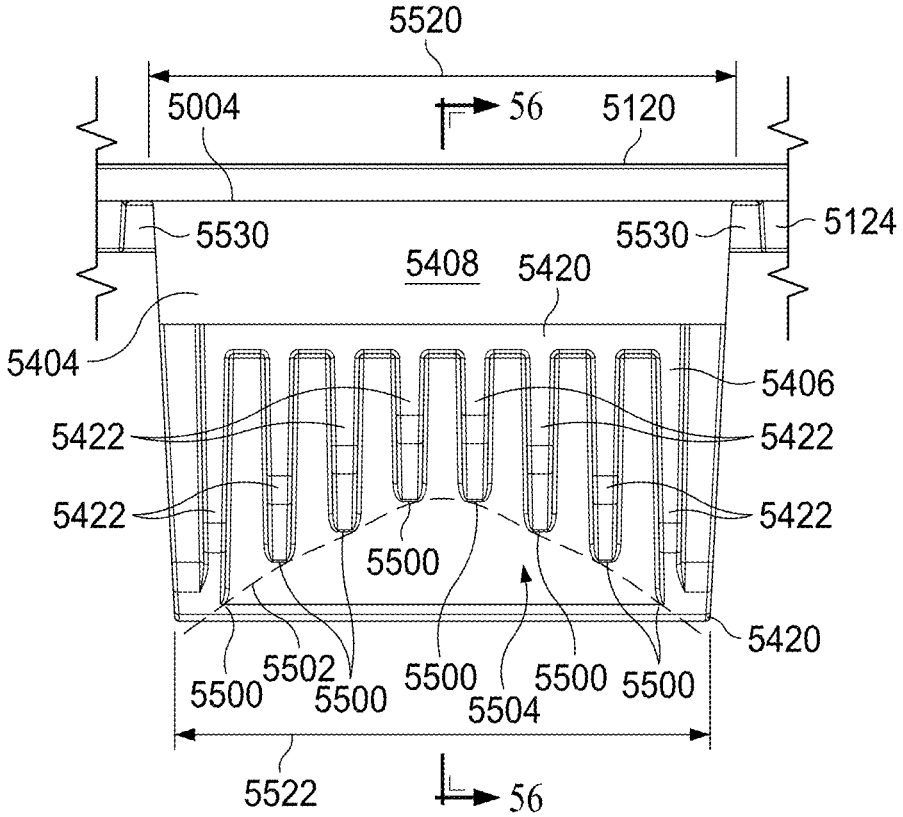
FIG. 55 is a partial front view of the lid of FIG. 54 including the flexible tab in accordance with at least one example embodiment.

FIG. 55 is a partial front view of the lid of FIG. 53 including the flexible tab in accordance with at least one example embodiment.

In at least one example embodiment, each of the ribs 5422 extends from the transversely-extending connector 5420. In at least one example embodiment, the distal end 5414 of the projection 5406 includes a plurality of distal ends or termination points 5500 of the plurality of ribs 5422, respectively. The ribs 5422 may have different terminations points at the distal end 5414 of the projection 5406 and/or different lengths. In other example embodiments, the ribs 5422 may have the same lengths and termination points such that they cooperate to define a substantially horizontal line.

In at least one example embodiment, the distal ends 5500 define a curved profile 5502, such as an arch or a portion of a circle. In at least one example embodiment, the curved profile 5502 is convex with respect to the free end 5402 of the flexible tab 5122. The tab surface 5408 may define a contact portion 5504 that is free of the ribs 5422. The contact portion 5504 may be between the curved profile 5502 and the free end 5402. The contact portion 5504 may be configured to receive a force in the first direction 5114 (shown in FIG. 58) to facilitate moving the lid 5004 from the closed and locked configuration to the closed and unlocked configuration, as will be described in greater detail below. In at least one example embodiment, contact may be made with the contact portion 5504 and a portion of one or more of the ribs 5422.

In at least one example embodiment, the flexible tab 5122 defines a tapered width parallel to the transverse axis 5024. The fixed end 5400 of the flexible tab 5122 may define a first width 5520 parallel to the transverse axis 5024 (and perpendicular to the first direction 5114 and the second direction 5206). The free end 5402 of the flexible tab 5122 may define a second width 5522 parallel to the transverse axis 5024 (and perpendicular to the first direction 5114 and the second direction 5206). The second width 5522 may be less than the first width 5520.

In at least one example embodiment, the first width 5520 is greater than or equal to about 10 mm (e.g., greater than or equal to about 12 mm, greater than or equal to about 15 mm, greater than or equal to about 16 mm, greater than or equal to about 18 mm, greater than or equal to about 20 mm, greater than or equal to about 25 mm, greater than or equal to about 30 mm, greater than or equal to about 35 mm, greater than or equal to about 40 mm, or greater than or equal to about 45 mm). In at least one example embodiment, the first width 5520 is less than or equal to about 50 mm (e.g., less than or equal to about 45 mm, less than or equal to about 40 mm, less than or equal to about 35 mm, less than or equal to about 30 mm, less than or equal to about 25 mm, less than or equal to about 24 mm, less than or equal to about 22 mm, less than or equal to about 20 mm, less than or equal to about 17 mm, or less than or equal to about 15 mm). In at least one example embodiment, the first width 5520 ranges from about 16 mm to about 24 mm (e.g., about 18 mm to about 22 mm, or about 19.97 mm).

In at least one example embodiment, the second width 5522 is greater than or equal about 10 mm (e.g., greater than or equal to about 12 mm, greater than or equal to about 14 mm, greater than or equal to about 15 mm, greater than or equal to about 16 mm, greater than or equal to about 20 mm, greater than or equal to about 25 mm, greater than or equal to about 30 mm, greater than or equal to about 35 mm, greater than or equal to about 40 mm, or greater than or equal to about 45 mm). In at least one example embodiment, the second width 5522 is less than or equal to about 50 mm (e.g., less than or equal to about 45 mm, less than or equal to about 40 mm, less than or equal to about 35 mm, less than or equal to about 30 mm, less than or equal to about 25 mm, less than or equal to about 22 mm, less than or equal to about 20 mm, less than or equal to about 17 mm, or less than or equal to about 15 mm). In at least one example embodiment, the second width 5522 ranges from about 14 mm to about 22 mm (e.g., about 16 mm to about 20 mm, about 18, or about 18.11 mm).

In at least one example embodiment, the flexible tab 5122, the skirt 5124, and the top wall 5120 define a notch or gap 5530 on both sides of the flexible tab 5122. The notch 5530 may provide clearance for movement of the flexible tab 5122, as will be described in greater detail below in connection with FIG. 56.

Figure 56:
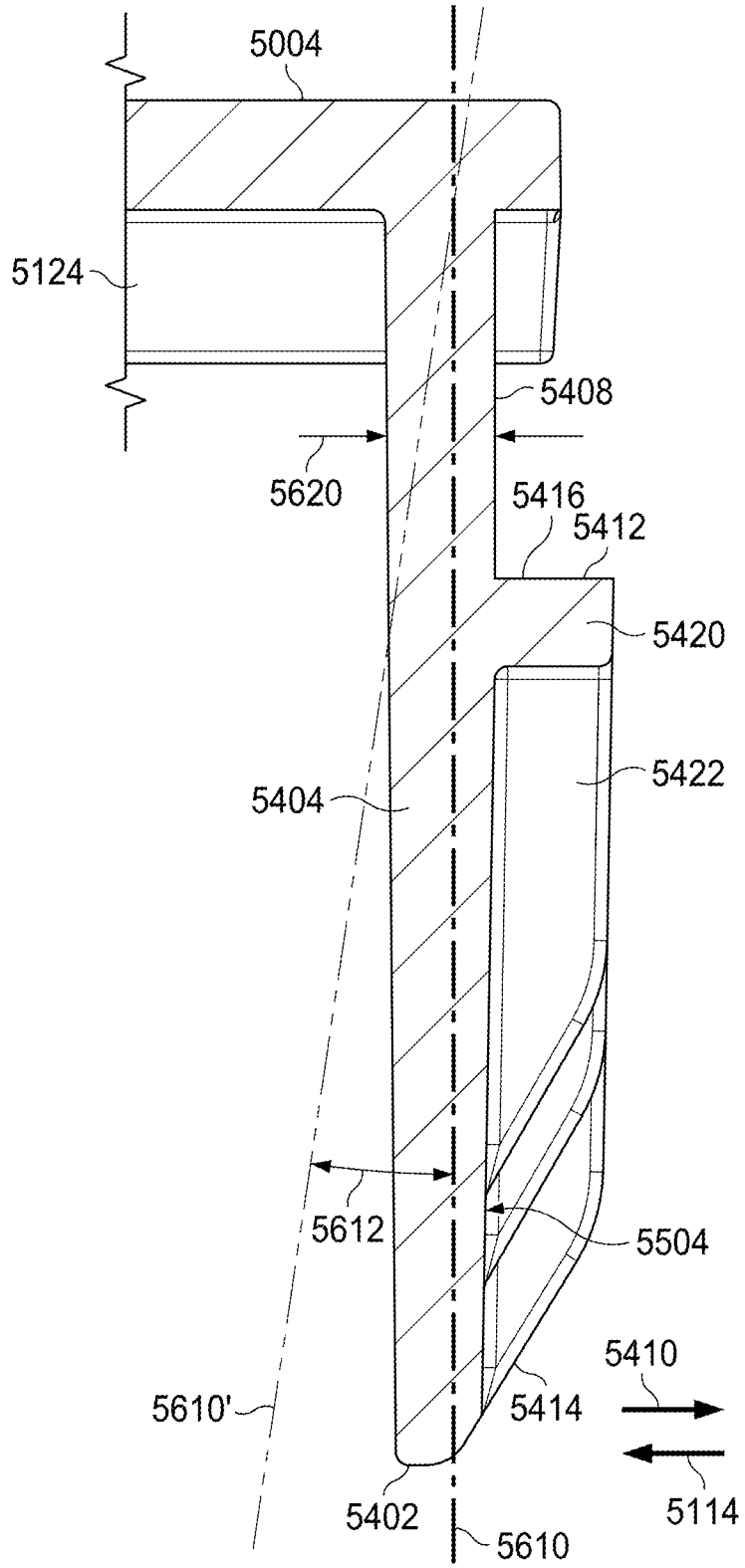
FIG. 56 is a partial sectional view of the flexible tab of FIG. 55 taken at line 56-56 of FIG. 55 according to at least one example embodiment.

FIG. 56 is a partial side view of the tab of FIG. 53 in accordance with at least one example embodiment.

In at least one example embodiment, the flexible tab 5122 is tapered along at least a portion of its length. The free end 5402 of the flexible tab 5122 may be tapered. In at least one example embodiment, each of the ribs 5422 may be tapered along at least a portion of its length. The termination points of the ribs 5422 may be tapered.

In at least one example embodiment, the flexible tab 5122 is configured to move between a relaxed position, as shown, and a flexed position. In the relaxed position, at least a portion of the flexible tab 5122 extends substantially perpendicular to the top wall 5120 of the lid 5004. The flexible tab 5122 may extend along a tab axis 5610 substantially parallel to the vertical axis 5020 when the lid 5004 is in the closed and locked configuration.

In at least one example embodiment, the flexible tab 5122 may be configured to be moved from the relaxed configuration to the flexed configuration by applying a force to the flexible tab 5122, such as to the contact portion 5504 of the tab surface 5408, in the first direction 5114. The force may cause the flexible tab 5122 to pivot about the fixed end 5400. In at least one example embodiment, the flexible tab 5122 pivots through an angle 5612 between the relaxed and flexed positions. That is, the tab axis 5610 of the flexible tab 5122 in the relaxed position and a flexed tab axis 5610' are angularly spaced apart by the angle 5612.

In at least one example embodiment, the angle 5612 is greater than or equal to about 2° (e.g., greater than or equal to about 3°, greater than or equal to about 4°, greater than or equal to about 5°, greater than or equal to about 6°, greater than or equal to about 8°, greater than or equal to about 10°, or greater than or equal to about) 15°. In at least one example embodiment, the angle 5612 is less than or equal to about 20° (e.g., less than or equal to about 15°, less than or equal to about 10°, less than or equal to about 8°, less than or equal to about 7°, less than or equal to about 6°, or less than or equal to about 5°). In at least one example embodiment, the angle 5612 ranges from about 2° to about 10° (e.g., about 4° to about 8°, or about 6°).

Flexibility of the flexible tab 5122 may be facilitated by its material and/or dimensions. The fixed end 5400 of the flexible tab 5122 defines a thickness 5620 substantially parallel to the longitudinal axis 5022. In at least one example embodiment, the thickness 5620 is greater than or equal to about 0.5 mm (e.g., greater than or equal to about 0.75 mm, greater than or equal to about 1 mm, greater than or equal to about 1.25 mm. greater than or equal to about 1.5 mm, greater than or equal to about 1.75 mm, or greater than or equal to about 2 mm). In at least one example embodiment, the thickness 5620 is less than or equal to about 3 mm (e.g., less than or equal to about 2 mm, less than or equal to about 1.75 mm, less than or equal to about 1.5 mm, less than or equal to about 1.25 mm, less than or equal to about 1 mm, or less than or equal to about 0.75 mm). In at least one example embodiment, the thickness 5620 ranges from 0.75 mm to 1.75 mm (e.g., about 1 mm to about 1.5 mm, or about 1.25 mm).

Figure 57:
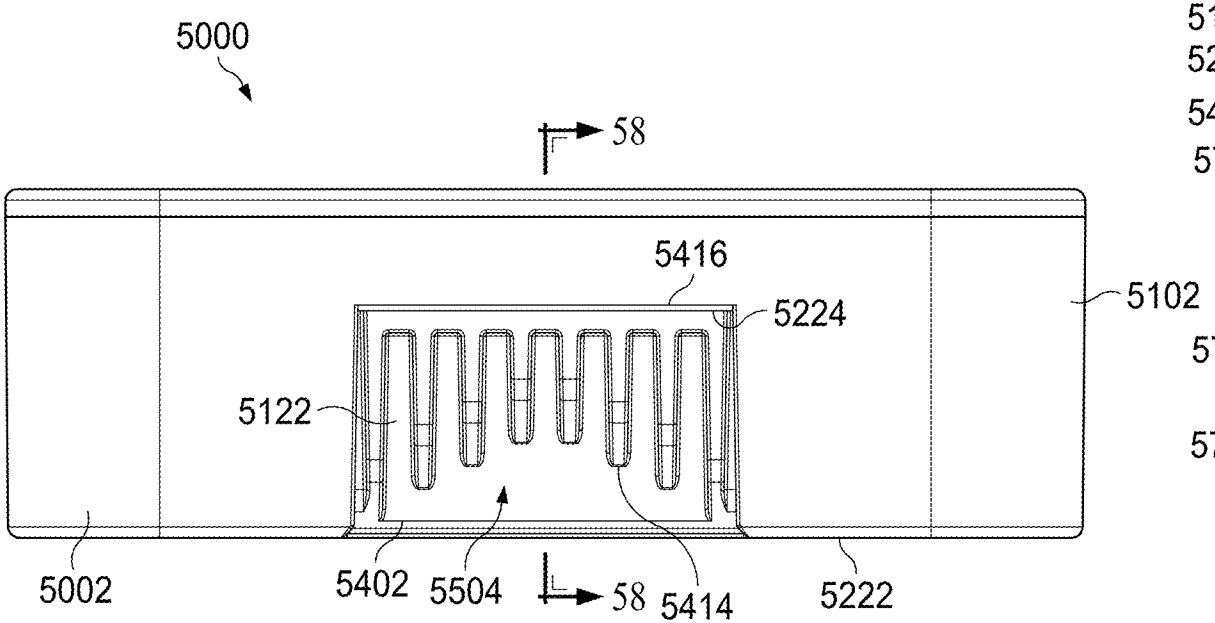
FIG. 57 is a front view of the container of FIG. 48 in accordance with at least one example embodiment.

FIG. 57 is a front view of the container of FIG. 48 in accordance with at least one example embodiment.

Figure 58:
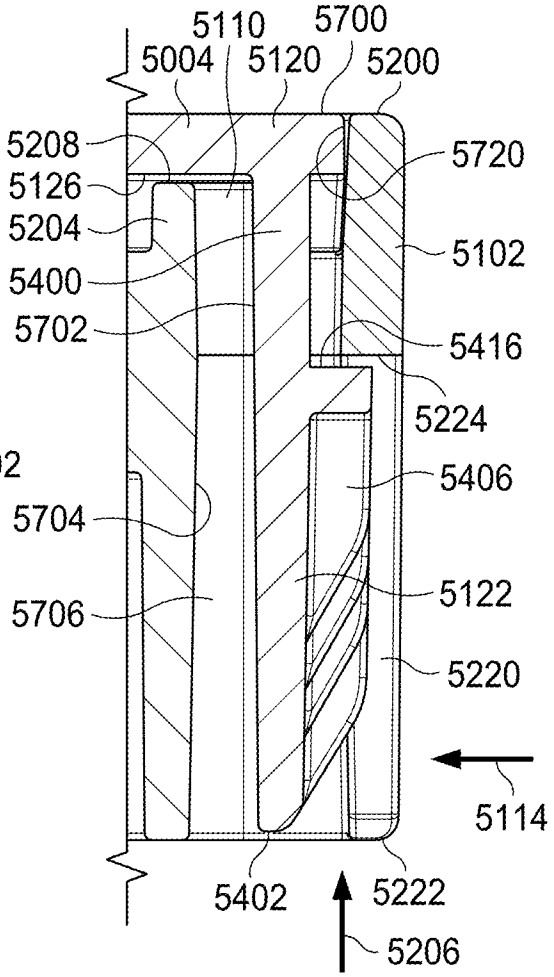
FIG. 58 is a partial sectional view of the container of FIG. 57 taken in at line 58-58 of FIG. 57 in accordance with at least one example embodiment.

FIG. 58 is a partial sectional view of the container of FIG. 57 taken in at line 58-58 of FIG. 57 in accordance with at least one example embodiment.

In at least one example embodiment, as shown in FIGS. 57-58, in the closed and locked configuration, an exterior or outer surface 5700 of the lid 5004 may be aligned or coplanar with the upper surface 5200 of the peripheral wall 5102. In at least one example embodiment, the free end 5402 of the flexible tab 5122 is recessed with respect to the lower surface 5222 of the peripheral wall 5102 and the bottom wall 5100 (shown in FIG. 50). In other example embodiments, the free end 5402 may be aligned with respect to the lower surface 5222 of the peripheral wall 5102 and the bottom wall 5100. In at least one example embodiment, in the closed configuration (locked and unlocked), the interior surface 5126 of the top wall 5120 may be configured to engage the upper surface 5208 of the ledge 5204.

In at least one example embodiment, in the closed configuration (locked and unlocked), the flexible tab 5122 is at least partially in the receptacle 5110. In at least one example embodiment, in the closed configuration (locked and unlocked), the flexible tab 5122 is fully in the receptacle 5110.

In the closed and locked configuration, the flexible tab 5122 is in the relaxed position. An interior or inner surface 5702 of the flexible tab 5122 is spaced from an exterior or outer surface 5704 of the receptacle wall 5112 to define a gap 5706. The gap 5706 is configured to receive the flexible tab 5122 in the flexed position. In at least one example embodiment, the gap 5706 is greater than or equal to about 0.5 mm (e.g., greater than or equal to about 0.75 mm, greater than or equal to about 1 mm, greater than or equal to about 1.25 mm, greater than or equal to about 1.5 mm, greater than or equal to about 1.75 mm, or greater than or equal to about 2 mm). In at least one example embodiment, the gap 5706 is less than or equal to about 2.5 mm (e.g., less than or equal to about 2 mm, less than or equal to about 1.75 mm, less than or equal to about 1.5 mm, less than or equal to about 1.25 mm, less than or equal to about 1 mm, or less than or equal to about 0.75 mm). In at least one example embodiment, the gap 5706 ranges from about 1 mm to about 1.5 mm (e.g., about 1.1 mm, about 1.2 mm, about 1.23 mm, about 1.25 mm, about 1.3 mm, or about 1.4 mm).

In at least one example embodiment, in the closed and locked configuration, the projection 5406 is at least partially in the recess 5220. In at least one example embodiment, the projection 5406 is recessed with respect to the peripheral wall 5102 such that the flexible tab 5122 does not extend beyond the peripheral wall 5102. In other example embodiments, the projection 5406 may be aligned or flush with the peripheral wall 5102 or project past the peripheral wall 5102.

In at least one example embodiment, the projection surface 5416 is configured to engage the intermediate surface 5224 of the peripheral wall 5102 when the lid 5004 is in the closed and locked configuration. Engagement of the projection surface 5416 with the intermediate surface 5224 may facilitate retention of the lid 5004 in the closed and locked configuration. More specifically, engagement of the projection surface 5416 with the intermediate surface 5224 may prevent motion of the lid 5004 in the second direction 5206.

Figure 59:
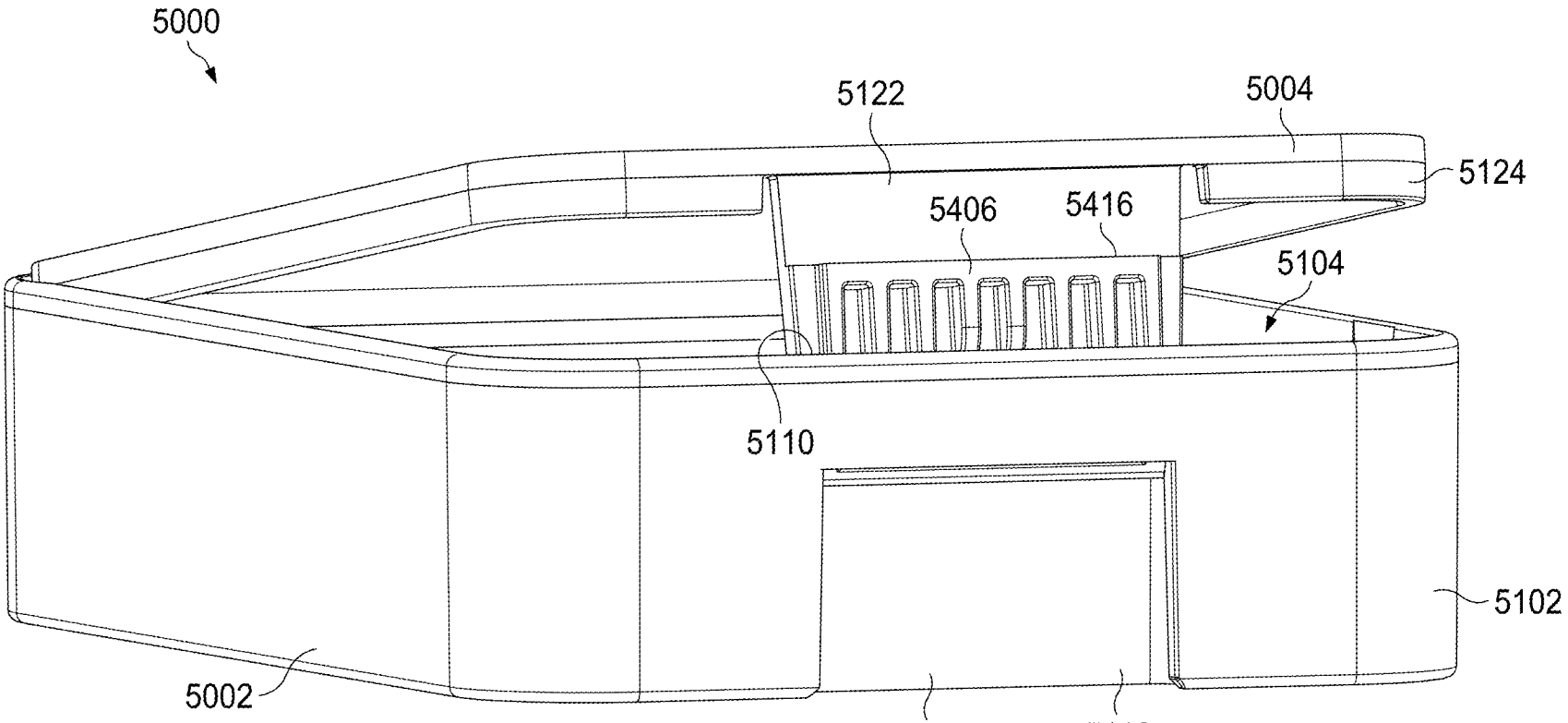
FIG. 59 is a front perspective view of the container of FIG. 48 in a partially open configuration in accordance with at least one example embodiment.

In at least one example embodiment, when the lid 5004 is in the closed and locked configuration, two separate motions or forces, in two separate directions, are required to move the container 5000 into the open configuration. The lid 5004 is configured to be moved from the closed and locked configuration, as shown in FIGS. 57-58, to the closed and unlocked configuration, as shown in FIG. 59, by applying a first force to the flexible tab 5122 in the first direction 5114. The first force in the first direction 5114 may cause the flexible tab 5122 to move from the relaxed position, as shown, to the flexed position. In the flexed position, the projection surface 5416 of the flexible tab 5122 is clear of the intermediate surface 5224 of the peripheral wall 5102 such that the lid 5004 may be moved in the second direction 5206. The lid 5004 is moved from the closed and unlocked configuration to the open configuration by applying a second force to the flexible tab 5122 in the second direction 5206 with the flexible tab 5122 in the flexed position (e.g., under application of the first force in the first direction).

In at least one example embodiment, the container 5000 is configured to be opened by an adult tobacco consumer using one hand. In at least one example embodiment, the adult tobacco consumer may press a thumb onto the contact portion 5504 of the flexible tab 5122 in the first direction 5114 to move the flexible tab 5122 from the relaxed position to the flexed position. While the flexible tab 5122 is in the flexed position, the adult tobacco consumer may slide their thumb against the distal end 5414 of the projection 5406 to push or slide the projection 5406 past the peripheral wall 5102. When the projection 5406 is clear of the peripheral wall 5102, the adult tobacco consumer may continue to pivot the lid 5004 to fully open the container 5000. The projection 5406 may be configured to return to the relaxed position when the first force is removed.

The lid 5004 may also be moved from the open configuration to the closed and locked configuration. To close and lock the container 5000, the lid 5004 may be pivoted to bring the flexible tab 5122 toward the receptacle 5110. When the free end 5402 of the flexible tab 5122 makes contact with the peripheral wall 5102, the tapered shapes of the flexible tab 5122 and the projection 5406 facilitate insertion of the flexible tab 5122 into the receptacle 5110. As the flexible tab 5122 enters the receptacle 5110, contact of the projection 5406 with an interior or inner surface 5720 of the peripheral wall 5102 may force the flexible tab 5122 from the relaxed configuration into the flexed configuration, as shown in FIG. 59. The projection 5406 may slide along the interior surface 5720 until proximal end 5412 of the projection 5406 clears the peripheral wall 5102. When the projection 5406 clears the peripheral wall 5102, the flexible tab 5122 may return to the relaxed configuration, thereby locking the lid 5004 in the closed and locked configuration.

Figure 60:
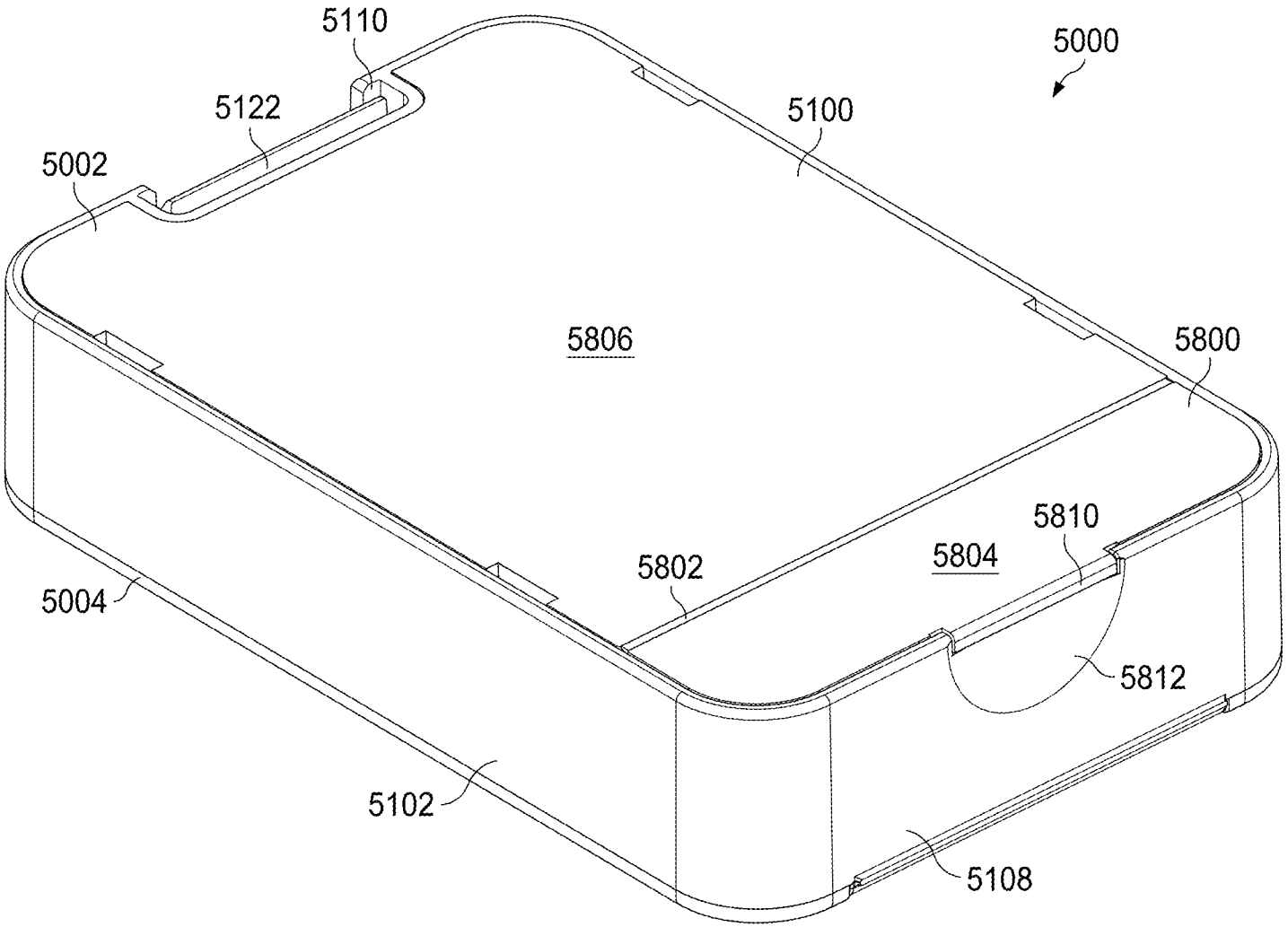
FIG. 60 is a bottom back perspective view of the container of FIG. 48 with a secondary lid in a closed position in accordance with at least one example embodiment.

FIG. 60 is a bottom back perspective view of the container of FIG. 48 with a secondary lid in a closed position in accordance with at least one example embodiment.

In at least one example embodiment, the lid 5004 (shown in FIG. 48) may be referred to as a primary lid. The container 5000 may further include a secondary lid 5800. The secondary lid 5800 may be movable from a closed configuration, as shown, to an open configuration or position (shown in FIG. 61).

The secondary lid 5800 may be coupled to the bottom wall 5100 and/or the peripheral wall 5102. In at least one example embodiment, the secondary lid 5800 is pivotally coupled to the bottom wall 5100. In at least one example embodiment, the secondary lid 5800 is coupled to the bottom wall 5100 by a hinge, such as a living hinge 5802. An exterior or outer surface 5804 of the secondary lid 5800 may be substantially coplanar or flush with an exterior or outer surface 5806 of the bottom wall 5100.

In at least one example embodiment, the secondary lid 5800 includes an extension 5810 adjacent to the peripheral wall 5102. The peripheral wall 5102 may define an indentation 5812. The indentation 5812 may provide access to the extension 5810 from moving the secondary lid 5800 between the closed position and the open position. In at least one example embodiment, the indentation 5812 is defined by one of the pair of end walls 5108 opposite the other of the pair of end walls 5108 that at least partially defines the receptacle 5110.

Figure 61:
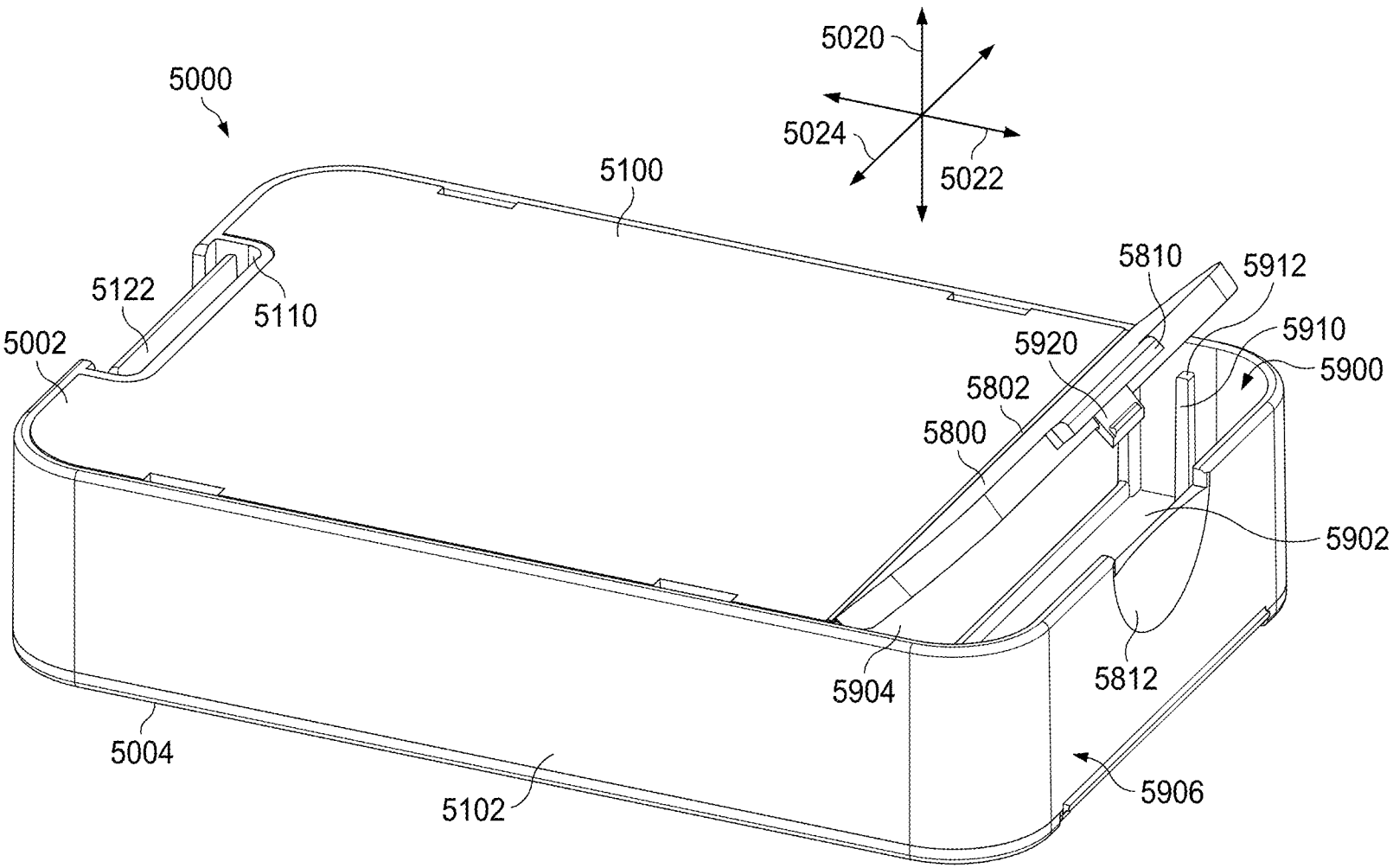
FIG. 61 is a bottom back perspective view of the container of FIG. 60 with the secondary lid in an open position in accordance with at least one example embodiment.

FIG. 61 is a bottom back perspective view of the container of FIG. 59 with the secondary lid in an open position in accordance with at least one example embodiment.

In at least one example embodiment, as shown in FIG. 61, in the open position, the secondary lid 5800 permits access to a secondary storage area 5900. The secondary storage area may be defined by an transverse wall or top wall 5902, an intermediate wall or end wall 5904, the secondary lid 5800, and a portion 5906 of the peripheral wall 5102. The transverse wall 5902 may be substantially parallel to the lid 5004 when the lid 5004 is in the closed configuration (locked and unlocked). The intermediate wall 5904 may be substantially parallel to the pair of end walls 5108.

One or more blocks 5910 may extend from the transverse wall 5902. The blocks 5910 may extend substantially parallel to the vertical axis 5020. Each of the blocks 5910 may include a block surface 5912 configured to engage the secondary lid 5800 when the secondary lid 5800 is in the closed position.

In at least one example embodiment, the secondary lid 5800 includes a catch 5920. The catch 5920 may be configured to engage the portion 5906 of the peripheral wall 5102 to retain the secondary lid 5800 in the closed position. In at least one example embodiment, the catch 5920 may be received in a slot (see slot 6410 shown in FIG. 67). The catch 5920 and the slot may be similar or the same as any other catch and/or slots described with respect to other example embodiments.

Figure 62:
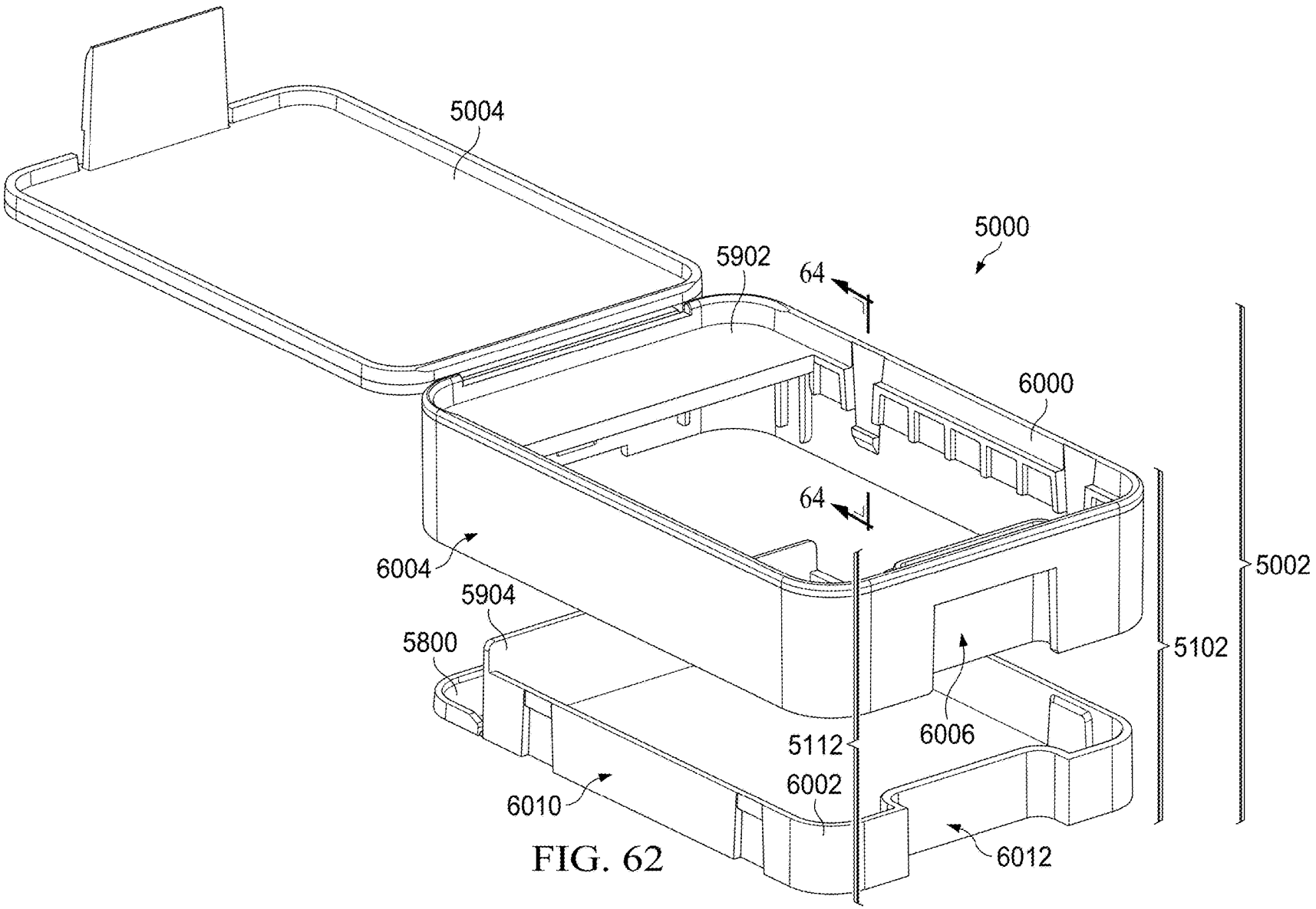
FIG. 62 is a top front exploded perspective view of the container of FIG. 48 in accordance with at least one example embodiment.

FIG. 62 is a top front exploded perspective view of the container of FIG. 48 in accordance with at least one example embodiment.

In at least one example embodiment, as shown in FIG. 62, the base 5002 includes a frame 6000 and an insert 6002. The lid 5004 may be coupled to the frame 6000. The insert 6002 may include the secondary lid 5800.

In at least one example embodiment, the frame 6000 includes an exterior or outer peripheral wall portion 6004, and exterior or outer receptacle wall portion 6006, and the transverse wall 5902. The insert 6002 includes an interior or inner peripheral wall portion 6010, and interior or inner receptacle wall portion 6012, the intermediate wall 5904, and the bottom wall 5100. The exterior and interior peripheral wall portions 6004, 6010 may cooperate to form the peripheral wall 5102. The exterior and interior receptacle wall portions 6006, 6012 may cooperate to form the receptacle wall 5112.

Figure 63:
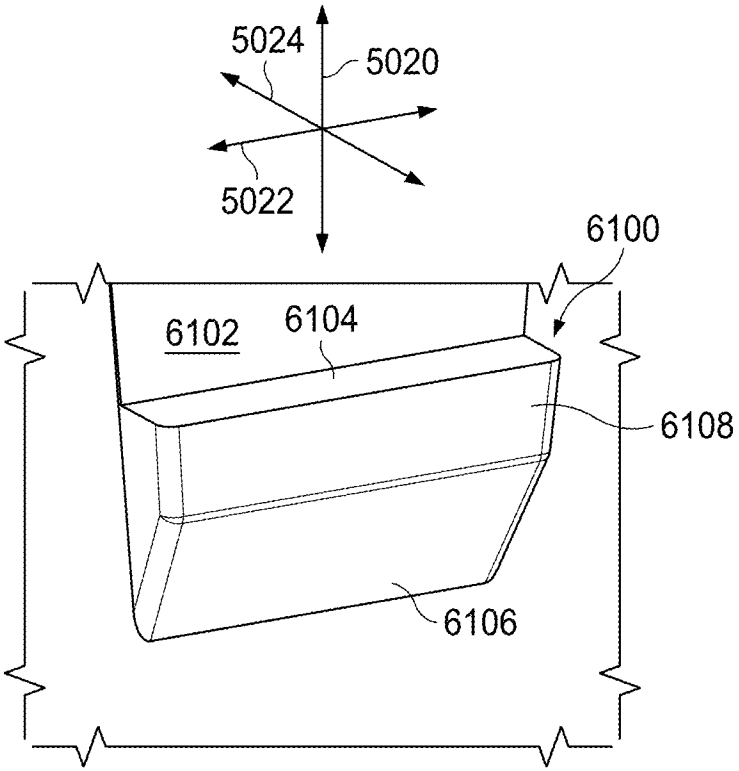
FIG. 63 is a partial perspective view of a frame of the container of FIG. 62 including a wedge in accordance with at least one example embodiment.

FIG. 63 is a partial perspective view of a frame of the container of FIG. 61 including a wedge in accordance with at least one example embodiment.

Figure 64:
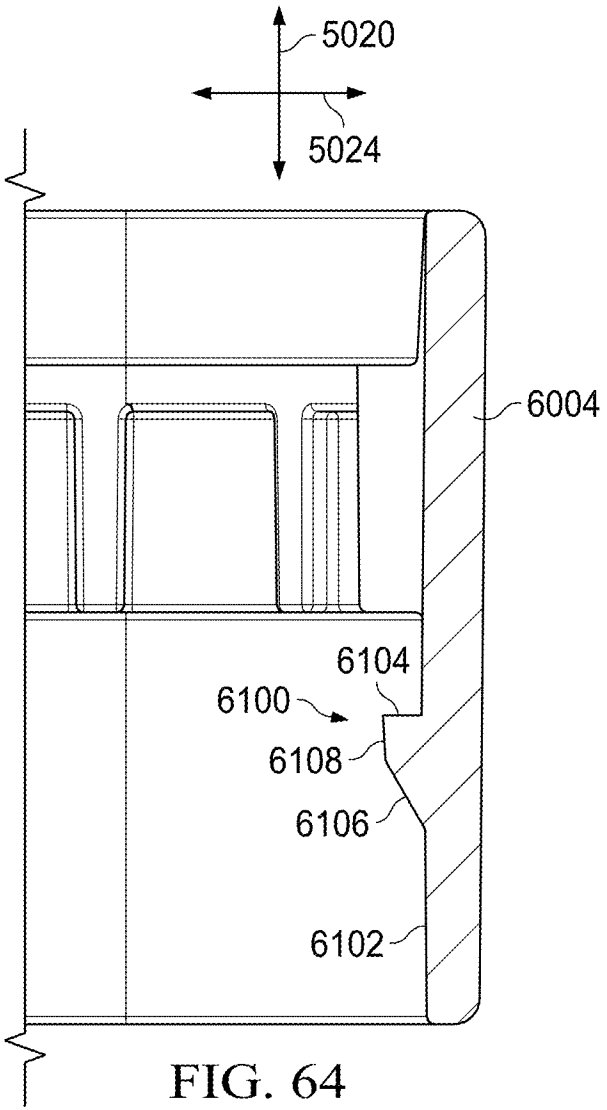
FIG. 64 is a sectional view of the frame of FIG. 62 including the wedge taken at line 63-63 of FIG. 62 in accordance with at least one example embodiment.

FIG. 64 is a partial sectional view of the frame of FIG. 62 taken at line 62-62 of FIG. 62 including the wedge in accordance with at least one example embodiment.

In at least one example embodiment, as shown in FIGS. 63-64, the frame 6000 includes a plurality of wedges 6100. The wedges 6100 may be configured to engage the insert (shown in FIG. 62) to retain the insert 6002 within the frame 6000, as will be described in greater detail below. The wedges 6100 project from an interior or inner surface 6102 of the exterior peripheral wall portion 6004. Each of the wedges 6100 may include an upper surface or step 6104, an angled or sloped surface 6106, and a front surface 6108 between the upper surface 6104 and the angled surface 6106. The upper surface 6104 may extend parallel to a plane defined by the longitudinal and transverse axes 5022, 5024. In at least one example embodiment, the upper surface 6104 may be substantially horizontal. The angled surface 6106 may be at an oblique angle with respect to the upper surface 6104 and the front surface 6108. The front surface 6108 may extend parallel to a plane defined by the vertical and longitudinal axes 5020, 5022.

Figure 65:
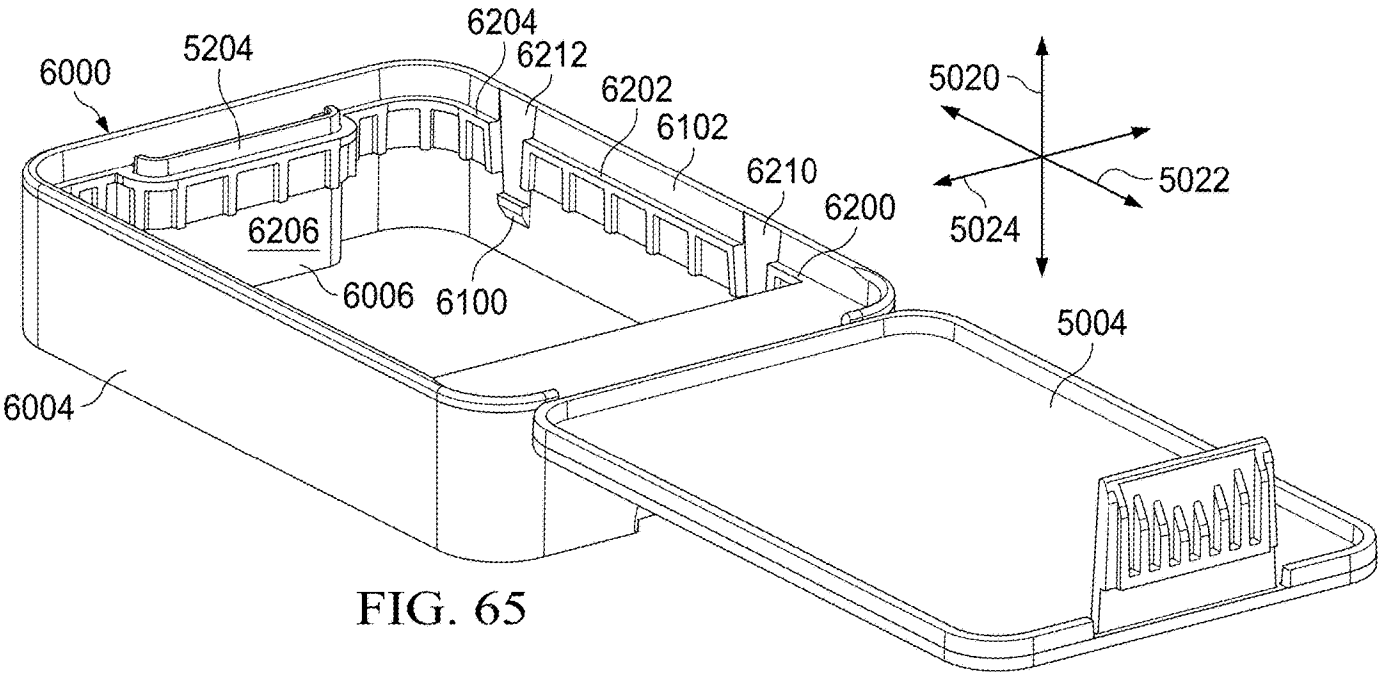
FIG. 65 is a top back perspective view of the frame of the container of FIG. 62 in the open configuration in accordance with at least one example embodiment.

FIG. 65 is a top back perspective view of a frame of the container of FIG. 62 in the open configuration in accordance with at least one example embodiment.

In at least one example embodiment, as shown in FIG. 65, the frame 6000 further includes a plurality of stops. The stops may facilitate positioning of the insert 6002 (shown in FIG. 62) within the frame 6000. In at least one example embodiment, the plurality of stops includes a pair a first stops 6200, a pair of second stops 6202, and a third stop 6204. In other embodiments, a frame may include other quantities of stops, such as a single continuously-extending stop.

In at least one example embodiment, each of the pair of first stops 6200 projects from the interior surface 6102 of the exterior peripheral wall portion 6004. Each of the pair of first stops 6200 is between the transverse wall 5902 and a respective one of the wedges 6100. Each of the pair of second stops 6202 projects from the interior surface 6102 of the exterior peripheral wall portion 6004. Each of the pair of second stops 6202 extends between a respective two of the plurality of wedges 6100. The third stop 6204 extends between two of the plurality of wedges 6100, across portions of the interior surface 6102 of the exterior peripheral wall portion 6004 and an interior or inner surface 6206 of the exterior receptacle wall portion 6006. A portion of the third stop 6204 may extend adjacent to the ledge 5204 of the receptacle wall 5112.

In at least one example embodiment, each of the pair of first stops 6200 is spaced apart from a respective one of the pair of second stops 6202 by a first gap 6210. Each of the pair of second stops 6202 is spaced apart from the third stop 6204 by a second gap 6212. Each of the first and second gaps 6210, 6212 may adjacent (e.g., above) a respective wedge 6100.

Figure 66:
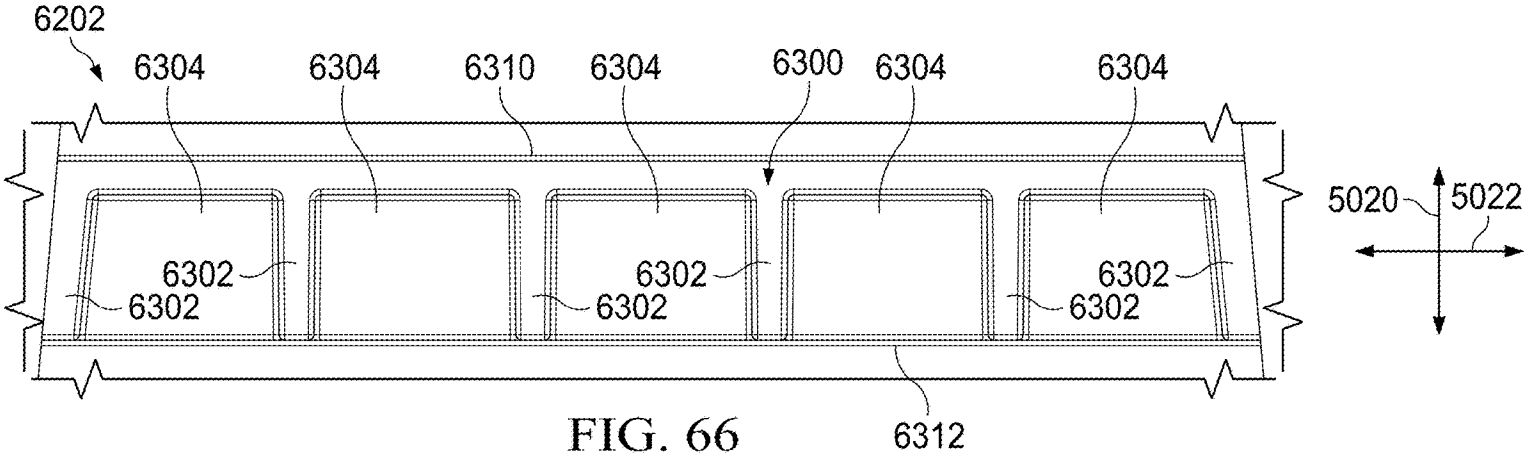
FIG. 66 is a partial side view of the frame of FIG. 65 including a stop in accordance with at least one example embodiment.

FIG. 66 is a partial side view of the frame of FIG. 65 including a stop in accordance with at least one example embodiment.

In at least one example embodiment, as shown in FIG. 66, each of the stops includes a continuous portion and a plurality of ribs extending from the continuous portion. For example, each of the pair of second stops 6202 includes a continuous portion 6300 and a plurality of ribs 6302. The ribs 6302 may extend from the continuous portion 6300. In at least one example embodiment, at least a portion of the ribs 6302, such as center ribs, are substantially parallel to one another. The ribs 6302 may define gaps 6304 therebetween. The gaps 6304 may facilitate weight reduction of the frame 6000. The gaps 6304 may also facilitate thickness reduction of the exterior peripheral wall portion 6006, thereby reducing or preventing shrink marks in the frame 6000.

In at least one example embodiment, each of the stops includes an upper surface or step. For example, each of the pair of second stops 6202 includes an upper surface 6310. The upper surface 6310 may extend parallel to a plane defined by the longitudinal and transverse axes 5022, 5024. In at least one example embodiment, the upper surface 6310 may be substantially horizontal. The upper surface 6310 may be configured to engage the lid 5004 when the lid 5004 is in the closed (locked and unlocked) configuration.

In at least one example embodiment, each of the stops includes a lower surface or step. For example, each of the pair of second stops 6202 includes a lower surface 6312. The lower surface 6312 may extend parallel to the plane defined by the longitudinal and transverse axes 5022, 5024. In at least one example embodiment, the lower surface 5306 may be substantially horizontal. The lower surface 6312 may be configured to engage the insert 6002 (shown in FIG. 62) when the insert 6002 is assembled to the frame 6000.

Figure 67:
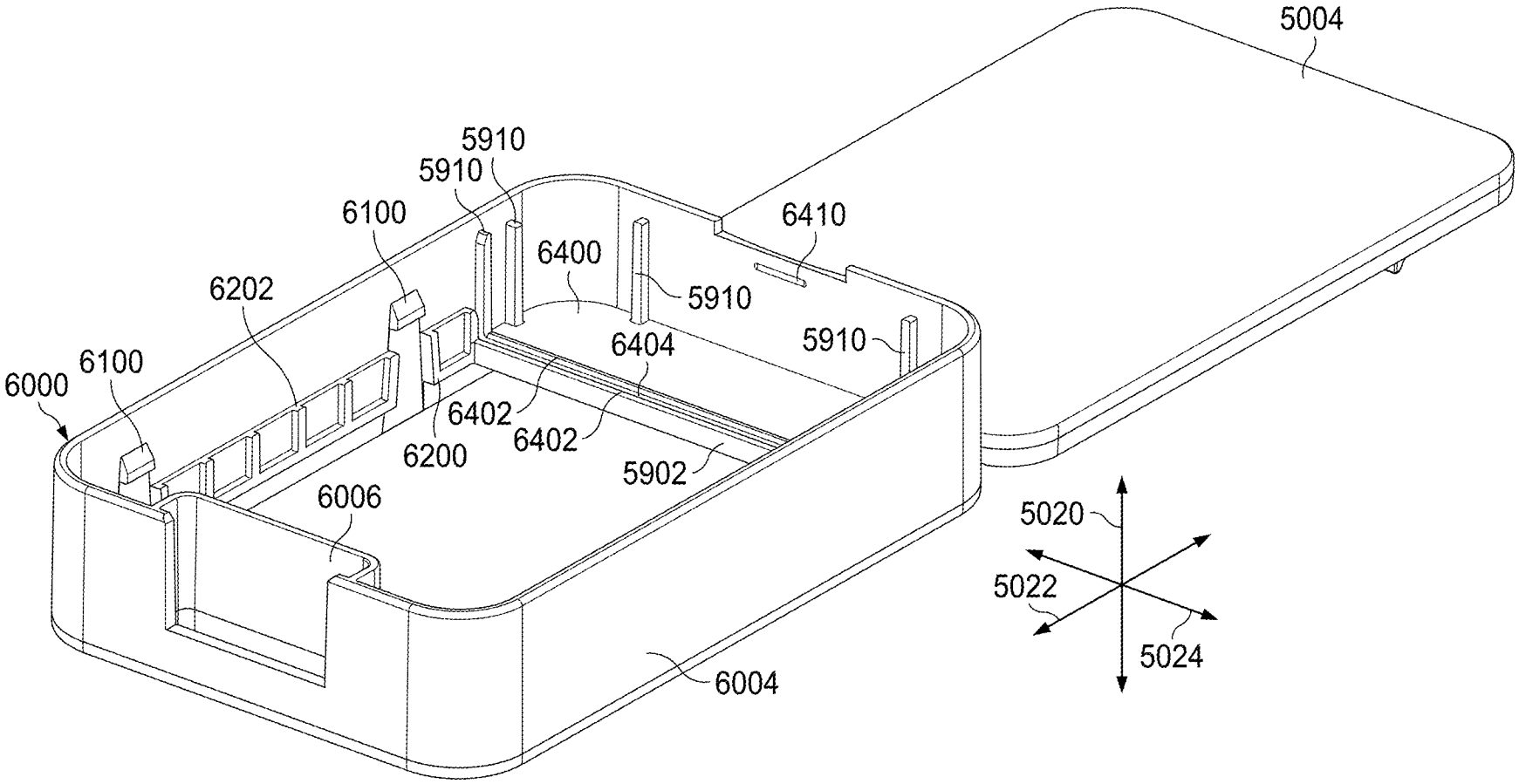
FIG. 67 is a front bottom perspective view of the frame of FIG. 65 in accordance with at least one example embodiment.

FIG. 67 is a front bottom perspective view of the frame of FIG. 65 in accordance with at least one example embodiment.

In at least one example embodiment, as shown in FIG. 67, the transverse wall 5902 includes a lower surface 6400. The blocks 5910 may project from the lower surface 6400 of the transverse wall 5902. The blocks 5910 may be adjacent and to and extend from the interior surface 6120 of the exterior peripheral wall portion 6004.

In at least one example embodiment, a pair of parallel ridges 6402 extend from the lower surface 6400. The ridges 6402 may extend substantially parallel to the longitudinal axis 5022. The pair of parallel ridges 6402 cooperate to define a channel 6404. The channel 6404 may be configured to receive a portion of the intermediate wall 5904 when the insert 6002 is assembled to the frame 6000.

In at least one example embodiment, the exterior peripheral wall portion 6006 defines a slot 6410. The slot 6410 may be configured to receive the catch 5920 of the secondary lid 5800 (shown in FIG. 58) when the insert 6002 is assembled to the frame 6000. Accordingly, the secondary lid 5800 may be retained in the closed position.

Figure 68:
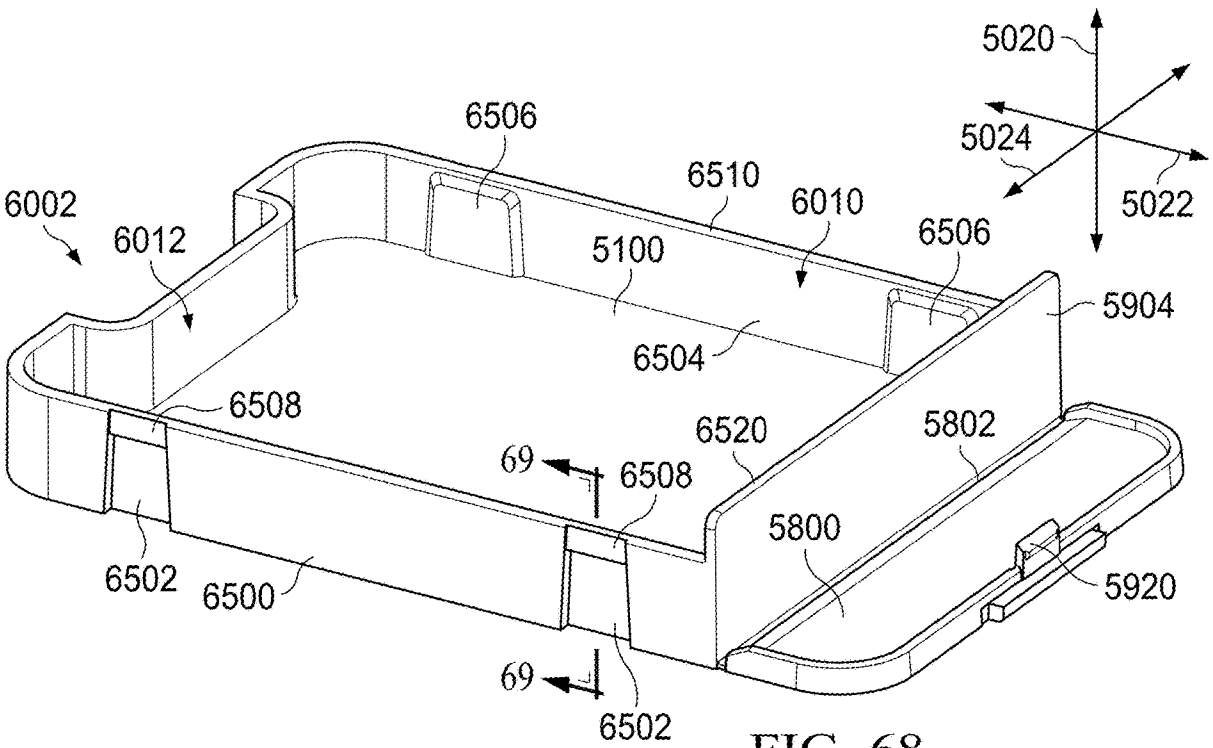
FIG. 68 is a top back perspective view of an insert of the package of FIG. 62 in accordance with at least one example embodiment.

FIG. 68 is a top back perspective view of an insert of the container of FIG. 62 in accordance with at least one example embodiment.

In at least one example embodiment, the interior peripheral wall portion 6010 includes an exterior or outer surface 6500. The exterior surface 6500 may define a plurality of depressions or channels 6502. In at least one example embodiment, each of the depressions 6502 defines a substantially trapezoidal profile. An interior or inner surface 6504 of the interior peripheral wall portion 6010 may define a respective plurality of protrusions 6506 opposite the depressions 6502. In at least one example embodiment, the depressions 6502 may be configured to receive the wedges 6100 of the frame 6000 (shown in FIG. 62).

In at least one example embodiment, the interior peripheral wall portion 6010 further includes a plurality of ridges 6508 adjacent to the plurality of depressions 6502, respectively. Each of the ridges 6508 may be between a respective one of the depressions 6502 and an upper surface 6510 of the interior peripheral wall portion 6010 and an upper surface 6512 of the receptacle wall portion 6012 along the vertical axis 5020.

The intermediate wall 5904 may extend between opposing sides of the interior peripheral wall portion 6010. An upper surface 6520 of the intermediate wall 5904 may be offset from the upper surface 6510 of the interior peripheral wall portion 6010. In at least one example embodiment, the upper surface 6520 of the intermediate wall 5904 projects past the upper surface 6510 of the interior peripheral wall portion 6010 along the vertical axis 5020.

Figure 69:
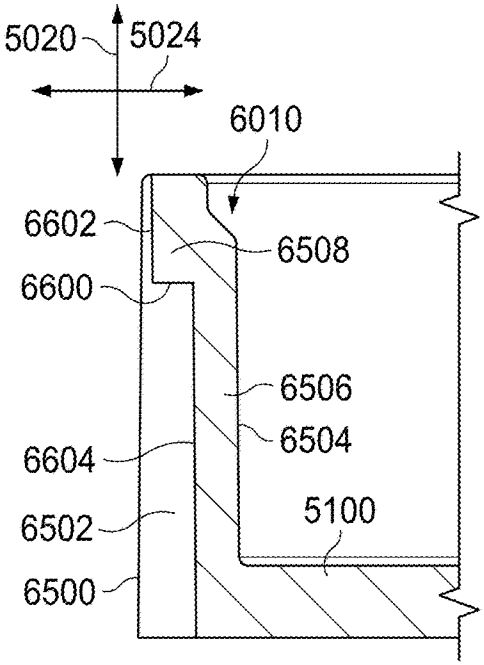
FIG. 69 is a partial sectional view of the insert of FIG. 68 taken at line 69-69 of FIG. 68 in accordance with at least one example embodiment.

FIG. 69 is a partial sectional view of the insert of FIG. 68 taken at line 69-69 of FIG. 68 in accordance with at least one example embodiment.

In at least one example embodiment, as shown in FIG. 69, each of the ridges 6508 includes a lower surface 6600 and an exterior or outer surface 6602. The exterior surface 6602 of the ridge 6508 may be between the exterior surface 6500 of the interior peripheral wall portion 6012 and an exterior or outer surface 6604 of the depression 6502 along the transverse axis 5024. Each of the exterior surfaces 6602, 6500, 6602 may be substantially parallel to a plane defined by the vertical axis 5020 and the longitudinal axis 5022.

The lower surface 6600 of the ridge 6508 may at partially define the depression 6502. The lower surface 6600 may be substantially parallel to a plane defined by the longitudinal and transverse axes 5022, 5024. In at least one example embodiment, the upper surface 6600 may be substantially horizontal.

Figure 70:
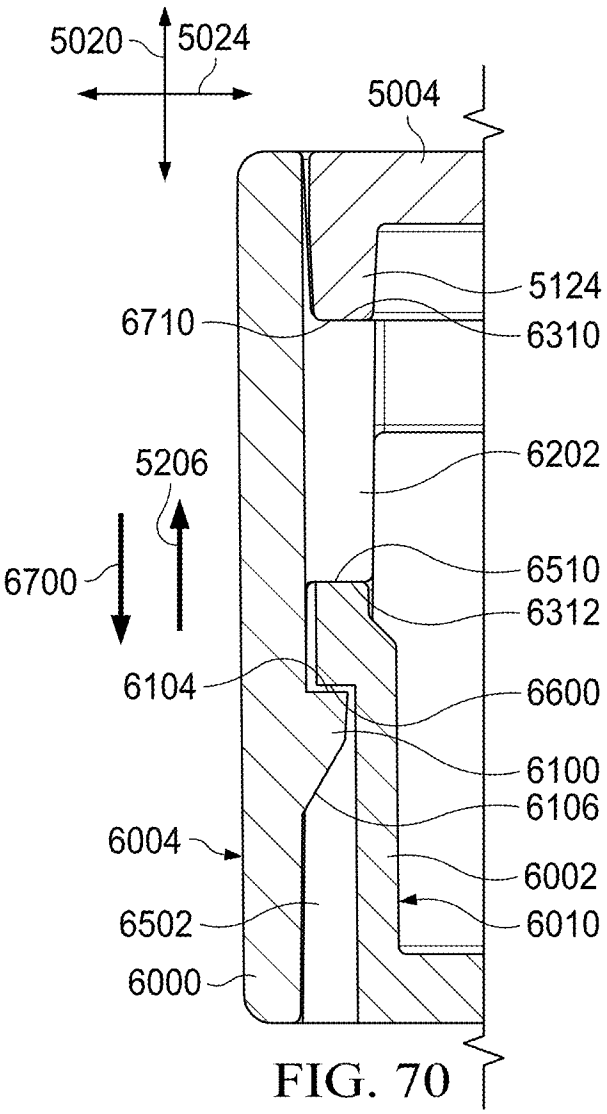
FIG. 70 is a partial sectional view of the container of FIG. 48 taken at line 70-70 of FIG. 48 in accordance with at least one example embodiment.

FIG. 70 is a partial sectional view of the container of FIG. 48 taken at line 70-70 of FIG. 48 in accordance with at least one example embodiment.

In at least one example embodiment, as shown in FIG. 70, as the insert 6002 is assembled to the frame 6000, the angled surface 6106 of each of the wedges 6100 slides past the respective ridge 6508. As the wedge 6100 slides past the ridge 6508, the exterior peripheral wall portion 6004 may flex outwardly along the longitudinal axis 5022. When the insert 6002 is assembled to the frame 6000, each of the wedges 6100 may be at least partially in a respective one of the depressions 6502.

In at least one example embodiment, the each of the ridges 6508 may engage a respective one of the wedges 6100 to facilitate retention of the insert 6002 to the frame 6000.

More specifically, the lower surface 6600 of the ridge 6508 may engage the upper surface 6104 of the wedge 6100 to reduce or prevent movement of the of the insert 6002 in a fourth direction 6700 opposite the second direction 5206 with respect to the frame 6000 and/or the frame 6000 in the second direction 5206 with respect to the insert 6202. In at least one example embodiment, the upper surface 6510 of the interior peripheral wall portion 6010 and the upper surface 6512 of the interior receptacle wall portion 6012 (shown in FIG. 68) may engage the lower surface 6312 of the stops 6200, 6202, 6204 (shown in FIG. 65) to facilitate retention of the insert 6002 to the frame 6000.

In at least one example embodiment, the skirt 5124 of the lid 5004 engages the stops 6200, 6202, 6204 (shown in FIG. 65) to reduce or prevent movement of the lid 5004 in the fourth direction 6700. More specifically, a lower surface 6710 of the skirt 5124 of the lid 5004 may engage the upper surfaces 6310 of the stops 6200, 6202, 6204 (shown in FIG. 65).

Figure 71:
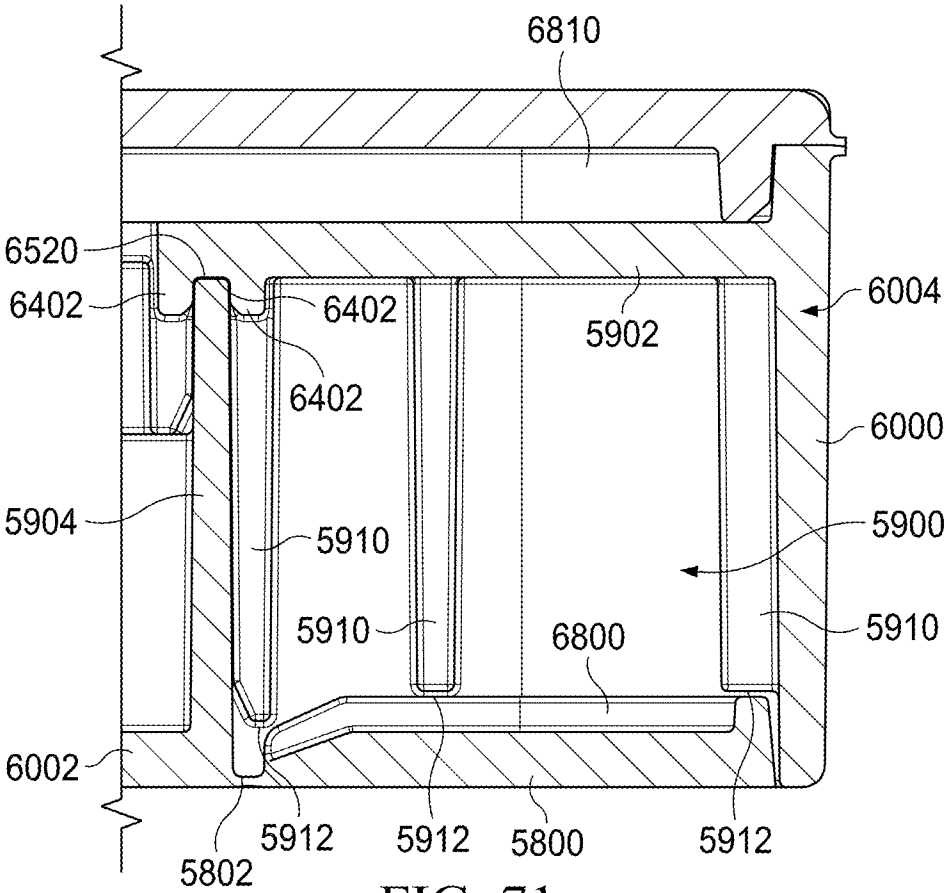
FIG. 71 is a partial sectional view of the container of FIG. 48 taken at line 71-71 of FIG. 48 in accordance with at least one example embodiment.

FIG. 71 is a partial sectional view of the container of FIG. 48 taken at line 71-71 of FIG. 48 in accordance with at least one example embodiment.

In at least one example embodiment, as shown in FIG. 71, when the insert 6002 is assembled to the frame 6000, a portion of the intermediate wall 5904 including the upper surface 6520 of the intermediate wall 5904 is in the channel 6404 of the transverse wall 5902, between the pair of parallel ridges 6402. The block surfaces 5912 may engage a skirt 6800 of the secondary lid 5800. The transverse wall 5902, the intermediate wall 5904, the exterior peripheral wall portion 6004, and the secondary lid 5800 cooperate to define the secondary storage area 5900. The lid 5004 may be spaced from the transverse wall 5902 by a gap 5810. The insert 6002 and frame 6000 may be used in other example embodiments described herein.

In at least one example embodiment, the package may include features of other example embodiments described herein and/or other example embodiments may include features of the package as described above.

Fifth Example Embodiment

Figure 72:
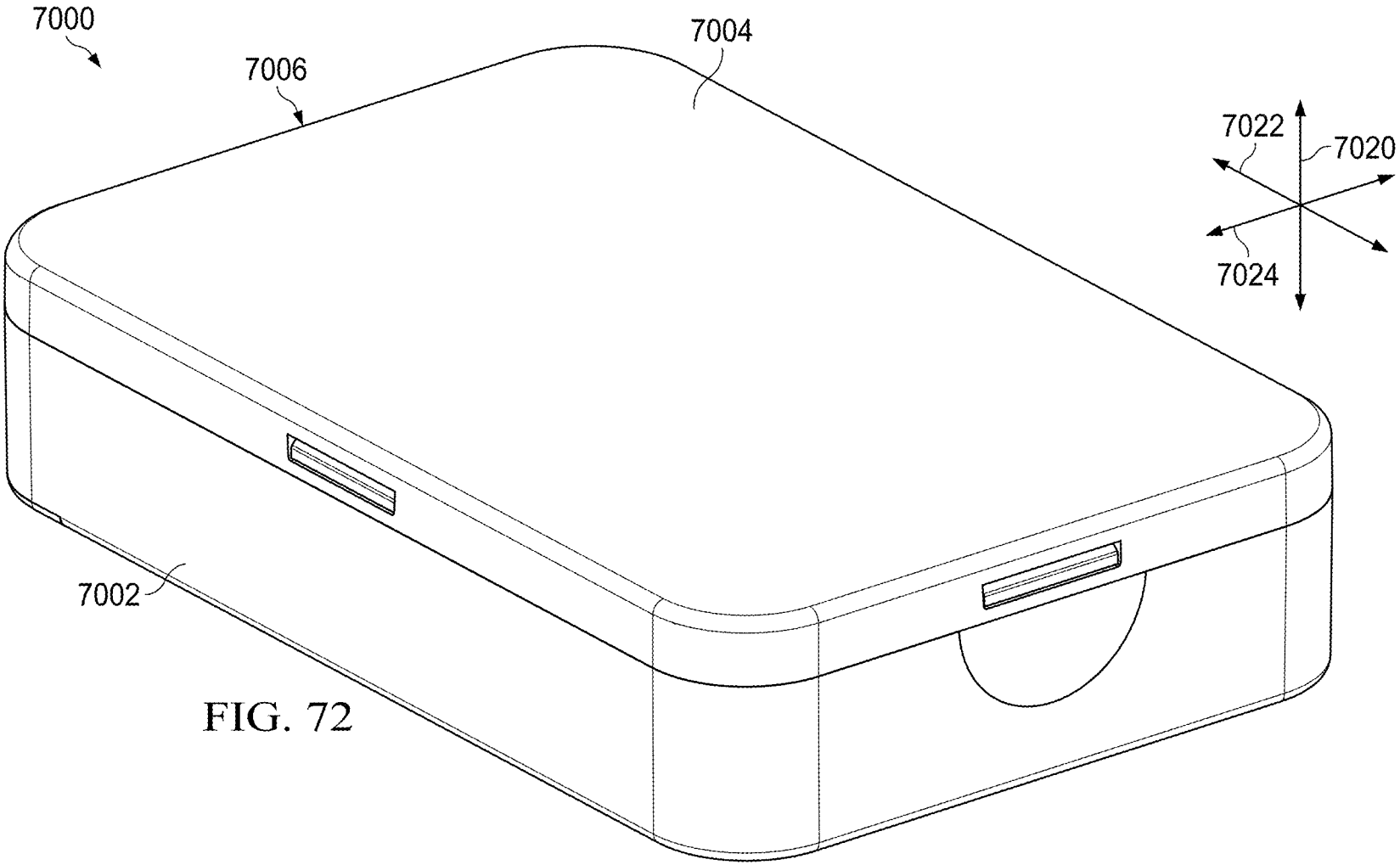
FIG. 72 is a top front perspective view of a container (or package) in a closed and locked configuration in accordance with at least one example embodiment.

FIG. 72 is a top front perspective view of a container or package in a closed configuration in accordance with at least one example embodiment.

In at least one example embodiment, as shown in FIG. 72, a container or package 7000 is provided. The container 7000 may be the same as the package 100 of FIGS. 1-13 except as described below. The container 7000 includes a base 7002 and a lid or primary lid 7004. The base 7002 and the lid 7004 may be coupled to one another. The base 7002 and the lid 7004 may be pivotally connected. In at least one example embodiment, the base 7002 and the lid 7004 are coupled by a hinge, such as a living hinge 7006. The container 7000 is movable between a closed and locked configuration or position, as shown, and an open configuration or position (shown in FIG. 73). In at least one example embodiment, the container 7000 moves or articulates through a closed and unlocked configuration or position between the closed and locked configuration and the open configuration.

The container 7000 may define an orthogonal coordinate system. The orthogonal coordinate system may include a first axis, a second axis, and a third axis. In at least one example embodiment, the first axis is a vertical axis 7020, the second axis is a longitudinal axis 7022, and the third axis is a transverse axis 7024.

Figure 73:
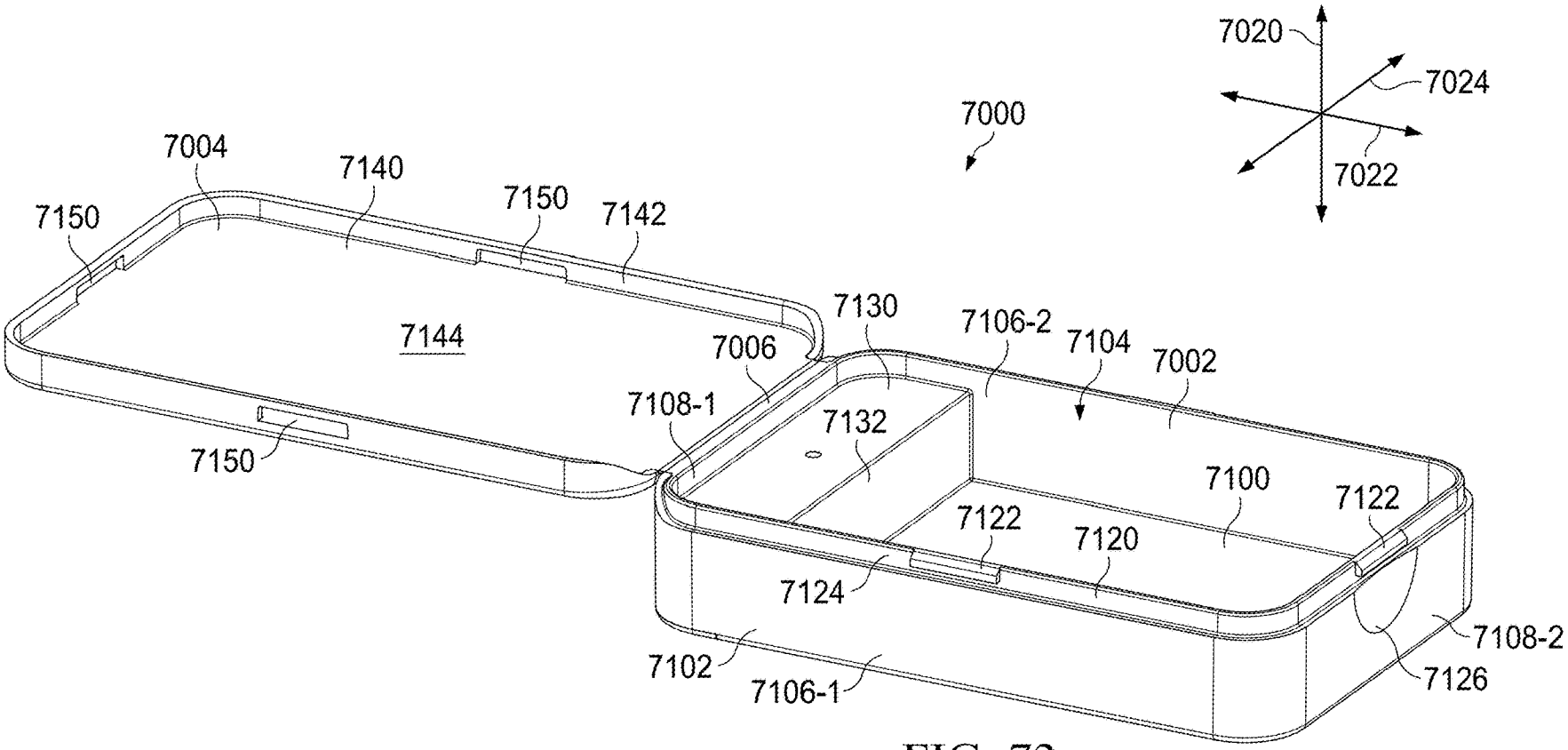
FIG. 73 is a top front perspective view of the container of FIG. 72 in an open configuration in accordance with at least one example embodiment.

FIG. 73 is a top front perspective view of the container of FIG. 72 in an open configuration in accordance with at least one example embodiment.

Figure 74:
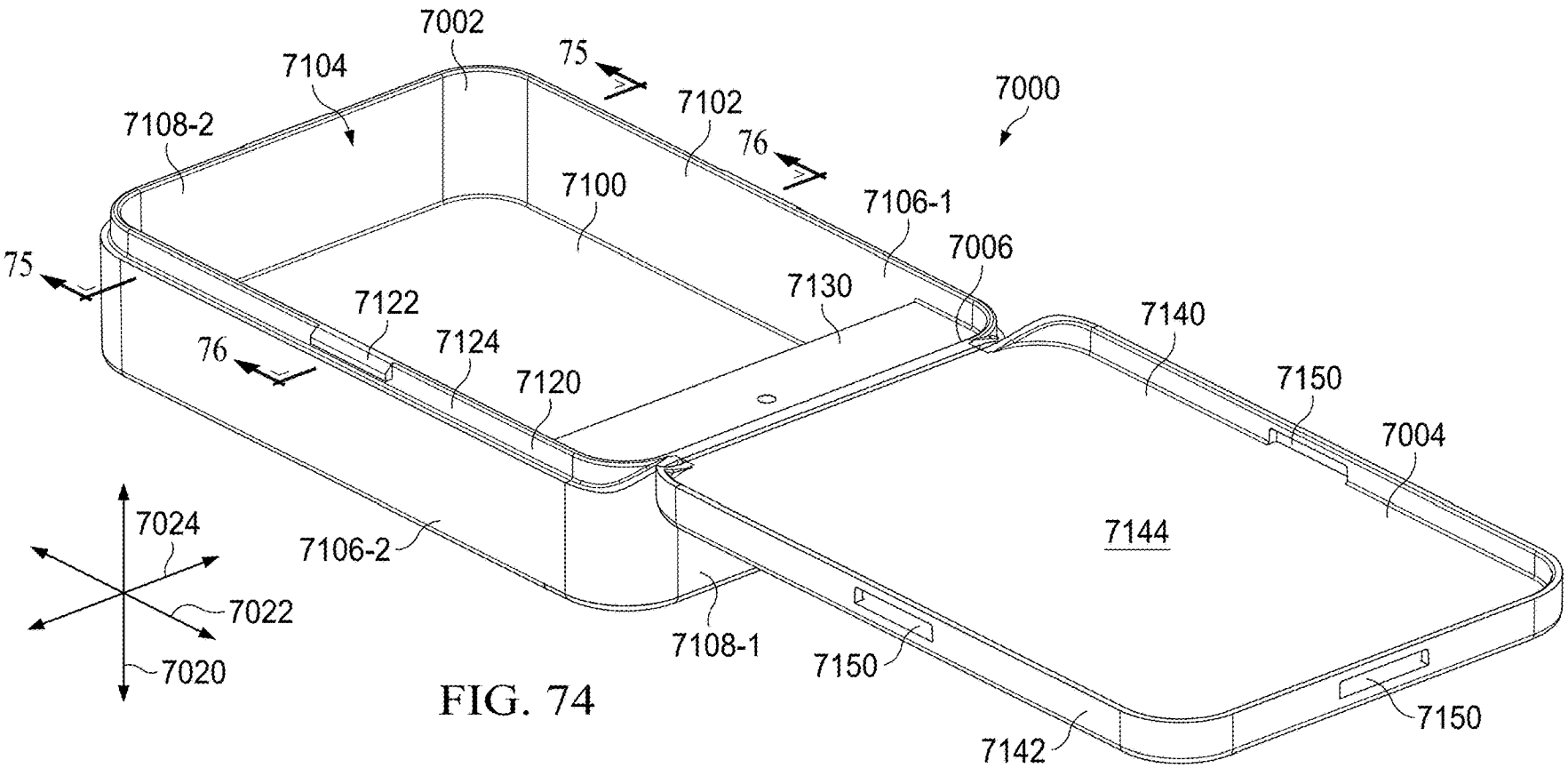
FIG. 74 is a top back perspective view of the container of FIG. 72 in the open configuration in accordance with at least one example embodiment.

FIG. 74 is a top back perspective view of the container of FIG. 72 in the open configuration in accordance with at least one example embodiment.

In at least one example embodiment, as shown in FIGS. 73-74, the base 7002 includes a bottom wall or floor 7100 and a peripheral or outer wall 7102. The base 7002 and the peripheral wall 7102 cooperate to at least partially define a storage area or primary storage area 7104. The base 7002 and peripheral wall 7102 may be a single, integral piece. In the closed and locked configuration (shown in FIG. 72), the lid 7004 prevents and/or reduces access to the storage area 7104. In the open configuration, the storage area 7104 is accessible.

In at least one example embodiment, the peripheral wall 7102 includes a pair of opposing side walls and a pair of opposing end walls. The pair of opposing side walls may include a first side wall 7106-1 and a second side wall 7106-2. The pair of opposing end walls may include a first end wall 7108-1 and a second end wall 7108-2. The hinge 7006 may be coupled to or integrally formed with the first end wall 7108-1.

Each of the side walls 7106-1, 7106-2 may define a first length substantially parallel to the longitudinal axis 7022. Each of the end walls 7108-1, 7108-2 may define a second length substantially parallel to the transverse axis 7024. In at least one example embodiment, the container 7000 defines a substantially rectangular profile such that the second length is shorter than the first length.

In at least one example embodiment, the base 7002 includes a connection rim 7120 configured to be at least partially within the lid 7004 when the lid 7004 is in the closed configuration (both locked and unlocked). The connection rim 7120 may extend around at least a portion of the peripheral wall 7102. The connection rim 7120 may be recessed with respect to the peripheral wall 7102, such that when the container is closed, an outer surface of the lid 7004 is flush with an outer surface of the peripheral wall 7102.

In at least one example embodiment, the base 7002 includes a plurality of protrusions or wedges 7122. The protrusions 7122 may extend from an exterior or outer surface 7124 of the connection rim 7120. The protrusions 7122 will be described in greater detail below in connection with FIGS. 76-78.

In at least one example embodiment, the peripheral wall 7102 defines an indentation 7126. In at least one example embodiment, the indentation 7126 is defined by the second end wall 7108-2. The indentation 7126 may be configured to provide access to an underside of the lid 7004 to facilitate moving the lid 7004 from the closed configuration to the open configuration, as will be described in greater detail below.

In at least one example embodiment, the base 7002 further includes a transverse wall or top wall 7130 and an intermediate wall or third end wall 7132. The transverse wall 7130 may extend substantially parallel to the bottom wall 7100. The intermediate wall 7132 may extend substantially parallel to the end walls 7108-1, 7108-2.

In at least one example embodiment, the lid 7004 includes a top wall 7140 and a skirt 7142. The skirt 7142 may project from the top wall 7140. The skirt 7142 may extend around at least a portion of a periphery of an interior or inner surface 7044 of the top wall 7140.

In at least one example embodiment, the skirt 7142 may define a plurality of receptacles 7150. Each of the receptacles 7150 may be configured to receive a respective one of the protrusions 7122 so as to retain the lid 7004 in the closed and locked configuration, as will be described in greater detail below. In at least one example embodiment, the plurality of receptacles 7150 is a plurality of apertures, as shown. In other example embodiments, the plurality of receptacles 7150 is a plurality of recesses.

Figure 75:
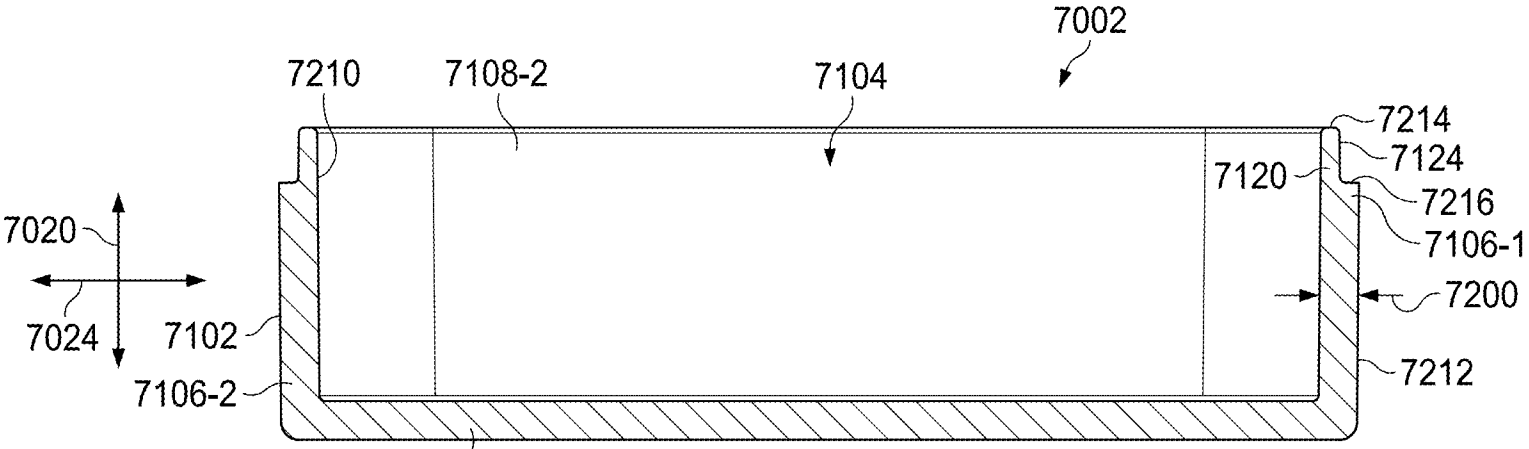
FIG. 75 is a sectional view of a base of the container of FIG. 72 taken along line 75-75 of FIG. 74 in accordance with at least one example embodiment.

FIG. 75 is a sectional view of the container of FIG. 72 taken along line 75-75 of FIG. 74 in accordance with at least one example embodiment.

In at least one example embodiment, as shown in FIG. 75, the peripheral wall 7102 may define an average thickness 7200. In at least one example embodiment, the average thickness 7200 is greater than or equal to about 1 mm (e.g., greater than or equal to about 1.25 mm, optionally greater than or equal to about 1.5 mm, optionally greater than or equal to about 1.75 mm, optionally greater than or equal to about 2 mm, optionally greater than or equal to about 2.5 mm, optionally greater than or equal to about 3 mm, or optionally greater than or equal to about 4 mm). In at least one example embodiment, the average thickness 7200 is less than or equal to about 5 mm (e.g., less than or equal to about 4 mm, less than or equal to about 3 mm, less than or equal to about 2.5 mm, less than or equal to about 2 mm, less than or equal to about 1.75 mm, less than or equal to about 1.5 mm, or less than or equal to about 1.25 mm). In at least one example embodiment, the average thickness 7200 ranges from about 1 mm to about 3 mm (e.g., about 1.5 mm to about 2 mm, or about 1.75 mm).

The peripheral wall 7102 may include an interior or inner surface 7210 and an exterior or outer surface 7212. In at least one example embodiment, the peripheral wall 7102 includes an upper surface 7214 on the connection rim 7120 and an intermediate surface or step 7216 adjacent to the connection rim 7120. The upper surface 7214 and the intermediate surface 7216 may be substantially parallel to the bottom wall 7100. The exterior surface 7124 of the connection rim 7120 may be recessed with respect to the exterior surface 7212 of the peripheral wall 7102.

Figure 76:
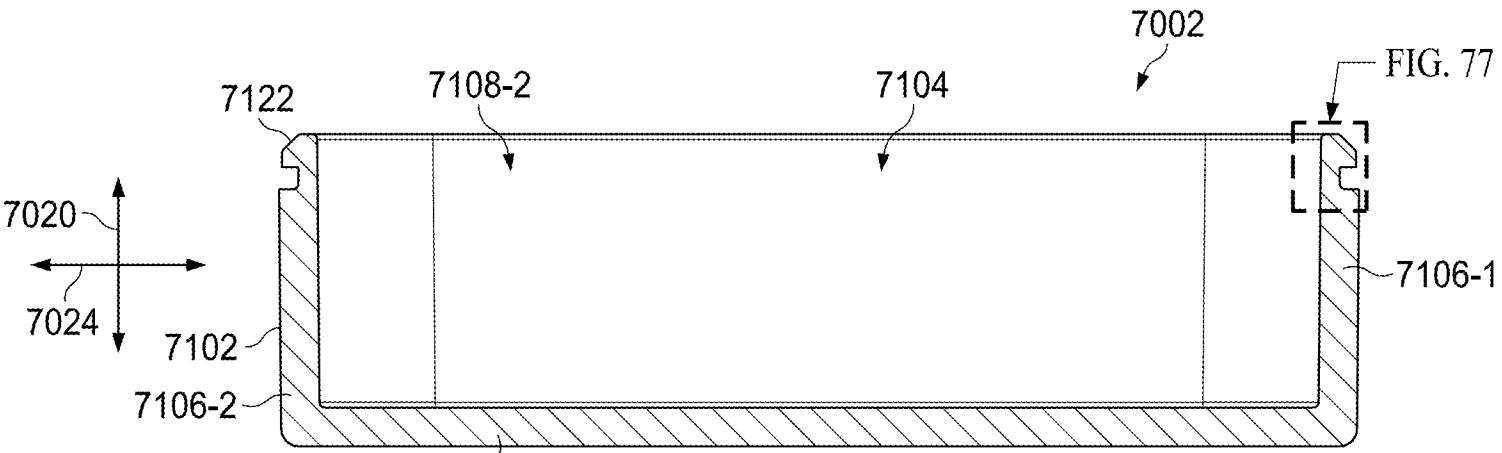
FIG. 76 is another sectional view the base of FIG. 75 taken along line 76-76 of FIG. 74 in accordance with at least one example embodiment.

FIG. 76 is another sectional view of the container of FIG. 72 taken along line 76-76 of FIG. 74 in accordance with at least one example embodiment.

Figure 77:
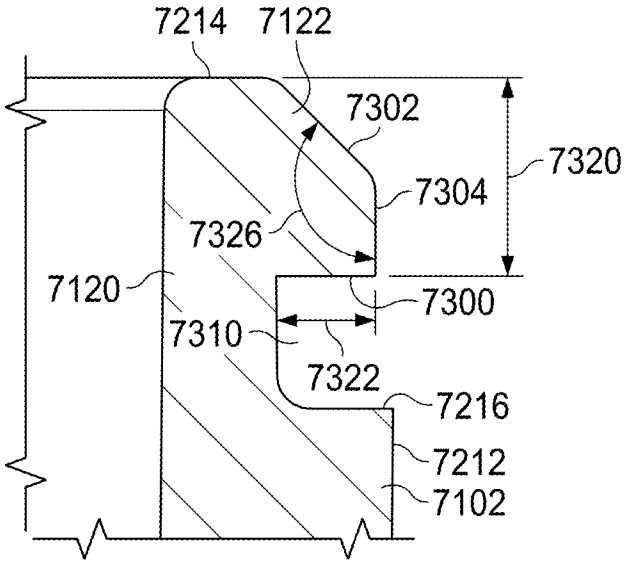
FIG. 77 is a detail sectional view of a protrusion of the base of FIG. 76 in accordance with at least one example embodiment.

FIG. 77 is a detail sectional view of a protrusion of the base of FIG. 76 in accordance with at least one example embodiment.

Figure 78:
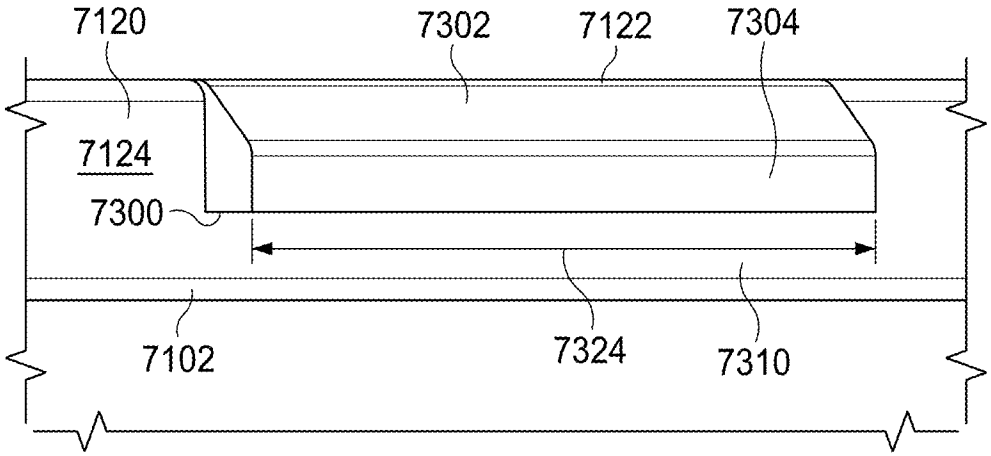
FIG. 78 is a partial perspective view of the protrusion of FIG. 77 in accordance with at least one example embodiment.

FIG. 78 is a partial perspective view of the protrusion of FIG. 77 in accordance with at least one example embodiment.

In at least one example embodiment, as shown in FIGS. 76-78, each of the protrusions 7122 includes a first or lower surface (or stop) 7300, a second or upper surface 7302, and a third or interior surface 7304. The first surface 7300 may be substantially parallel to the bottom wall 7100. The first surface 7300 of each of the protrusions 7122 may be configured to engage a portion of the lid 7004 (shown in FIG. 72) so as to retain the lid 7004 in the closed configuration. The first surface 7300 may extend substantially parallel to a plane defined by the longitudinal and transverse axes 7022, 7024. The second surface 7302 may be sloped or angled with respect to the first surface 7300, such that the lid 7004 readily and/or easily slides along the second when the lid 7004 is moved from the open configuration to the closed and locked configuration. The third surface 7304 may be between the first and second surfaces 7300, 7304 along the vertical axis 7020.

In at least one example embodiment, the protrusions 7122 are adjacent to and/or protrude from the upper surface 7214 of the connection rim 7120. Each of the protrusions 7122 may cooperate with the exterior surface 7124 of the connection rim 7120 and the intermediate surface 7216 of the peripheral wall 7102 to at least partially define a gap 7310.

In at least one example embodiment, the third surface 7304 of each of the protrusions 7122 is recessed with respect to the exterior surface 7212 of the peripheral wall 7102, as shown. In other example embodiments, the third surface 7304 of each of the protrusions 7122 may be aligned or coplanar with respect to the exterior surface 7212 of the peripheral wall 7102. In other example embodiments, the third surface 7304 of each of the protrusions 7122 projects with respect to the exterior surface 7212 of the peripheral wall 7102.

In at least one example embodiment, each of the protrusions 7122 defines a height 7320, a thickness 7322, and a length 7324. Each of the protrusions 7122 further defines an angle 7326 between the second and third surfaces 7302, 7304. The angle 7326 facilitates sliding the lid 7004 over the protrusion 7122 to move the lid 7004 from the open configuration to the closed and locked configuration. In at least one example embodiment, the angle 7326 is greater than or equal to about 30° (e.g., greater than or equal to about 35°, greater than or equal to about 40°, greater than or equal to about 45°, or greater than or equal to about 50°). In at least one example embodiment, the angle 7326 is less than or equal to about 60° (e.g., less than or equal to about 55°, less than or equal to about 50°, less than or equal to about 45°, less than or equal to about 40°, or less than or equal to about 35°). In at least one example embodiment, the angle 7326 ranges from 35° to about 55° (e.g., about 40° to about 50°, or about 45°).

In at least one example embodiment, the height 7320 is a height between a highest point and a lowest point on the protrusion 7122, such as parallel to the vertical axis 7020. In at least one example embodiment, the height 7320 is greater than or equal to about 1 mm (e.g., greater than or equal to about 1.25 mm, greater than or equal to about 1.5 mm, greater than or equal to about 1.75 mm, greater than or equal to about 2 mm, or greater than or equal to about 2.5 mm). In at least one example embodiment, the maximum height 7320 is less than or equal to about 3 mm (e.g., less than or equal to about 2.5 mm, less than or equal to about 2 mm, less than or equal to about 1.75 mm, less than or equal to about 1.5 mm, or less than or equal to about 1.25 mm). In at least one example embodiment, the maximum height 7320 ranges from 1 mm to 2 mm (e.g., 1.25 mm to 1.75, or about 1.5 mm).

In at least one example embodiment, the thickness 7322 is a thickness between a point closest to the connection rim 7120 and a point furthest from the connection rim 7120 on the protrusion 7122. In at least one example embodiment, the thickness 7322 is greater than or equal to about 0.1 mm (e.g., greater than or equal to about 0.25 mm, greater than or equal to about 0.5 mm, greater than or equal to about 0.75 mm, greater than or equal to about 1 mm, or greater than or equal to about 1.5 mm). In at least one example embodiment, the thickness 7322 is less than or equal to about 2 mm (e.g., less than or equal to about 1.5 mm, less than or equal to about 1 mm, less than or equal to about 1.75 mm, less than or equal to about 1.5 mm, or less than or equal to about 1.25 mm). In at least one example embodiment, the thickness 7322 ranges from 1 mm to 2 mm (e.g., 0.5 mm to 2, or about 0.75 mm, or about 1.5 mm.

In at least one example embodiment, the maximum length 7324 is greater than or equal to about 1 mm (e.g., greater than or equal to about 5 mm, greater than or equal to about 8 mm, or greater than or equal to about 10 mm). In at least one example embodiment, the length 7324 is less than or equal to about 20 mm (e.g., less than or equal to about 15 mm, less than or equal to about 12 mm, less than or equal to about 10 mm, less than or equal to about 8 mm). In at least one example embodiment, the length 7324 ranges from about 1 mm to about 20 mm (e.g., about 5 mm to about 15 mm, about 8 mm to about 12, or about 10 mm).

Figure 79:
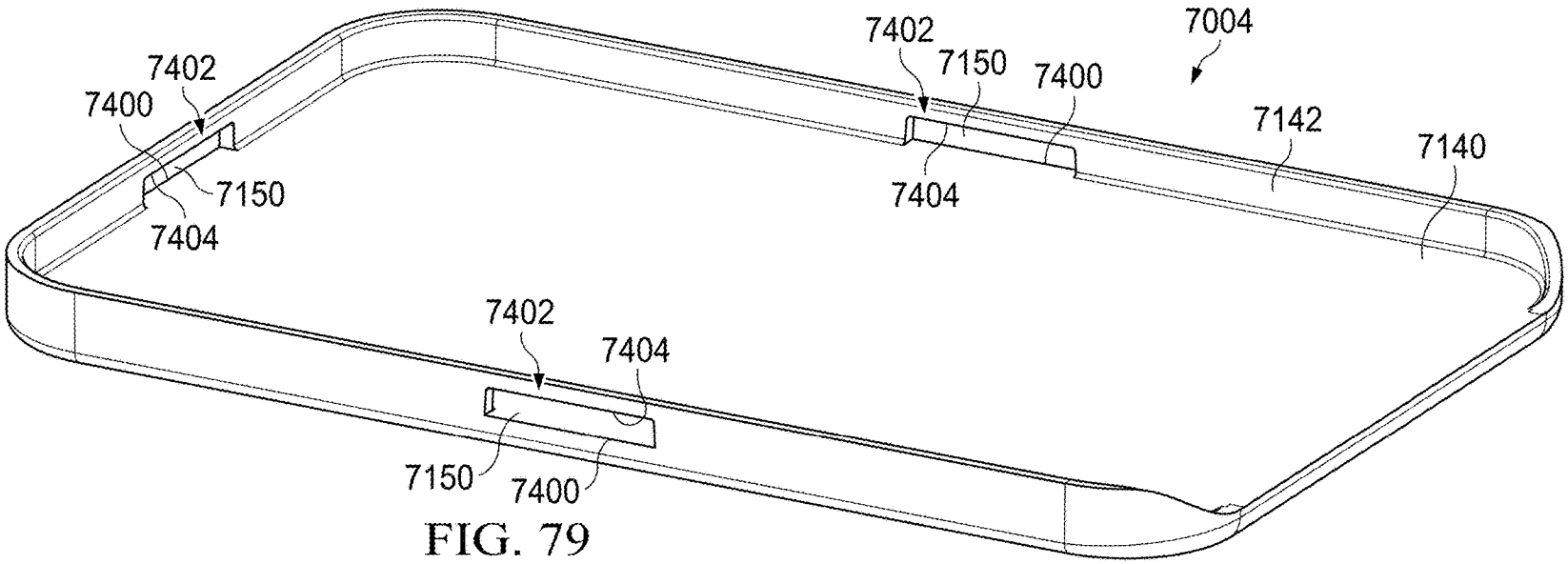
FIG. 79 is a perspective view of an inside of a lid of the container of FIG. 72 in accordance with at least one example embodiment.

FIG. 79 is a perspective view of an inside of a lid of the container of FIG. 72 in accordance with at least one example embodiment.

Figure 80:
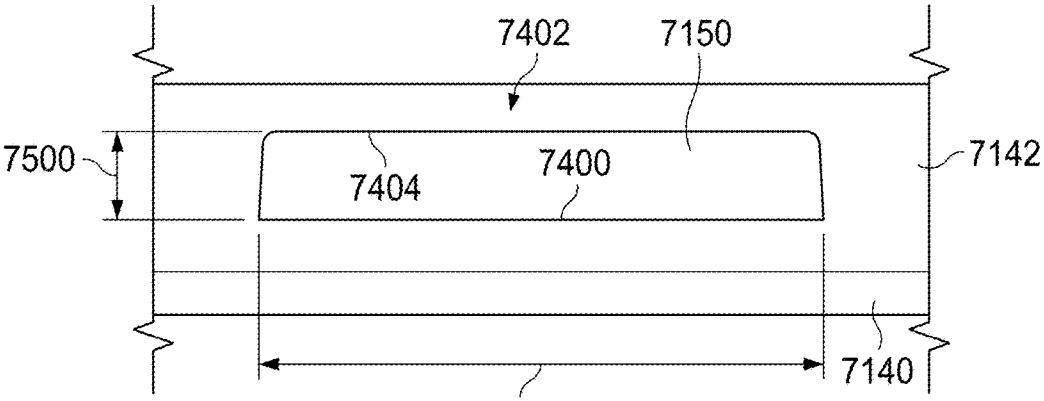
FIG. 80 is a partial side view of a skirt of the lid of FIG. 79 including a receptacle in accordance with at least one example embodiment.

In at least one example embodiment, as shown in FIG. 79-80, the skirt 7142 and the top wall 7140 cooperate to define each of the receptacles 7150. In other example embodiments, receptacles 7150 may be spaced apart from the top wall 7140 and completely defined by the skirt 7142. The top wall 7140 may define a proximal side 7400 of each of the receptacles 7150. A bridge portion 7402 of the skirt 7142 may extend adjacent to a distal side 7404 of the each of the receptacles 7150.

FIG. 80 is a partial side view of a skirt of the lid of FIG. 79 including a receptacle in accordance with at least one example embodiment.

In at least one example embodiment, as shown in FIG. 80, each of the plurality of receptacles 7150 may define a substantially rectangular profile. The receptacles 7150 may have sharp corners, rounded corners, or a combination of sharp corners and round corners, as shown (e.g., two sharp corners and two round corners). Each receptacle 7150 may define a height 7500 and a length 7502. In at least one example embodiment, the length 7502 may be greater than the height 7500. In other example embodiments, the receptacles may define other shapes, such as trapezoidal, elliptical, triangular, or any other shape suitable to receive a protrusion.

In at least one example embodiment, the height 7500 is greater than or equal to about 1 mm (e.g., greater than or equal to about 1.25 mm, greater than or equal to about 1.5 mm, greater than or equal to about 1.75 mm, greater than or equal to about 2 mm, or greater than or equal to about 2.5 mm). In at least one example embodiment, the height 7500 is less than or equal to about 3 mm (e.g., less than or equal to about 2.5 mm, less than or equal to about 2 mm, less than or equal to about 1.75 mm, less than or equal to about 1.5 mm, or less than or equal to about 1.25 mm). In at least one example embodiment, the height 7500 ranges from 1 mm to 2 mm (e.g., 1.25 mm to 1.75, about 1.5 mm, about 1.6 mm, or about 1.63 mm).

In at least one example embodiment, the length 7502 is greater than or equal to about 1 mm (e.g., greater than or equal to about 5 mm, greater than or equal to about 8 mm, or greater than or equal to about 10 mm). In at least one example embodiment, the length 7502 is less than or equal to about 20 mm (e.g., less than or equal to about 15 mm, less than or equal to about 12 mm, less than or equal to about 10 mm, less than or equal to about 8 mm). In at least one example embodiment, the length 7502 ranges from about 1 mm to about 20 mm (e.g., about 5 mm to about 15 mm, about 8 mm to about 12, about 10 mm, about 10.5 mm, or about 10.42 mm).

In at least one example embodiment, the receptacles of other example embodiments may have a same or similar structure to the receptacle 7150 described above.

Figure 81:
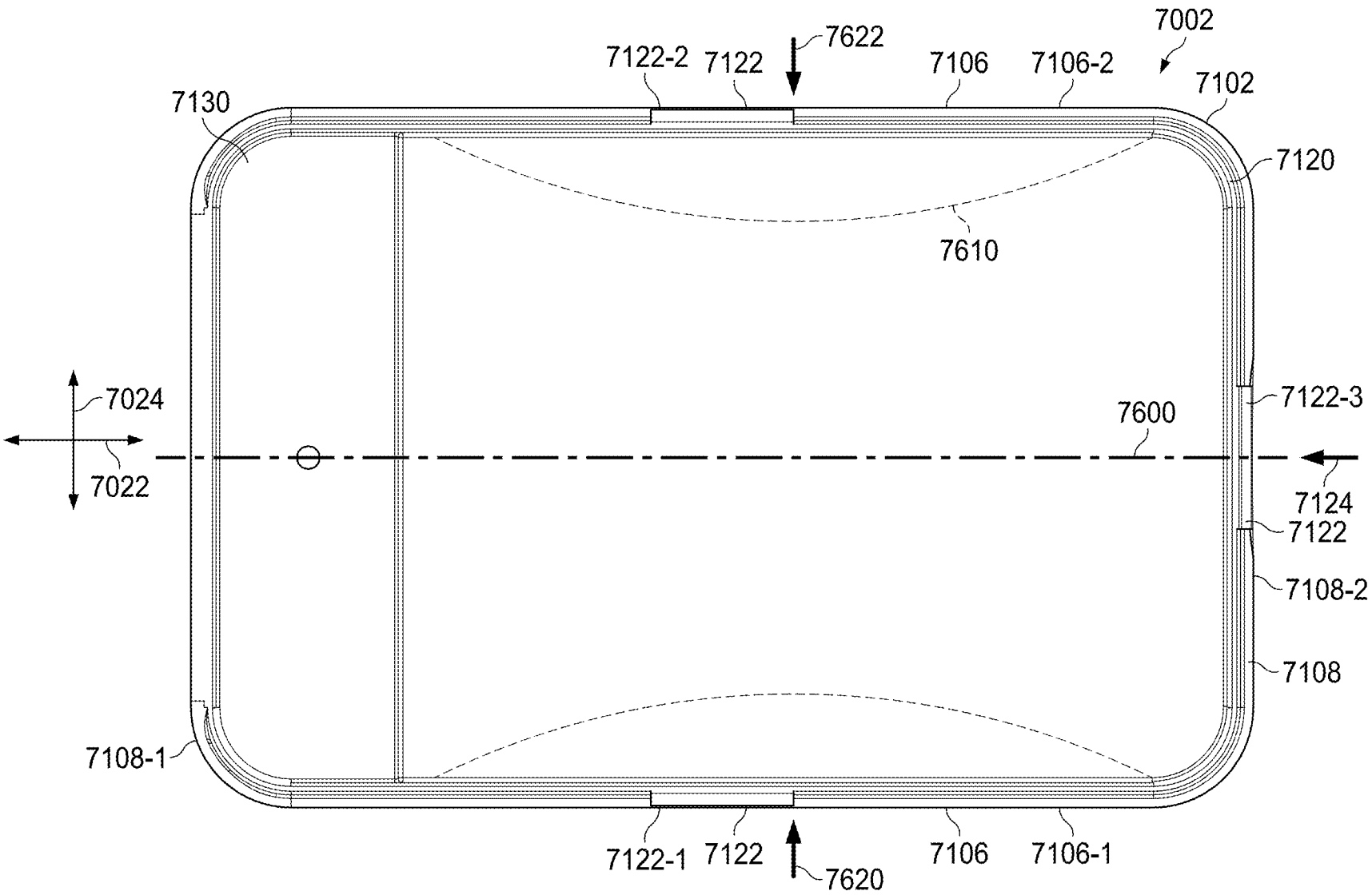
FIG. 81 is a top view of the base of FIG. 75 in accordance with at least one example embodiment.

FIG. 81 is a top view of the base of FIG. 75 in accordance with at least one example embodiment.

In at least one example embodiment, the plurality of protrusions 7122 includes three protrusions. A first protrusion 7122-1 may be on the first side wall 7106-1, a second protrusion 7122-2 may be on the second side wall 7106-2, and a third protrusion 7122-3 may be on the second end wall 7108-2. In other example embodiments, the plurality of protrusions includes a pair of protrusions or more than three protrusions (e.g., four protrusions, five protrusions, six protrusions, seven protrusions, eight protrusions, nine protrusions, or ten protrusions or more). In at least one example embodiment, a pair of protrusions is on a respective pair of side walls. In at least one example embodiment, the protrusions 7122 may be discrete and spaced apart from another, as shown. The protrusions 7122 may be present on a portion of the side and end walls 7106, 7108 (e.g., three side and end walls 7106, 7108, as shown), or all of the side/and end walls 7106, 7108. Where protrusions 7122 are present, the respective side or end wall 7106, 7108 may include a single protrusion 7122, as shown, or multiple protrusions 7122. The protrusions 7122 may be present on a portion of a length (e.g., parallel to the longitudinal axis 7022) of a side or end wall 7106, 7108, as shown, or substantially an entire length of a side or end wall 7106, 7108.

In at least one example embodiment, the first and second protrusions 7122-1, 7122-2 are symmetric about a center plane 7600 defined by the vertical and longitudinal axes 7020, 7022. That is, the first and second protrusions 7122-1, 7122-2 are equidistant to the first end wall 4108-1, at a common location along the longitudinal axis 7022. In other example embodiments, the first and second protrusions 7122-1, 7122-2 are asymmetric about the center plane 7600.

In at least one example embodiment, the first and second protrusions 7122-1, 7122-2 are centered along the longitudinal axis 7022. That is, the first and second protrusions 7122-1, 7122-2 are equidistant to the first and second end walls 7108-1, 7108-2. In other example embodiments, the first and second protrusions 7122-1, 7122-2 are closer to the first end wall 7108-1 or the second end wall 7108-2.

In at least one example embodiment the third protrusion 7122-3 is transversely centered on the second end wall 7108-2. That is, the protrusion 7122-3 is centered along the transverse axis 7024 and intersecting the center plane 7600. In other example embodiments, the third protrusion 7122-3 is off-center with respect to the center plane 7600.

In at least one example embodiment, the peripheral wall 7102 is flexible. The peripheral wall 7102 may be flexible between a relaxed position, as shown, and a flexed position, as indicated at 7610. The flexibility may be facilitated by material and dimensions (e.g., thickness 7200 shown in FIG. 75) of the peripheral wall 7102.

The peripheral wall 7102 may be moved from the relaxed configuration to the flexed configuration by applying a first force to the first side wall 7106-1 in a first direction 7620 and a second force to the second side wall 7106-2 in a second direction 7622 different from the first direction 7620. In at least one example embodiment, the second direction 7622 is parallel to and opposite of the first direction 7620. In at least one example embodiment, the first and second directions 7620, 7622 are both substantially parallel to the transverse axis 7024.

In at least one example embodiment, the peripheral wall 7102 may be moved from the relaxed configuration to the flexed configuration by applying the first force to the first side wall 7106-1 in the first direction 7620, the second force to the second side wall 7106-2 in the second direction 7622, and a third force to the second end wall 7108-2 in a third direction 7624 different from the first direction 7620 and the second direction 7622. In at least one example embodiment, the third direction 7624 is substantially perpendicular to the first direction 7620 and the second direction 7622. In at least one example embodiment, the third direction 7624 is substantially parallel to the longitudinal axis 7022.

Figure 82:
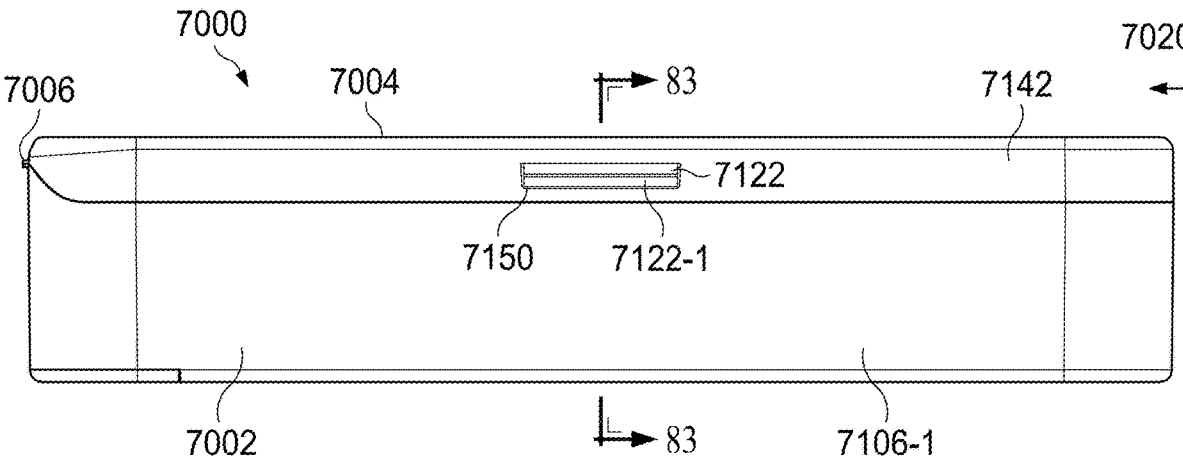
FIG. 82 is a side view of the container of FIG. 72 in the closed and locked configuration according to at least one example embodiment.

FIG. 82 is a side view of the container of FIG. 72 in the closed and locked configuration according to at least one example embodiment.

Figure 83:
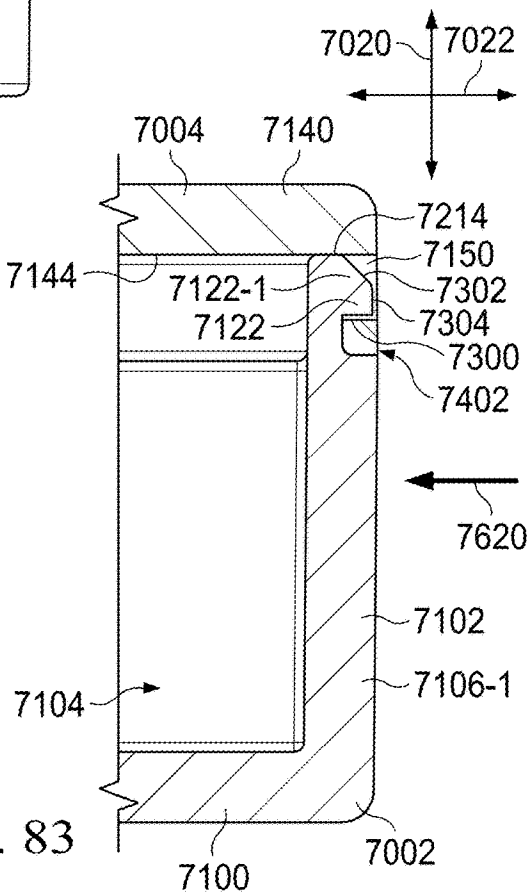
FIG. 83 is a partial sectional view of the container of FIG. 82 taken along line 83-83 of FIG. 82.

FIG. 83 is a partial sectional view of the container of FIG. 82 taken at line 83-83 of FIG. 82.

Figure 84:
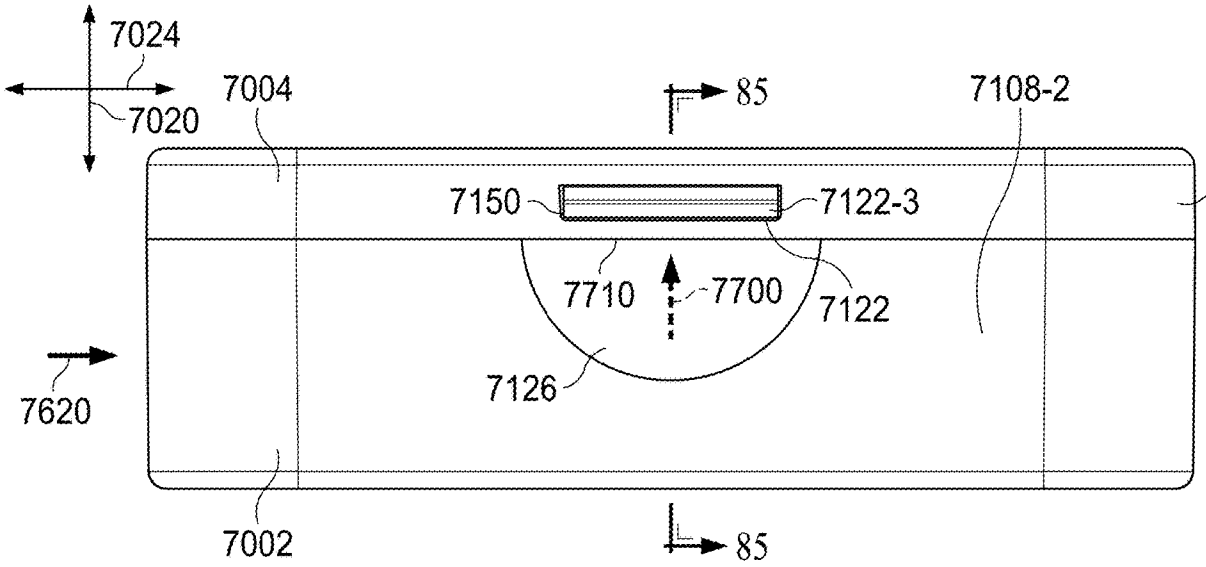
FIG. 84 is an end view of the container of FIG. 72 in the closed and locked configuration according to at least one example embodiment.

FIG. 84 is an end view of the container of FIG. 72 in the closed and locked configuration according to at least one example embodiment.

Figure 85:
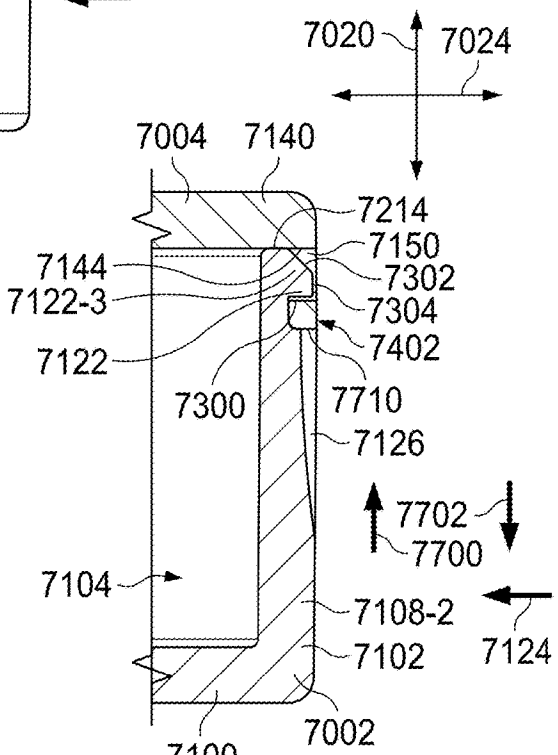
FIG. 85 is a partial sectional view of the container of FIG. 84 taken along line 85-85 of FIG. 84.

FIG. 85 is a sectional view of the container of FIG. 84 taken at line 85-85 of FIG. 84.

In at least one example embodiment, as shown in FIGS. 82-85, in the closed and locked configuration, each of the protrusions 7122 is received in a respective receptacle 7150. The protrusions 7122 may be recessed (as shown) or aligned with the skirt 7142 such that they do not extend beyond the skirt 7142. In other example embodiments, the protrusions 7122 may project beyond the skirt 7142.

In at least one example embodiment, in the closed and locked configuration, the first surface 7300 of each of the protrusions 7122 is configured to engage the respective bridge portions 7402 of the skirt 7142 so as to reduce and/or substantially prevent movement of the lid 7004 in a fourth direction 7700 as shown in FIGS. 84-85. In at least one example embodiment, the fourth direction 7700 is substantially perpendicular to the first and second directions 7620, 7622. In at least one example embodiment, the fourth direction 7700 is an upward direction. The upper surface 7214 of the peripheral wall 7102 may engage the interior surface 7144 of the top wall 7140 so as to reduce and/or substantially prevent movement of the lid 7004 in a fifth direction 7702 (shown in FIG. 85) opposite the fourth direction 7700. In at least one example embodiment, the fifth direction 7702 is a downward direction.

In at least one example embodiment, each protrusion 7122 and respective receptacle 7150 is collectively referred to as a locking mechanism. In at least one example embodiment, the container 7000 may include three locking mechanisms. Accordingly, in the closed and locked configuration, there may be at least three points of engagement between the lid 7004 and the base 7002.

In at least one example embodiment, when the lid 7004 is in the closed and locked configuration, at least three separate motions or forces, in three separate directions, are required to move the lid 7004 into the open configuration (e.g., when the plurality of protrusions 7122 includes two protrusions 7122). In at least one example embodiment, when the lid 7004 is in the closed and locked configuration, four separate motions or forces, in four separate directions, are required to move the lid 7004 into the open configuration (e.g., when the plurality of protrusions 7122 includes three protrusions 7122). The lid 7004 is configured to be moved from the closed and locked configuration, as shown, to the closed and unlocked configuration by applying a first force to the peripheral wall 7102 in the first direction 7620, a second force to the peripheral wall 7102 in the second direction 7622, and a third force to the peripheral wall 7102 in the third direction 7624 to move the peripheral wall 7102 from the relaxed configuration to the flexed configuration. In the flexed configuration, the first, second, and third protrusions 7122-1, 7122-2, 7122-3 are at least partially removed from the respective receptacles 7150. This may be referred to as a closed and unlocked configuration. While the peripheral wall 7102 is in the flexed configuration, the lid 7004 may be moved in the fourth direction 7700 (i.e., applying a fourth force in the fourth direction 7700) to move the lid 7704 into the open configuration. The peripheral wall 7102 may return to the relaxed configuration absent the first, second, and third forces.

In at least one example embodiment, the container 7000 is configured to be opened by an adult tobacco consumer using one hand. In at least one example embodiment, the adult tobacco consumer may squeeze the peripheral wall 7102 in the palm of a hand while moving the lid 7004 in the fourth direction 7700 with a finger. The indentation 7126 may provide clearance or access to a lower surface 7710 of the skirt 7142 of the lid 7004.

The lid 7004 may also be moved from the open configuration to the closed and locked configuration. To close and lock the container 7000, the lid 7004 may be pivoted toward the connection rim 7120 of the base 7002 until the lower surface 7710 of the skirt 7142 contacts the upper surface 7214 of the peripheral wall 7102. The lid 7004 may be pressed in the fifth direction 7702 to cause the skirt 7142 to slide across the second surfaces 7302 of the protrusions 7122. The second surfaces 7302 may therefore facilitate moving the lid 7004 into the closed and locked configuration. The skirt 7142 may flex outwardly to slide over the protrusions 7122. When the skirt 7142 clears the second and third walls 7302, 7304 of the protrusions 7122, it may snap around the protrusions 7122 so that each of the protrusions 7122 is at least partially in a respective receptacle 7150.

Figure 86:
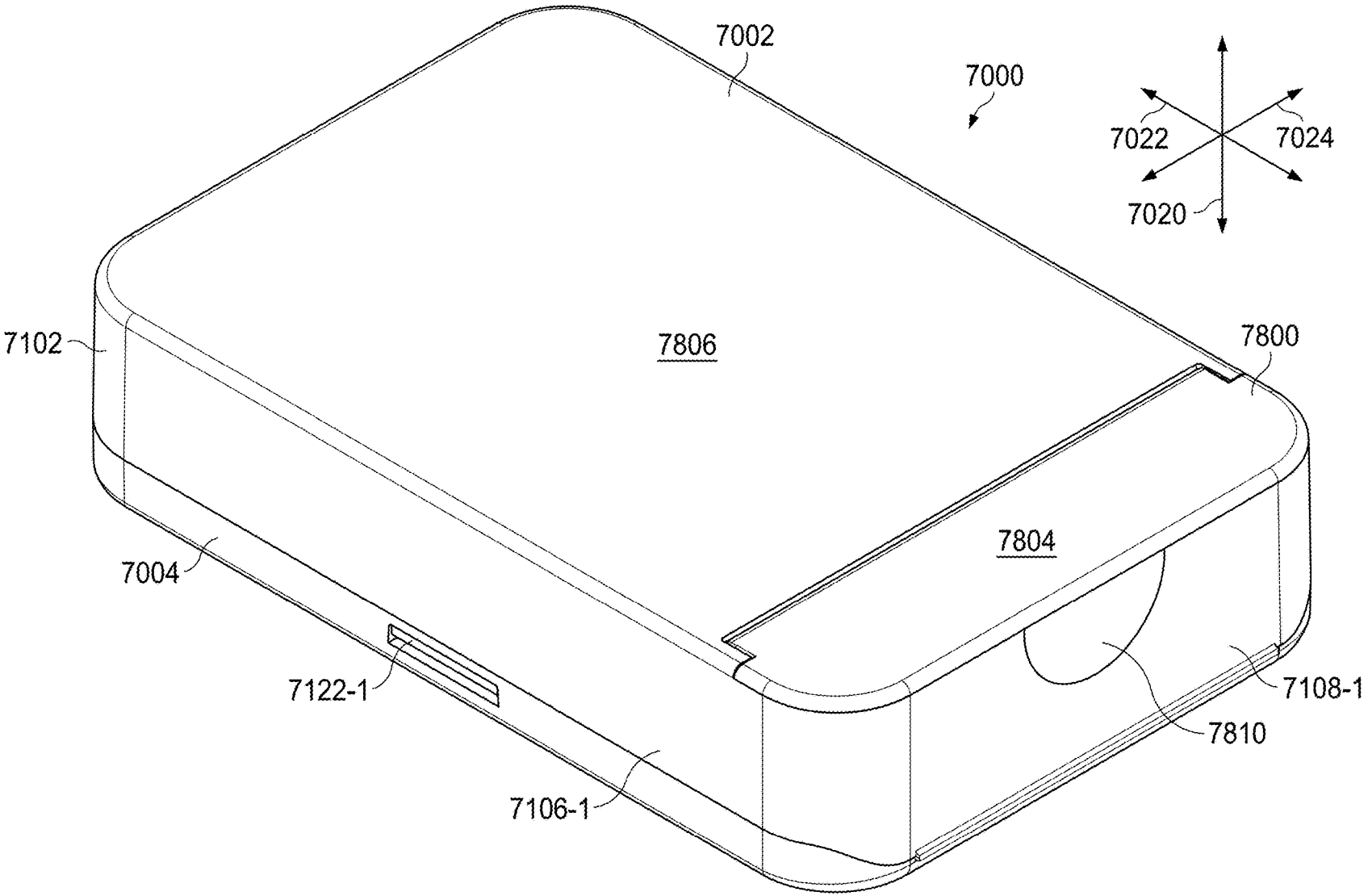
FIG. 86 is a bottom back perspective view of the package of FIG. 72 with a secondary lid in a closed position in accordance with at least one example embodiment.

FIG. 86 is a bottom back perspective view of the package of FIG. 72 with a secondary lid in a closed position in accordance with at least one example embodiment.

In at least one example embodiment, the lid 7004 (shown in FIG. 72) may be referred to as a primary lid. The container 7000 may further include a secondary lid 7800. The secondary lid 7800 may be movable from a closed configuration, as shown, to an open configuration or position (shown in FIG. 87).

The secondary lid 7800 may be coupled to the bottom wall 7100 and/or the peripheral wall 7102. In at least one example embodiment, the secondary lid 7800 is pivotally coupled to the bottom wall 7100. In at least one example embodiment, the secondary lid 7800 is a separate or separable element from the base 7002. In at least one example embodiment, the secondary lid 7800 includes integral prongs that are received in apertures of the base 7002 to pivotally couple the secondary lid 7800 to the base 7002. In other example embodiments, the secondary lid 7800 is coupled to the base 7002 by a distinct hinge. In other example embodiments, the secondary lid 7800 is integrally formed with the base 7002 and coupled to the base 7002 by a living hinge.

An exterior or outer surface 7804 of the secondary lid 7800 may be substantially coplanar or flush with an exterior or outer surface 7806 of the bottom wall 7100 when the secondary lid 7800 closed. The first end wall 4801-1 may define an indentation 7810 adjacent to the secondary lid 7800. The indentation 7810 may provide access to the secondary lid 7800 to open the secondary lid 7800.

Figure 87:
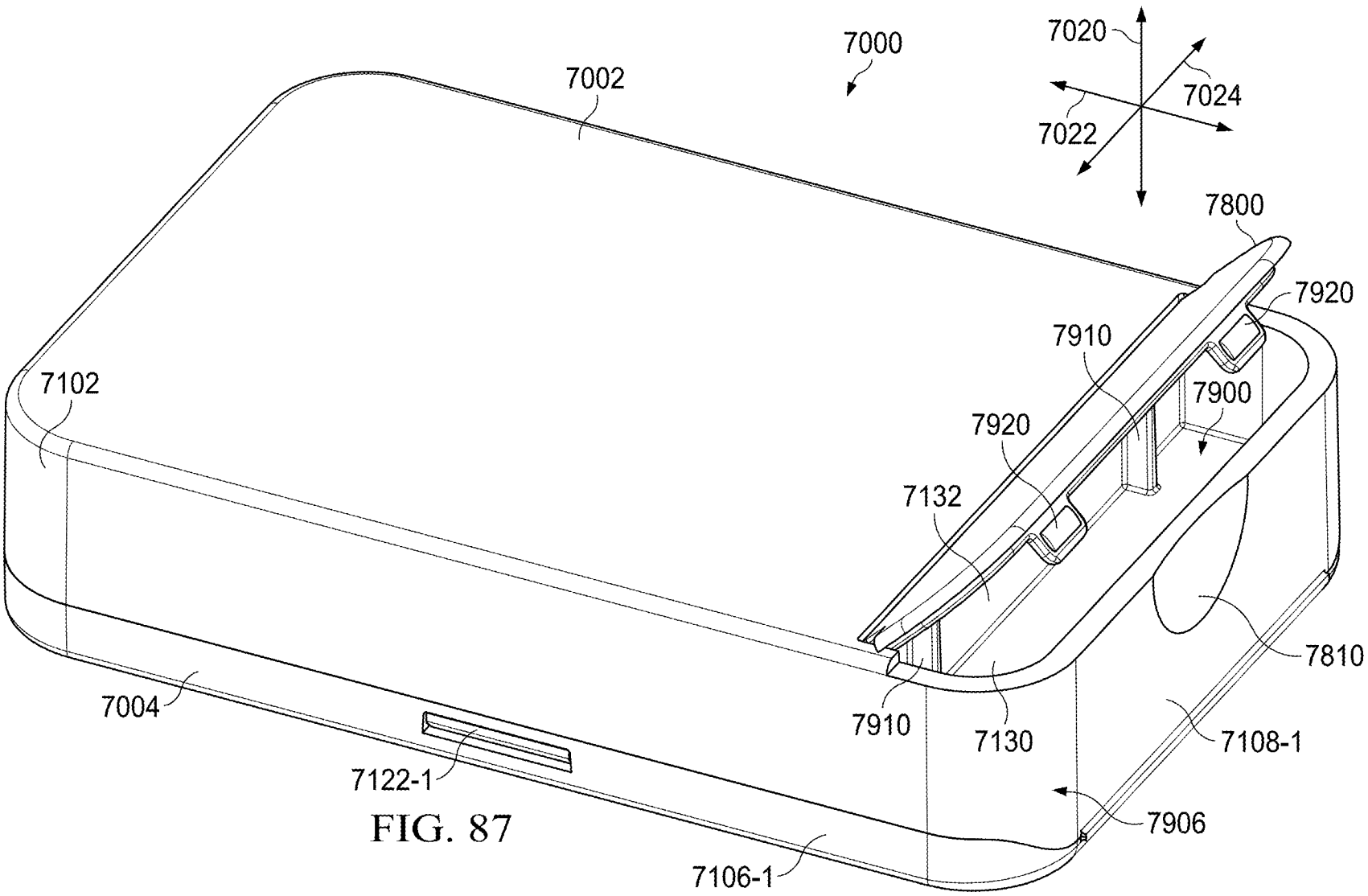
FIG. 87 is a bottom back perspective view of the package of FIG. 86 with the secondary lid in an open position in accordance with at least one example embodiment.

FIG. 87 is a bottom back perspective view of the package of FIG. 86 with the secondary lid in an open position in accordance with at least one example embodiment.

In at least one example embodiment, in the open position, the secondary lid 7800 permits access to a secondary storage area 7900. The secondary storage area may be defined by the transverse wall 7130, the intermediate wall 7132, the secondary lid 7800, and a portion 7906 of the peripheral wall 7102 including the first end wall 7108-1. The transverse wall 7130 may be substantially parallel to the lid 7004 when the lid 7004 is in the closed configuration (both locked and unlocked). The intermediate wall 7132 may be substantially parallel to the pair of end walls 7108.

One or more blocks 7910 may extend from the transverse wall 7902. The blocks 7910 may extend substantially parallel to the vertical axis 7020. Each of the blocks 7910 may be configured to engage the secondary lid 7800 when the secondary lid 7800 is in the closed position.

In at least one example embodiment, the secondary lid 7800 includes one or more catches 7920. The catches 7920 may be configured to engage the first end wall 7108-1 of the peripheral wall 7102 to retain the secondary lid 7800 in the closed position. In at least one example embodiment, the catches 7920 may be received in respective slots defined in the first end wall 7160-1.

In at least one example embodiment, the package may include features of other example embodiments described herein and/or other example embodiments may include features of the package as described above.

Sixth Example Embodiment

In at least one example embodiment, as shown in FIG. 88-97, a container or package 9000 is provided. The package 9000 may be the same as one or more of the example packages detailed above (including, for example only, package 100 as illustrated in FIG. 1), expect as may be detailed below.

Figure 88:
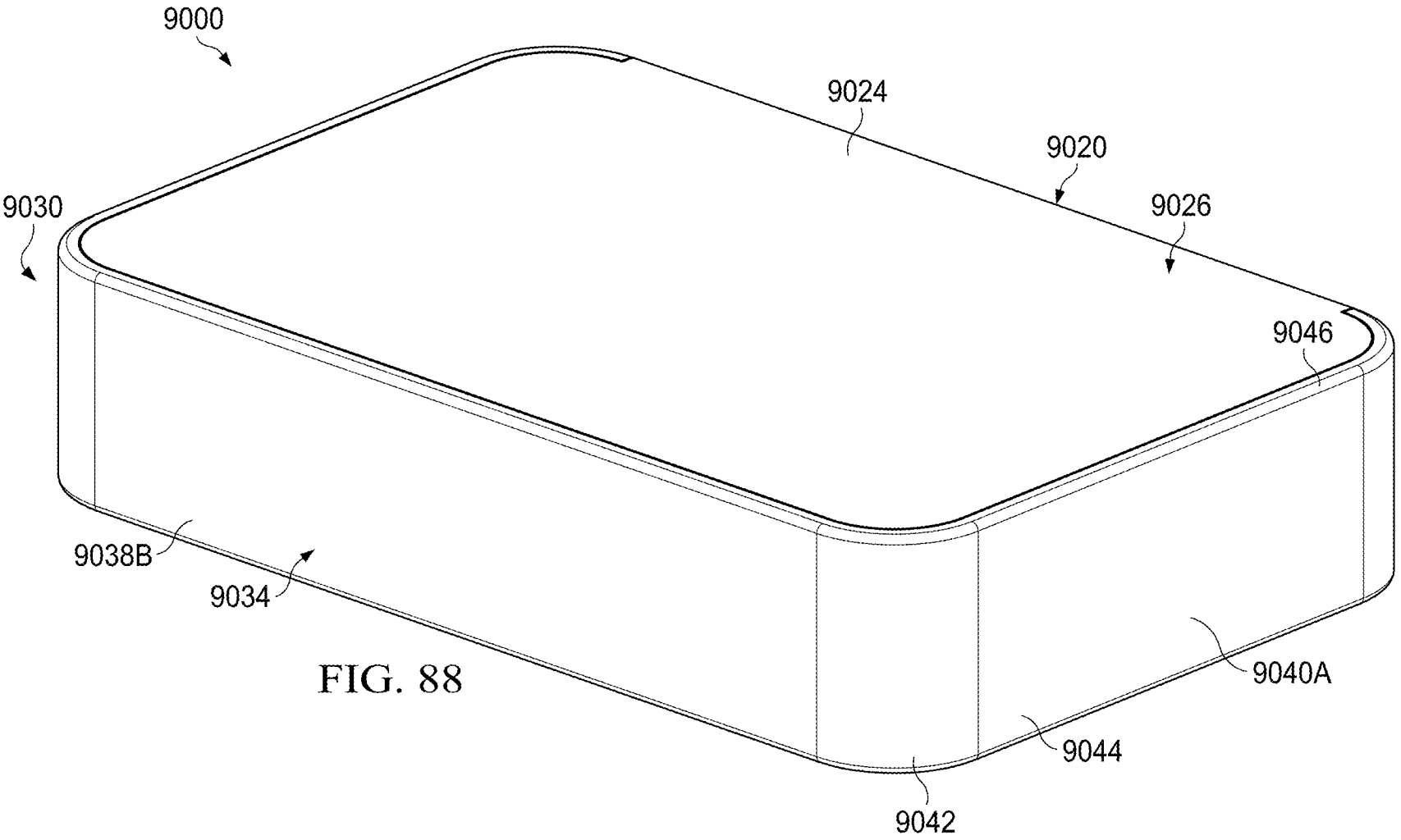
FIG. 88 is a top perspective view of a package in a closed and locked configuration in accordance with at least one example embodiment.

FIG. 88 is a top perspective view of a package in a closed and locked configuration in accordance with at least one example embodiment. In at least one example embodiment, as illustrated in FIG. 88, the package 9000 may have a substantially rectangular shape, from an overhead perspective. However, in other example embodiments, the package 9000 may have any other suitable shape. For example, the package 9000 may be triangular, oval, square, circular, polygonal, or any other shape, as viewed from an overhead perspective view.

Figure 89:
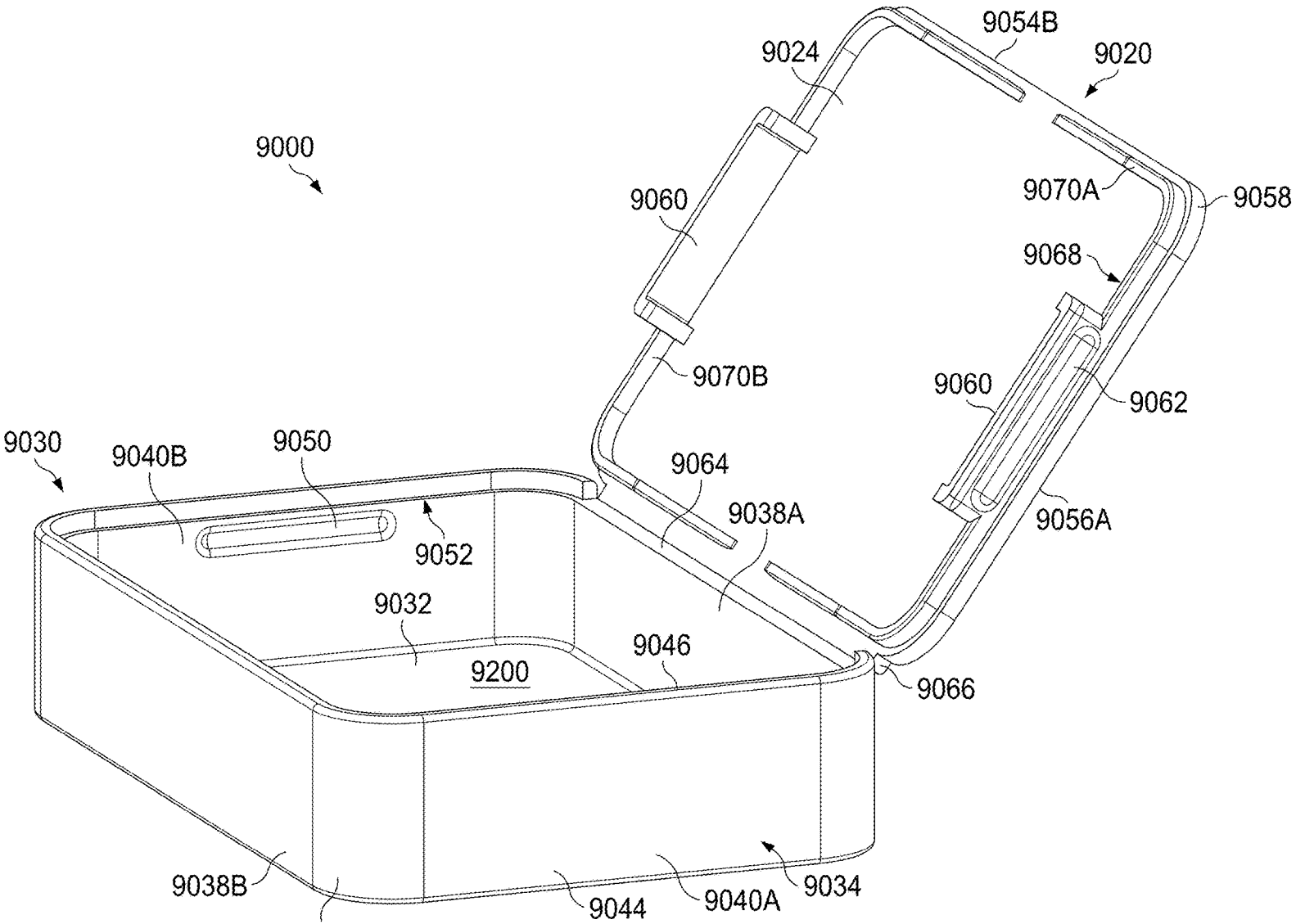
FIG. 89 is a first side perspective view of the package of FIG. 88 in an open configuration in accordance with at least one example embodiment.
Figure 90:
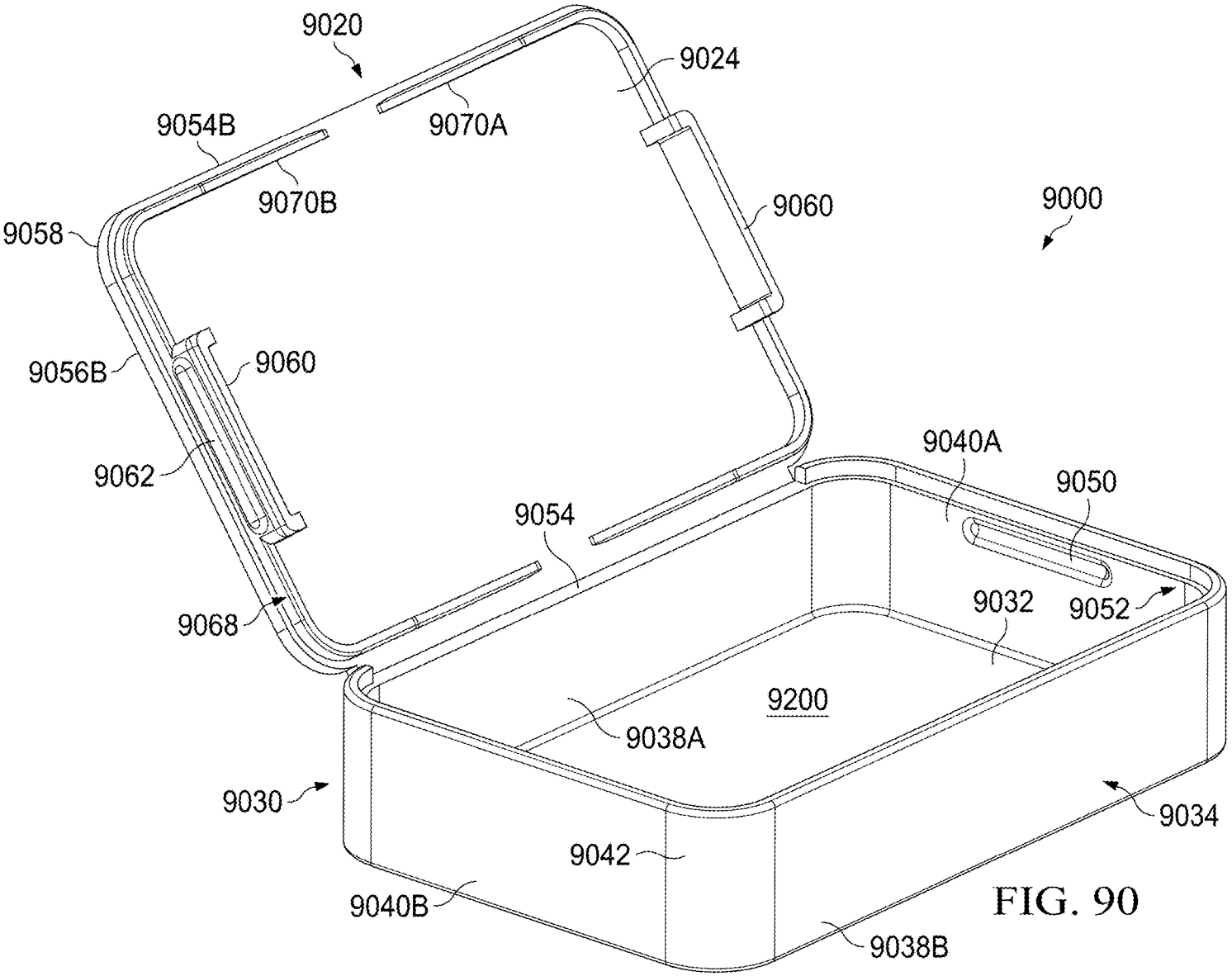
FIG. 90 is a second side perspective view of the package of FIG. 88 in an open configuration in accordance with at least one example embodiment.
Figure 91:
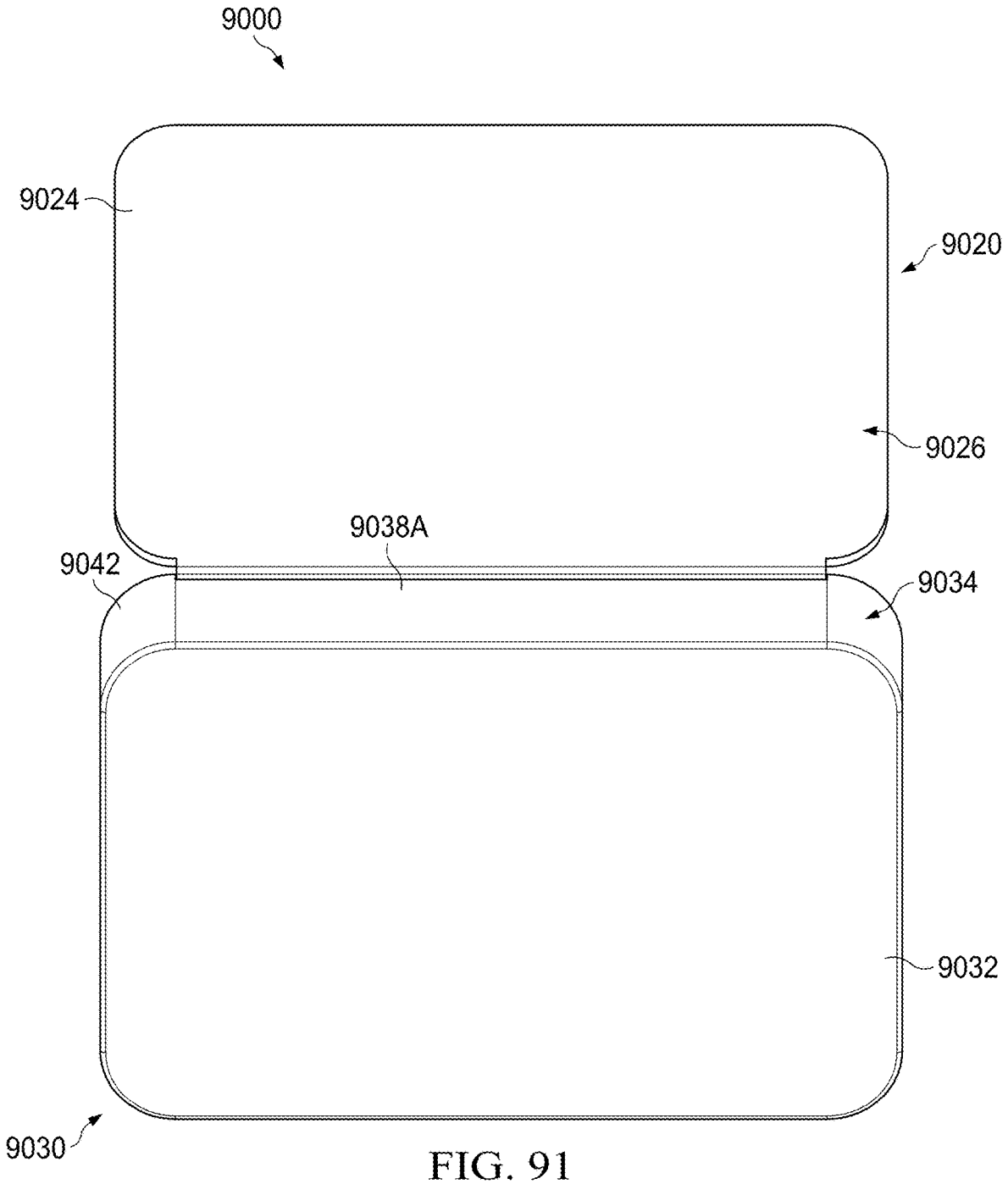
FIG. 91 is bottom perspective view of the package of FIG. 88 in an open configuration in accordance with at least one example embodiment.
Figure 92:
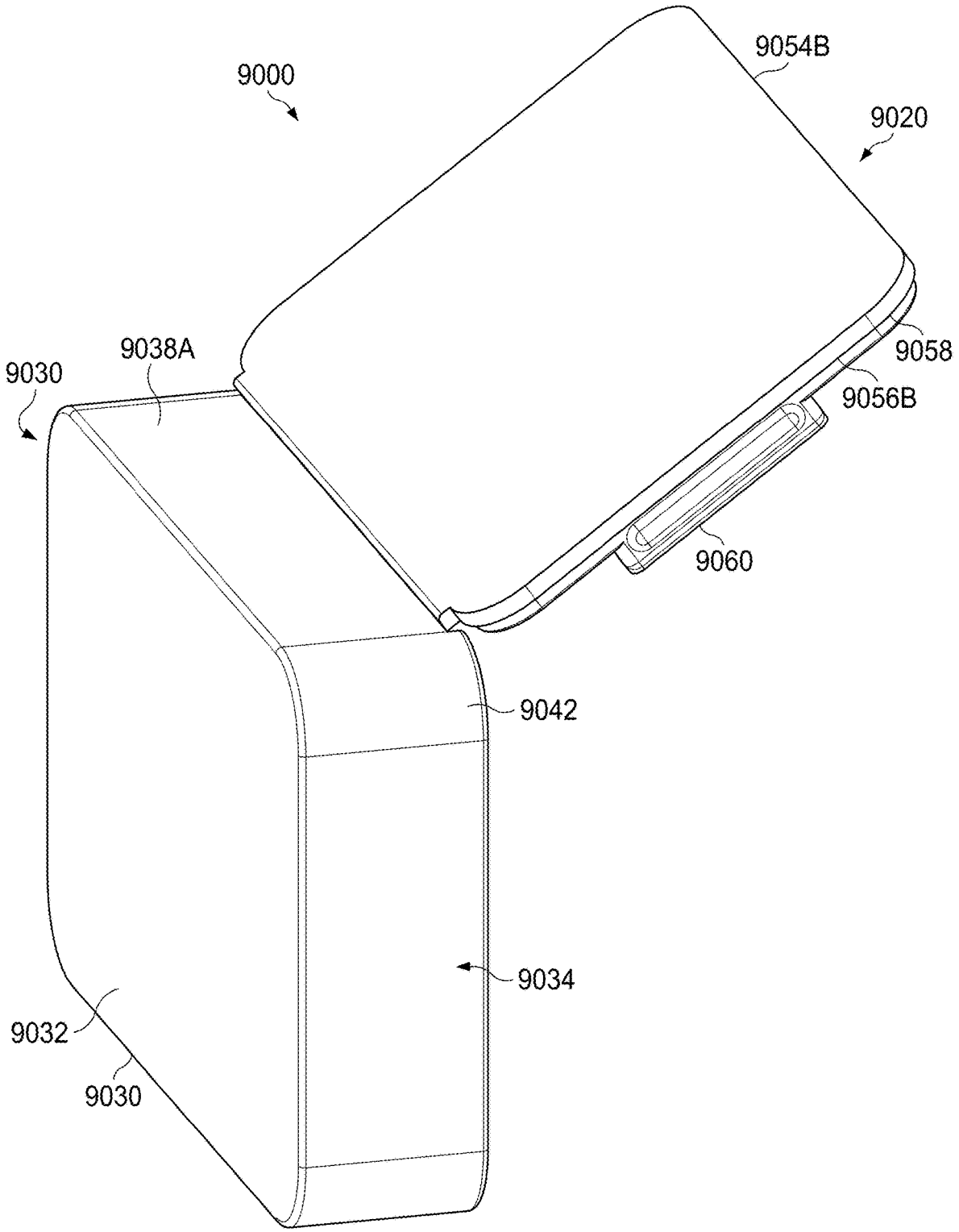
FIG. 92 is a side, bottom perspective view of the package of FIG. 88 in an open configuration in accordance with at least one example embodiment.

FIG. 89 is a first side, top perspective view of the package 9000 of FIG. 88 in an open configuration in accordance with at least one example embodiment; FIG. 90 is a second side top perspective view of the package 9000 of FIG. 88 in an open configuration in accordance with at least one example embodiment; FIG. 91 is bottom perspective view of the package 9000 of FIG. 88 in an open configuration in accordance with at least one example embodiment; and FIG. 92 is a side, bottom perspective view of the package 9000 of FIG. 88 in an open configuration in accordance with at least one example embodiment.

In at least one example embodiment, as illustrated in FIG. 88-92, the package 9000 includes a base 9030 and a lid 9020. The base 9030 and the lid 9020 may be movably coupled to one another. In at least one example embodiment, the base 9030 and the lid 9020 may be pivotally connected, allowing the lid 9020 to readily articulate between a closed position (as shown in FIG. 88) and an opened position (as shown in FIGS. 89-92). For example, the base 9030 and the lid 9020 may be coupled by a hinge, such as a living hinge. In other example embodiments, the lid 9020 may be completely removable from the base 9030 and may not be hingedly connected to the base 9030. In other example embodiments, the base 9030 and the lid 9020 are integrally formed elements. In each instance, the package 9000 is movable between a closed and locked position or configuration (as illustrated in FIG. 88), a closed and unlocked position or configuration, and an open position or configuration (as illustrated in FIG. 89-92).

Figure 93:
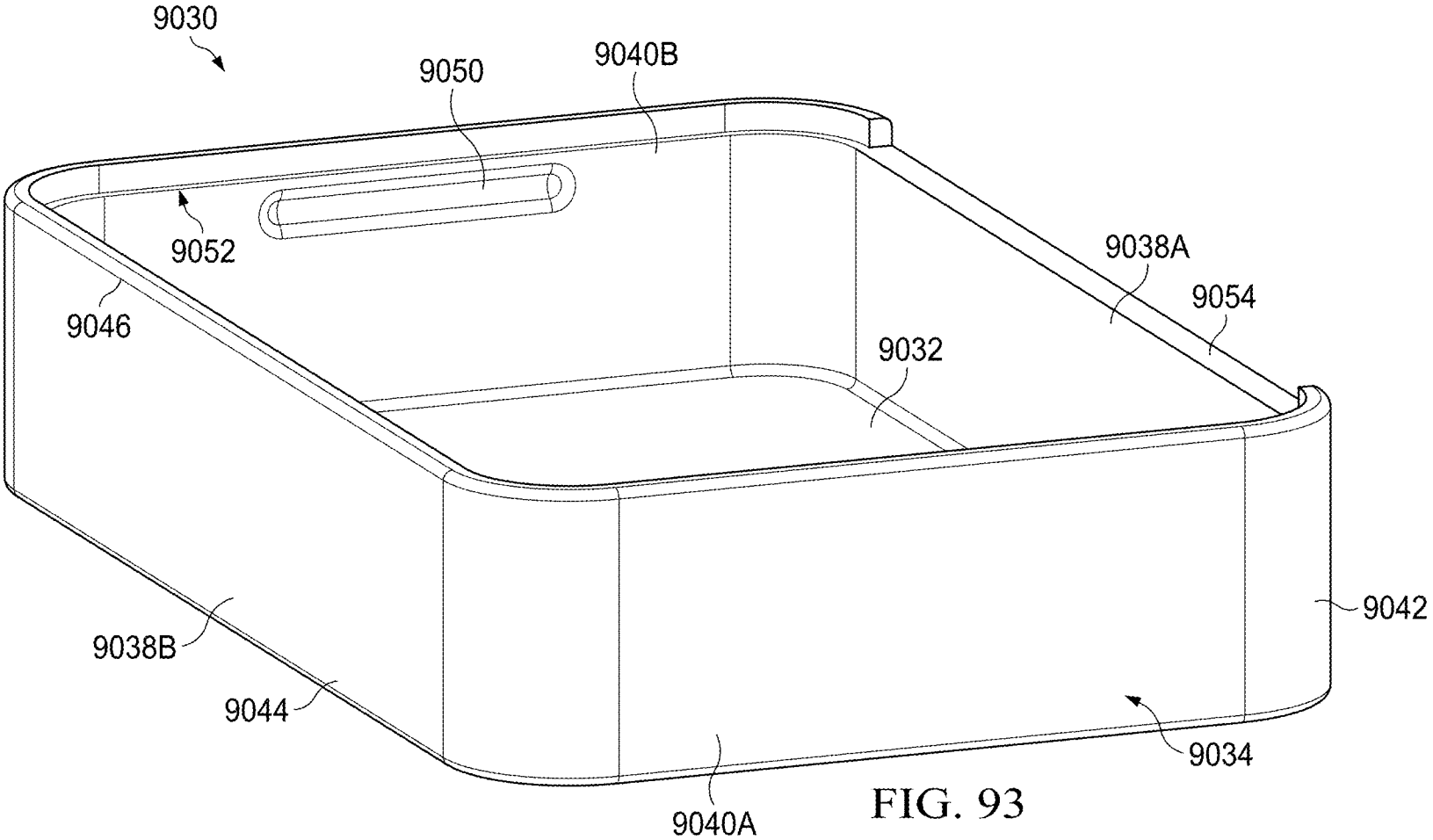
FIG. 93 is a top perspective view of a base of the package of FIG. 88 in accordance with at least one example embodiment.

FIG. 93 is a perspective view of the base 9030 of the package 9000 of FIG. 88 in accordance with at least one example embodiment. In at least one example embodiment, as illustrated in FIG. 93, the base 9030 includes a bottom wall or floor 9032 and a peripheral or outer wall 9034. The bottom wall 9032 and the peripheral wall 9034 cooperate so as to at least partially define a storage area or cavity 9200. The storage area 9200 may include one or more consumer products. In the closed and locked configuration (as illustrated in FIG. 88), and also, the closed and unlocked position, the lid 9020 meets with an upper surface 9046 of the peripheral wall 9034 to close the package 9000. For example, as illustrated in FIG. 88, the lid 9020 includes an exterior surface 9026 of the top wall 9024 that is visible when the package 9000 is in the closed configuration, and the lid 9020 prevents (or restrains or resists) access to the storage area 9200. In the open configuration (as illustrated in FIG. 89-92), the storage area 9200 is readily accessible. In at least one example embodiment, the storage area 9200 may include one or more sections or portions.

In at least one example embodiment, the peripheral wall 9034 may be coupled to and extending from the bottom wall 9032. For example, the peripheral wall 9034 extends perpendicularly from the bottom wall 9032. In at least one example embodiment, the peripheral wall 9034 includes a pair of sidewalls 9038A, 9038B and a pair of end walls 9040A, 9040B. The pair of sidewalls may include a first sidewall 9038A and a second sidewall 9038B. The sidewalls 9038A, 9038B may be longer than the end walls 9040A, 9040B. For example, the first sidewall 9038A may define a first long side of the base 9030, and the second sidewall 9038B may define a second long side of the base 9030. The first sidewall 9038A and the second sidewall 9038B of the base 9030 may be opposing and parallel. In at least one example embodiment, as illustrated in FIG. 89-92, the lid 9020 may be coupled to the first sidewall 9038A. The pair of end walls may include a first end wall 9040A and a second end wall 9040B. For example, the first end wall 9040A may define a first short side of the base 9030, and the second end wall 9040B may define a second short side of the base 9030. The first end wall 9040A and the second end wall 9040B of the base 9030 may be opposing and parallel. In at least one example embodiment, the peripheral wall 9034 includes curved or beveled corners 9042.

In at least one example embodiment, the curved or beveled corners 9042 may be omitted. For example, the first end wall 9040A may couple a first end of the first sidewall 9038A and a first end of the second sidewall 9038B so as to define opposing first and second sharp corners. Similarly, the second end wall 9040A may couple a second or opposing end of the first sidewall 9038A and a second or opposing end of the second sidewall 9038B so as to define opposing third and fourth shape corners.

In at least one example embodiment, the peripheral wall 9034 includes a first or lower or bottom surface 9044 and a second or upper surface 9046. The bottom surface 9044 of the peripheral wall 9034 is configured to interface with the bottom wall 9032. The upper surface 9046 of the peripheral wall 9034 is configured to interface with the lid 9020.

In at least one example embodiment, the upper surface 9046 includes a connection rim 9052. For example, the connection rim or ledge or step 9052 may define a ledge extending from the interior surface of the peripheral wall 9034. The ledge 9052 may extend perpendicularly from the interior surface of the peripheral wall 9034. In at least one example embodiment, the ledge 9052 may be continuous. For example, the ledge 9052 may extend substantially around the upper surface 9046 of the base 9030. In other example embodiment, the ledge 9052 may be discontinuous. For example, the ledge 9052 may include one or more segments or parts that extend along one or more portions of the upper surface 9046 of the base 9030.

In at least one example embodiment, the ledge 9052 may be configured to interface with the lid 9020 in the closed and locked configuration such that an exposed edge of the upper surface 9046 of the peripheral wall 9034 is about flush with the exterior surface exterior surface 9026 of the lid 9020 so as to mitigate pick points and the ability to circumvent locking mechanisms 150 (discussed in detail below). For example, in the closed and locked configuration (as illustrated in FIG. 88), the lid 9020 may nest within the base 9030. However, in other example embodiments, the lid 9020 may be configured so as to cover at least a portion of an exposed edge of the upper surface 9046 of the peripheral wall 9034 in the closed and locked configuration. In each instance, the ledge 9052 may also be configured to at least partially interface with the lid 9020 in the closed and unlocked position. In the closed and unlocked position, however, at least one pick point or opening point may be more readily accessible.

Figure 94:
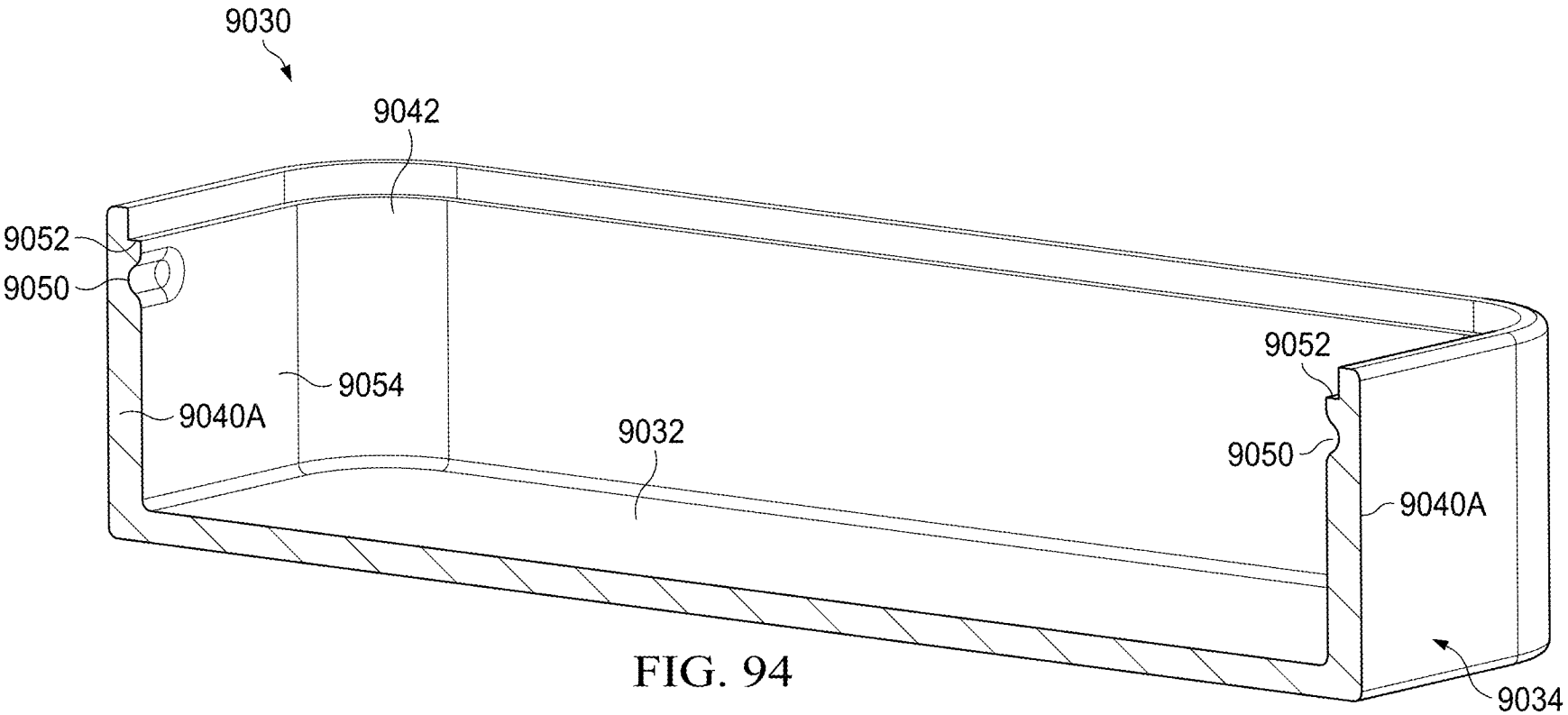
FIG. 94 is a cross-sectional view of the base of FIG. 93 in accordance with at least one example embodiment.

FIG. 94 is a cross-sectional view of the base 9030 of the package 9000 of FIG. 93 in accordance with at least one example embodiment. In at least one example embodiment, as illustrated in FIG. 94, the interior-facing surface 9054 of the peripheral wall 9034 defines one or more receptacles 9050. In one embodiment, the receptacles are position closer to the upper surface 9046 than the bottom surface of the peripheral wall 9034. Said another way, the receptacles are positioned in an upper portion of the peripheral wall 9034. In one embodiment, the receptacles 9050 are disposed adjacently below the connection rim 9052. In at least one example embodiment, the receptacles 9050 are positioned along one or both of the end walls 9040A, 9040B of the peripheral wall 9034. In other example embodiments, the receptacles 9050 are positioned along the one or both of the sidewalls 9038A, 9038B of the peripheral wall 9034. In still other example embodiments, the receptacles 9050 are positioned along at least one of the end walls 9040A, 9040B of the peripheral wall 9034 and at least one of the sidewalls 9038A, 9038B of the peripheral wall 9034. In each instance, the receptacles 9050 can be centrally positioned or non-centrally positioned along the end walls 9040A, 9040B and/or sidewalls 9038A, 9038B. In at least one example embodiment, the receptacles 9050 may be symmetrically disposed about a longitudinal plane parallel to and equidistant between the first sidewall 9038A and the second sidewall 9038B of the base 9030. In at least one example embodiment, the receptacles 9050 may be equidistant between the pair of opposing sidewalls 9038A, 9038B of the base 9030. In one embodiment, the receptacles 9050 have a concave arcuate or polygonal cross-sectional profile as shown in FIG. 94

Figure 95:
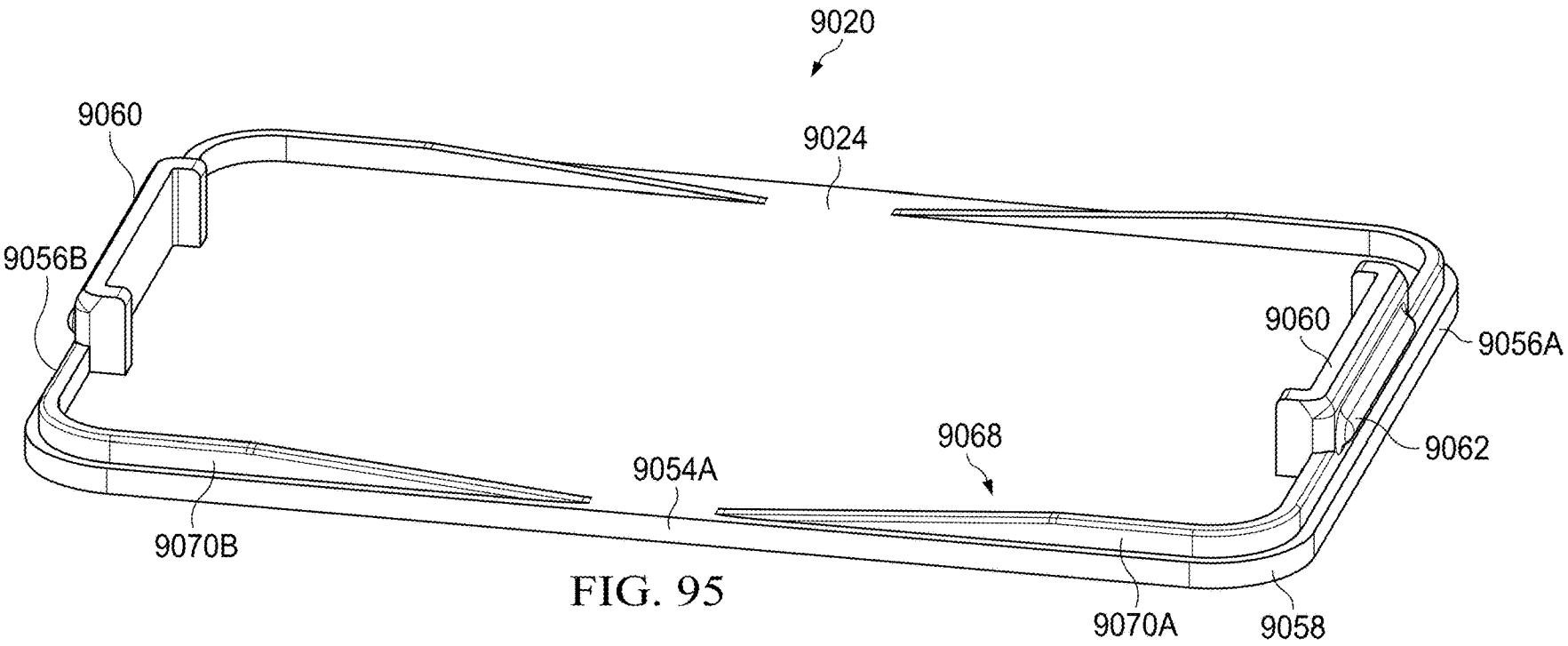
FIG. 95 is a bottom perspective view of a lid of the package of FIG. 88 in accordance with at least one example embodiment.

FIG. 95 is a perspective view of a lid 9020 of the package of FIG. 88 in accordance with at least one example embodiment. In at least one example embodiment, as illustrated in FIG. 95, the lid 9020 includes a top wall 9024 and one or more locking projections 9060 extending from an interior-facing surface of the top wall 9024. For example, the locking projections 9060 (discussed in further detail below) may extend substantially perpendicularly from the interior-facing surface of the top wall 9024. In at least one example embodiment, the lid 9020 may further include a skirt 9068 that extends from the interior-facing surface of the top wall 9024. The skirt 9068 may be non-continuous or discontinuous. For example, the skirt 9068 may include one or more segments or parts that extend along one or more portions of the interior-facing surface of the top wall 9024. The skirt 9068 may extend substantially perpendicularly from the interior-facing surface of the top wall 9024.

In at least one example embodiment, the lid 9020 includes a pair of sidewalls 9054A, 9054B and a pair of end walls 9056A, 9056B. The sidewalls 9054A, 9054B are longer than the end walls 9056A, 9056B. The pair of sidewalls may include a first sidewall 9054A and a second sidewall 9054B. For example, the first sidewall 9054A may define a first long side of the lid 9020, and the second sidewall 9054B may define a second long side of the lid 9020. The first sidewall 9054A and the second sidewall 9054B of the lid 9020 may be opposing and parallel. In at least one example embodiment, as illustrated in FIG. 89-92, the first sidewall 9054A of the lid 9020 may be coupled to a first sidewall 9038A of the base 9030. In at least one example embodiment, the first sidewall 9038A of the base 9030 may include a cutout 9064 that is configured to receive or communication with the first sidewall 9054A of the lid 9020 in the closed configuration. The first sidewall 9054A of the lid 9020 may include an extension 600 that fits within and is received by the cutout 9064 in the base 9030 in the closed configuration. In at least one example embodiment, the pair of end walls may include a first end wall 9056A and a second end wall 9056B. For example, the first end wall 9056A may define a first short side of the lid 9020, and the second end wall 9056B may define a second short side of the lid 9020.

In at least one example embodiment, the lid 9020 includes curved or beveled corners 9058. In at least one example embodiment, the curved or beveled corners 9058 may be omitted. For example, the first end wall 9056A may couple a first end of the first sidewall 9054A and a first end of the second sidewall 9054B so as to define opposing first and second sharp corners. Similarly, the second end wall 9056A may couple a second or opposing end of the first sidewall 9054A and a second or opposing end of the second sidewall 9054B so as to define opposing third and fourth shape corners.

In at least on example embodiment, the non-continuous skirt 9068 may include a first portion 9070A extending along the first end wall 9056A of the lid 9020 and a second portion 9070B extending along the second end wall 9056B of the lid 9020. Segments of the first portion 9070A of the skirt 9068 extending centrally along the first and second sidewalls 9054A, 9054B towards a middle of the lid 9020 may be sloped or angled. Similarly, segments of the second portion 9070B of the skirt 9068 extending centrally along the first and second sidewalls 9054A, 9054B towards a middle of the lid 9020 may be sloped or angled. For example, segments of the first portion 9070A of the skirt 9068 extending towards segments of the second portion 9070B of the skirt 9068 may be sloped or angled.

In at least on example embodiment, the plurality of locking projections 9060 are positioned along one or both of the end walls 9056A, 9056B of the lid 9020. In other example embodiments, the locking projections 9060 are positioned along the one or both of the sidewalls 9054A, 9054B of the lid 9020. In still other example embodiments, the locking projections 9060 are positioned along at least one of the end walls 9056A, 9065B of the lid 9020 and at least one of the sidewalls 9054A, 9054B of the lid 9020. In each instance, the locking projections 9060 can be centrally positioned or non-centrally positioned along the end walls 9056A, 9056B and/or sidewalls 9054A, 9054B. In at least one example embodiment, the locking projections 9060 may be symmetrically disposed about a longitudinal plane parallel to and equidistant between the first sidewall 9054A and the second sidewall 9054B of the lid 9020. In at least one example embodiment, the locking projections 9060 may be equidistant between the pair of opposing sidewalls 9054A, 9054B of the lid 9020. In each instance, the plurality of locking projections 9060 extending from the lid 9020 and the plurality of receptors 9050 defined in the base 9030 are positioned so as to be aligned.

Figure 96:
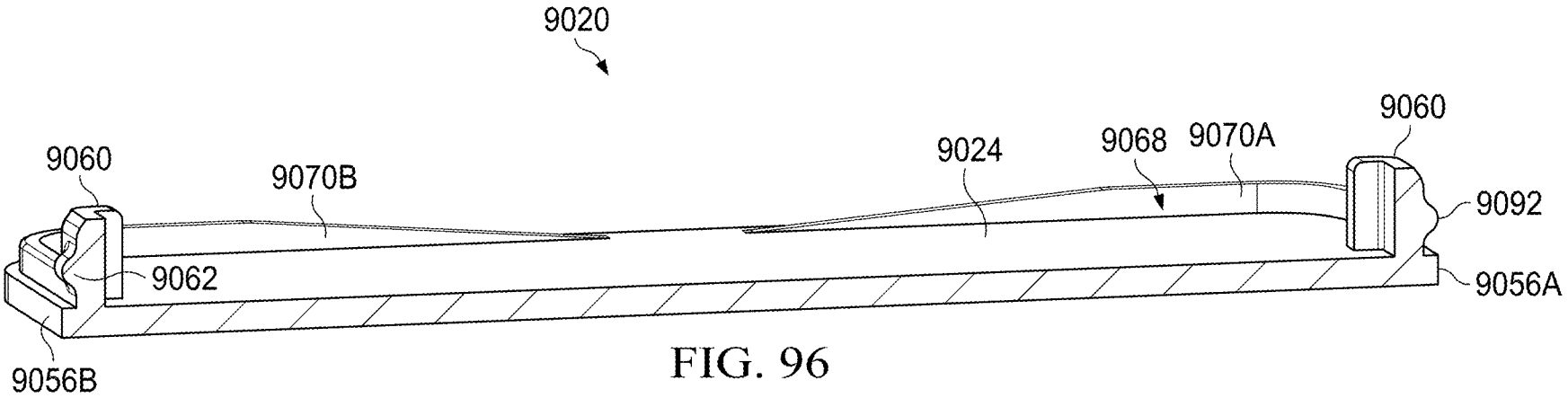
FIG. 96 is a cross-sectional view of the lid of FIG. 95 in accordance with at least one example embodiment.
Figure 97:
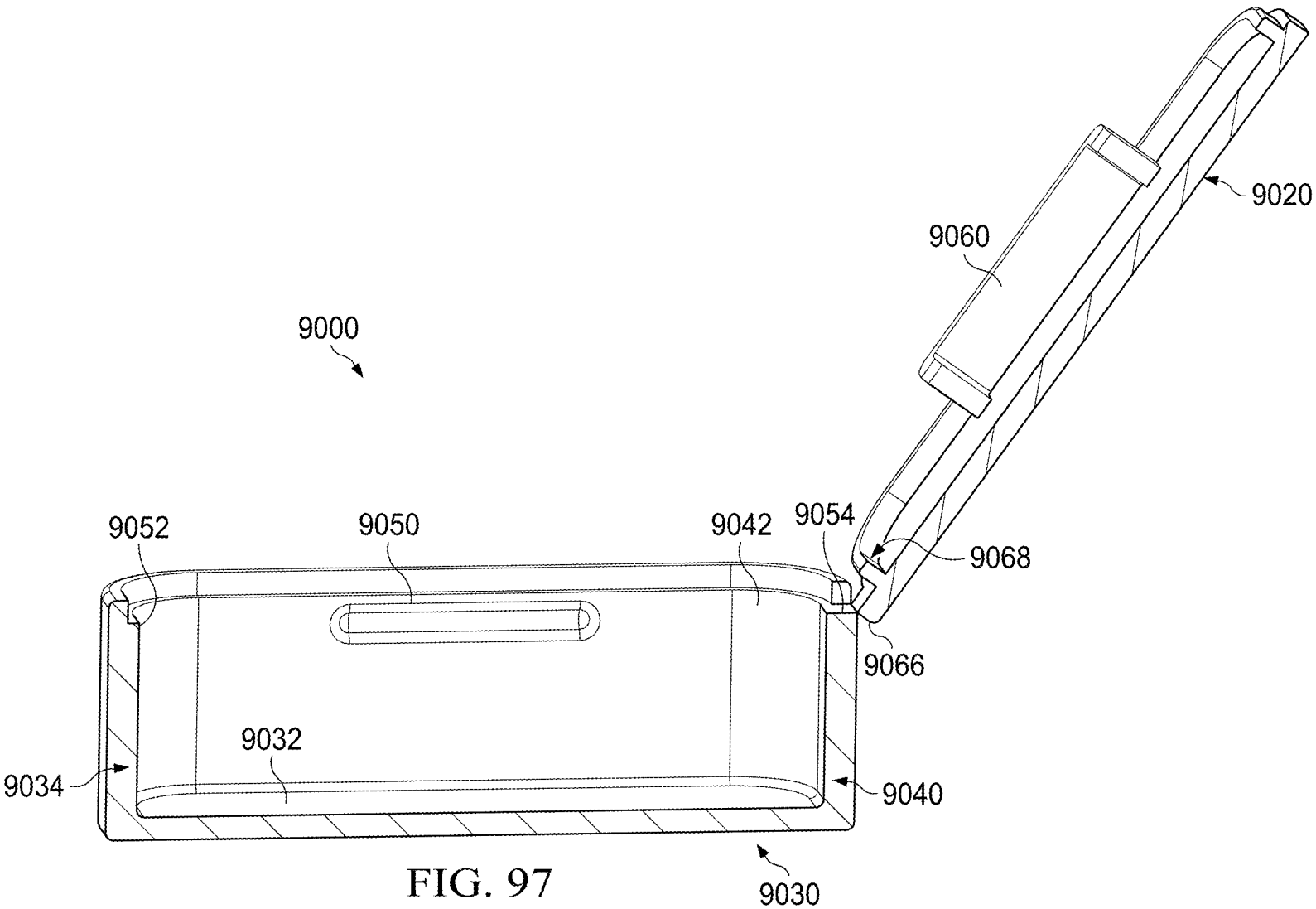
FIG. 97 is a cross-sectional view of the package of FIG. 88 in an open configuration in accordance with at least one example embodiment.

FIG. 96 is a cross-sectional view of the lid 9020 of FIG. 95 in accordance with at least one example embodiment. In at least one example embodiment, as illustrated in FIG. 95, each locking projection 9060 includes a respective protrusions 9062. For example, the respective protrusion 9062 may extend from an exterior-facing surface of the locking projection 9060. The protrusions 9062 are shaped so as to be respectively receivable by the plurality of receptacles 9050 defined in the base 9030. For example, the protrusions 9062 may have a convex arcuate or polygonal cross-sectional profile as shown in FIG. 96 that matches, partially matches or does not match the corresponding concave profile of the receptacles 9050. In the closed and locked configuration (as illustrated in FIG. 88), the protrusions 9062 may be respectively and at least partially received by the receptacles 9050. The protrusions 9062 may be substantially retained by the receptacles 9050 in the closed and locked configuration. For example, a respective pair of a protrusion 9062 and a receptacle 9050 may define a locking mechanism 9050 that locks (or retains) the lid 9020 onto the base 9030 in the closed and locked configuration. In at least one example embodiment, the package 9000 may automatically lock when the lid 9020 is pressed down firmly onto the base 9030 and the protrusions 9062 are engaged by the receptacles 9050. In the closed and unlocked configuration, the protrusions 9062 may be only partially received by or merely disposed adjacent to the plurality of receptacles 9050 as defined in the base 9030. In the open configuration (as illustrated in FIG. 89-92), the protrusions 9062 and the receptacles 9050 do not interface.

In at least one example embodiment, the package 9000 requires at least two separate motions to unlock or open. The separate motions may include applying two or more forces to the peripheral wall 9034 such that the peripheral wall 9034 moves from a first or relaxed position to a second or flexed position. For example, a first force may be applied to a first portion of the peripheral wall 9034 in a first direction, and a second force may be applied to a second portion of the peripheral wall 9034 in a second direction. The second direction may be different from the first direction. For example, the first and second directions may be parallel and opposite on another. The first and second portions of the peripheral wall 9034 may be opposing portions. For example, the first portion of the peripheral wall 9034 may be substantially parallel with the second portion of the peripheral wall 9034.

In at least one example embodiment, where the peripheral wall 9034 includes a plurality of receptacles 9050 defined in the opposing end walls 9040A, 9040B of the peripheral wall 9034 (as illustrated), the package 9000 may be unlocked or open by simultaneously applying a first force on the first sidewall 9038A of the peripheral wall 9034, and a second force on the second sidewall 9038B of the peripheral wall 9034. For example, inward forces may be applied by the adult consumer to both the first and second sidewalls 9038A, 9038B so as to at least partially dislodge the protrusions 9062 from the receptacles 9050. In other example embodiments, the peripheral wall 9034 may include a plurality of receptacles 9050 defined in opposing sidewalls 9038A, 9038B of the peripheral wall 9034, and the package 9000 may be unlocked or open by simultaneously applying a first force on the first end wall 9040A of the peripheral wall 9034 and a second force on the second end wall 9040B of the peripheral wall 9034. For example, the first and second forces are directed inwards and may be applied by the adult consumer to both the first and second end walls 9040A, 9040B so as to at least partially dislodge the protrusions 9062 from the receptacles 9050. In each instance, once the protrusions 9062 of the lid 9020 are at least partially dislodged from the receptacles 9050 of the base 9030, the lid 9020 may be capable of being lifted (e.g., third motion) in order to open the package 9000. For example, the adult consumer applies a third force in a direction different from the first and second forces (e.g., perpendicular to the first and second forces) to lift the lid 9020

In at least one example embodiment, the package may include features of other example embodiments described herein and/or other example embodiments may include features of the package as described above.

While various example embodiments are discussed separately, it is understood that the first, second, third, fourth, fifth, and sixth example embodiments and/or features of each of the examples embodiments may be combined in different ways. For example, locking mechanisms of two or more example embodiments (e.g., first and second, second and third, third and fourth, fourth and fifth, fifth and sixth, second and fourth, second and fifth, second and sixth, third and first, third and fifth, third and sixth, first and fourth, second and fourth, fourth and sixth, first and fifth, first and sixth, etc.) may be combined in a single package and/or portions of the locking mechanisms of two or more example embodiments may be combined. Further, the locking mechanisms of an example embodiment may be included on one or more of the side walls and/or end walls of the package or container. In at least one example embodiment, multiple locking mechanisms may be included on a single side wall and/or end wall of the package or container. In some example embodiments, locking mechanisms as described herein may be on opposing walls or on adjacent walls. Further, a number of the locking mechanisms per package may be varied.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A package, comprising:

a base, at least one first step being defined along an interior upper portion of the base;

a primary lid connected to an upper portion of the base via a first hinge, a lower portion of the primary lid defining at least one second step, the at least one first step mating with and lying flat against the at least one second step such that an exterior surface of the primary lid is flush with an upper-most surface of the base when the primary lid is in a closed position, the primary lid and the base collectively defining a primary storage area when the primary lid is in the closed position;

a first locking mechanism on a first side of the package; and a second locking mechanism on a second side of the package, the first locking mechanism and the second locking mechanism each including, an arm with a first engagement, the arm being connected to the primary lid, and a flexible structure including a tab and at least one attachment member, the at least one attachment member extending from an interior surface of the tab in a first direction when the flexible structure is in a relaxed position, the at least one attachment member attaching the tab to the base, the first direction being perpendicular to the interior surface when viewed along a line of sight that is parallel to a longitudinal length of the first side and the second side, respectively, the tab including a second engagement on the interior surface of the tab, an upper surface of the tab being flush with the exterior surface of the primary lid and the upper-most surface of the base, an exterior surface of the tab being flush with an exterior surface of a wall of the base, and a lower surface of the tab being flush with an exterior surface of a floor of the base, when the flexible structure is in the relaxed position and the primary lid is in the closed position, the flexible structure being in the relaxed position when the primary lid is in the closed position, the first engagement being retained by the second engagement to lock the primary lid onto the base in the closed position, the flexible structure configured to move from the relaxed position to a flexed position to disengage the second engagement from the first engagement when a first force is applied in the first direction on an exterior surface of a lower portion of the tab, the lower portion of the tab moving inward and an upper portion of the tab moving outward in response to the first force being applied to the lower portion of the tab, and the flexible structure being configured to return to the relaxed position absent the first force.

2. The package of claim 1, wherein the second engagement is moved in a second direction as the flexible structure moves from the relaxed position to the flexed position for each of the first locking mechanism and the second locking mechanism, the first direction and the second direction being opposite each other.

3. The package of claim 1, wherein the tab pivots relative to the at least one attachment member as the flexible structure is moved from the relaxed position to the flexed position, for each of the first locking mechanism and the second locking mechanism.

4. The package of claim 1, wherein the at least one attachment member is attached to a portion of the base, and the at least one attachment member bends or pivots relative to the portion of the base as the flexible structure is moved from the relaxed position to the flexed position, for each of the first locking mechanism and the second locking mechanism.

5. The package of claim 1, wherein the at least one attachment member is attached to a portion of the base, and the tab pivots relative to the at least one attachment member and the at least one attachment member pivots relative to the portion of the base as the flexible structure is moved from the relaxed position to the flexed position, for each of the first locking mechanism and the second locking mechanism.

6. The package of claim 1, wherein the base includes a guard, the guard being inwardly adjacent to the tab, the at least one attachment member being connected to the guard, for each of the first locking mechanism and the second locking mechanism.

7. The package of claim 6, wherein the at least one attachment member traverses horizontally across a gap between the interior surface of the tab and the guard, for each of the first locking mechanism and the second locking mechanism.

8. The package of claim 1, wherein the base includes a guard, the guard being a section of a peripheral wall of the package, the at least one attachment member being connected to the guard, for each of the first locking mechanism and the second locking mechanism.

9. The package of claim 1, wherein the at least one attachment member is connected to a section of a sidewall of the base, the section of the sidewall being inwardly adjacent to the tab, for each of the first locking mechanism and the second locking mechanism.

10. The package of claim 9, wherein the at least one attachment member traverses horizontally across a gap between the interior surface of the tab and the section of the sidewall, for each of the first locking mechanism and the second locking mechanism.

11. The package of claim 1, wherein the first engagement includes exposed surfaces that are exposed by a channel and a ledge that are defined by an outer surface of the arm, a portion of the second engagement fitting into the channel and contacting the exposed surfaces when the primary lid is in the closed position, for each of the first locking mechanism and the second locking mechanism.

12. The package of claim 1, wherein the first engagement includes exposed surfaces that are exposed by an opening that traverses through an outer surface and an inner surface of the arm, the second engagement engaging the exposed surfaces of the arm with a portion of the second engagement extending within the opening when the primary lid is in the closed position, for each of the first locking mechanism and the second locking mechanism.

13. The package of claim 12, wherein the arm is U-shaped, the arm including a first end and a second end that are connected to the primary lid, for each of the first locking mechanism and the second locking mechanism.

14. The package of claim 1, wherein the second engagement includes a catch, the catch defining a step, the step being configured to retain the catch in the first engagement when the primary lid is in the closed position, for each of the first locking mechanism and the second locking mechanism.

15. The package of claim 1, wherein the at least one attachment member includes a pair of attachment members, the pair of attachment members being connected to the tab at a same vertical elevation along a vertical midsection of the tab, for each of the first locking mechanism and the second locking mechanism.

16. The package of claim 1, wherein the primary lid is configured to be moved to an open position from the closed position in response to a second force applied to the primary lid in a second direction perpendicular to the first direction while the first locking mechanism and the second locking mechanism are both in the flexed position.

17. The package of claim 1, further comprising:

a secondary lid connected to a lower portion of the base via a second hinge, the secondary lid and the base collectively defining a secondary storage area when the secondary lid is closed.

18. The package of claim 1, wherein the primary lid has at least three points of contact with the base when the primary lid is in the closed position, the three points of contact being provided by the first locking mechanism, the second locking mechanism and the first hinge.

19. The package of claim 1, wherein the base includes a frame, the frame including outer walls, and an insert, the insert including the floor, the insert and the frame being connected such that the outer walls and the floor combine to at least partially form an outer surface of the package.

20. The package of claim 1, wherein the first locking mechanism and the second locking mechanism are offset from each other, on the first side and the second side of the package, respectively.

21. The package of claim 1, wherein the first locking mechanism and the second locking mechanism are directly opposed to each other, on the first side and the second side of the package, respectively.

22. The package of claim 1, wherein the first hinge is a living hinge.

23. The package of claim 1, wherein the exterior surface of the tab of the first locking mechanism and the second locking mechanism each are an entirely solid surface.

24. The package of claim 1, wherein the at least one attachment member of the first locking mechanism and the second locking mechanism each are configured to pivot relative to at least one of the base or the tab when the flexible structure moves from the relaxed position to the flexed position.

25. The package of claim 1, wherein the at least one attachment member of the first locking mechanism and the second locking mechanism each are configured to pivot relative to the base when the flexible structure moves from the relaxed position to the flexed position, the at least one attachment member continuing to be perpendicular to the interior surface when the flexible structure is in the flexed position.

26. The package of claim 1, wherein the at least one attachment member of the first locking mechanism and the second locking mechanism each are configured to pivot relative to the interior surface when the flexible structure moves from the relaxed position to the flexed position.

* * * * *